US007503740B2

(12) United States Patent
Lemens et al.

(10) Patent No.: US 7,503,740 B2
(45) Date of Patent: Mar. 17, 2009

(54) PUNCHING AND BINDING SYSTEM AND ELEMENTS THEREOF

(75) Inventors: Paul J Lemens, Scottsdale, AZ (US); Ronald J Hoffman, Phoenix, AZ (US); David Miller, Phoenix, AZ (US); Jeppe Glaser, Scottsdale, AZ (US); David A. Muckridge, Glendale, AZ (US); David Aitchison, Phoenix, AZ (US); Robert Leack, Scottsdale, AZ (US); Christopher A. Holman, Mesa, AZ (US)

(73) Assignee: Esselte, Sint-Niklaas (BE)

( * ) Notice: Subject to any disclaimer, the term of this patent is extended or adjusted under 35 U.S.C. 154(b) by 195 days.

(21) Appl. No.: 11/302,385

(22) Filed: Dec. 14, 2005

(65) Prior Publication Data

US 2006/0093461 A1 May 4, 2006

(51) Int. Cl.
*B42B 5/00* (2006.01)
*B42B 5/08* (2006.01)

(52) U.S. Cl. ..... 412/33; 412/38

(58) Field of Classification Search ..... 412/1, 412/6, 9, 10, 33, 38, 39, 40
See application file for complete search history.

(56) References Cited

U.S. PATENT DOCUMENTS

| | | | | |
|---|---|---|---|---|
| 3,879,783 | A | 4/1975 | Giulie | |
| 3,992,741 | A * | 11/1976 | Staats | 412/20 |
| 4,175,457 | A | 11/1979 | Jacobs et al. | |
| 4,902,183 | A * | 2/1990 | Vercillo et al. | 412/7 |
| 5,051,050 | A * | 9/1991 | Scharer | 412/40 |
| 5,178,049 | A | 1/1993 | Tsai-Hsin | |
| 5,527,142 | A * | 6/1996 | Chih-Kwo | 412/38 |
| 5,894,778 | A | 4/1999 | Mori | |
| 6,471,458 | B1 * | 10/2002 | Soule | 412/38 |
| 2003/0160094 | A1 | 8/2003 | Ko | |

FOREIGN PATENT DOCUMENTS

BE 898163 3/1984

(Continued)

OTHER PUBLICATIONS

European Search Report issued in EP 05253073.0 dated Jan. 26, 2006.

(Continued)

*Primary Examiner*—Dana Ross
*Assistant Examiner*—Pradeep C Battula
(74) *Attorney, Agent, or Firm*—Pillsbury Winthrop Shaw Pittman LLP

(57) ABSTRACT

An apparatus for punching and binding a stack of papers is disclosed. The apparatus includes a paper clamp and a binding element insertion device that are movable relative to each other. The binding element insertion device is configured to receive and detect binding elements of different sizes. The apparatus also includes a punching mechanism, a controller, and a user interface. The controller controls movement of the paper clamp and the binding element insertion device based on the size of the binding element needed to bind the stack of papers together. The user interface is configured to provide information to a user of the apparatus and to receive input from the user before, during, and after the punching and binding operation.

21 Claims, 94 Drawing Sheets

FOREIGN PATENT DOCUMENTS

| | | | |
|---|---|---|---|
| BE | 901190 | | 3/1985 |
| BE | 1000550 | | 1/1989 |
| BE | 1000926 | | 5/1989 |
| BE | 1001243 | | 8/1989 |
| BE | 1001306 | | 9/1989 |
| BE | 1004902 | | 2/1993 |
| BE | 1005191 | | 5/1993 |
| BE | 1009010 | | 10/1996 |
| BE | 1009426 | | 3/1997 |
| BE | 1013578 | | 4/2002 |
| BE | 1014602 | | 1/2004 |
| BE | 1014632 | | 2/2004 |
| BE | 1015069 | | 9/2004 |
| CA | 2321937 | A1 | 6/2001 |
| CN | 1101606 | | 4/1995 |
| DE | 4230885 | | 3/1993 |
| EG | 22315 | | 12/2002 |
| EP | 0334260 | | 9/1989 |
| EP | 0334261 | | 9/1989 |
| EP | 0395869 | | 11/1990 |
| EP | 0395873 | | 11/1990 |
| EP | 0 409 204 | A2 | 1/1991 |
| EP | 0 409 204 | A3 | 1/1991 |
| EP | 0504961 | | 9/1992 |
| EP | 0516207 | | 12/1992 |
| EP | 0525241 | | 2/1993 |
| EP | 0527246 | | 2/1993 |
| EP | 0555035 | | 8/1993 |
| EP | 0267651 | B1 | 10/1993 |
| EP | 0641674 | | 3/1995 |
| EP | 0390201 | B1 | 8/1995 |
| EP | 0392512 | B1 | 9/1995 |
| EP | 0719655 | | 7/1996 |
| EP | 0763408 | | 3/1997 |
| EP | 0869012 | | 10/1998 |
| EP | 1054780 | | 11/2000 |
| EP | 1213155 | | 6/2002 |
| EP | 1332845 | | 8/2003 |
| EP | 1332846 | | 8/2003 |
| EP | 1332847 | | 8/2003 |
| EP | 1332848 | | 8/2003 |
| EP | 1332849 | | 8/2003 |
| EP | 1336458 | | 8/2003 |
| GB | 728421 | | 4/1955 |
| GB | 740305 | | 11/1955 |
| GB | 756307 | | 9/1956 |
| GB | 783248 | | 9/1957 |
| GB | 879477 | | 10/1961 |
| GB | 890739 | | 3/1962 |
| GB | 930863 | | 7/1963 |
| GB | 1028535 | | 5/1966 |
| GB | 1384622 | | 2/1975 |
| GB | 1393441 | | 5/1975 |
| GB | 1421300 | | 1/1976 |
| GB | 1443011 | | 7/1976 |
| GB | 1512709 | | 6/1978 |
| GB | 2197256 | | 5/1988 |
| GB | 2293129 | | 3/1996 |
| GB | 2375735 | | 11/2002 |
| GB | 2384740 | | 8/2003 |
| GB | 2388331 | | 11/2003 |
| GB | 2405610 | | 3/2005 |
| IN | 185106 | | 11/2000 |
| JP | 6-55499 | A | 3/1994 |
| NO | 900766 | | 2/1990 |
| NO | 902514 | | 6/1990 |
| NO | 915070 | | 12/1991 |
| RU | 2 057 649 | C1 | 4/1996 |
| SE | 0 103 227 | | 3/2003 |
| WO | 90/00982 | | 2/1990 |
| WO | 90/15722 | | 12/1990 |
| WO | 93/09958 | | 5/1993 |
| WO | 93/22144 | | 11/1993 |
| WO | 93/24289 | | 12/1993 |
| WO | 94/00302 | | 1/1994 |
| WO | 95/30548 | | 11/1995 |
| WO | 95/30549 | | 11/1995 |
| WO | 96/11112 | | 4/1996 |
| WO | 99/20474 | | 4/1999 |
| WO | 99/51406 | | 10/1999 |
| WO | 00/58111 | | 10/2000 |
| WO | 00/61381 | | 10/2000 |
| WO | 00/62984 | | 10/2000 |
| WO | 01/19620 | | 3/2001 |
| WO | 01/19622 | | 3/2001 |
| WO | 01/23152 | | 4/2001 |
| WO | 01/43898 | | 6/2001 |
| WO | 01/68379 | | 9/2001 |
| WO | 02/00444 | | 1/2002 |
| WO | 02/14034 | A2 | 2/2002 |
| WO | 02/28664 | | 4/2002 |
| WO | 02/42090 | | 5/2002 |
| WO | 02/094576 | A1 | 11/2002 |
| WO | 03/020533 | | 3/2003 |
| WO | 03/066292 | A1 | 8/2003 |
| WO | 03/072474 | | 9/2003 |
| WO | 03/089204 | | 10/2003 |
| WO | 03/095163 | | 11/2003 |
| WO | 2004/000574 | | 12/2003 |
| WO | 2004/037549 | | 5/2004 |
| WO | 2004/108425 | | 12/2004 |
| WO | 2005/011996 | | 2/2005 |

OTHER PUBLICATIONS

PCT International Search Report issued in International Application No. PCT/US2005/016634 dated Jan. 23, 2006.

International Preliminary Report on Patentability and Written Opinion of the International Searching Authority received in related PCT application No. PCT/US2005/016634, mailed Nov. 30, 2006 (11 pages).

* cited by examiner

PUNCHING AND BINDING SYSTEM AND ELEMENTS THEREOF

CROSS-REFERENCE TO RELATED APPLICATIONS

The present application claims the benefit of priority from U.S. application Ser. No. 11/133,311, filed May 20, 2005, and entitled "PUNCHING AND BINDING SYSTEM AND ELEMENTS THEREOF," U.S. Provisional Application Ser. No. 60/572,747, filed May 21, 2004 and entitled "PUNCHING AND BINDING SYSTEM AND ELEMENTS THEREOF," U.S. Provisional Application Ser. No. 60/613,509, filed Sep. 28, 2004 and entitled "CAM-DRIVEN PUNCHING APPARATUS," U.S. Provisional Application Ser. No. 60/635,443, filed Dec. 14, 2004 and entitled "BINDING SYSTEM AND ELEMENTS THEREOF," and U.S. Provisional Application Ser. No. 60/663,877, filed Mar. 22, 2005 and entitled "BINDING SYSTEM AND ELEMENTS THEREOF." The entire content of each of the aforementioned applications are incorporated herein by reference.

BACKGROUND OF THE INVENTION

1. Field of the Invention

The present invention relates generally to combination document punching and binding systems and more particularly to punching and binding systems that utilize comb-type binders.

2. Description of Related Art

Combination paper punching and binding machines are known in the art. However, most current machines that are utilized in an office environment are specifically designed for one size of paper. In the United States, the majority of machines are configured to handle only letter size (8.5"×11") paper. In Europe, the majority of machines are configured to handle metric A4 size (8.27"×11.69") paper. In today's business world, however, it is not uncommon for an office to routinely handle both letter size and metric A4 size paper. As such, in order to have the capability to bind stacks of both sizes of paper, separate machines are required. Although some machines are configured to handle both sizes of paper, the spacing of the punches is optimized for one size or the other. This yields a good quality bound book for one size, but not the other.

In addition, most machines that are used in an office environment cannot handle a large number of papers at one time. This is due to their compact size and limited power. The power required to punch through many sheets of paper at one time is significant because, in most machines, multiple holes are punched simultaneously. This limits the amount of paper that can be processed at one time. Although machines can be designed with increased power, increasing the power of a machine necessarily increases the size and cost of the machine.

Moreover, desktop type binding machines that also have the capability of punching the holes in the papers prior to the binding operation typically require significant operator interaction. A typical machine first requires the operator to lift the lid of the machine to the open position. The operator must find the correct size of binding element for the particular document that is about to be bound. The operator may select the "covers" setting on the machine, insert the covers into the machine, pull a lever to punch the covers, and then release the lever. The covers must then be removed from the machine. The operator may then select the "document" setting on the machine, insert the document to be bound into the machine, pull the lever to punch the document, release the lever, and then remove the document. The covers are then placed on the document. The binding element is carefully loaded by hand onto the machine so that the binding element can be opened with a lever. The covered document must be loaded onto the opened binding element, sometimes in stages if the document is too thick. Once all of the pages of the document are loaded onto the binding element, the lever may be released to close the binding element. The document is now bound.

In view of the current state of the art, the inventors have endeavored to provide a wide variety of improvements to punching and/or binding apparatus.

SUMMARY OF THE INVENTION

The present application discloses a wide variety of improvements in the punching and binding art. These improvements include:

a synchronized translating punching mechanism;

a binding element applicator that moves linearly to uncurl the fingers of a binding element;

a removable punch device for a punching mechanism;

a binding element with an advantageous pitch, and a book bound by such a binding element;

a cam-driven punching apparatus designed to accommodate the use of internal bore punches;

a movable paper clamp for a binding or punching and binding apparatus;

the ability to control movement of such a paper clamp depending on the size of a binding element;

a binding apparatus with a controller for controlling a position of a paper clamp to align punched holes with fingers of the binding element;

a pusher for properly positioning a binding element in a binding element insertion device;

a binding element that loads in only one orientation;

counting the number of punching cycles to signal for emptying of waste;

a user interface that displays information for guiding interaction with an apparatus;

a user interface with a display having a first portion for displaying information to guide the user's interaction and a second portion for indicating the current step being performed;

displaying an error message if the sensed size of the binding element does not correspond to the thickness of the stack being bound;

an indicator that provides information instructing the user which size binding element to insert;

a visual display that provides information about the binding apparatus while it is operating;

a cover for a stack of documents with holes arranged at an advantageous pitch;

an interlock device for locking a lid of a binding apparatus during operation; and chad removers for disengaging chads from the punches.

Other aspects, features and advantages of the present invention will become apparent from the following detailed description, the accompanying drawings, and the appended claims.

BRIEF DESCRIPTION OF THE DRAWINGS

Features of the invention are shown in the drawings, in which like reference numerals designate like elements. The drawings form part of this original disclosure, in which.

DETAILED DESCRIPTION OF EMBODIMENTS OF THE INVENTION

Figure 1:
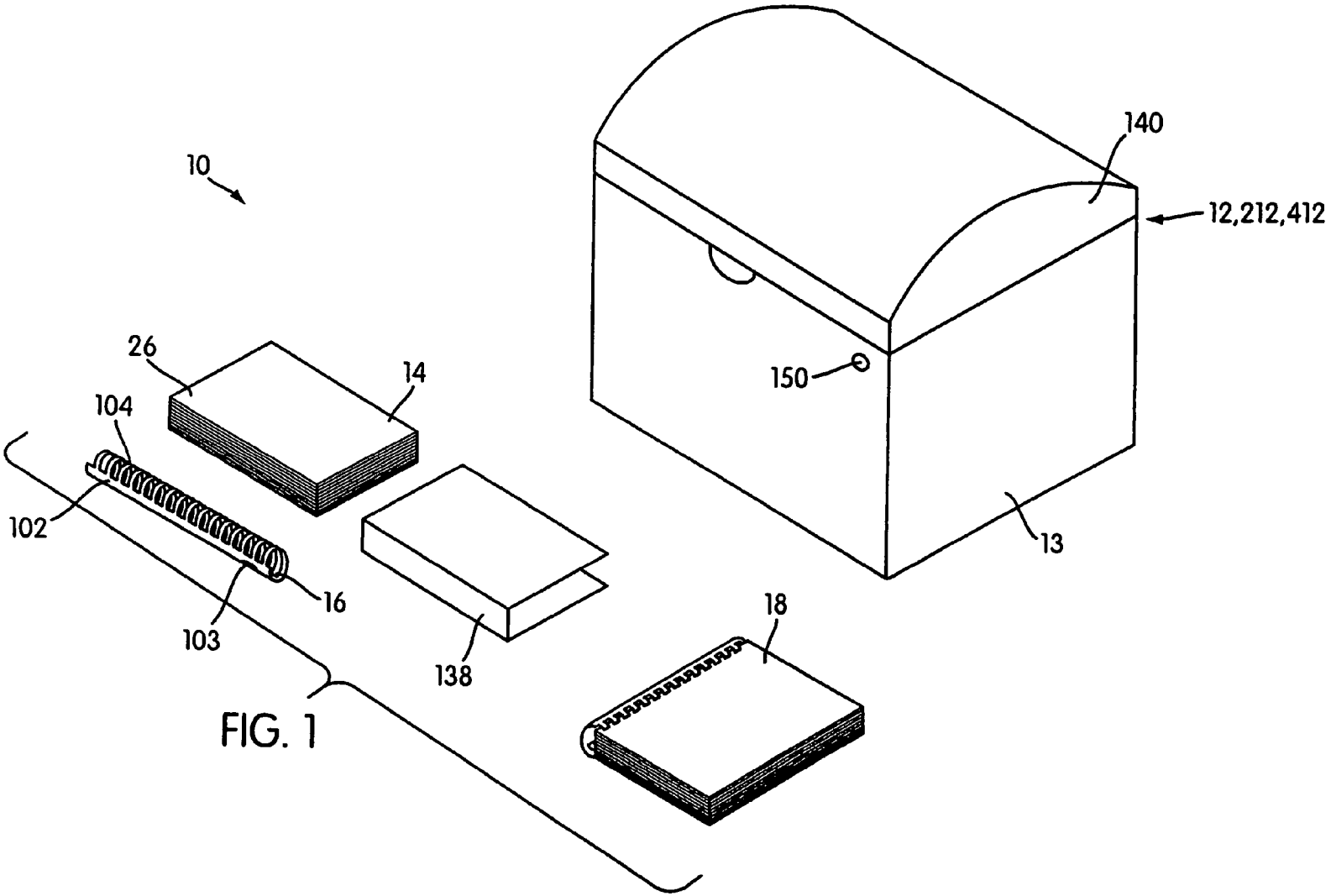
FIG. 1 is a perspective view of a binding system of at least one embodiment of the present invention.

FIG. 1 generally shows a binding system 10 of at least one embodiment of the present invention. The system includes an apparatus 12, 212, 412 for performing a hole punching operation and a binding operation on a stack of paper 14, and a binding element 16 that is connected to the stack of paper 14 during the binding operation to yield a bound book 18.

Figure 2:
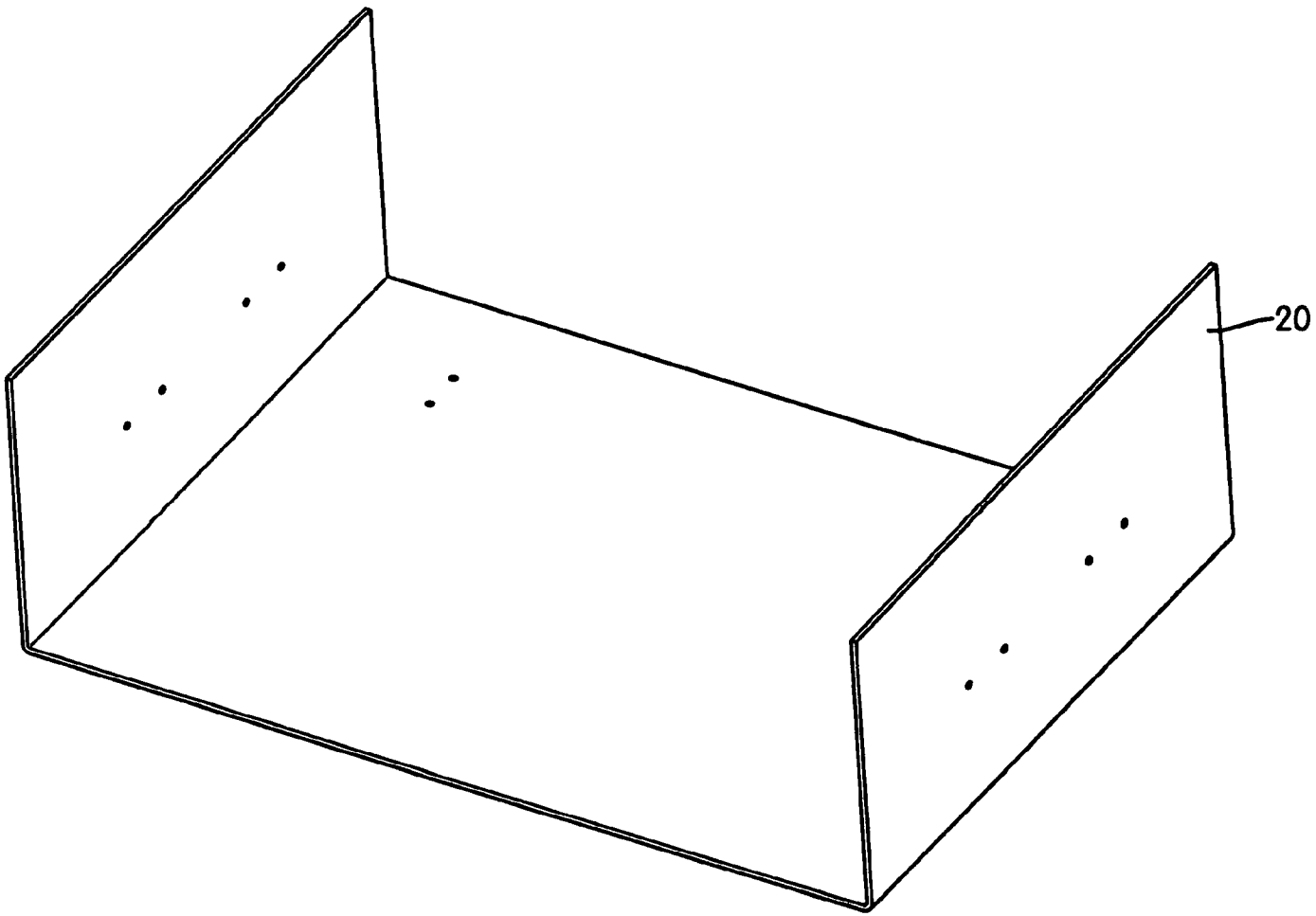
FIG. 2 is a perspective view of a frame of a binding apparatus of the binding system of FIG. 1.

The apparatus 12 includes a housing 13 (shown in FIG. 1) and a frame 20 (shown in FIG. 2) that is disposed within the housing 13. The apparatus 12 also includes a punch drive unit 19, an example of which is shown in FIGS. 3-14, that is disposed within the housing 13 and is supported by the frame 20. A paper support base is also supported by the frame and includes a surface on which the stack of paper 14 can be placed when the stack of paper 14 is loaded into the apparatus 12. The paper support base is structured such that when the stack of paper 14 is in a punching position, the stack of paper 14 is generally horizontal, and an edge 26 of the stack of paper 14 is oriented in a linear direction 28. Alternatively, the stack of paper 14 may be held at another angle. Details of at least one embodiment of the paper support base that may be part of the apparatus 12 are discussed below.

The stack of paper 14 includes at least two sheets of paper (the term paper is being used herein in a very generic manner to encompass all types of material which may be bound as leafs of a book, and is not limited to pulp or fiber based materials). The term document may also be used to generically describe materials to be bound together. Thus, the terms "paper" and "document" may be used herein interchangeably and should not be construed as being limited to fiber based materials or synthetic materials, but should be construed as referring to materials to b bound together. The size of the paper may be standard letter size (8.5"×11"), metric A4 size (210 mm×297 mm), ledger size (11"×17"), or metric A3 size (297 mm×420 mm). When ledger or metric A3 sizes are used, the edges of the short sides may be oriented in the linear direction 28. For example, when a stack of paper 14 that includes ledger paper is being used in the apparatus 12, the 11" side may be placed on the surface of the support base such that the 11" side is oriented in the linear direction 28. It should be understood, however, that the apparatus 12 could be used or designed for use with any size paper with any edge thereof in the linear direction 28, and the ones mentioned herein are the ones most widely available.

In the embodiment shown in FIGS. 3-14, the punch drive unit 19 includes a frame 21 that is substantially shaped as a 'C.' This gives the frame 21 a large strength to weight ratio and a superior stress distribution, thereby allowing the frame 21 to be strong, while minimizing the weight of the apparatus 12. However, the C-shape of the frame 21 is not necessary, and is only preferred.

Figure 3:
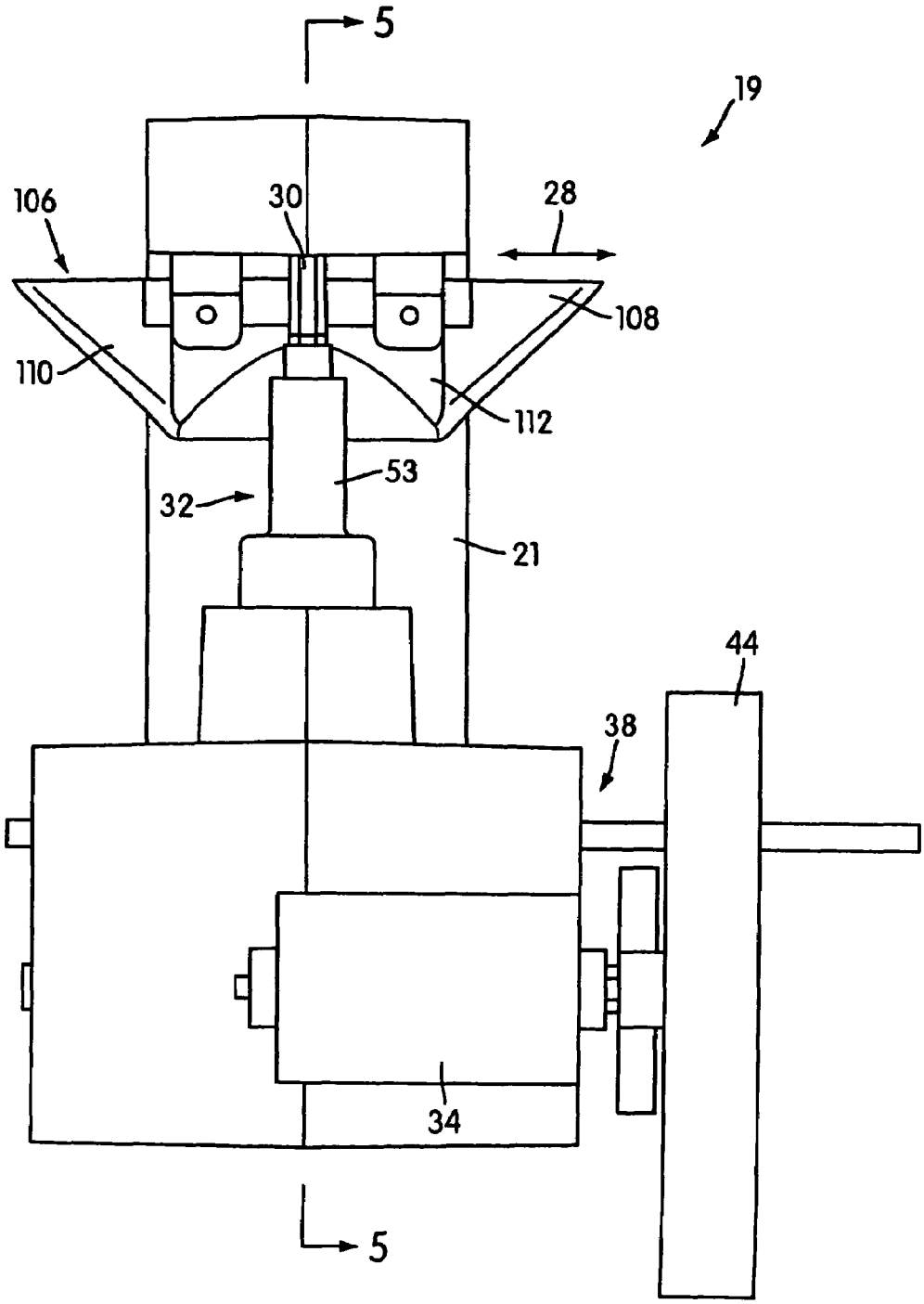
FIG. 3 is a front view of one embodiment of a punch drive unit of the binding apparatus of the binding system of FIG. 1.
Figure 4:
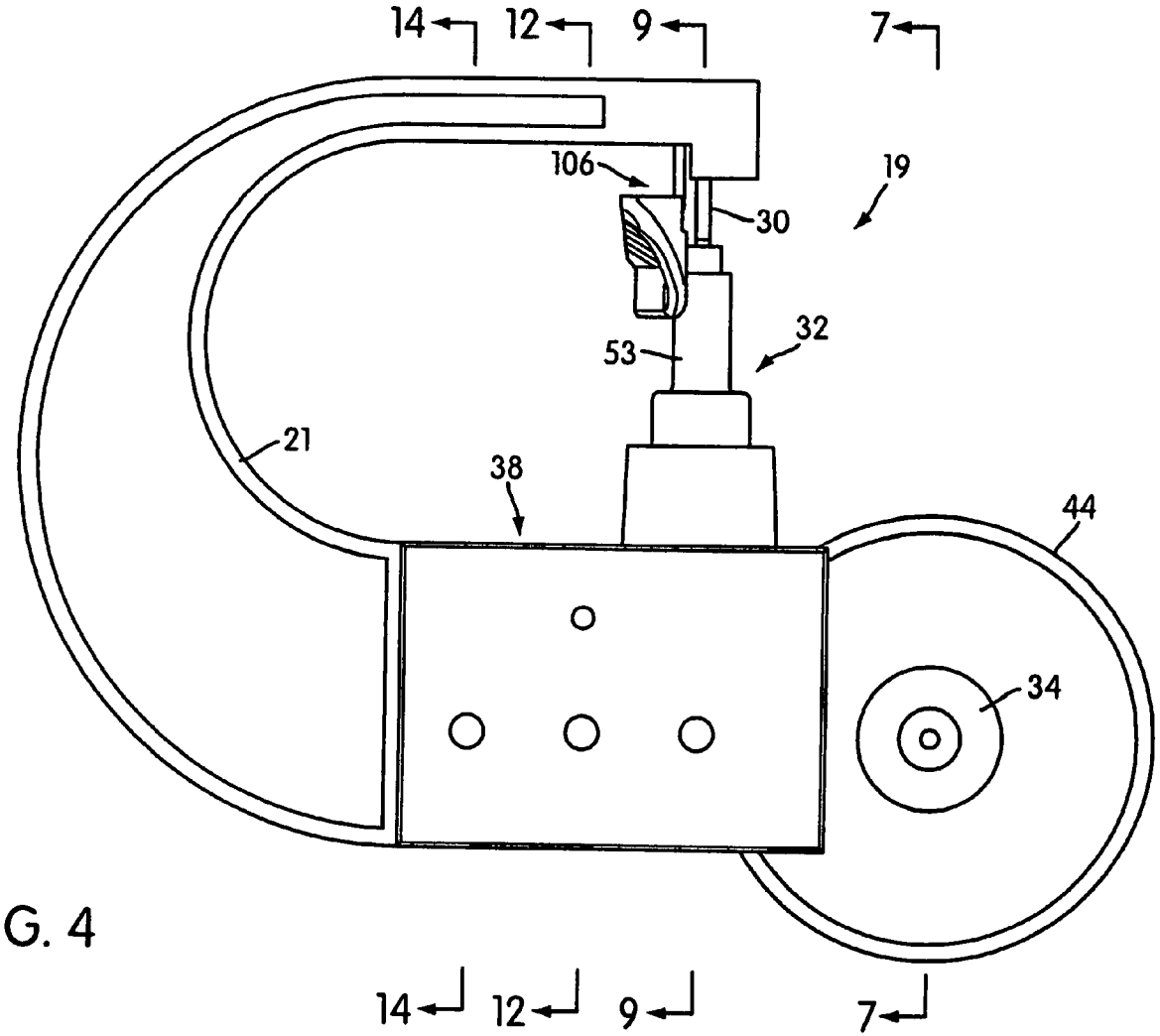
FIG. 4 is a side view of the punch drive unit of FIG. 3.

As shown in FIG. 3, the punch drive unit 19 of the apparatus 12 also includes at least one punch 30 that is constructed to punch through the stack of paper 14. In at least one embodiment, the punch 30 is operatively connected to a power-operated punch drive mechanism 32. The term "punch drive mechanism" is a generic structural term used to describe mechanisms for driving punches and is being used herein consistent with that definition. Although only a single punch 30 is shown in FIGS. 3-14, it is understood that a plurality of punches may be used. For example, two, three, or six punches may be mounted either side-by-side, or in a spaced apart configuration so that two, three, or six holes may be created upon a single stroke of the punch driver mechanism 32. An embodiment that includes six punches is described below.

At least one embodiment of the punch drive mechanism 32 is discussed below and is illustrated in the figures. The punch driver mechanism 32 is operatively connected to a power source 34, such as an electric motor. It is also contemplated that the power source 34 may be battery powered, or may operate off of direct current or alternating current, or may be hydraulically or otherwise driven. In the illustrated embodiment, the power source 34 preferably, but not necessarily, powers the punch driver mechanism 32 continuously, such that the punch driver mechanism 32 continuously moves, as further explained below.

The punch driver mechanism 32 is operable to reciprocally drive the punch 30 through a plurality of drive strokes and a plurality of return strokes. During the drive stroke, the punch driver mechanism 32 drives the punch 30 through the edge 26 of the stack of paper 14. During the return stroke, the punch driver mechanism 32 withdraws the punch 30 from the edge 26 of the stack of paper 14. A punch cycle includes one drive stroke and one subsequent return stroke. At the end of the punch cycle, a hole 36 is formed in the edge 26 of the stack of paper 14. Also, it is contemplated that the punch 30 may be rotated like a drill so that the punch drills the stack of paper 14 rather than presses through the stack of paper 14. All references to "punching" are intended to also include "drilling," where applicable.

The apparatus 12 further includes a power-operated translation mechanism 38 that is constructed to affect relative translational movement between the paper support base and the punch 30 in the linear direction 28. The term "translation mechanism" is a generic structural term used to describe mechanisms for translating an object, such as the punch drive mechanism, 32 in a linear direction, and is being used herein consistent with that definition. An exemplary, non-limiting embodiment of the translation mechanism 38 is discussed below. The translation mechanism 38 and the punch driver mechanism 32 are synchronized such that, when the stack of paper 14 is in the punching position, the translation mechanism 38 affects the relative translational movement between the paper support base and the punch 30 during the hole punching operation in an indexing manner, as will be discussed below.

During the hole punching operation, after each occurrence of the punch 30 being withdrawn from the stack of paper 14 on the return stroke, the translation mechanism 38 affects the relative translational movement by a predetermined distance 40 in the linear direction 28 prior to each occurrence of the punch 30 engaging the stack of paper 14 during the next punch cycle. In other words, with respect to each punch cycle, the translation mechanism 38 operates to affect this relative translational movement by the predetermined distance 40 after the time the punch 30 has withdrawn from the stack of paper 14, but before the punch 30 re-engages with the stack of paper 14. This causes the stack of paper 14 to be punched along the edge 26 such that a series of holes 36 are spaced apart essentially evenly with a pitch 42 in the linear direction 28. When there is a single punch 30, the predetermined distance 40 is equal to the pitch 42.

The synchronization of the punch driver mechanism 32 and the translation mechanism 38 may be controlled and executed in a number of ways, including but not limited to the use of servomechanisms and servomotors that may be operatively connected to a common controller that operates both the punch driver mechanism 32 and the translation mechanism 38 in a synchronized manner, such as a programmed controller. In the illustrated embodiment, a mechanical transmission gears the translation mechanism 38 to the power source 34 driving the punch driver mechanism 32, but this construction is only an example and should not be considered limiting. Additionally, although the illustrated embodiments show the translation mechanism 38 moving the punch 30 relative to a stationary paper support base, the reverse could be done and the paper support base could be moved relative to a stationary punch. Further, although the illustrated embodiment shows the punch drive mechanism 32 and the translation mechanism 38 as being housed together and sharing a common power source, they could be distinct units and use separate power sources if desired.

In at least one embodiment, the punch driver mechanism 32 also includes a flywheel 44, shown in FIGS. 3-7, that is driven by the power source 34 and is operatively connected to the punch 30. The flywheel 44 is rotatably driven and is configured to store kinetic energy during rotation and to transfer energy to the punch 30 as the punch 30 engages the stack of paper 14 during the drive stroke. This enables the punch driver mechanism 32 to require less power, as the flywheel 44 will store kinetic energy prior to engaging the stack of paper 14, and then release that kinetic energy upon engaging the stack of paper 14 to assist in driving the punch 30 through the stack of paper 14. In the illustrated embodiment wherein an electric motor is used as the power source 34, the flywheel 44 may allow the motor to be approximately one-sixth the size of a motor that would be used in the absence of the flywheel 44. Also, the flywheel 44 may be used to manually cycle the apparatus 12 and back the punch 30 out from the stack of paper 14 in the event that power is lost to the apparatus 12 (i.e., by manually grasping and rotating the flywheel 44 to cycle the punch 30 back through a return stroke). Energy may be transferred from the flywheel 44 to the punch 30 through a series of gears and belts. While several gears are shown in the figures, it is contemplated that more or less gears and/or belts may be used in practicing the invention, and also the presence of gears and/or belts could be omitted such that the power source transmits force directly to the punch 30. Additionally, in the broader aspects of the invention, the flywheel 44 is an optional feature and should not be considered limiting in any way.

Figure 8:
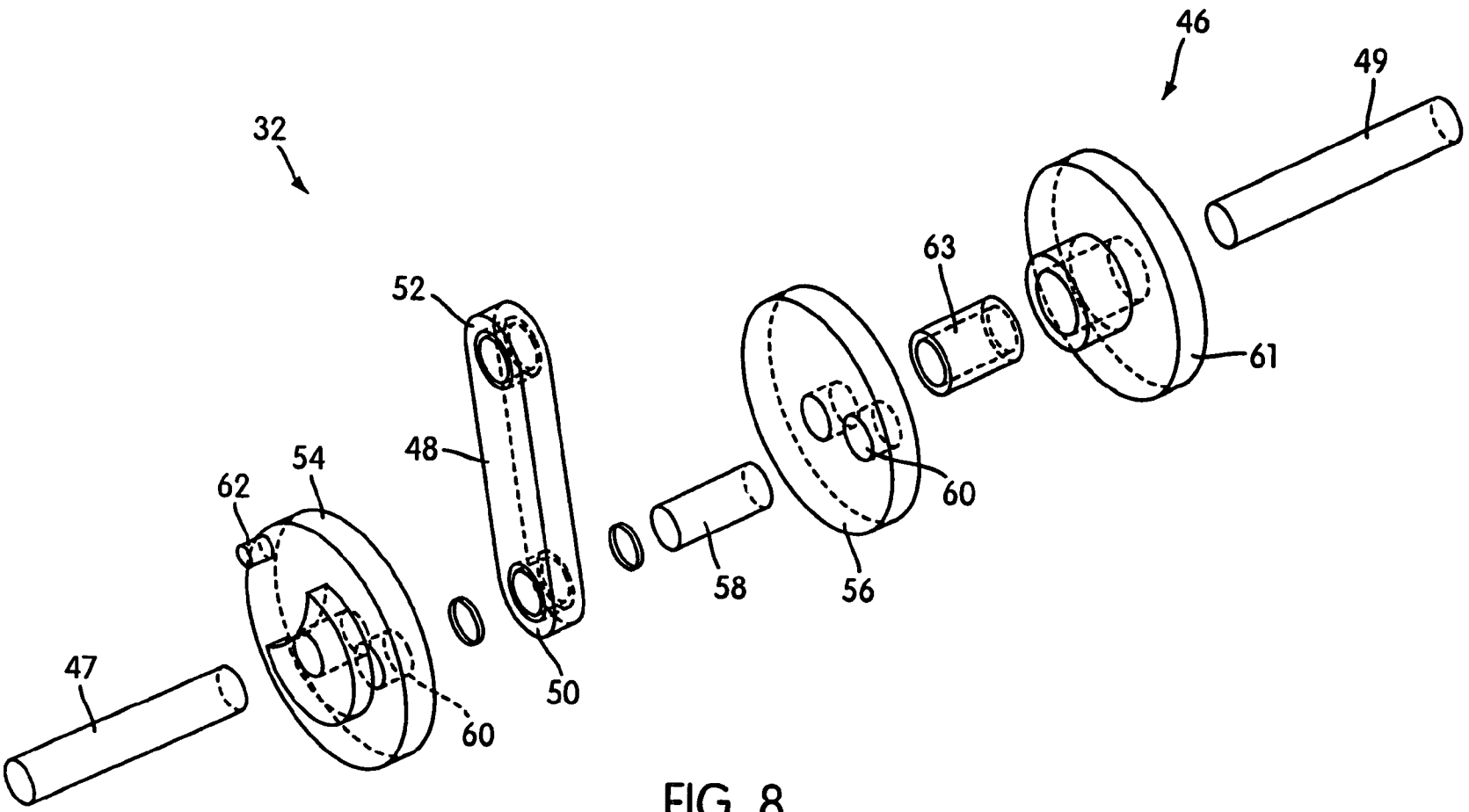
FIG. 8 is an exploded view of a crankshaft of the binding apparatus of FIG. 3.
Figure 9:
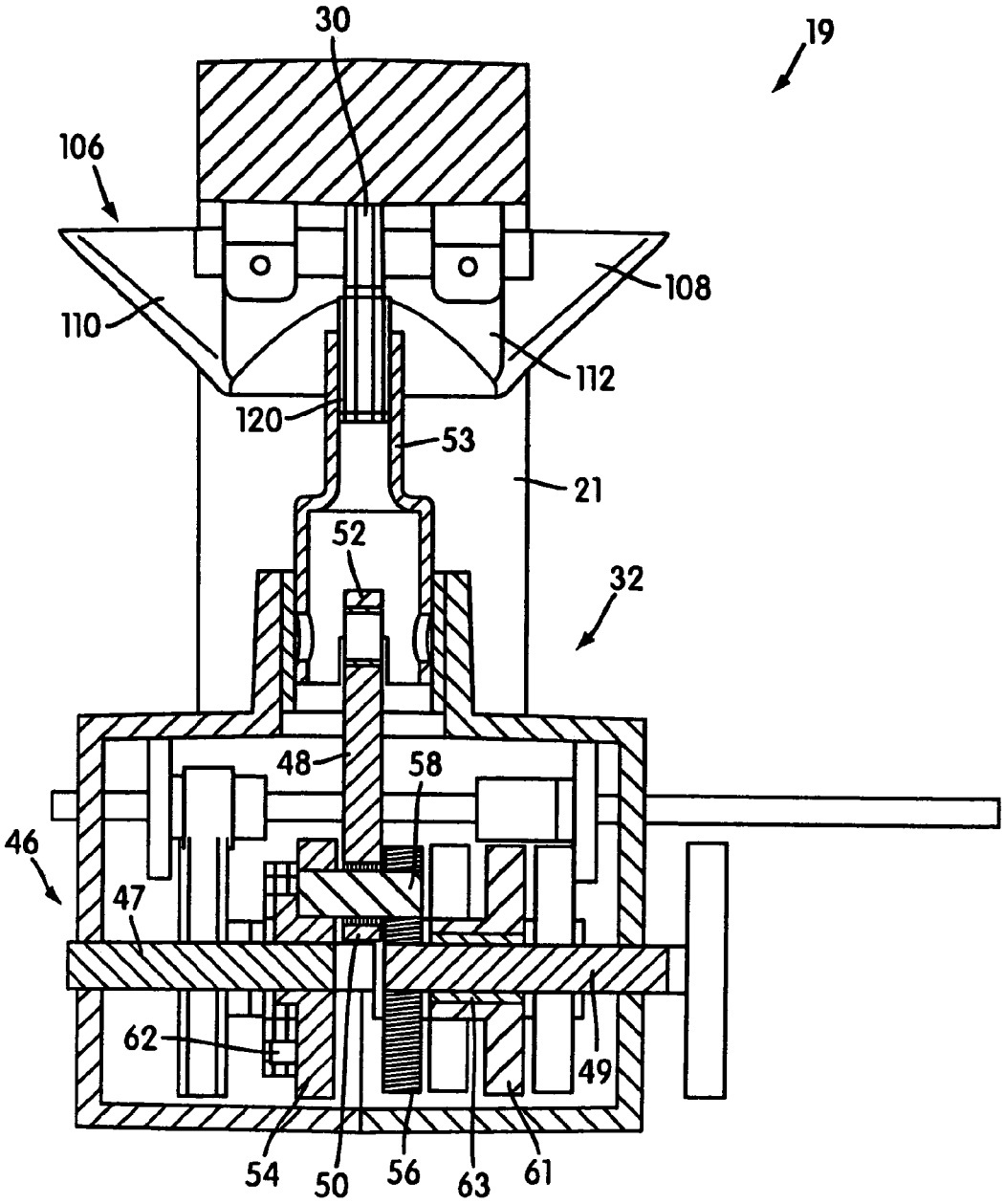
FIG. 9 is a cross-sectional front view of the punch drive unit of the binding apparatus taken along line 9-9 of FIG. 4.

FIGS. 8 and 9 illustrate a portion of one embodiment of the punch drive mechanism 32. As shown, the punch driver mechanism 32 may include a crank shaft 46 with an elongated link 48 disposed in between coaxial first and second portions 47, 49 of the crank shaft 46. The elongated link 48 includes a first end 50 and a second end 52. The first end 50 is operatively connected to the crank shaft 46 such that when the crank shaft 46 rotates, the second end 52 of the elongated link 48, which is operatively connected to a punch piston 53, moves in a substantially radial direction relative to the longitudinal axis of the crank shaft 46.

Figure 5:
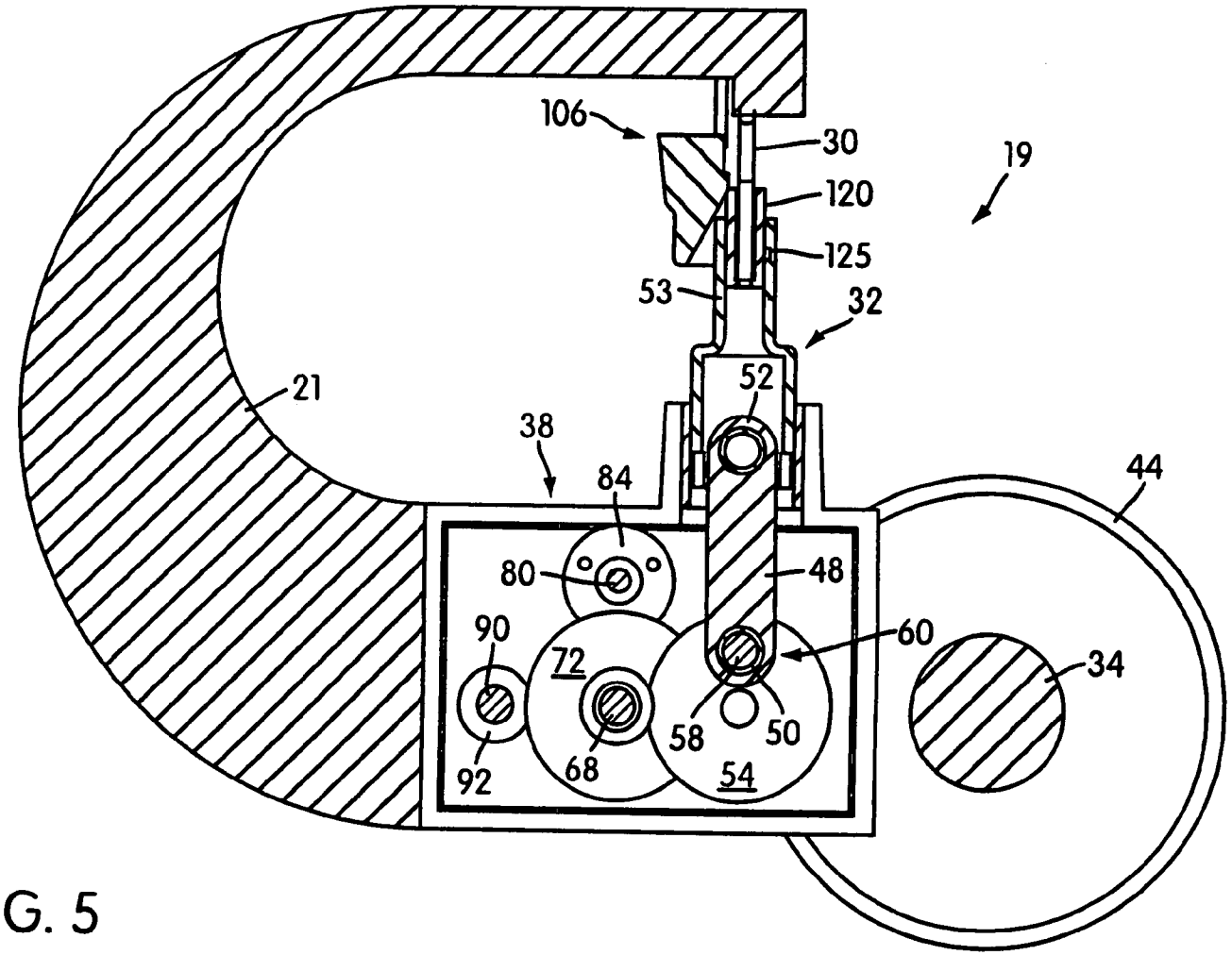
FIG. 5 is a cross-sectional side view of the punch drive unit of the binding apparatus taken along line 5-5 of FIG. 3.
Figure 6:
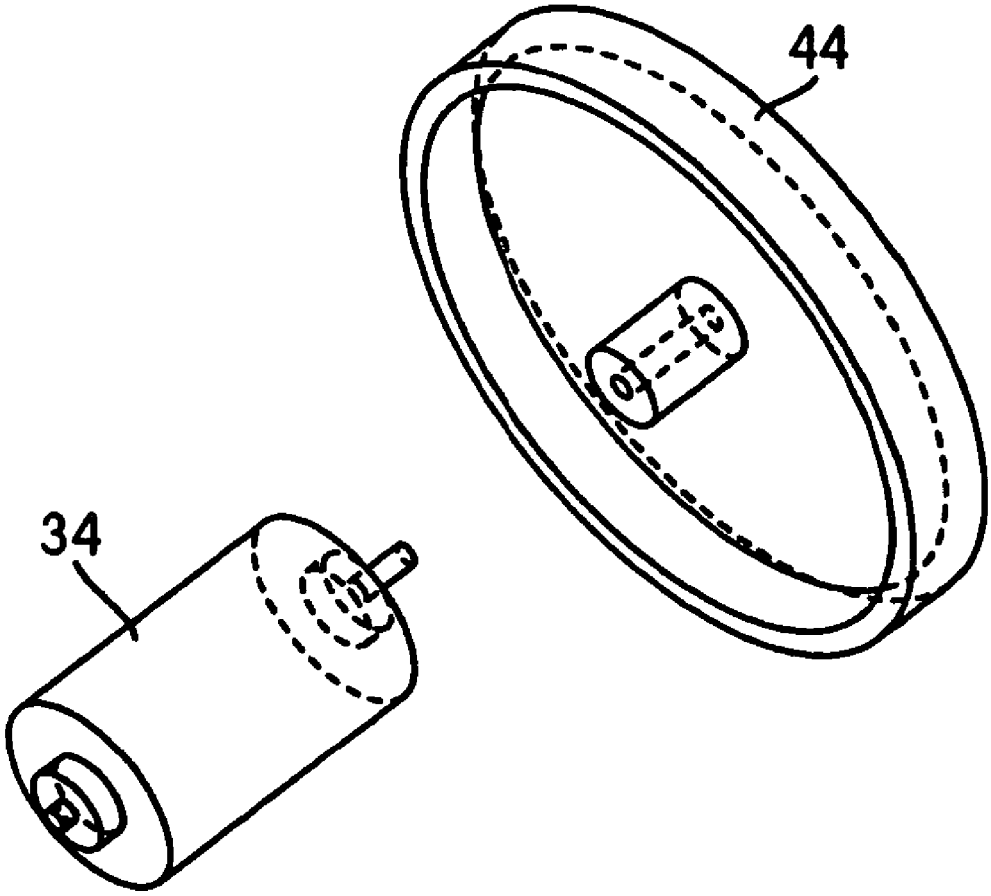
FIG. 6 is an exploded view of a power source and a flywheel of the binding apparatus of FIG. 3.
Figure 7:
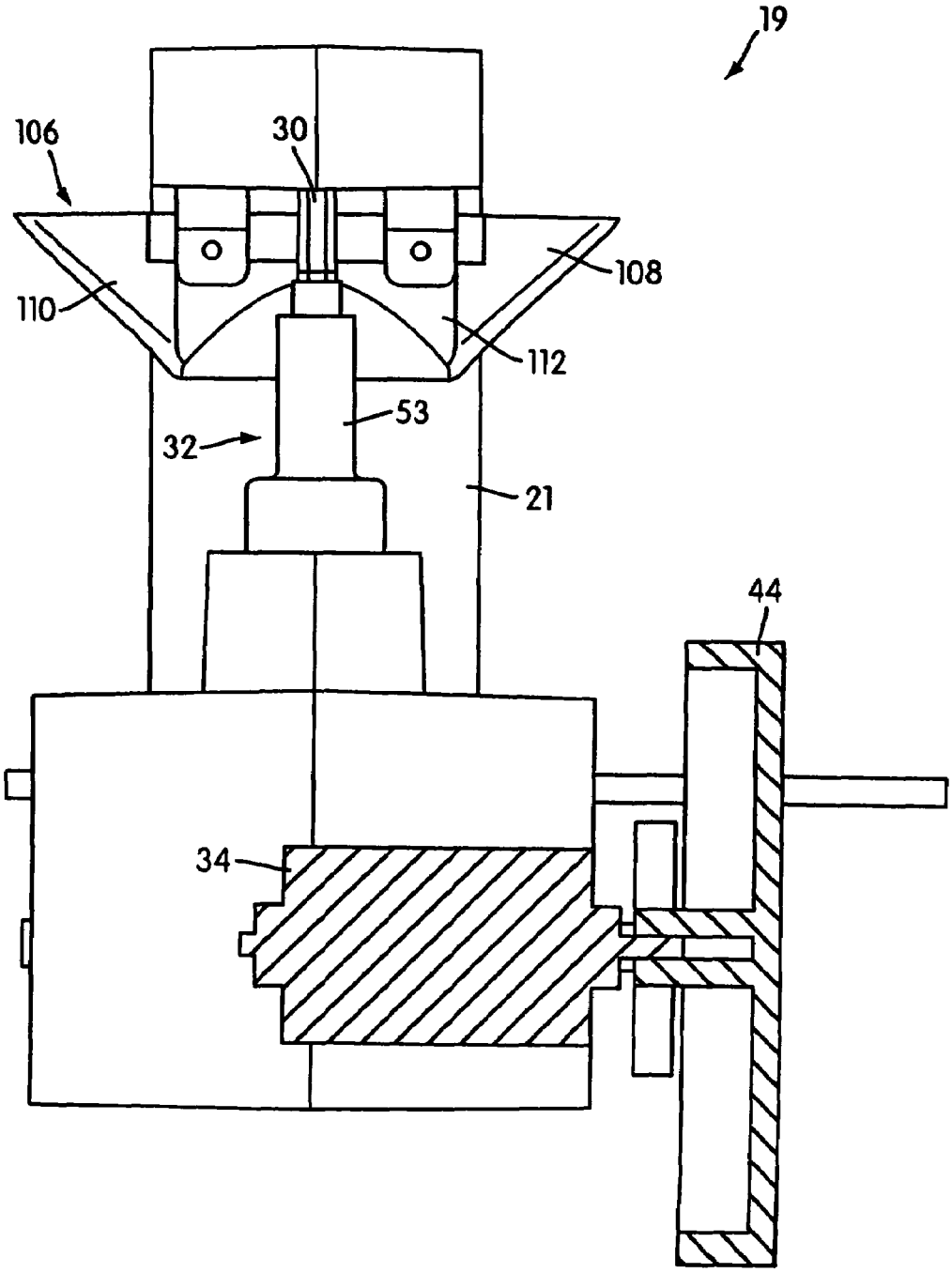
FIG. 7 is a cross-sectional front view of the punch drive unit of the binding apparatus taken along line 7-7 of FIG. 4.

As shown, the elongated link 48 is operatively connected to a rotatable transfer member 54 and a disc 56 by a connecting member 58. The rotatable transfer member 54 and the disc 56 may be gears, pulleys, or any other type of rotatable member. As explained below, the disc 56 receives the force from the power source 34 through other gears constituting a transmission and provides the driving force to the punch 30 via the elongated link 48. The connecting member 58 extends from the disc 56, through the elongated link 48, and to the rotatable transfer member 54. In the illustrated embodiment, the connecting member 58 connects to the rotatable transfer member 54 and the disc 56 at connecting points 60 that are offset (i.e., eccentric) from the centers of the rotatable transfer member 54 and disc 56 (which are coaxial with the first and second portions 47, 49 of the crank shaft 46). This way, as the rotatable transfer member 54 and the second disc 56 rotate in tandem, the first end 50 of the elongated link 48 will travel circumferentially and the second end 52 will travel radially outwardly, inwardly, and outwardly as the rotatable transfer member 54 and disc 56 complete one revolution. This causes the punch piston 53 to move upward and then downward in a piston-like motion. The punch piston 53 moves upward during the drive stroke and downward during the return stroke. In FIGS. 5 and 9, the elongated link 48 is shown in its fully radially outward position. This position corresponds to the punch 30 being fully inserted into the stack of paper 14 and is the transition point between the drive stroke and the return stroke.

As shown in FIGS. 8 and 9, another rotatable member 61 is disposed on the second portion 49 of the crankshaft 46. As shown, a bushing 63 is provided so that the rotatable member 61 may rotate independently of the crankshaft 46. The rotatable member 61 may be a gear, pulley, or any other type of rotatable member. As explained below, the rotatable member 61 is part of the drive train or transmission that drives the punch 30.

Preferably, the rotatable transfer member 54 includes a contact portion 62 that is spaced radially from an axis about which the rotatable transfer member 54 rotates. The rotatable transfer member 54 is rotated continuously during the hole punching operation as the punch driver mechanism 32 continuously moves the punch 30 through the drive and return strokes. The function of this contact portion 62 will be discussed below in relation to the translation mechanism 38.

Figure 10:
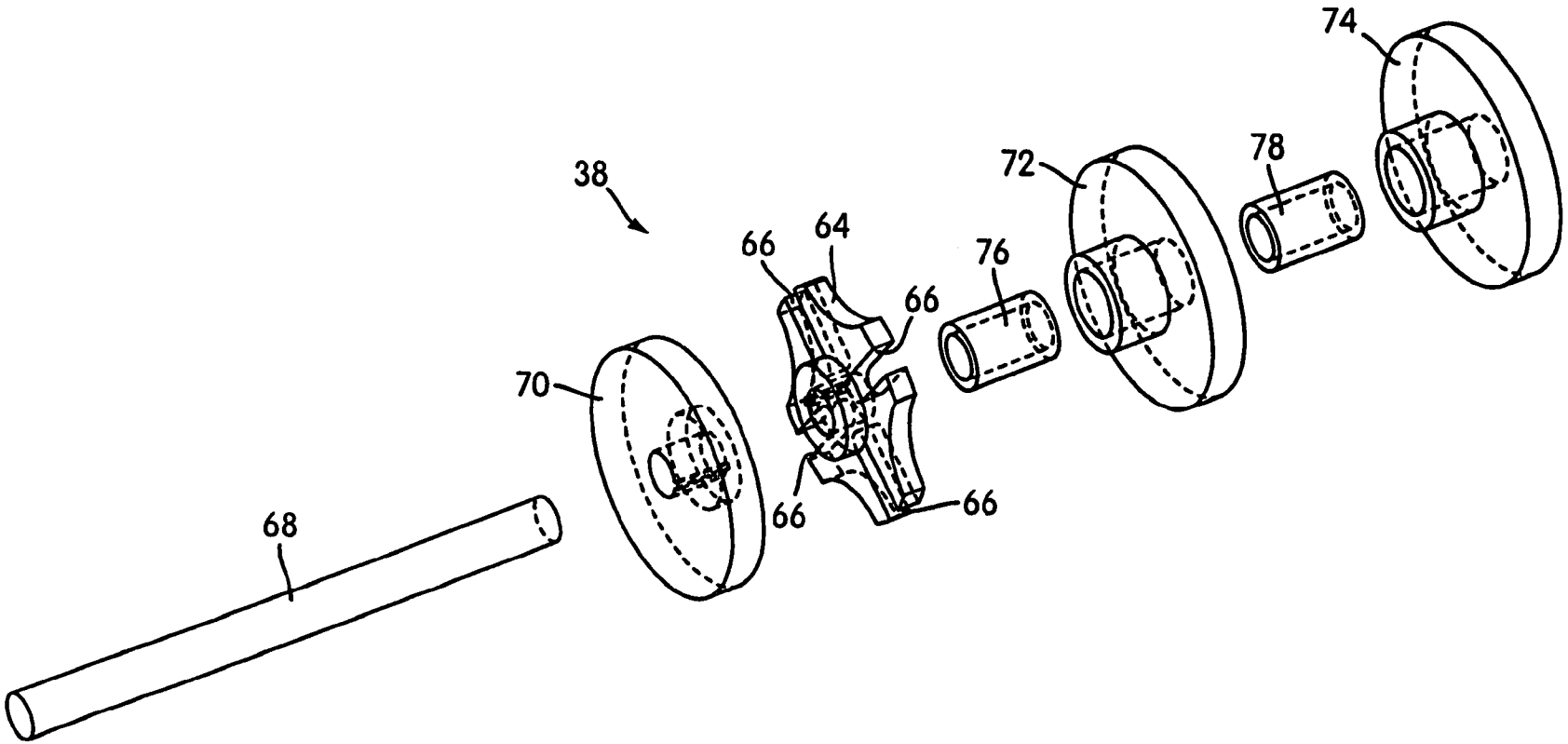
FIG. 10 is an exploded view of a portion of a translation mechanism of the binding apparatus of FIG. 3.

As illustrated in FIG. 10, the translation mechanism 38 includes a rotatable drive member 64 that has a plurality of engagement surfaces 66 that are spaced radially from an axis about which the rotatable drive member 64 rotates. The engagement surfaces 66 are angularly spaced apart from one another essentially evenly. As will be discussed in further detail below, the translation mechanism 38 is constructed such that rotating the drive member 64 in an amount equal to the angular spacing of the engagement surfaces causes the translation mechanism 38 to affect the relative translational movement between the punch 30 and the paper support base by the predetermined distance 40.

In the illustrated embodiment, the transfer member 54 and the drive member 64 are constructed and arranged with respect to one another such that as the transfer member 54 is continuously rotated during the hole punching operation, the contact portion 62 repeatedly engages one of the engagement surfaces 66 at a point after each occurrence of the punch 30 being withdrawn from the stack of paper 14 on the return stroke to rotate the drive member 64 an amount equal to the angular spacing of the engagement surfaces 66. Then, the contact portion 62 disengages the engaged one of the engagement surfaces 66 to cease rotation of the drive member 64 at a point prior to each occurrence of the punch 30 engaging the stack of paper 14 on the subsequent drive stroke. This operation is repeated continuously with the contact portion 62 engaging the engagement surfaces 64 sequentially. This synchronizes the punch drive mechanism 32 and the translation mechanism 38.

Specifically, as mentioned above, rotating the drive member 64 in an amount equal to the angular spacing between the engagement surfaces 66 will cause the translation mechanism 38 to affect the relative translational movement between the paper support base and the punch 30 by the predetermined distance 40. By arranging the contact portion 62 and the engagement surfaces 66 with respect to one another as described, synchronization is achieved wherein the translational movement occurs only during the time period between withdrawal of the punch 30 from the stack of paper 14 and re-engagement of the punch 30 with the stack of paper 14.

Although the embodiment illustrated in FIGS. 8 and 10 shows the transfer member 54 and the drive member 64 to be two components of a Geneva wheel, any type of intermittent gearing may be used to synchronize the punch drive mechanism 32 and the translation mechanism 38.

Returning to FIG. 10, the drive member 64 is disposed on a shaft 68 such that the shaft 68 rotates when the drive member 64 rotates. A gear 70 is disposed on the shaft 68 adjacent to the drive member 64 such that the gear 70 rotates with the drive member 64 and the shaft 68. Known techniques in the art may be used to attach the drive member 64 and the gear 70 to the shaft, including but not limited to the use of matching grooves in the shaft 68 and drive member 64 and the gear 70, along with keys to key the drive member 64 and the gear 70 to the shaft 68.

Additional optional gears 72, 74 may also be disposed on the shaft 68. As shown, the gears 72, 74 may be attached to the shaft 68 with bushings 76, 78, which allows the gears 72, 74 to rotate independent from the rotation of the shaft 68. In the illustrated embodiment, the gears 72, 74 are both operatively connected to the rotatable member 61 that is disposed on the crank shaft 46, as explained below, and are not considered to be part of the translation mechanism 38. Instead, these gears 72, 74 are part of the transmission or drive train that couples the power source 34 to the punch drive mechanism 32, and will be discussed below. These gears 72, 74 are mounted on shaft 68 for more compact packaging, and this construction is optional and should not be considered limiting.

Figure 11:
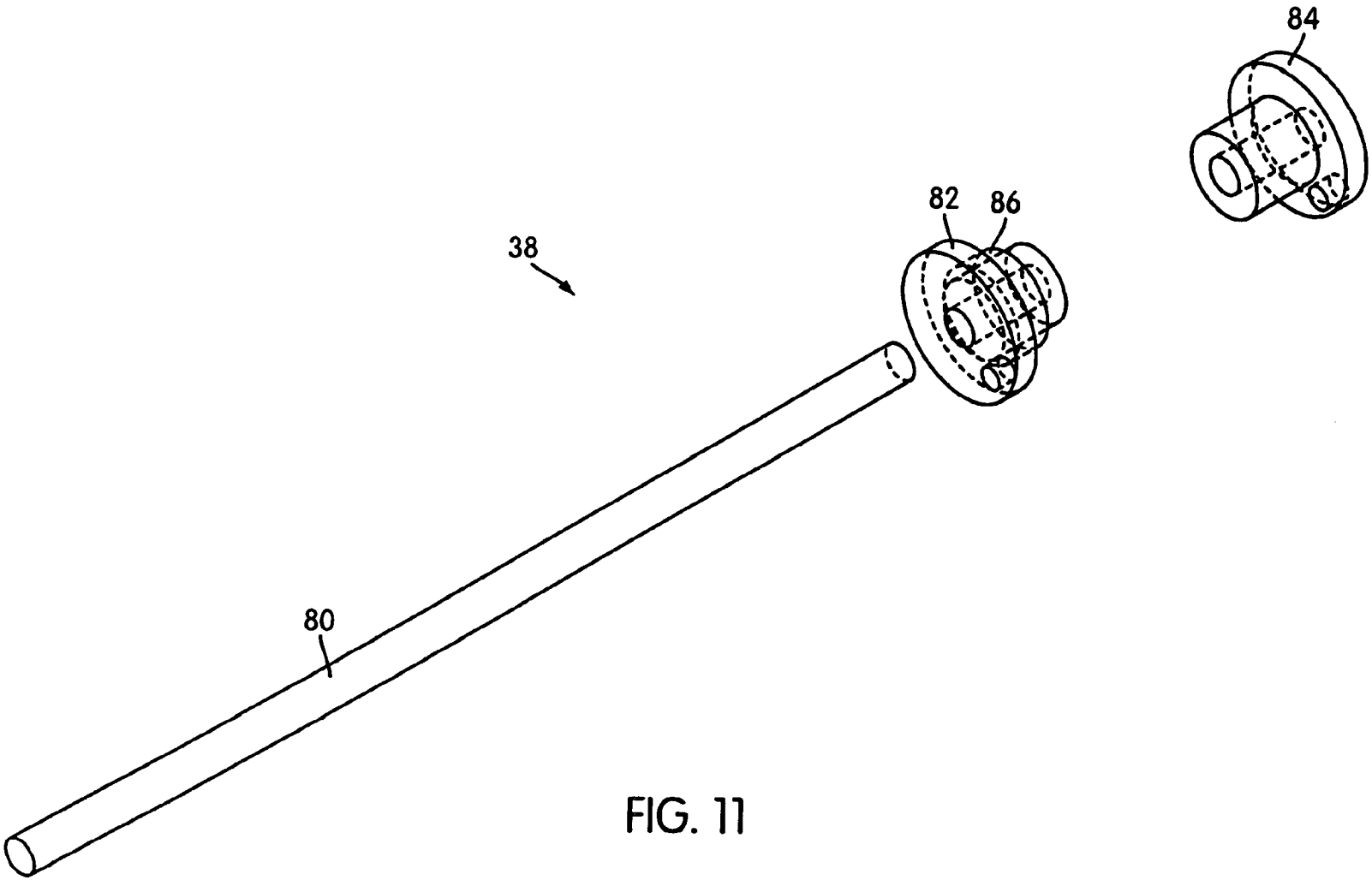
FIG. 11 is an exploded view of another portion of the translation mechanism of the binding apparatus of FIG. 3.
Figure 12:
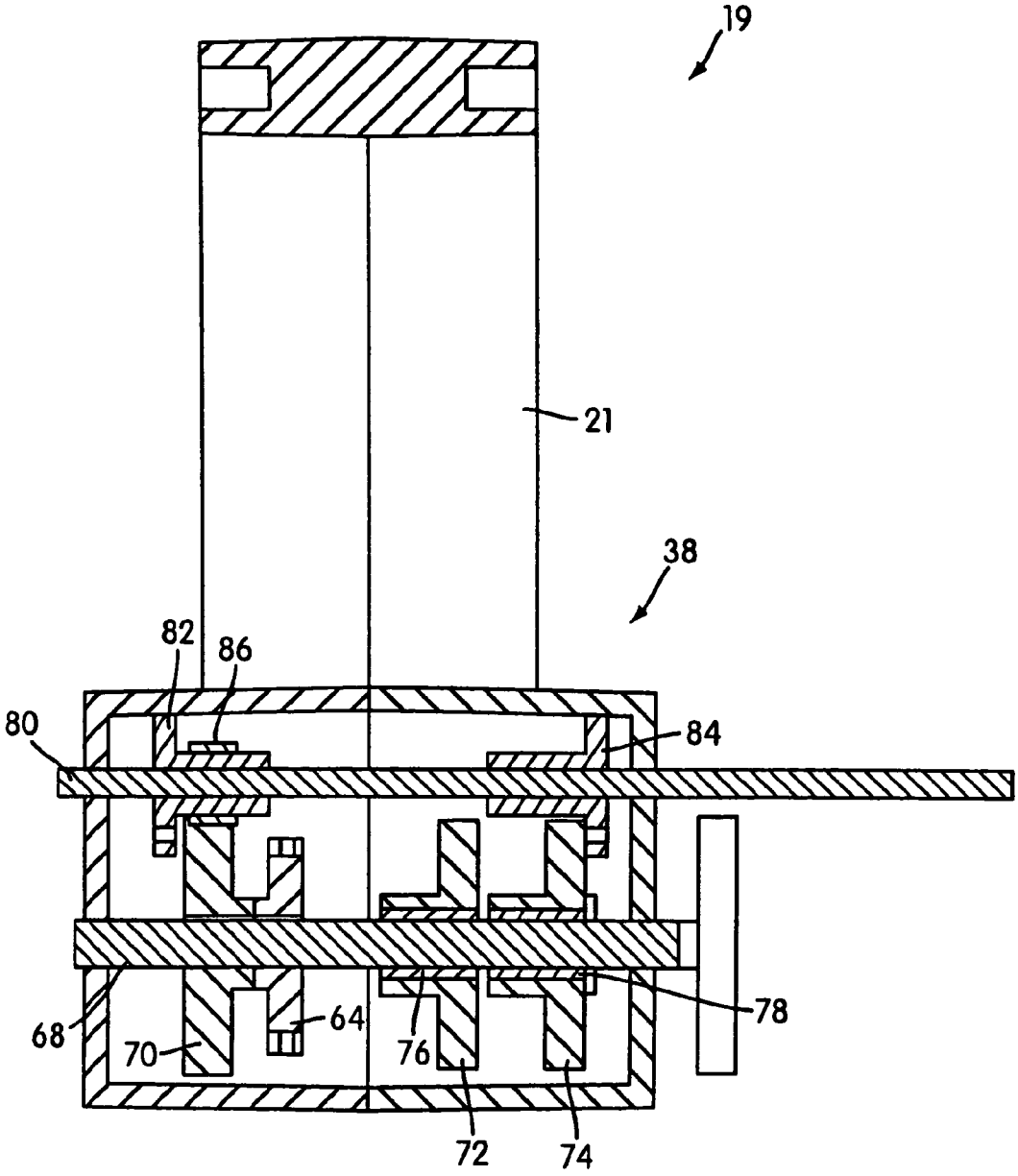
FIG. 12 a cross-sectional front view of the punch drive unit of the binding apparatus taken along line 12-12 of FIG. 4.

FIGS. 11 and 12 illustrate another portion of the translation mechanism 38 which, includes a shaft 80, and a pair of rotatable members, including a first rotatable member 82 and a second rotatable member 84. The shaft 80 includes external threads in a screw-like configuration and remains fixed to the apparatus frame 20 and extends in the above-mentioned linear direction 28 so as to be parallel to the edge of the stack of paper 14 in its punching position. The rotatable members 82, 84, which include matching internal threads in a nut-like configuration that intermesh with the external threads of the shaft 80. The rotatable members 82, 84 are rotatably attached to the punch drive unit 19 such that they are able to rotate about and translate along the shaft 80 to move the entire punch drive unit 19 in the linear direction 28.

As shown in FIG. 12, the first rotatable member 82 is operatively connected by intermeshed teeth to the gear 70 that is driven by the drive member 64 such that when the drive member 64 rotates, the first rotatable member 82 rotates about the shaft 80. Because the shaft 80 remains fixed and does not rotate, the rotation of the first rotatable member 82 causes the first rotatable member 82 to translate along the shaft 80 and move the punch drive unit 19 in the linear direction 28. The design of the shaft 80 and the first rotatable member 82, and particularly the relative gear pitches/ratio, are such that when the drive member 64 rotates intermittently, the rotation of the first rotatable member 82 causes the punch drive unit 19 of the apparatus to move a distance equal to the predetermined distance 40.

The connection between the gear 70 and the first rotatable member 82 may be provided by gearing, a belt, or any other structure that provides translation from one rotating member to another rotatable member. As shown, the first rotatable member 82 includes a spur gear 86 fixed thereon and the gear 70 has axially extending splines on its peripheral edge for driving the gear 86 and hence the member 82. The second rotatable member 84 is disposed on the shaft 80 such that is may interact with other rotatable members and gears to provide additional support to the punch drive unit 19 of the apparatus 12 so that translation in the linear direction 28 is smooth, accurate, and precise.

Figure 13:
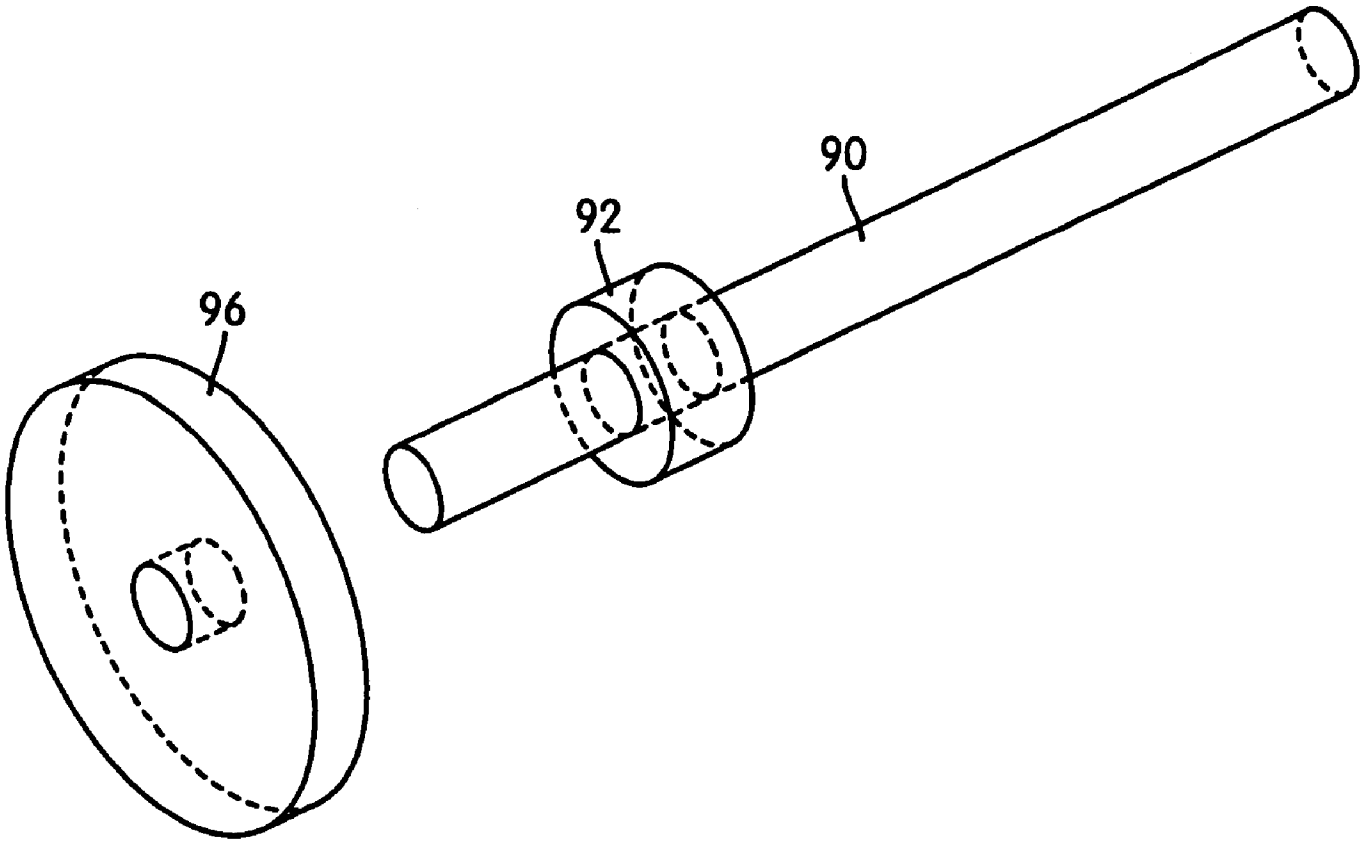
FIG. 13 is an exploded view of another shaft of the binding apparatus of FIG. 3.
Figure 14:
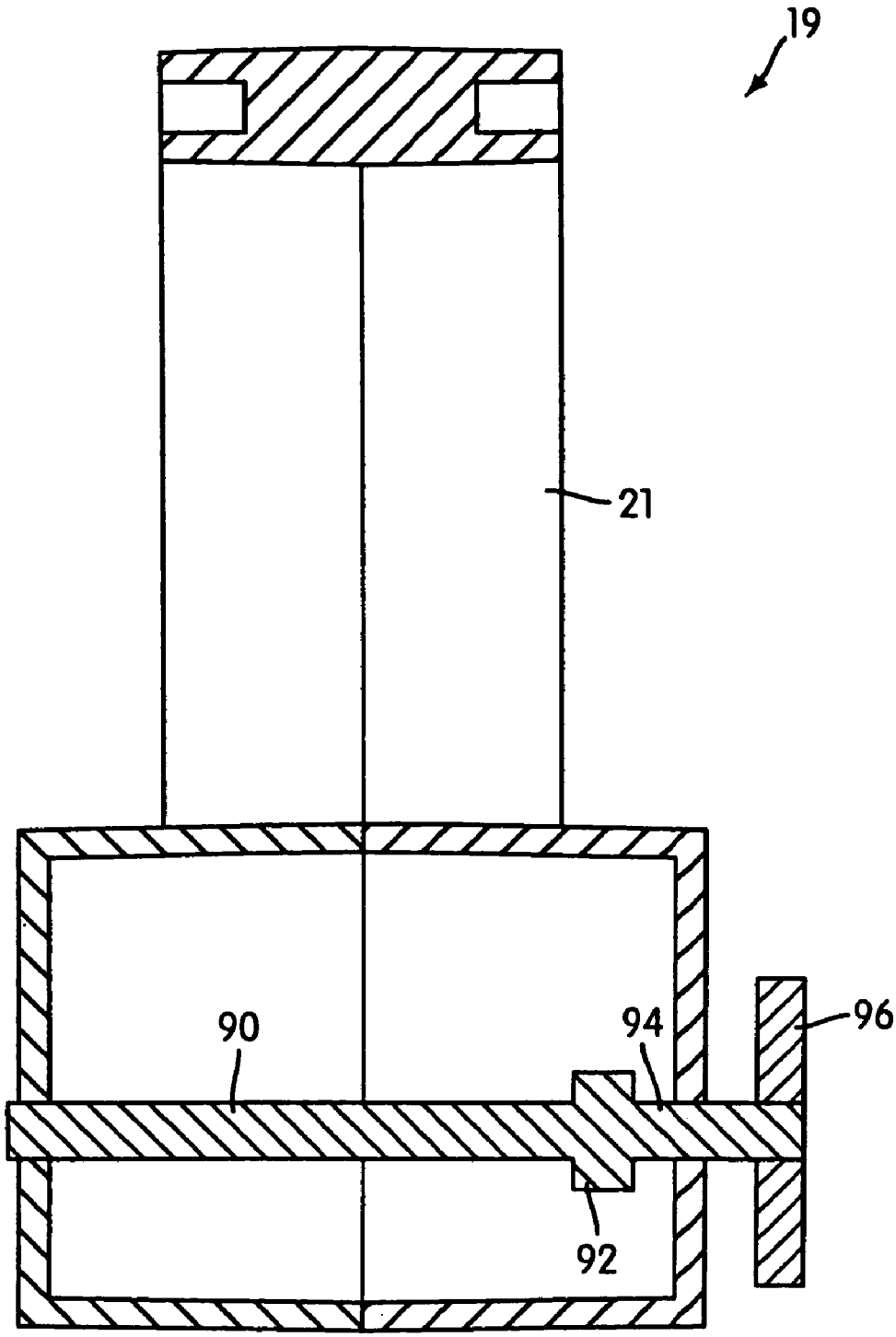
FIG. 14 a cross-sectional front view of the punch drive unit of the binding apparatus taken along line 14-14 of FIG. 4.

FIGS. 13 and 14 illustrate another shaft 90 that is part of the drive train of the punch drive unit 19 of the apparatus 12. A gear 92 is fixedly disposed on the shaft 90 so that it rotates with the shaft 90 and is operatively connected, by intermeshed teeth, to the gear 74 that is disposed on the shaft 68. A pulley 96, or gear, is disposed on the outside of the frame 21, as shown in FIG. 14, and may be connected to the power source 34 and/or flywheel 44 directly by, for example, a belt (not shown).

In operation, the drive train of the illustrated embodiment drives the punch 30 in the following manner. The power source 34 and flywheel 44 are connected to the pulley 96, by a toothed belt or otherwise, so as to cause the pulley 96 to rotate. This in turn rotates the shaft 90 and the gear 92 that is disposed on the shaft 90. Rotation of the gear 92 causes rotation of the gear 74. However, because the gear 74 is disposed on the bushing 78, this rotation does not cause the shaft 68 to rotate. Rotation of the gear 74 causes rotation of the rotatable member 61 as they are also intermeshed. Similarly, because rotatable member 61 is disposed on the bushing 63, this rotation does not cause the second portion 49 of the crank shaft 46 to rotate. Rotation of the rotatable member 61 next causes rotation of the gear 72 by their intermeshing. The bushing 76 likewise does not allow the rotation of the rotatable member 61 to cause rotation of the shaft 68. Rotation of the gear 72 next causes rotation of the disc 56 by their intermeshed teeth, which then drives the elongated link 48, and, hence, the punch 30, and causes rotation of the transfer member 54, as discussed above. The members of the drive train are designed with the proper gear ratios so as to provide the punch 30 with the power needed to punch through a large stack of paper 14, yet allow for an overall compact design. By utilizing bushings and allowing gears to rotate independently of the shafts on which they are mounted, a significant amount of space is saved.

The apparatus 12 may further include a binding element retainer (not shown) that is constructed to receive the binding element 16 in an application position. In the application position, the binding element 16 extends in the linear direction 28 such that when the stack of paper 14 is in the punching position, a spine 102 of the binding element 16 is essentially parallel to the edge of the stack of paper 26 and fingers 104 of the binding element 16 are adjacent to the edge of the stack of paper.

Preferably, the spine 102 of the binding element 16 includes at least one notch 103 (shown in FIG. 1) that corresponds to a protrusion (not shown) in the binding element retainer such that the binding element 16 may only be loaded into the binding element retainer in one orientation. This ensures that the binding element 16 is loaded into the binding element retainer in the proper orientation. The overall size of the binding element 16 will correspond to the height of the stack of papers 14 to be bound together. In at least one embodiment, the width of the spine 102 of the binding element 16 is consistent, independent of the overall size of the binding element 16. Thus, a large binding element will have the same size spine 102 and longer fingers 104 as compared to a small binding element. However, it is contemplated to have other designs, such as where the spine 102 also increases in width as the stack of paper 14 increases in thickness.

Referring back to FIG. 3, a binding element applicator 106 includes a leading portion 108, a trailing portion 110, and an intermediate portion 112 that connects the leading portion 108 and trailing portion 110. The leading portion 108 and the trailing portion 110 are offset with respect to one another.

The binding element applicator 106, the paper support base, and the binding element retainer are mounted to enable relative translational movement between the binding element applicator 106 and both the paper support base and the binding element retainer in the linear direction 28 during the binding element application operation. The binding element retainer remains fixed relative to the paper support base in the linear direction 28. It is also contemplated that the binding element applicator could be fixed and that the paper support base and the binding element retainer could be moved relative to the stationary binding element applicator.

The binding element applicator 106 is positioned relative to the paper support base and the binding element retainer such that both the leading portion 108 and trailing portions 110 are oriented essentially in the linear direction 28. When the stack of paper 14 is in the punching position and the binding element 16 is in the application position, the leading portion 108 is in alignment with the fingers 104 of the binding element 16 and spaced apart from the edge of the stack of paper 26. Also, the trailing portion 110 is oriented in the linear direction 28 immediately adjacent the edge of the stack of paper 26.

The binding element applicator 106 is configured such that, when the binding element 16 is in the application position and the stack of paper 14 is in the punching position, affecting the relative translational movement between the binding element applicator 106 and both the binding element retainer and the paper support base in the linear direction 28 such that the binding element applicator 106 travels along an entire length of the binding element 16 with the leading portion 108 leading and the trailing portion 110 trailing performs the binding element application operation in a manner to be discussed below. In the illustrated embodiment, the binding element applicator 106 is mounted to the punch drive unit 19 so that the punch drive unit 19, and particularly the translation mechanism 38 therein, will move the binding element applicator 106 in the linear direction 28 relative to the binding element retainer and the paper support base.

Figure 15:
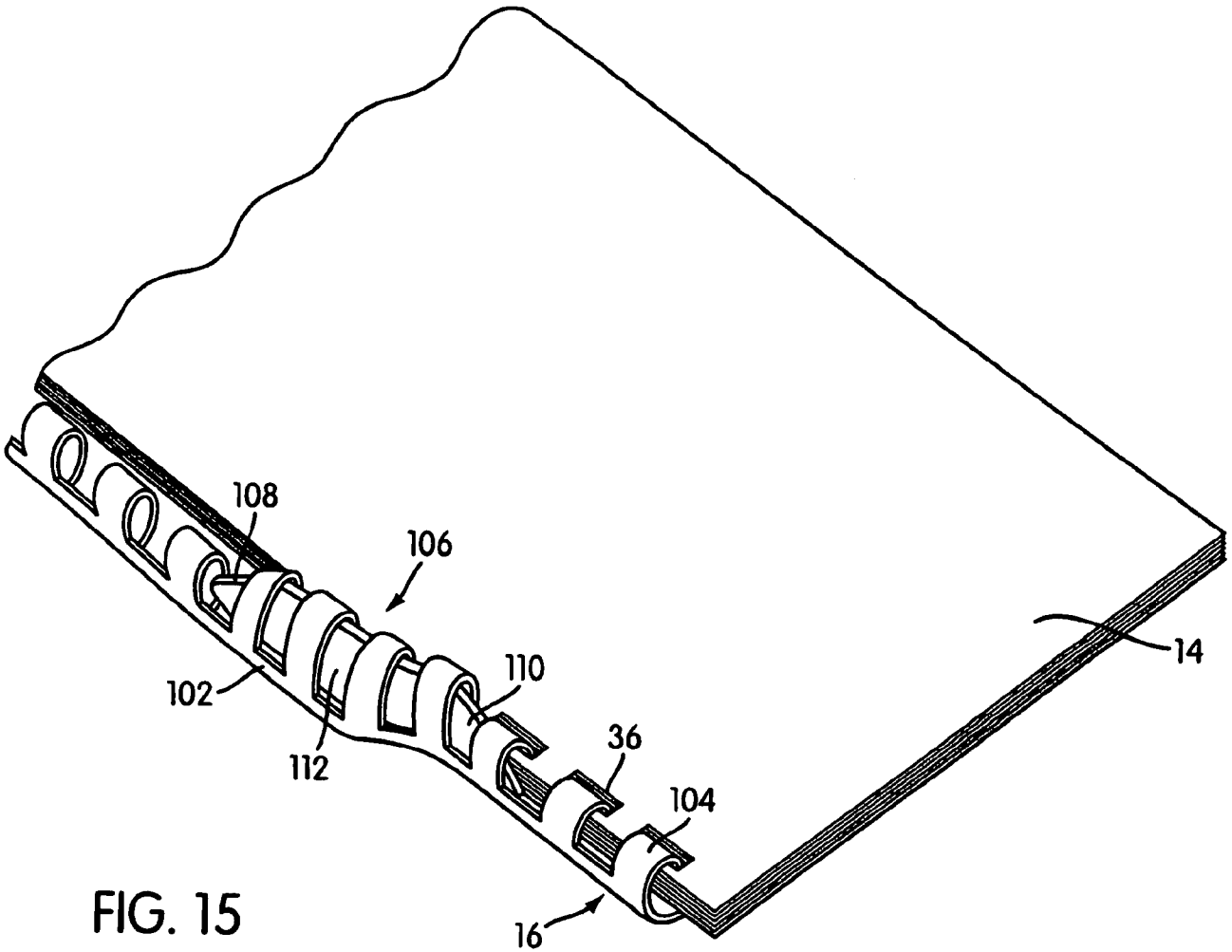
FIG. 15 is a partial top perspective view of one embodiment of a binding element apparatus as it is applies a binding element to a stack of paper.

FIG. 15 shows how the binding element application operation is performed in a schematic manner with other structures removed for clarity. During the binding element application operation, the leading portion 108 sequentially engages and uncurls the resilient fingers 104 against the bias of the fingers 104. The uncurled fingers 104 are then sequentially received over the intermediate portion 112 and transferred to the trailing portion 110. The trailing portion 110 then sequentially aligns free ends of the uncurled fingers 104 with the holes 36 punched in the stack of paper 14. The trailing portion 110 then sequentially disengages from the uncurled fingers 104 to enable the resilient fingers 104 to resiliently deflect into the holes 36 punched in the stack of paper 14. At the end of the binding element operation, the binding element 16 is attached to the stack of paper 14, thereby creating the bound book 18, which can then be removed from the apparatus 12.

As can be appreciated from FIG. 3, the leading portion 108 is on one side of the punch 30 and the trailing portion 110 is on the other side in the linear direction 28. The arrangement is such that the leading portion 108 engages the binding element fingers 104 and then the trailing portion 110 deposits those fingers 104 into the holes 36 formed by the punch 30. In this construction, it is required to always translate the punch 30 and the binding element applicator 106 in the same direction, and they must be returned in the opposite direction back "home" for performance of another operation.

Alternatively, two binding element applicators 106 may be mounted to the punch drive unit 19 on a pivoted member. In this alternative, the trailing one of the binding element applicators 106 would be pivoted down into an operative position and the leading one would be raised. In both applicator members, the leading portion 108 would be aimed towards the punch 30 and the trailing portion 110 would be aimed away. The operation could then be performed with the punch drive unit 19 traveling in one direction so that the operative, trailing binding element applicator 106 performs the binding element application operation. At the end of the punch drive unit's 19 travel, the pivoted member could be pivoted so that the other applicator member 106 is operative and the first one inoperative. This would enable a subsequent operation to be performed with the punch drive unit 19 traveling in the opposite direction, thus avoiding the need for the punch drive unit 19 to return "home" between operations.

It should be understood that the binding element applicator 106 could be entirely independent from the punch drive unit 19 and would have its own power source. Further, the use of the applicator member 106 is optional in some variations, and the structure disclosed should not be considered limiting in any way.

The apparatus 12 may further include a stop member (not shown) that is movable between a paper loading position and an operating position. When the stop member is in the loading position, it defines a stop surface that extends in the linear direction 28 and essentially perpendicularly and adjacent to the surface of the paper support base for enabling the edge 26 of the stack of paper 14 to be abutted against the stop surface so as to facilitate locating of the stack of paper 14 in the punching position with the edge 26 of the stack of paper 14 oriented in the linear direction 28 in proper relation to the punch 30 and the binding element retainer. When the stop member is in the operating position, it is disengaged from the stack of paper 14 in the punching position so as to allow the binding element applicator 106 to move along the edge 26 of the stack of paper 14 in the linear direction 28.

Figure 18:
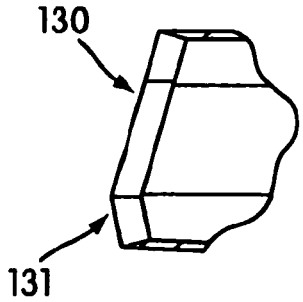
FIG. 18 is an enlarged cross-sectional view of an alternative end to the punch of FIG. 17.
Figure 19:
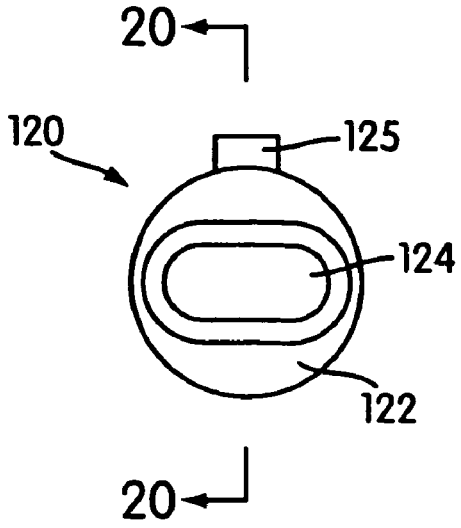
FIG. 19 is an end view of a punch mount of the apparatus of FIG. 3.
Figure 20:
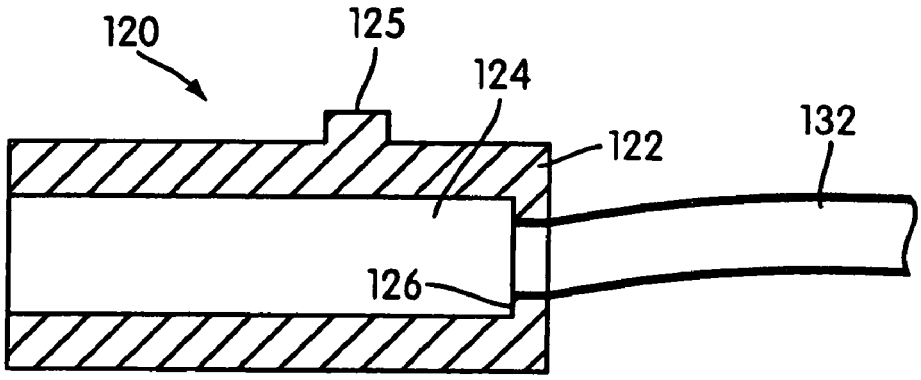
FIG. 20 is a cross-sectional view of the punch mount taken along line 20-20 of FIG. 19.

As an optional feature, the punch 30 is part of a removable punch device 118. The removable punch device 118 includes the punch 30, shown in FIGS. 16-18, and a punch mount 120, shown in FIGS. 19 and 20. The punch mount 120 includes a peripheral wall 122 that defines a punch receiving bore 124. The punch 30 is received within the punch receiving bore 124. The punch mount 120 is constructed to be removably mounted to the punch piston 53 for enabling removal and replacement of the punch device 118. As illustrated in FIGS. 19 and 20, the punch mount 120 may also include a protrusion 125 that acts as a key so that the punch mount 120 can only be installed in the punch piston 53 in only one orientation, as shown in FIG. 5, the punch piston 53 including a recess that is configured to receive the protrusion 125. This ensures that the punch 30 is properly oriented relative to the stack of paper 14 to be punched when the removable punch device 118 is inserted into the punch piston 53.

The punch mount 120 also includes a seat 126 that extends into the bore 124 and engages an end 128 of the punch 30 that is opposite a cutting end 130 thereof. The seat 126 is constructed to transmit force to the punch 30 when the punch driver mechanism 32 moves the punch device 118 through the drive stroke to punch through the stack of paper 14. The seat 126 is constructed to mechanically fail when the force being transmitted from the seat 126 to the punch 30 exceeds a predetermined threshold selected as corresponding to an overload condition in the punch driver mechanism 32.

The punch 30 may be designed such that it has a cross section that is substantially oval in shape. Other shapes are contemplated, including but not limited to rectangular, circular, and trapezoidal. In at least one embodiment, the cross section of the punch 30 is substantially a "D" shape.

The punch 30 is preferably made of a high strength steel and may include a coating to increases the hardness of the punch 30, while decreasing the friction of the punch 30. It is desirable to have a punch 30 with high hardness and low friction so that the force needed to cut through the stack of paper 14 is as low as possible. It is contemplated that a diamond like carbon ("DLC") may be used to increase the hardness and decrease the friction of the punch 30.

Figure 16:
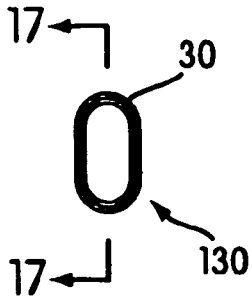
FIG. 16 is an end view of a punch of the binding apparatus of FIG. 3.
Figure 17:
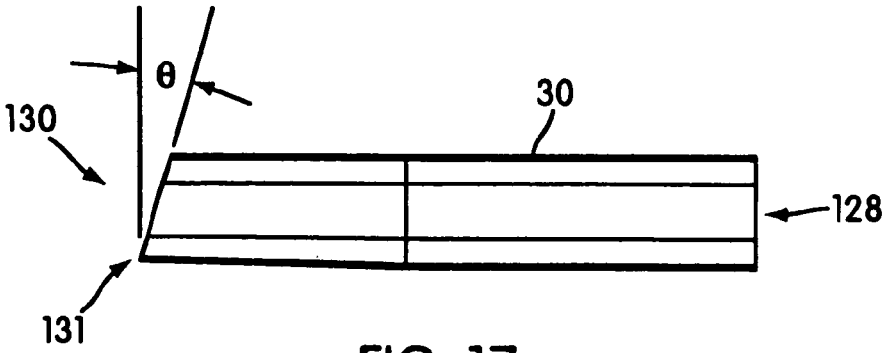
FIG. 17 is a cross-sectional view of the punch taken along line 17-17 of FIG. 16.

As shown in FIG. 17, the cutting end 130 of the punch 30 may include an angle θ so that when the punch 30 comes into contact with the stack of papers 14, a leading edge 131 of the cutting end 130 contacts the stack of papers 14 first, thereby initiating a cut in the stack of papers 14 before the remainder of the cutting end 130 contacts the stack of paper 14. Preferably, the angle θ is about 15 degrees. The cutting end 130 may also be beveled on the inside, as shown in FIG. 18. It is also contemplated that the cutting end 130 may include a double bevel, as shown in FIG. 16, such that the inside and the outside of the cutting end 130 are angled. This provides a cutting end with a very fine contact surface. Such a design will reduce the amount of force that is needed to cut through the stack of paper 14, as compared to a cutting end 130 without the bevels. This design may be applied to any punch described in this application (or any other punch for that matter).

The punch device 118 may further include a flexible tube 132 that is operatively connected to the bore 124 at one end and to a paper waste container at the other end. As paper slugs are pushed into the bore 124 after each punch cycle, the paper slugs (i.e. the punched chads compressed together) enter the flexible tube 132 and are eventually emptied into the paper waste container. A small fan (not shown) may be used to create air flow to assist in moving the paper slugs from the punch device 118 to the paper waste container.

A cover 138 (shown in FIG. 1) may also be used as part of the system 10. Although it is contemplated that a two-piece cover may be used as part of the system 10, in at least one embodiment, the cover 138 is a single piece that is configured to surround the stack of paper 14 on at least three sides. The cover 138 is typically wider than the stack of paper 14. Therefore, it is desirable to center the stack of paper 14 within the cover 138 before the punching operation is started so that the finished product will have a professional appearance.

Referring back to FIG. 1, the apparatus 12 may also include a door 140 that allows the apparatus 12 to be closed. A centering and clamping mechanism (not shown) may be operatively connected to the door 140 such that when the door is closed, the cover 138 and the stack of papers 14 are held in place by the centering and clamping mechanism. The centering and clamping mechanism may also allow for the centering of the stack of paper 14 relative to the cover 138. Of course, two mechanisms may be provided with one for centering and one for clamping. It is also contemplated that the centering and clamping mechanism may not be operatively connected to the door 140. Instead, the operator may manually adjust the centering and clamping mechanism prior to closing the door 140.

The apparatus 12 may further include a start sequence mechanism 150. The start sequence mechanism 150 allows for the operator to initiate the punching and binding cycle. The start sequence mechanism 150 may be a button, a switch, or any other type of mechanism that allows the operator to initiate the sequence. As an optional feature, the start sequence mechanism 150 is operatively connected to an interlock device (not shown) that prevents the sequence from initiating if the door 140 to the apparatus 12 is open. Preferably, the interlock device also includes a sensor to sense whether the stack of paper 14 is present in the apparatus 12 so that if the apparatus 12 is empty, the apparatus 12 will not operate even if the apparatus 12 is on and the start sequence mechanism 150 has been activated.

Figure 21:
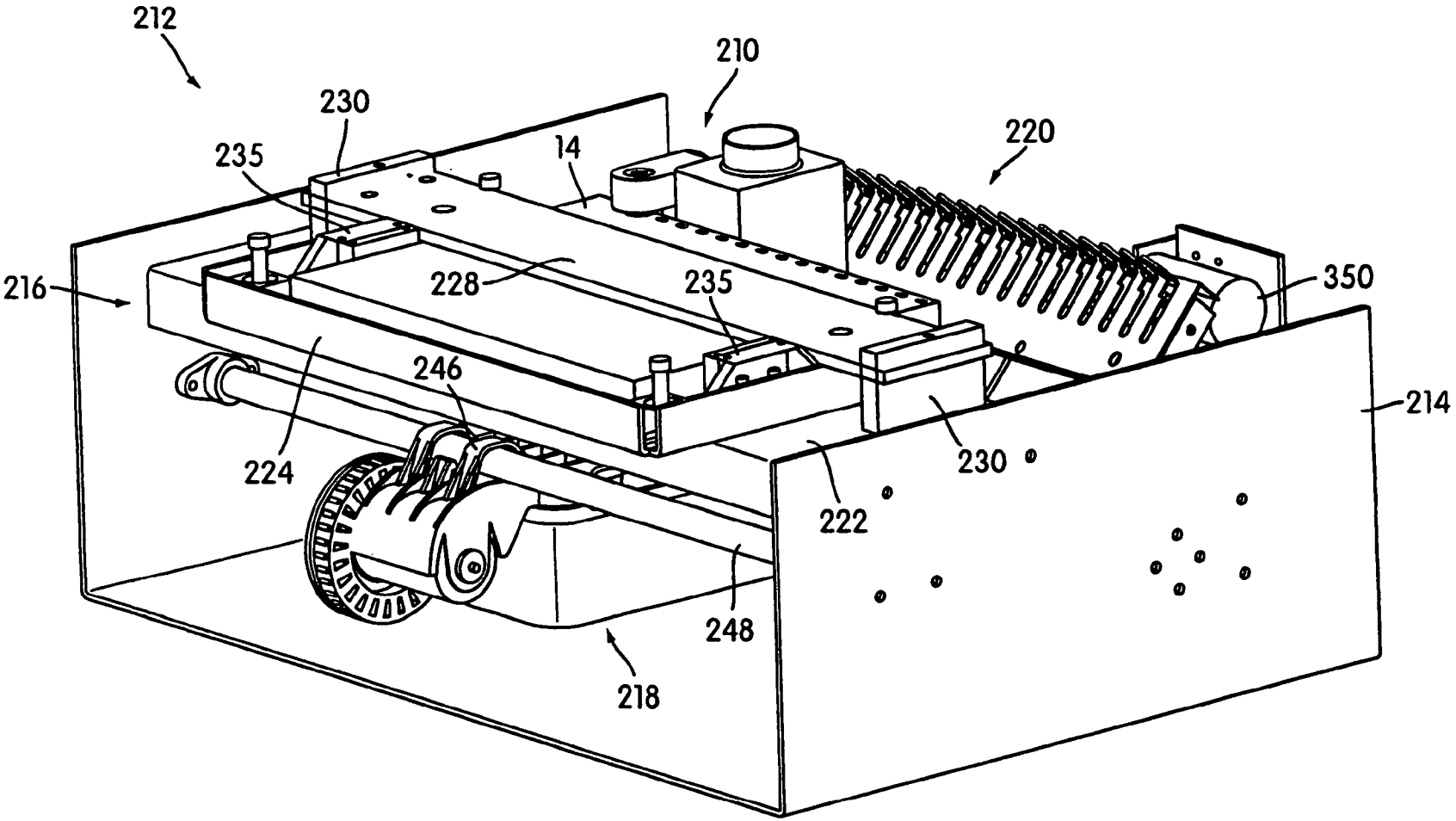
FIG. 21 is a front perspective view of another embodiment of internal components of the binding apparatus of FIG. 1.
Figure 22:
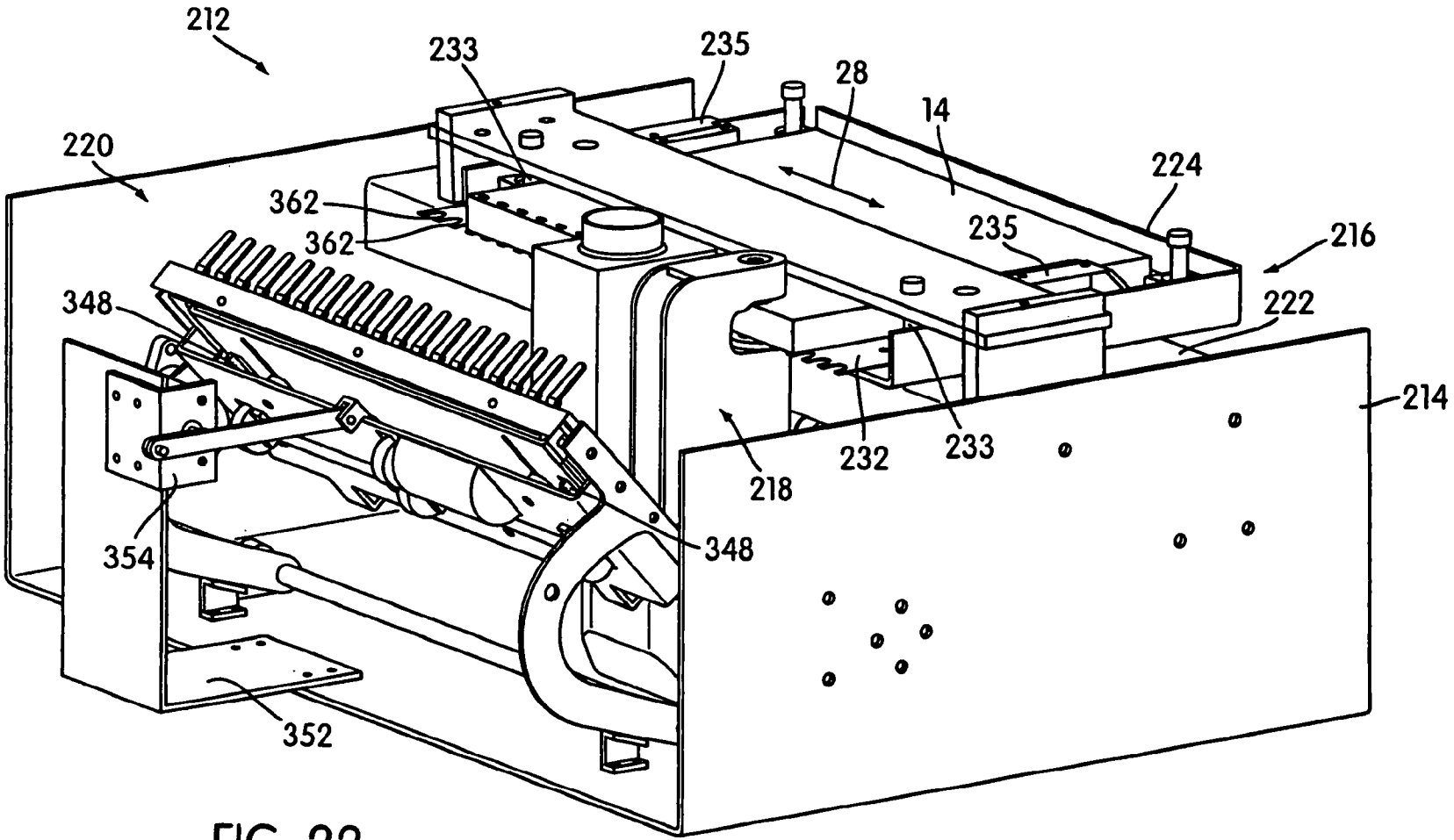
FIG. 22 is a rear perspective view of the binding apparatus of FIG. 21.

FIGS. 21-38 illustrate another embodiment of the apparatus 212. As shown in FIGS. 21 and 22, the apparatus 212 includes a frame 214, a paper support base 216, a punch drive unit 218 and a binding element applicator 220.

Figure 23:
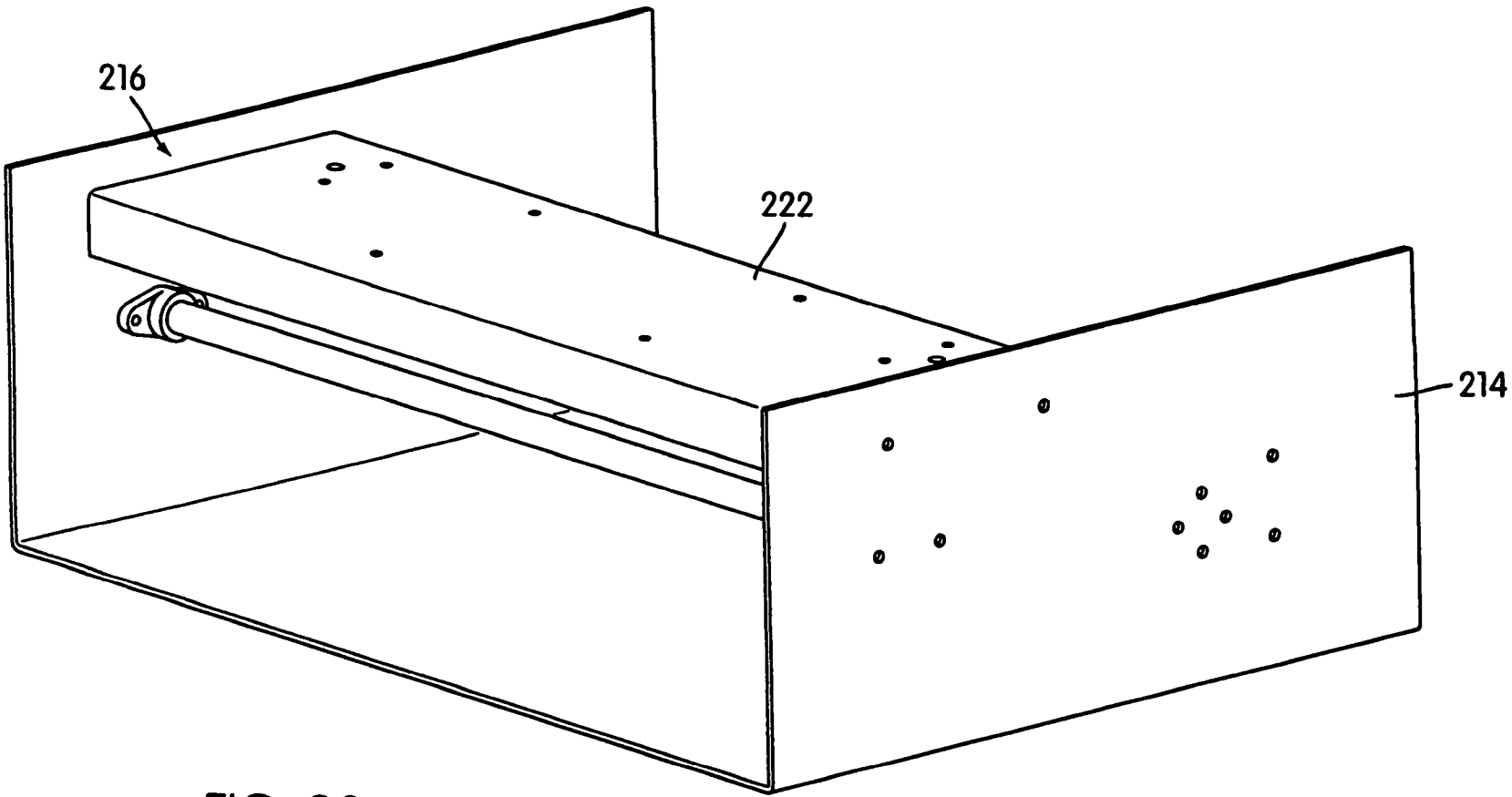
FIG. 23 is a front perspective view of a frame of the binding apparatus of FIG. 21.
Figure 24:
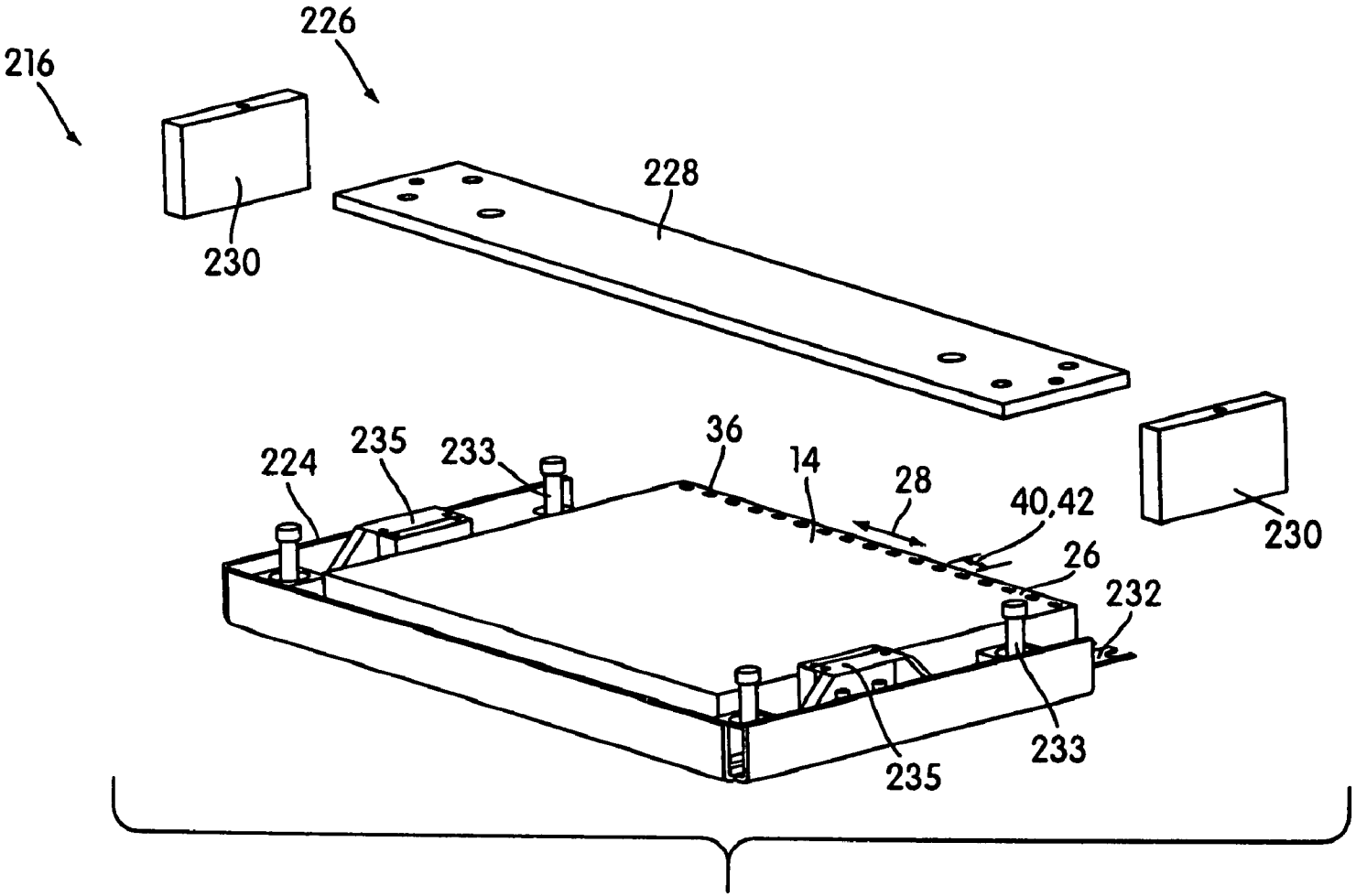
FIG. 24 is an exploded view of a paper support base assembly of the binding apparatus of FIG. 21.

As shown in FIGS. 23 and 24, the paper support base 216 includes a paper support plate 222 and a paper support tray 224 that is supported by the paper support plate 222. The paper support plate may be rigidly attached to the frame 214 and the paper support tray 224 may be rigidly attached to the paper support plate 222. The paper support base 216 further includes an optional clamp 226 that may include an elongated plate 228 and a pair of support columns 230. As shown in FIGS. 21 and 22, the clamp 226 may be operatively connected to the paper support plate 222 to enable the stack of paper 14 to be clamped down and held between the clamp 226 and the paper support tray 224. As shown in FIG. 22, the paper support tray 224 includes a surface 232 on which the stack of paper 14 rests.

The clamp 226 may be adjusted to accommodate stacks of paper 14 of different heights. As shown in FIG. 22, the elongated plate 228 may be received by a pair of posts 233 which assist in locating the elongated plate 228 and securing the elongated plate 228 at the proper height.

A pair of lateral positioning structures 235 are provided to correctly position the stack of paper 14 relative to the punch drive unit 218 so that the holes 36 will be properly positioned, regardless of the size of the paper in the stack of paper 14, as further explained below.

As an optional feature, the paper support base 216 may further include a stop member (not shown) that is movable between a paper loading position and an operating position. When the stop member is in the loading position, it defines a stop surface that extends in the linear direction 28 and essentially perpendicularly and adjacent to the surface 232 of the paper support base 216 for enabling the edge 26 of the stack of paper 14 to be abutted against the stop surface so as to facilitate locating of the stack of paper 14 in the punching position with the edge 26 of the stack of paper 14 oriented in the linear direction 28. This way, when the operator loads the stack of paper 14 into the apparatus 212, the edge 26 of the stack of paper 14 is properly located with ease. The stop member may then be manually moved to the operating position so that is out of the path of the punch drive unit 218. Alternatively, the stop member may be actuated so that it is automatically moved to the operating position when the apparatus 212 is closed, or when the operator initiates the punching operating, as further explained below.

Figure 25:
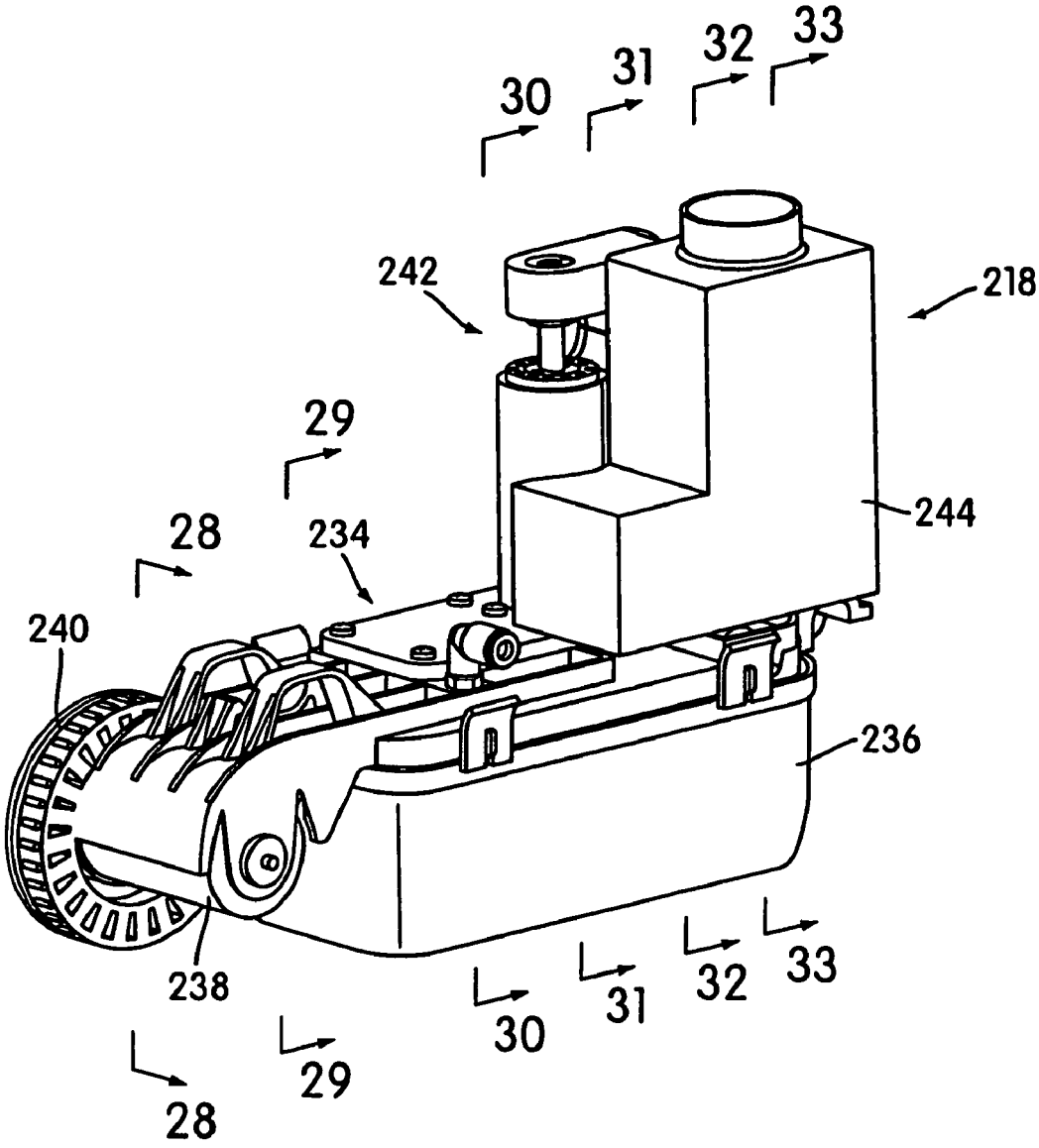
FIG. 25 is a front right perspective view of a punch drive unit of the binding apparatus of FIG. 21.

FIG. 25 illustrates an example of the punch drive unit 218 that may be used in the apparatus 212. The punch drive unit 218 includes a frame 234, a cover 236, a power source 238, a flywheel 240, a power-operated punch driver mechanism 242, and a waste paper bin 244.

Figure 26:
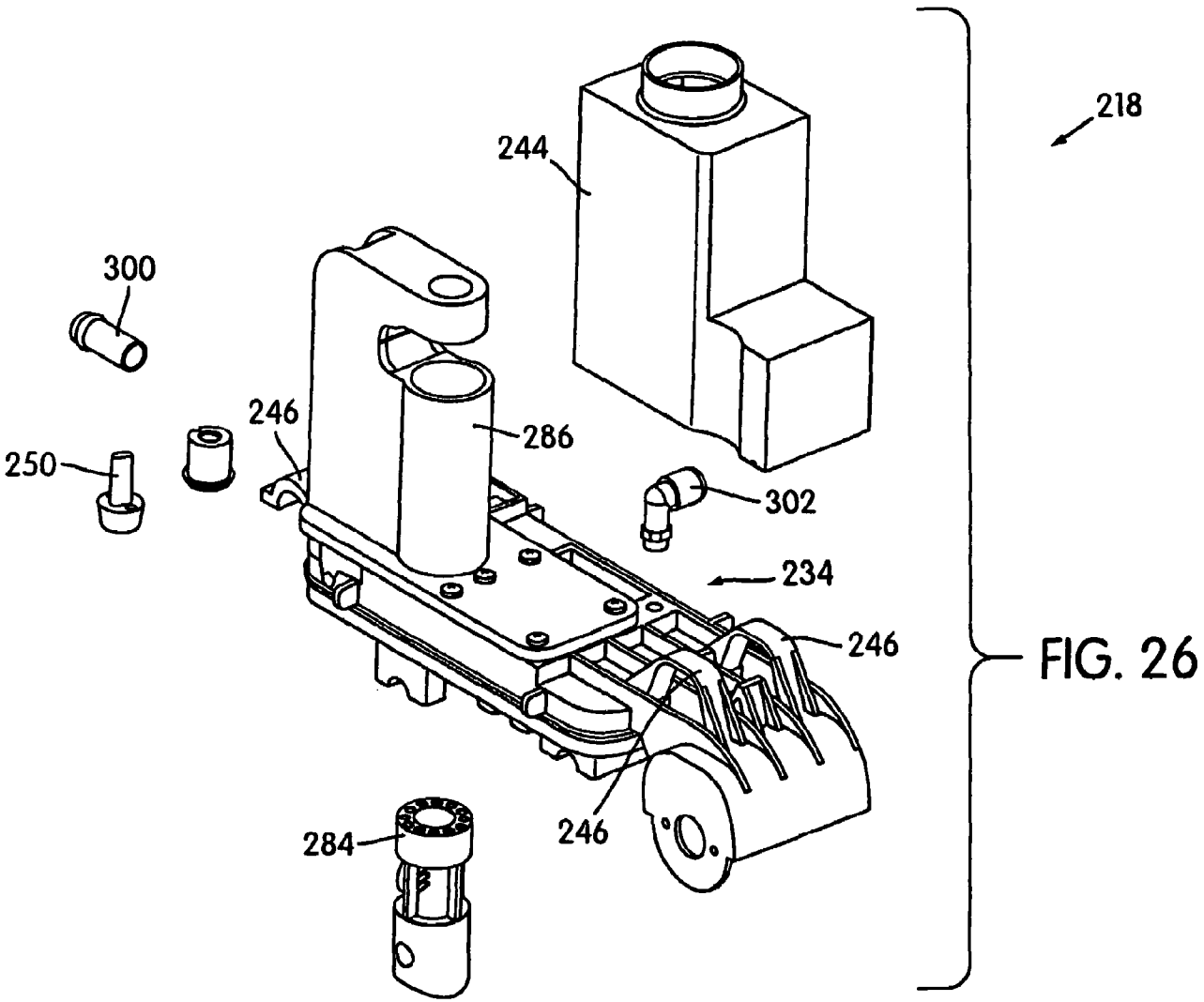
FIG. 26 is a partial exploded view of a top portion of the punch drive unit of FIG. 25, taken from a front left perspective.
Figure 27:
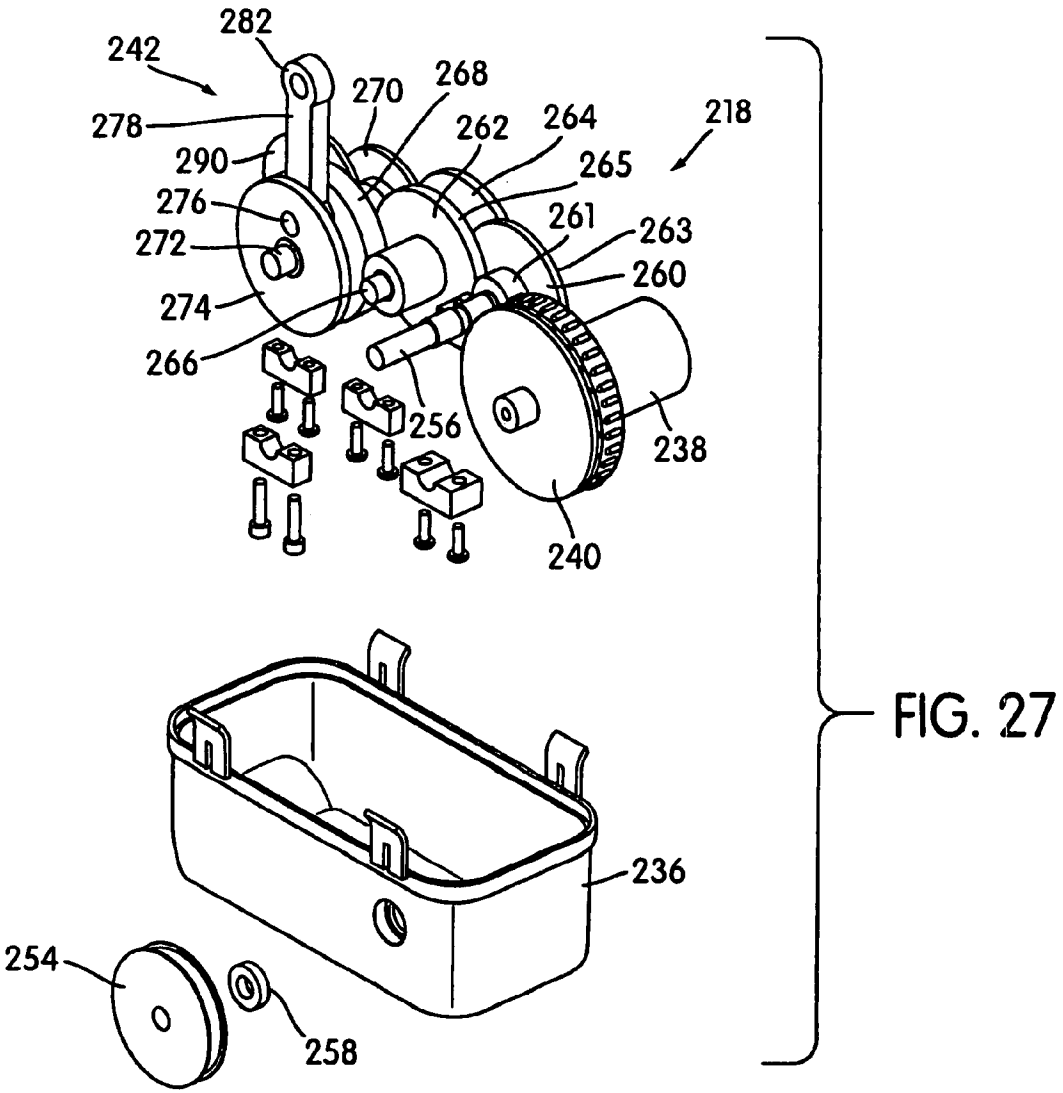
FIG. 27 is a partial exploded view of a bottom portion of the punch drive unit of FIG. 25 taken from a front left perspective.

FIGS. 26 and 27 show the punch drive unit 218 in further detail. The frame 234 of the punch drive unit 218 includes rail mounts 246 that allow the frame 234 to slide along rails 248 that extend in the linear direction 28 so as to be parallel to the edge of the stack of paper 14 and are mounted within the frame 214 of the apparatus 212, as shown in FIG. 23. The rails 248 are configured to support the weight of the entire punch drive unit 218 and also allow the punch drive unit 218 to slide freely with little or no frictional resistance.

Figure 28:
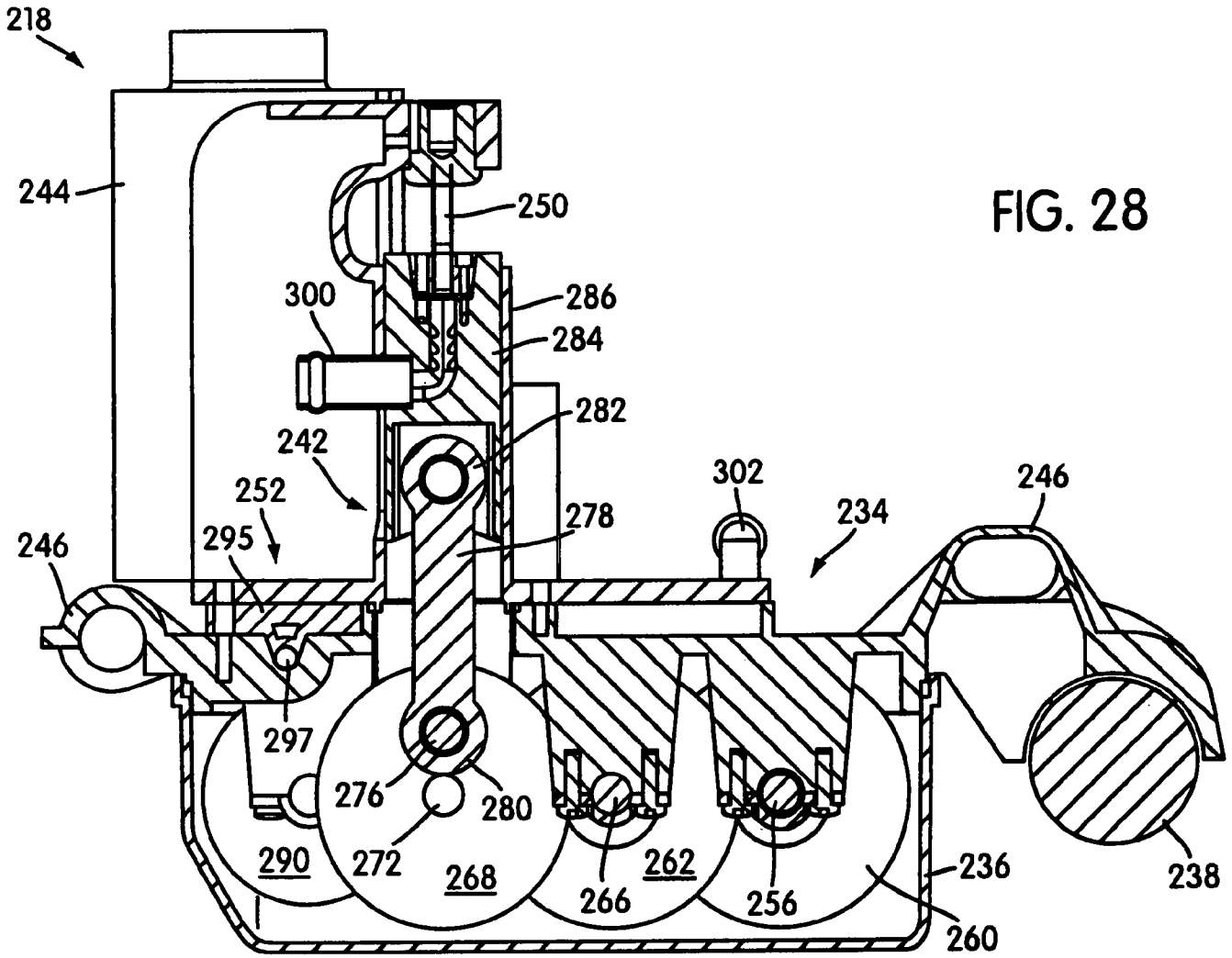
FIG. 28 is a cross-sectional view of the punch drive unit taken along line 28-28 of FIG. 25.

As shown in FIGS. 26 and 28, the punch drive unit 218 of the apparatus 212 also includes a punch 250 that is constructed to punch through the stack of paper 14. An exemplary, non-limiting embodiment of the punch drive mechanism 242 is discussed below and is illustrated in the figures. The punch driver mechanism 242 is operatively connected to the power source 238, such as an electric motor. As with the previous embodiment, it is also contemplated that the power source 238 may be battery powered, or may operate off of direct current or alternating current, or may be hydraulically or otherwise driven. The power source 238 continuously powers the punch driver mechanism 242 such that the punch driver mechanism 242 continuously moves, as further explained below.

Similar to the previous embodiment, the punch driver mechanism 242 is constructed to be operable to reciprocally drive the punch 250 through a plurality of drive strokes and a plurality of return strokes. During the drive stroke, the punch driver mechanism 242 drives the punch 250 through the edge 26 of the stack of paper 14. During the return stroke, the punch driver mechanism 242 withdrawals the punch 250 from the edge 26 of the stack of paper 14. A punch cycle is defined to include one drive stroke and one subsequent return stroke. At the end of the punch cycle, a hole 36 is formed in the edge 26 of the stack of paper 14.

The apparatus 212 further includes a translation mechanism 252, shown in FIGS. 28, and 33-35, that is constructed to affect relative translational movement between the paper support base 216 and the punch 250 in the linear direction 28. An exemplary, non-limiting embodiment of the translation mechanism 252 is discussed below. The translation mechanism 252 and the punch driver mechanism 242 are synchronized similarly to the embodiment discussed above, such that when the stack of paper 14 is in the punching position, the translation mechanism 252 affects the relative translational movement between the paper support base 216 and the punch 250 during the hole punching operation in an indexing manner, as will be discussed below.

During the hole punching operation, after each occurrence of the punch 250 being withdrawn from the stack of paper 14 on the return stroke, the translation mechanism 252 affects the relative translational movement by a predetermined distance 40 in the linear direction 28 prior to each occurrence of the punch 250 engaging the stack of paper 14 during the next punch cycle. In other words, with respect to each punch cycle, the translation mechanism 252 operates to affect this relative translational movement by the predetermined distance 40 after the time the punch 250 has withdrawn from the stack of paper 14, but before the punch 250 re-engages with the stack of paper 14. This causes the stack of paper 14 to be punched along the edge 26 such that a series of holes 36 are spaced apart essentially evenly with a pitch 42 in the linear direction 28. When there is a single punch 250, the predetermined distance 40 is equal to the pitch 42.

The synchronization of the punch driver mechanism 242 and the translation mechanism 252 may be controlled and executed in a number of ways, including but not limited to the use of servomechanisms and servomotors that may be operatively connected to a common controller that operates both the punch driver mechanism 242 and the translation mechanism 252 in a synchronized manner, such as a programmed controller. In the illustrated embodiment, a mechanical transmission gears the translation mechanism 252 to the power source 238 driving the punch driver mechanism 242, but this construction is only an example and should not be considered limiting. Additionally, although the illustrated embodiments show the translation mechanism 252 moving the punch 250 relative to a stationary paper support base, the reverse could be done and the paper support base could be moved relative to a stationary punch.

Figure 29:
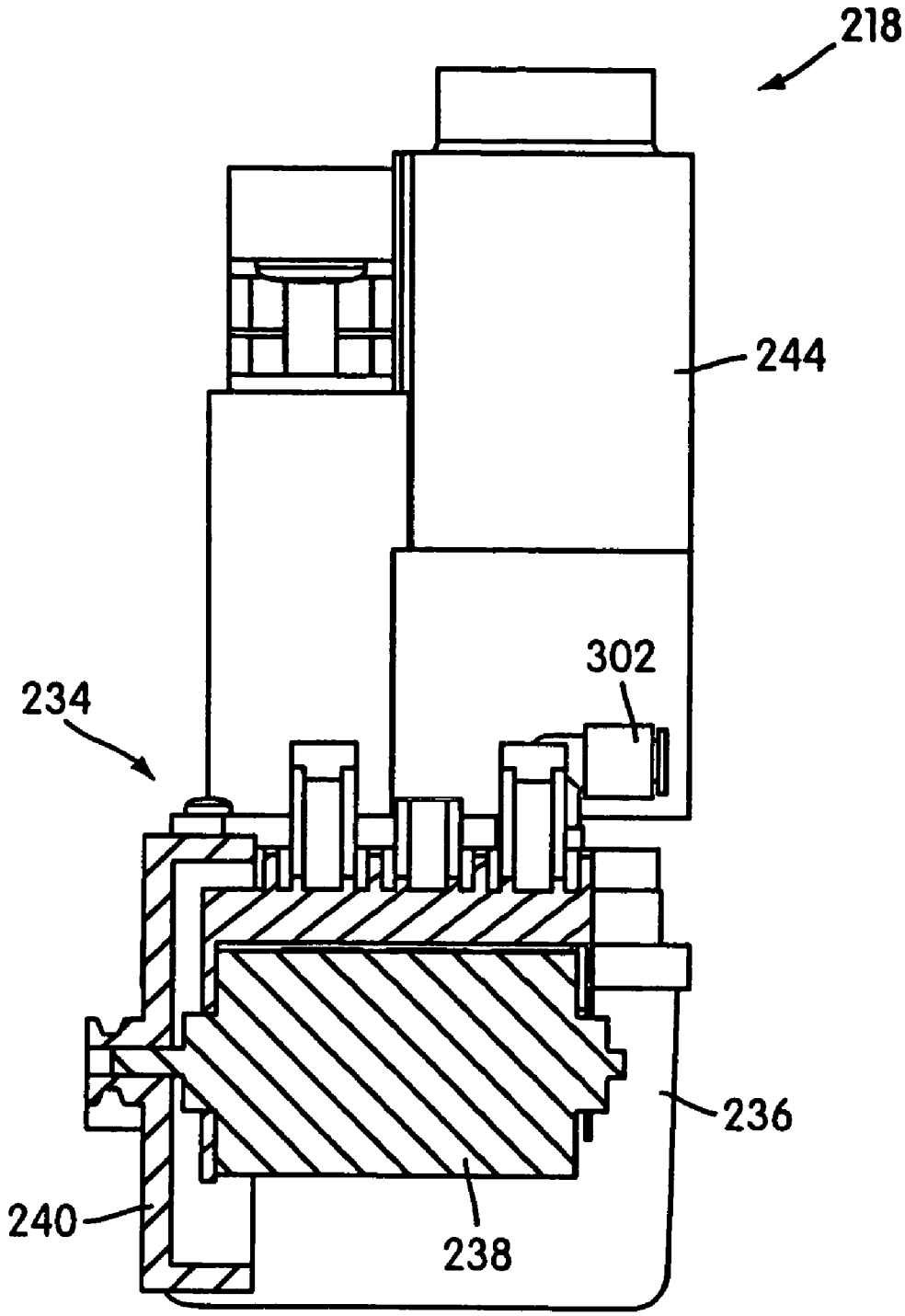
FIG. 29 is a cross-sectional view of the punch drive unit taken along line 29-29 of FIG. 25.

In at least one embodiment, the punch drive unit 218 also includes a flywheel 240 that is driven by the power source 238, as shown in at least FIG. 29, and is operatively connected to the punch 250. As explained above with respect to the previous embodiment, the flywheel 240 is rotatably driven and is configured to store kinetic energy during rotation and to transfer energy to the punch 250 as the punch 250 engages the stack of paper 14 during the drive stroke. This enables the punch driver mechanism 242 to require less power, as the flywheel 240 will store kinetic energy prior to engaging the stack of paper 14, and then release that kinetic energy upon engaging the stack of paper 14 to assist in driving the punch 250 through the stack of paper 14. The flywheel 240 may allow the power source 238, which may be an electric motor, to be approximately one-sixth the size of a power source that is used in the absence of the flywheel 240. Also, the flywheel 240 may be used help store power during a manual cycle of the apparatus 212 and back the punch 250 out from the stack of paper 14 in the event that power is lost to the apparatus 212 (i.e., by manually grasping and rotating the flywheel 240 to cycle the punch 250 back through a return stroke). Energy may be transferred from the flywheel 240 to the punch 250 through a series of gears and belts. While several gears are shown in the figures, it is contemplated that more or less gears and/or belts may be used in practicing the invention. Additionally, in the broader aspects of the invention, the flywheel 240 is an optional feature and should not be considered limiting in any way.

Figure 30:
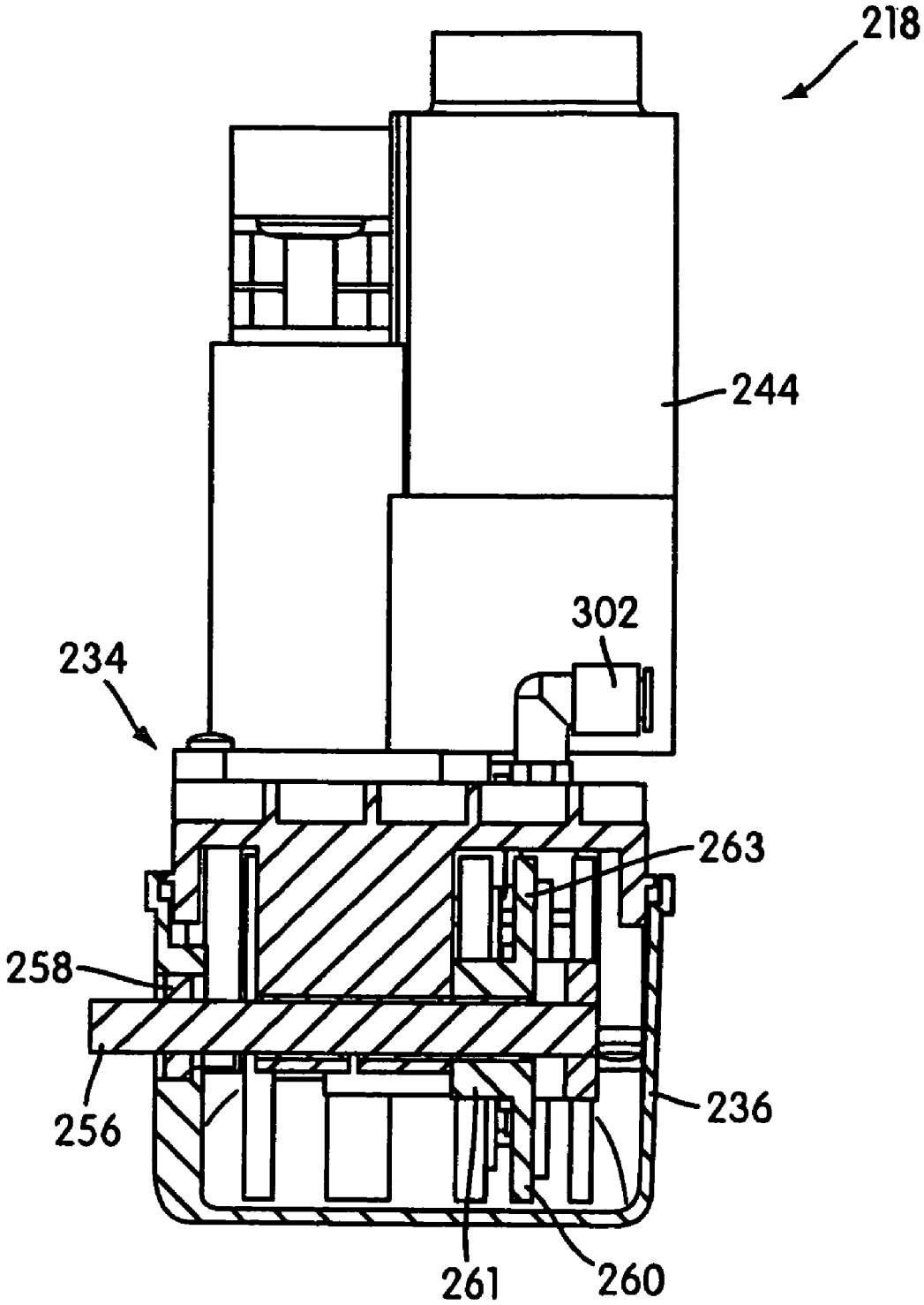
FIG. 30 is a cross-sectional view of the punch drive unit taken along line 30-30 of FIG. 25.

In the illustrated embodiment, the flywheel 240 drives a pulley 254 with a belt (not shown). The pulley 254 is disposed outside of the cover 236 of the punch drive unit 218 and is fixedly connected to a first shaft 256 that is connected to the frame 234 and disposed inside of the cover 236. As shown in FIGS. 27 and 30, a bearing 258 may be used to provide support to the shaft 256 as it extends through the cover 236 and also provide a seal between the inside of the cover 236 and the outside of the cover 236. A first gear 260 is disposed on the first shaft 256 such that is turns with the first shaft 256.

Figure 31:
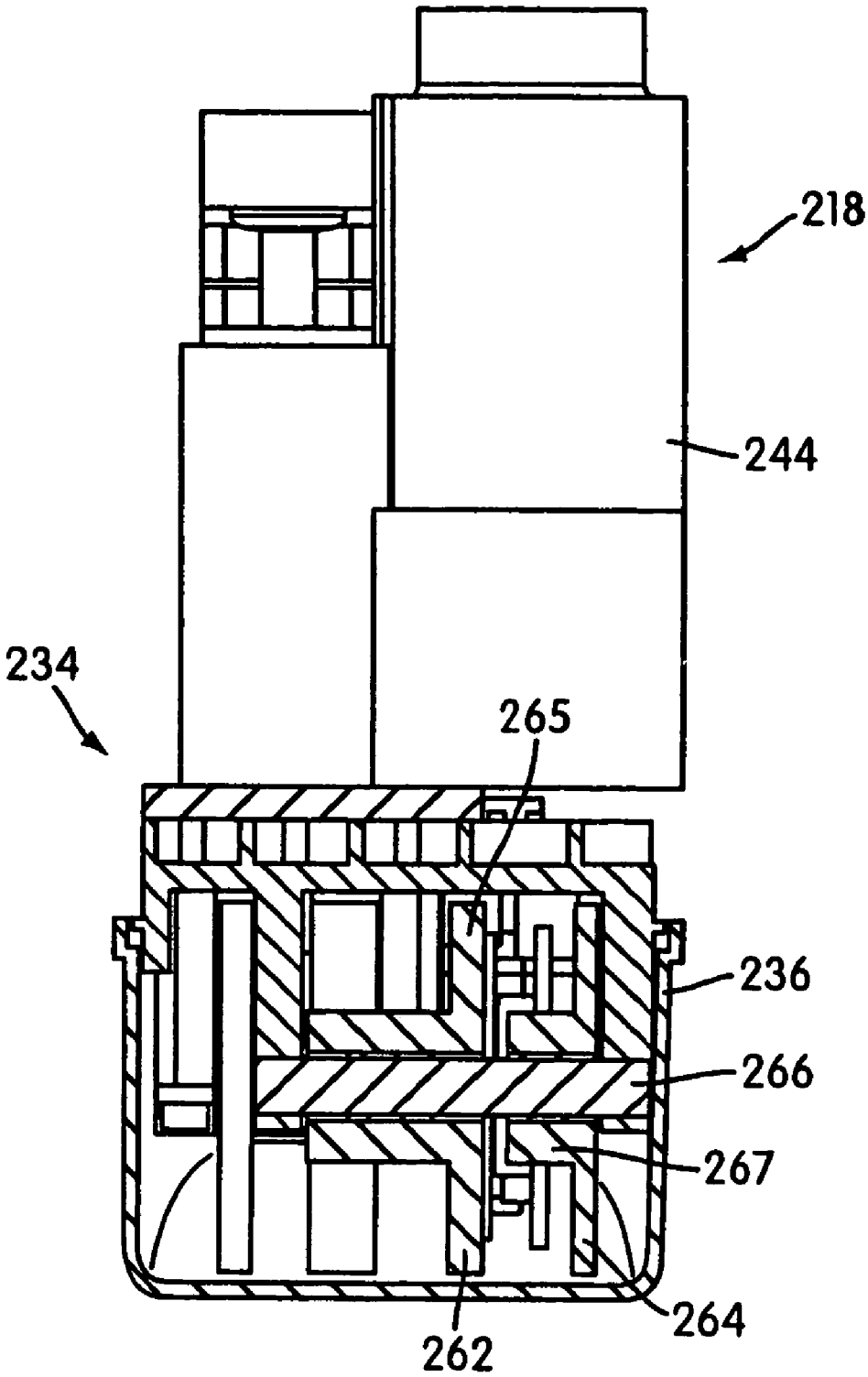
FIG. 31 is a cross-sectional view of the punch drive unit taken along line 31-31 of FIG. 25.

As shown in FIGS. 27 and 31, a second gear 262 and a third gear 264 are disposed on a second shaft 266 that is oriented parallel to the first shaft 256 and is disposed completely within the cover 236. The second and third gears 262, 264 are designed to mesh with the first gear 260 such that rotation of the first gear 262 causes rotation of the second and the third gears 262, 264. For example, as shown in FIGS. 27 and 30, the first gear 260 has an inner portion 261 and an outer portion 263. Both portions 261, 263 each include a plurality of teeth (not shown) disposed circumferentially. The plurality of teeth disposed on the inner portion 261 mesh with a plurality of teeth (not shown) disposed on an outer portion 265 (as shown in FIGS. 27 and 31) of the second gear 262, while the plurality of teeth disposed on the outer portion 263 mesh with a plurality of teeth (not shown) disposed on an inner portion 267 (as shown in FIG. 31) of the third gear 264. The second and the third gears 262, 264 are connected to the second shaft 266 via bushings so that rotation of the second and third gears 262, 264 do not cause the second shaft 266 to rotate.

Figure 32:
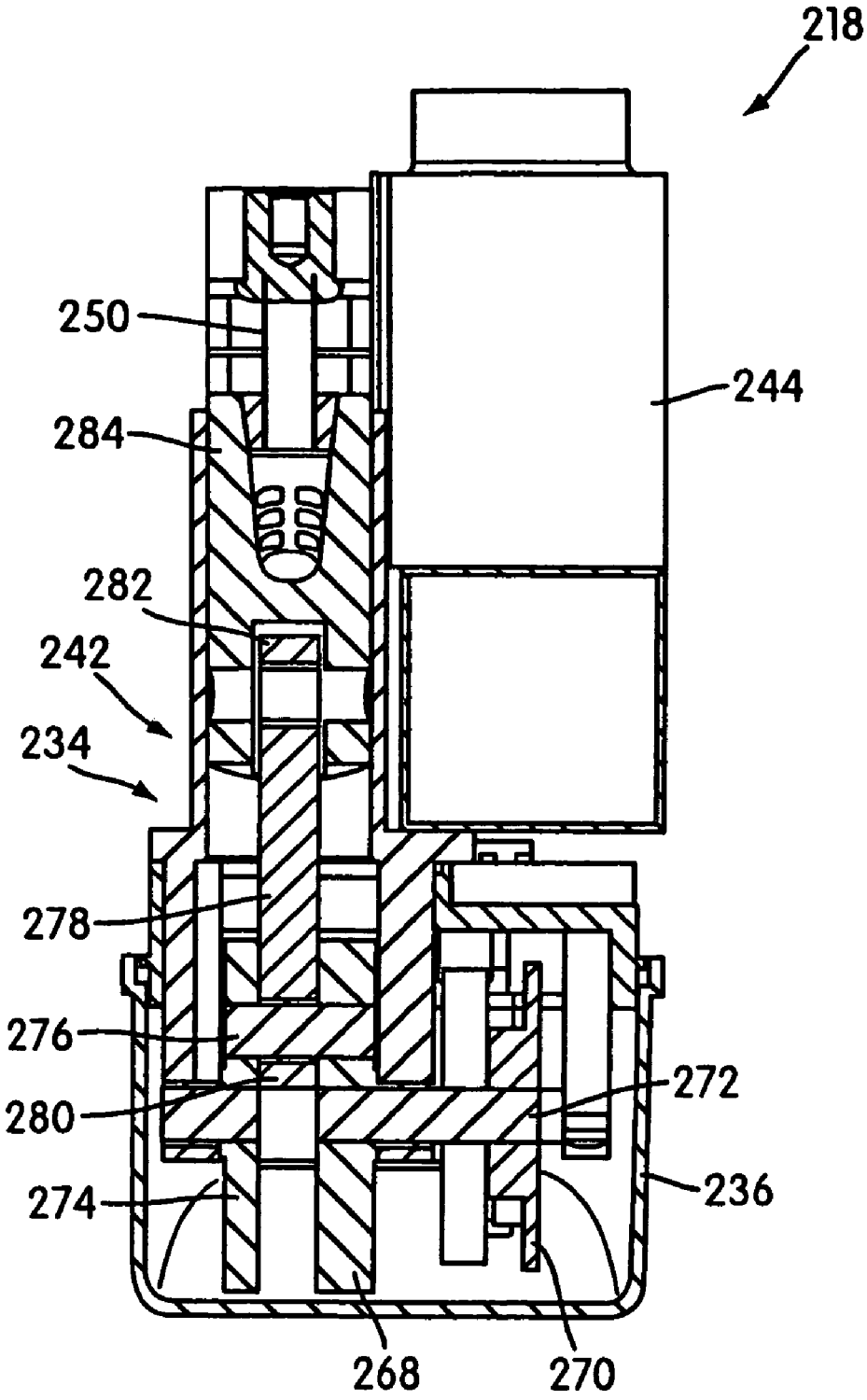
FIG. 32 is a cross-sectional view of the punch drive unit taken along line 32-32 of FIG. 25.

FIGS. 27, 28 and 32 illustrate a portion of the punch drive mechanism 242. As shown in FIG. 32, the punch driver mechanism 242 may include a fourth gear 268 and a fifth gear 270 that are disposed on a crank shaft 272. The fourth and fifth gears 268, 270 are configured to mesh with the second and third gears 262, 264, respectively, in a similar way that the first gear 260 meshed with the second and third gears 262, 264, as described above. A rotatable disc 274 is disposed such that its center of rotation is aligned with the crank shaft 272, although the rotatable disc 274 does not necessarily have to be disposed on the crank shaft 272. The rotatable disc 274 may be a gear, a pulley, or any other type of rotatable disc. A connecting member 276 connects the fourth gear 268 and the rotatable disc 274 such that the fourth gear 268 and the rotatable disc rotate together. As shown in FIGS. 27 and 32, the connecting member 276 connects to the fourth gear 268 and the rotatable disc 274 at a point radially outward from the center of the fourth gear 268 and rotatable disc 274. An elongated link 278 is disposed on the connecting member 276. The fourth gear 268 drive the elongated link 278.

The elongated link 278 includes a first end 280 and a second end 282. The first end 280 is operatively connected to the connecting member 276 such that when the fourth gear 268 rotates, the second end 282 of the elongated link 278 moves in a substantially radial direction relative to the longitudinal axis of the crank shaft 272. As the fourth gear 268 and the rotatable disc 274 rotate in tandem, the first end 280 of the elongated link 278 will travel circumferentially and the second end 282 will travel radially outwardly, inwardly, and outwardly as the fourth gear 268 and the rotatable disc 274 complete one revolution.

The second end 282 of the elongated link 278 is connected to a punch piston 284 such that the punch piston 284 moves with the second end 282. Thus, as the fourth gear 268 rotates, the punch piston 284 will move upward and downward within a tube 286 that extends upward from the frame 234. The punch 250 is attached to the punch piston 284 in such a way that it may be removed from the punch piston 284 and replaced, if necessary. The punch 250 of this embodiment may be of the same design as the punch 30 of the previously described embodiment.

In at least one embodiment, the fifth gear 270 includes a contact portion 288 (shown in FIG. 35) that is spaced radially from an axis about which the fifth gear 270 rotates. The fifth gear 270 is rotated continuously during the hole punching operation as the punch driver mechanism 242 continuously moves the punch 250 through the drive and return strokes. This contact portion 288 is similar to the previous embodiment and drives the translation mechanism 252.

Figure 33:
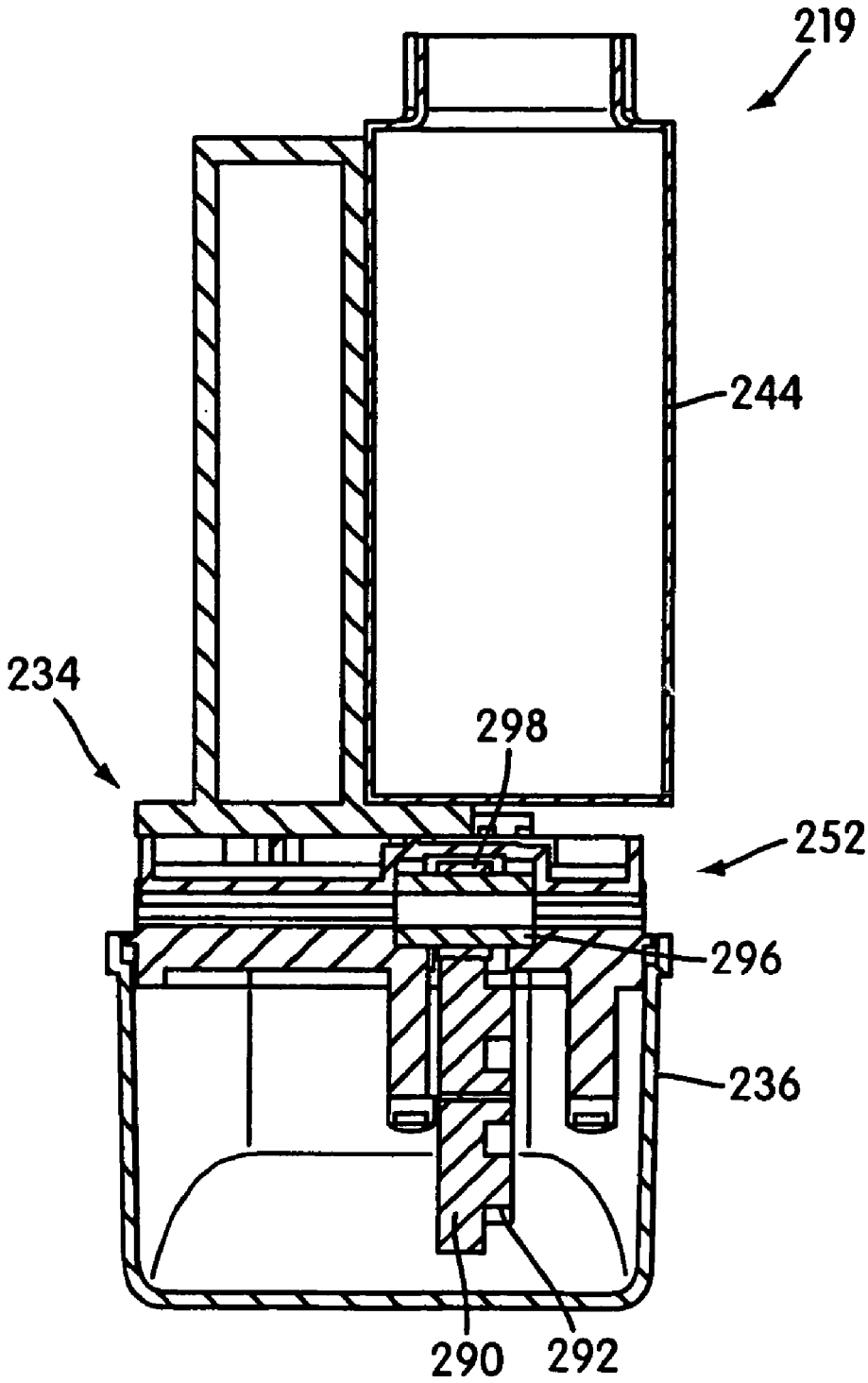
FIG. 33 is a cross-sectional view of the punch drive unit taken along line 33-33 of FIG. 25.
Figure 34:
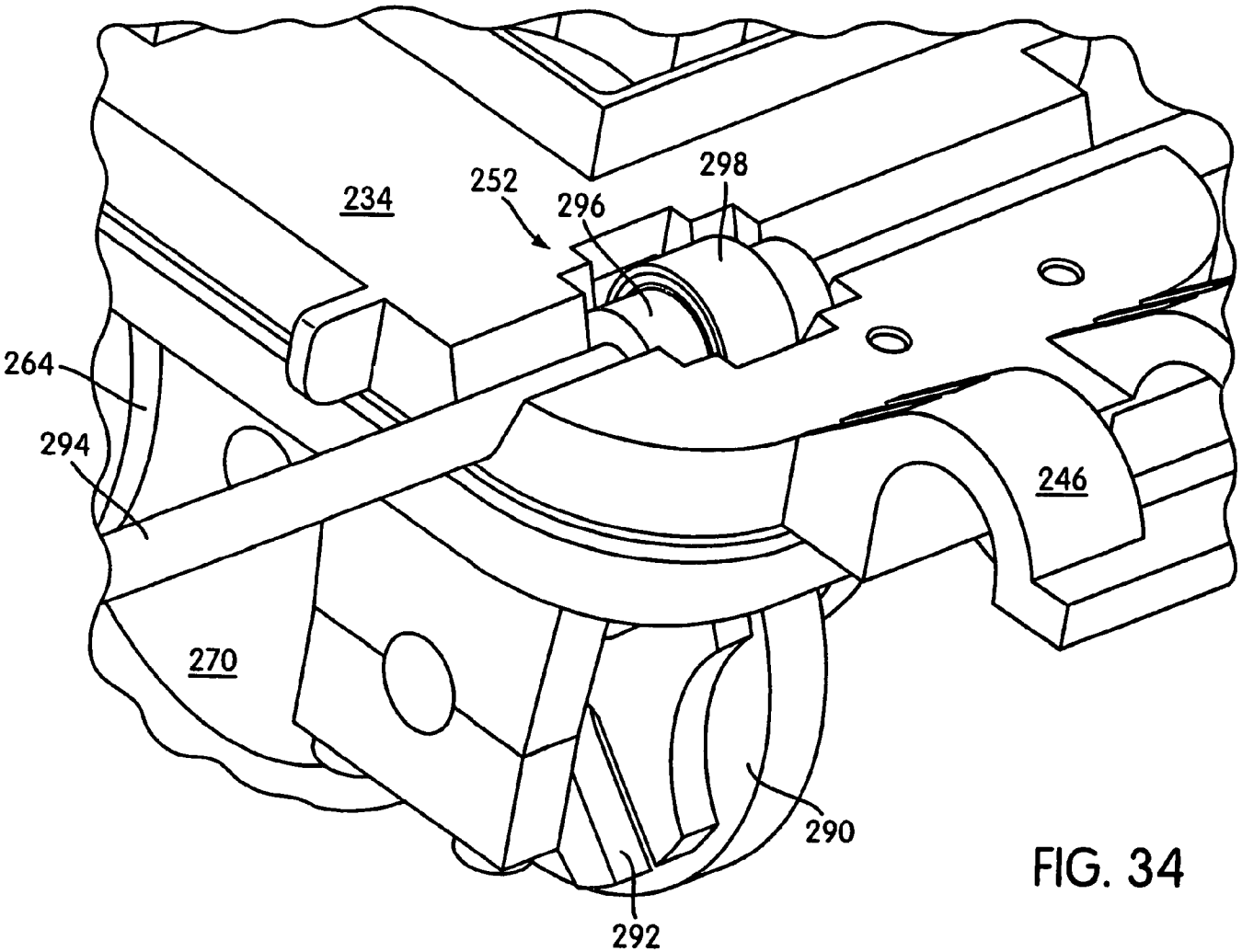
FIG. 34 is a close-up rear top perspective view of a portion of the punch drive unit of FIG. 25 with a cover removed.
Figure 35:
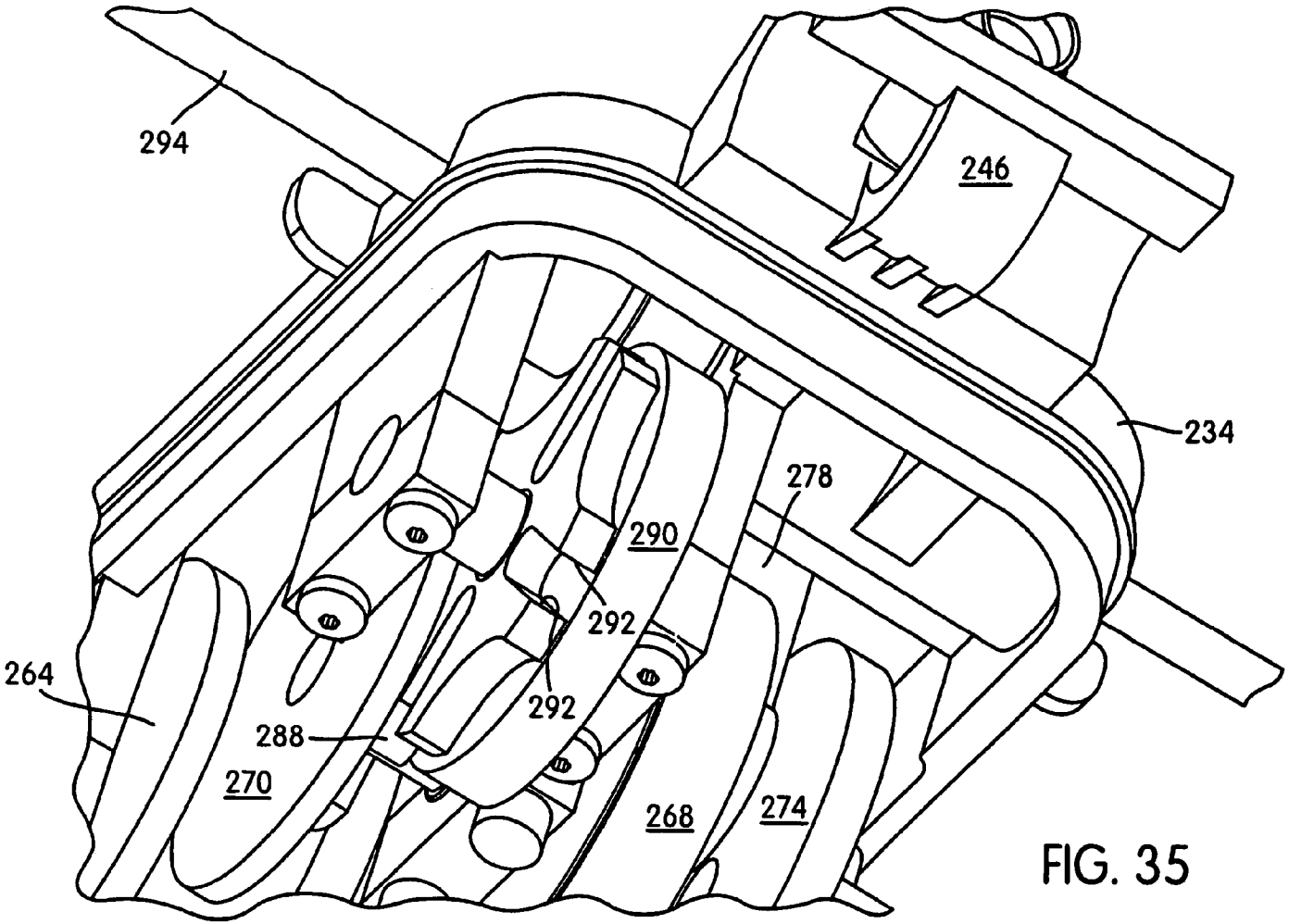
FIG. 35 is a close-up rear bottom perspective view of the portion of the punch drive unit of FIG. 34.

As illustrated in FIGS. 33-35, the translation mechanism 252 includes a rotatable drive member 290 that has a plurality of engagement surfaces 292 that are spaced radially from an axis about which the rotatable drive member 290 rotates. The engagement surfaces 292 are angularly spaced apart from one another essentially evenly. The translation mechanism 252 is constructed such that rotating the drive member 290 in an amount equal to the angular spacing of the engagement surfaces causes the translation mechanism 252 to affect the relative translational movement between the punch 250 and the paper support base 216 by the predetermined distance 40.

In this embodiment, the fifth gear 270 and the drive member 290 are constructed and arranged with respect to one another such that as the fifth gear 270 is continuously rotated during the hole punching operation, the contact portion 288 repeatedly engages one of the engagement surfaces 292 after each occurrence of the punch 250 being withdrawn from the stack of paper 14 on the return stroke to rotate the drive member 290 an amount equal to the angular spacing of the engagement surfaces 292. Then, the contact portion 288 disengages the engaged one of the engagement surfaces 292 to cease rotation of the drive member 290 prior to each occurrence of the punch 250 engaging the stack of paper 14 on the subsequent drive stroke. This operation is repeated continuously with the contact portion 288 engaging the engagement surfaces 292 sequentially. This synchronizes the punch drive mechanism 242 and the translation mechanism 252.

Specifically, as mentioned above, rotating the drive member 290 in an amount equal to the angular spacing between the engagement surfaces 292 will cause the translation mechanism 252 to affect the relative translational movement between the paper support base and the punch 250 by the predetermined distance 40. By arranging the contact portion 288 and the engagement surfaces 292 with respect to one another as described, synchronization is achieved wherein the translational movement occurs only during the time period between withdrawal of the punch 250 from the stack of paper 14 and re-engagement of the punch 30 with the stack of paper 14.

Although the embodiment illustrated in FIGS. 34 and 35 show the fifth gear 270 and the drive member 290 to be two components of a Geneva wheel, any type of intermittent gearing may be used to synchronize the punch drive mechanism 242 and the translation mechanism 252.

FIGS. 34 and 35 also illustrate another portion of the translation mechanism 252 which includes a shaft 294, and a rotatable member 296. The shaft 294 includes external threads in a screw-like configuration and remains fixed to the apparatus frame 214 and extends in the above-mentioned linear direction 28 so as to be parallel to the edge of the stack of paper 14 in its punching position. The rotatable member 296, which includes matching internal threads in a nut-like configuration that intermesh with the external threads of the shaft 294. The rotatable member 296 is rotatably attached to the frame 234 of the punch drive unit 218 such that it is able to rotate about the shaft 294 while moving the entire punch drive unit 218.

The rotatable member 296 is operatively connected to the drive member 290 via a sixth gear 298 that is disposed about the rotatable member 296 such that when the drive member 290 rotates, the rotatable member 296 rotates about the shaft 294. Because the shaft 294 remains fixed and does not rotate, the rotation of the rotatable member 290 causes the rest of the punch drive unit 218 to move in the linear direction 28. The design of the shaft 294 and the rotatable member 296, and particularly the relative gear pitches/ratio, are such that when the drive member 290 rotates intermittently, the rotation of the rotatable member 296 causes the punch drive unit 219 of the apparatus to move a distance equal to the predetermined distance 40.

The cover 236 also functions to contain a volume of oil that provides constant lubrication to the gears and shafts that are contained within the cover 236. The bearing 258 provides a seal so that oil will not be able to leak out of the cover 236. Also, gaskets may be provided between the cover 236 and the frame 234 so that oil cannot leak at the interface between the cover 236 and the frame 234. For example, FIG. 28 shows a gasket 295 that may be disposed adjacent an opening 297 for that receives the threaded shaft 294.

The waste paper bin 244 may be connected to the punch 250 by way of a connector 300 that is inserted into the punch piston 284. Preferably, suction is provided such that paper waste created by the punching operation with be pulled out of the punch 250 and through the connector 300 and to the waste paper bin 244 via a flexible tube, or any other suitable structure. Also, in at least one embodiment, a hose (not shown) may be provided between a compartment that contains the power source 238 and the waste paper bin 244 such that suction may be provided by the properly configured flywheel 240. As shown, the waste paper bin 244 is sized such that it may hold a considerable amount of waste paper so that many cycles may be performed by the apparatus 212 before the waste paper bin 244 needs to be emptied, thereby minimizing operator interaction.

An air vent 302 may be disposed on the punch drive unit 218 and designed to allow air to escape the otherwise sealed punch drive unit 218, but not allow air to enter the punch drive unit 218. This way, as the punch piston 284 operates, a small vacuum will be created as the punch piston 284 moves downward within the tube 286. When the punch piston 284 moves upward within the tube 286 towards the stack of paper 14, it will displace air. The displaced air can then escape the punch drive unit 218 through the air vent 302. This allows a vacuum to be maintained within the punch drive unit 218, thereby allowing the oil contained within the cover 236 to remain within the cover 236.

Figure 36:
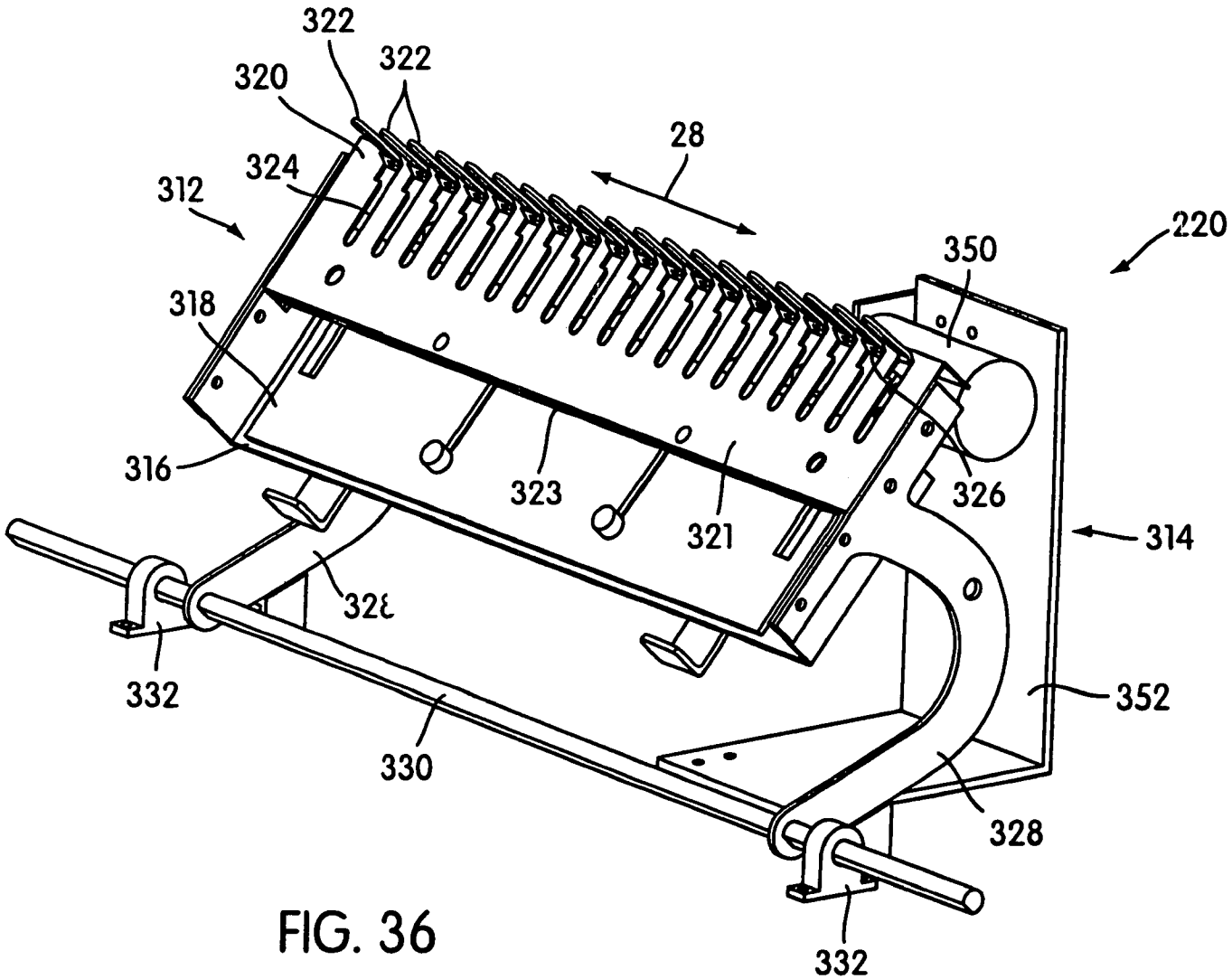
FIG. 36 is a front perspective view of a binding element applicator of the binding apparatus of FIG. 21.
Figure 37:
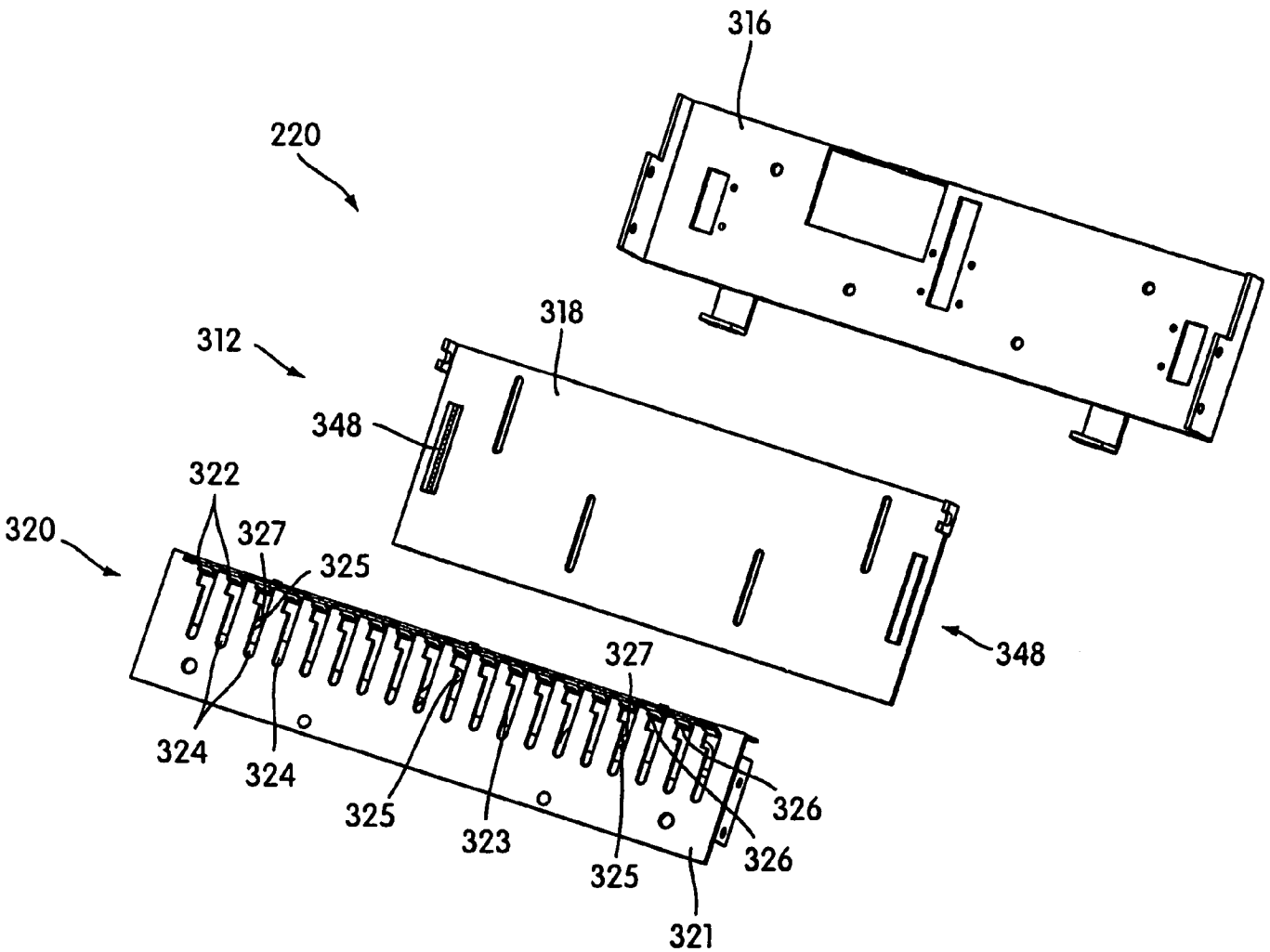
FIG. 37 is an exploded view of a portion of the binding element applicator of FIG. 36.
Figure 38:
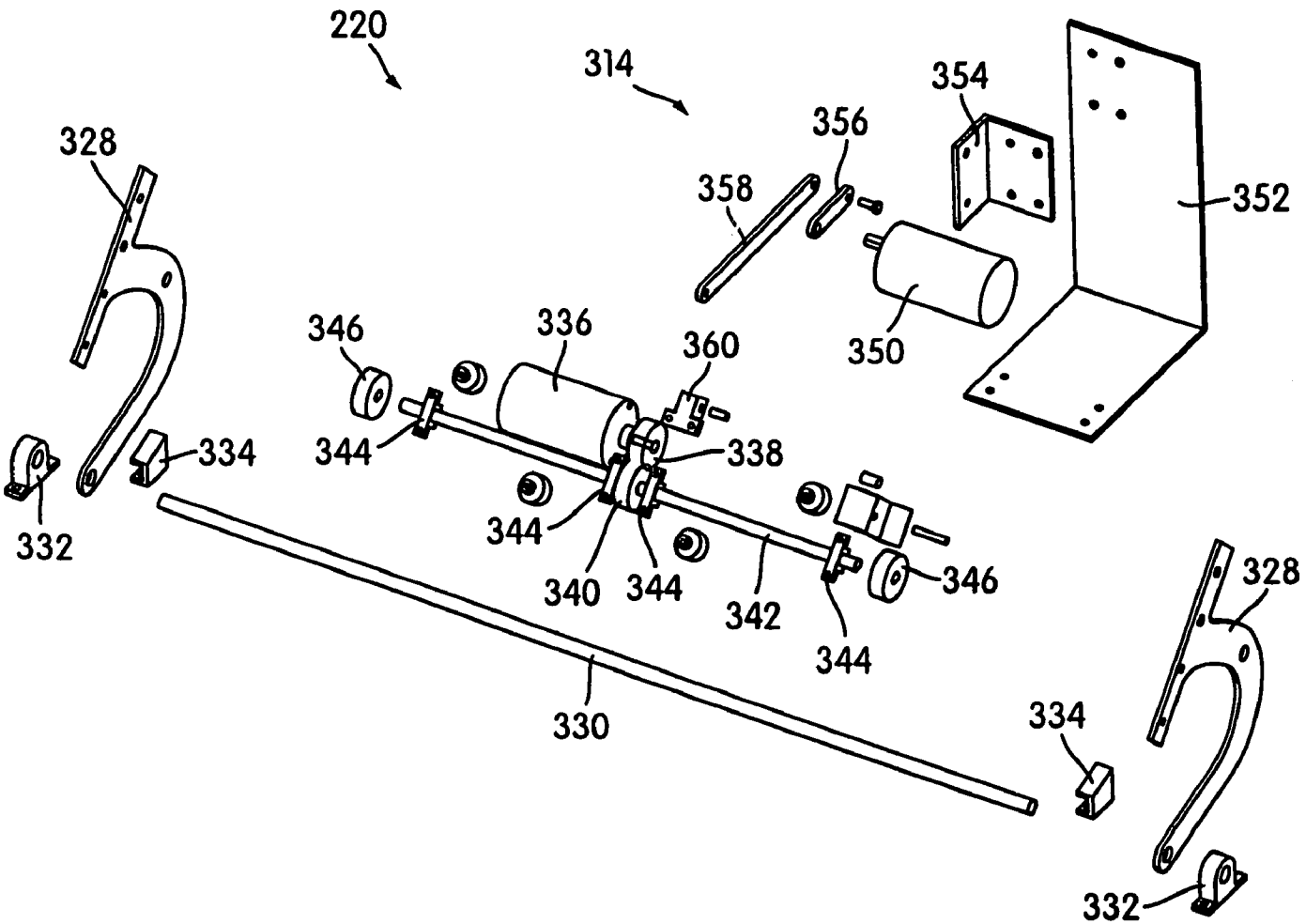
FIG. 38 is an exploded view of another portion of the binding element applicator of FIG. 36.

The binding element applicator 220 of the apparatus 12 is shown in greater detail in FIGS. 36-38. The binding element applicator is constructed to receive the binding element 16 in an application position. In the application position, the binding element 16 extends in the linear direction 28 such that when the stack of paper 14 is in the punching position, a spine 102 of the binding element 16 is essentially parallel to the edge of the stack of paper 26 and fingers 104 of the binding element 16 are adjacent to the edge of the stack of paper.

As illustrated, the binding element applicator 220 includes a binding element receiving assembly 312, shown in detail in FIG. 37, and an actuating assembly 314, shown in detail in FIG. 38. The binding element receiving assembly 312 includes a back plate 316, a center plate 318, and a binding element manipulating portion 320. A first plurality of fingers 322 extend from the manipulating portion 320 and are spaced along an edge of the manipulating portion 320 at a pitch essentially equal to the predetermined distance 40 (i.e., the predetermined distance by which the translation mechanism 252 moves the punch 250). A first plurality of slots 324 are disposed in a top portion 321 of the manipulating portion 320 such that they extend from the first plurality of fingers 322 towards an opposite edge of the top portion 321 of the manipulating portion 320, as shown in FIG. 37. A second plurality of fingers 326 are formed on a first movable plate 323 such that they protrude out of the first plurality of slots 324. The second plurality of fingers 326 are substantially shorter than the first plurality of fingers 322 and are preferably formed as inverted "L" shapes, as shown in FIG. 36, so that they will be able to engage the fingers 104 of the binding element 16.

The first movable plate 323 also includes a plurality of angled slots 325 that are disposed on an angle relative to the first plurality of slots 324. A plurality of protrusions 327 extend through the plurality of angled slots 325 and are connected to a second movable plate (not shown) that is disposed behind the first movable plate 323 relative to the top portion 321. The second movable plate is configured to move along the direction of the first plurality of slots 324. As the second movable plate moves downward and away from the first plurality of fingers 322, the first movable plate 323 moves first towards one side of the manipulating portion 320, due to the plurality of angled slots 325. When the protrusions 327 reach the end of the angled slots 325, the first movable plate 323 travels with the second movable plate substantially downward such that the second plurality of fingers 326 move downward within the first plurality of slots 324. This movement of the second plurality of fingers 326 relative to the first plurality of fingers 322 is well known in the art, as evidenced by, for example, U.S. Pat. No. 4,872,796, which is herein incorporated by reference in its entirety.

The back plate 316 and the top portion 321 of the manipulating portion 320 may be rigidly connected to a pair of arms 328 at one end of the arms 328. Opposite ends of each arm 328 are connected to a rod 330 in such a way that if the rod 330 rotates, the arms 328 pivot. Each end of the rod 330 is operatively connected to a bearing 332 that is rigidly connected to the frame 214. A pair of stops 334 are also fixed to the frame 214 and aligned with the arms 328 such that the arms 328 are restricted from pivoting any further in that direction, as shown in FIG. 22.

As shown in FIG. 38, the actuating assembly 314 of the binding element applicator 220 also includes a first motor 336 that is attached to the back plate 316 of the receiving portion 312 of the binding element applicator 220. The first motor 336 is operatively connected to a pair of gears, including a first gear 338 and a second gear 340. The second gear 340 is disposed on a shaft 342 such that when the second gear 340 rotates, the shaft 342 rotates. The shaft 342 is connected to the back plate 316 by a plurality of bearings 344. Disposed on each end of the shaft 342 are a pair of gears 346 that are connected to the shaft 342 such that they rotate when the shaft 342 rotates. The pair of gears 346 are operatively connected to a pair of racks 348, as shown in FIGS. 22 and 37, that are disposed on the center plate 312 of the binding element receiving portion 312 and affect the movement of the second movable plate. Because the second movable plate includes the protrusions 327 that extend into the angled slots 325 on the first movable plate 323, the second plurality of fingers 326 may be manipulated by the first motor 336.

The actuating assembly 314 further includes a second motor 350 that is supported by a bracket 352 that is connected to the frame 214. A second bracket 354 may also be used to support the second motor 350, as shown in FIGS. 22 and 38. The second motor 350 is operatively connected to the back plate 316 of the binding element receiving portion 316 with a pair of links 356, 358 and a mounting bracket 360. The mounting bracket 360 is attached to the back plate 316 and the links 356, 358 are rotatably connected to each other and to the mounting bracket 360 such the links 356, 358 may pivot relative to each other as the second motor 350 drives one of the links 356. This configuration allows the second motor 350 to move the entire binding element applicator 220 towards the stack of paper 14 as the stack of paper 14 rests on the paper support base 216.

In operation, the binding element 16 is placed on the first plurality of fingers 322 of the binding element applicator 220 (also referred to as a binding element insertion device—either term may be used interchangeably) such that the spine 102 faces away from the paper support base 216 and the fingers 104 of the binding element 16 face towards the paper support base 216 and point substantially upward. A binding element bin (not shown) may be operatively connected to the first plurality of fingers 322 such that the binding element 16 may be placed in the bin and the binding element will be placed on the first plurality of fingers 322 in the proper orientation automatically. Once the binding element 16 is properly placed on the first plurality of fingers 322, the first motor 336 operates to cause the second plurality of fingers 326 to move over and then downward within the slots 324, thereby causing the second plurality of fingers 326 to move the fingers 104 of the binding element 16 away from the spine 102 and open the binding element 16. The second motor 350 operates to cause the binding element applicator 220 to move towards the stack of paper 14 that is supported by the paper support base 216.

The actual distance traveled by the second plurality of fingers 326 will depend on the diameter of the binding element 16 used. For example, binding elements 16 with larger diameters will require the second plurality of fingers 326 to travel further than binding elements 16 with smaller diameters. It is contemplated that a sensor (not shown) may be used to sense the size of the binding element 16 by either sensing its size directly, or sensing some other indicator on the binding element 16 itself, such as holes or notches. The sensor may then communicate a signal to the first motor 336, thereby causing the first motor 336 to operate for the appropriate amount of time. It is also contemplated that the operator of the apparatus 212 may be able to select the size of the binding element 16 by moving a switch or by programming the apparatus 212 by know procedures.

As shown in FIG. 22, the surface of the paper support base 232 includes a plurality of notches 362 that allow the punch 250 of the punch drive unit 218 to punch holes 36 in the stack of paper 14 and also allow the fingers 104 of the binding element 16 to align and pass through the holes 36 in the stack of paper 14. After the punch drive unit 218 has made a pass along the edge of the stack of paper 26 and punched the holes 36 in the stack of paper 14, the punch drive unit 218 remains at one end of the frame 214. The first motor 336 of the binding element application 220 causes the second plurality of fingers 326 to engage the fingers 104 of the binding element 16 to open. The binding element applicator 220 may then be moved into position by the second motor 350 to align the fingers 104 of the binding element 16 with the holes 36. The first motor 336 may then be reversed to rotate the first gear 338 in the opposite direction, thereby causing the second plurality of fingers 326 to retract back towards the first plurality of fingers 322. This allows the fingers 104 of the binding element 16 to relax and close into a substantially curled position. The second motor 350 may then move the binding element applicator 220 away from the stack of paper 14, leaving the binding element 16 installed on the stack of paper 14, thereby yielding a bound book 18.

In operation, the operator places the stack of paper 14 inside the cover 138, if a cover is desired, and places the stack of paper 14 on the paper support tray 224 of the paper support base 216 so that it abuts the stop member. The stack of paper 14 is properly positioned in the apparatus 212 and then firmly clamped into place with the clamp 226. The operator also inserts the binding element 16 of the proper size into the binding element retainer, or directly onto the binding element applicator 220. The operator closes the door 140 and initiates the punching and binding operation by contacting the start sequence mechanism 150. The stop member moves out of the way, and the punch driver unit 218 sequentially punches holes 36 at the predetermined distance 42 along the edge 26 of the stack of paper 14 until all holes are punched. The binding element applicator 220 opens the binding element 16 and moves toward the stack of paper 14. The fingers 104 of the binding element 16 are lined up with the holes 36 and inserted into the holes 36 in the stack of paper 14. The binding element applicator 220 releases the binding element 16 as it retracts away from the stack of paper 14. At the end of the operation, the operator opens the door 140 to the apparatus 12 and removes the bound book 18.

Figure 39:
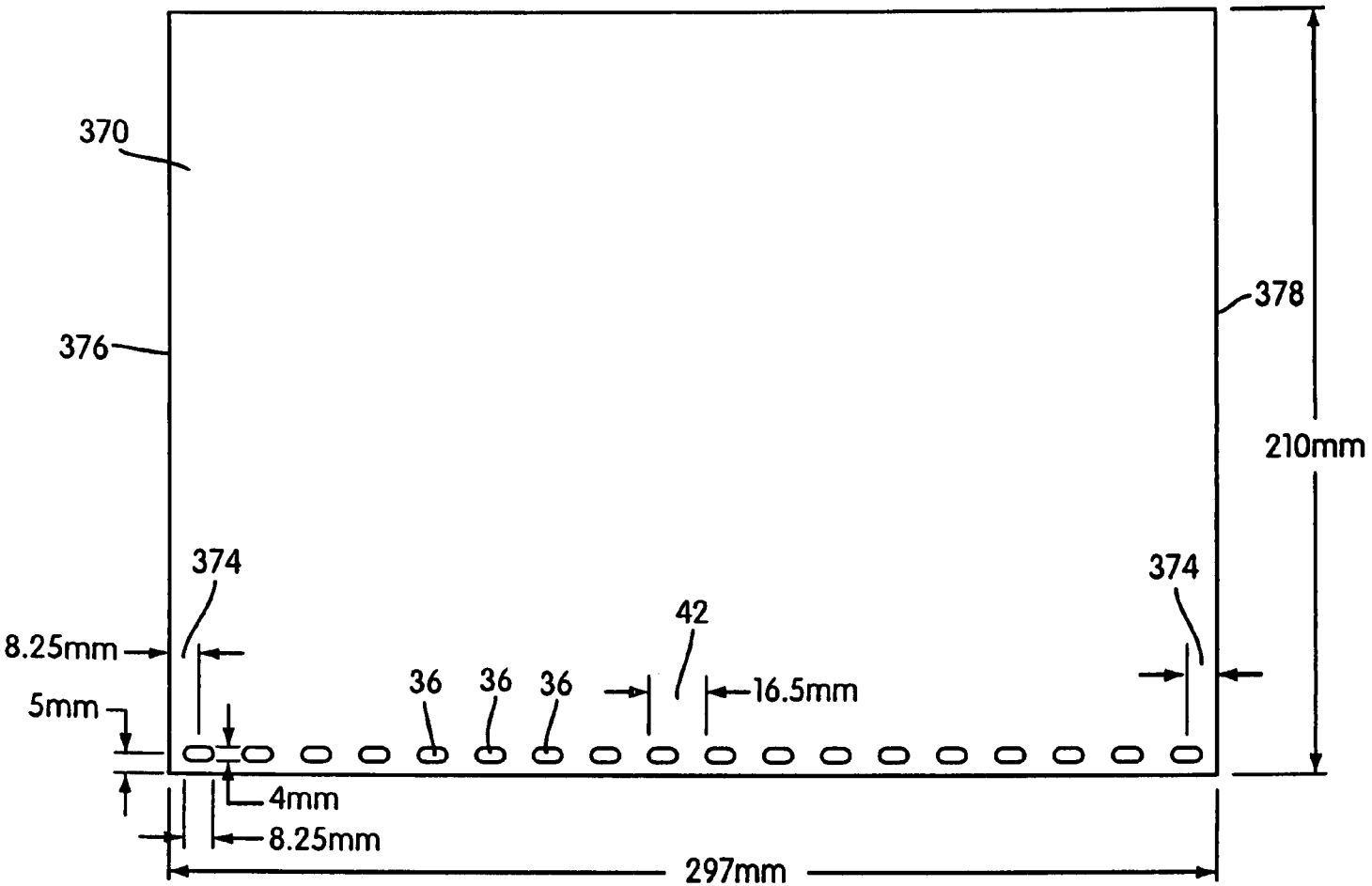
FIG. 39 is a schematic of a metric A4 paper that has been punched with the apparatus of FIG. 1.
Figure 40:
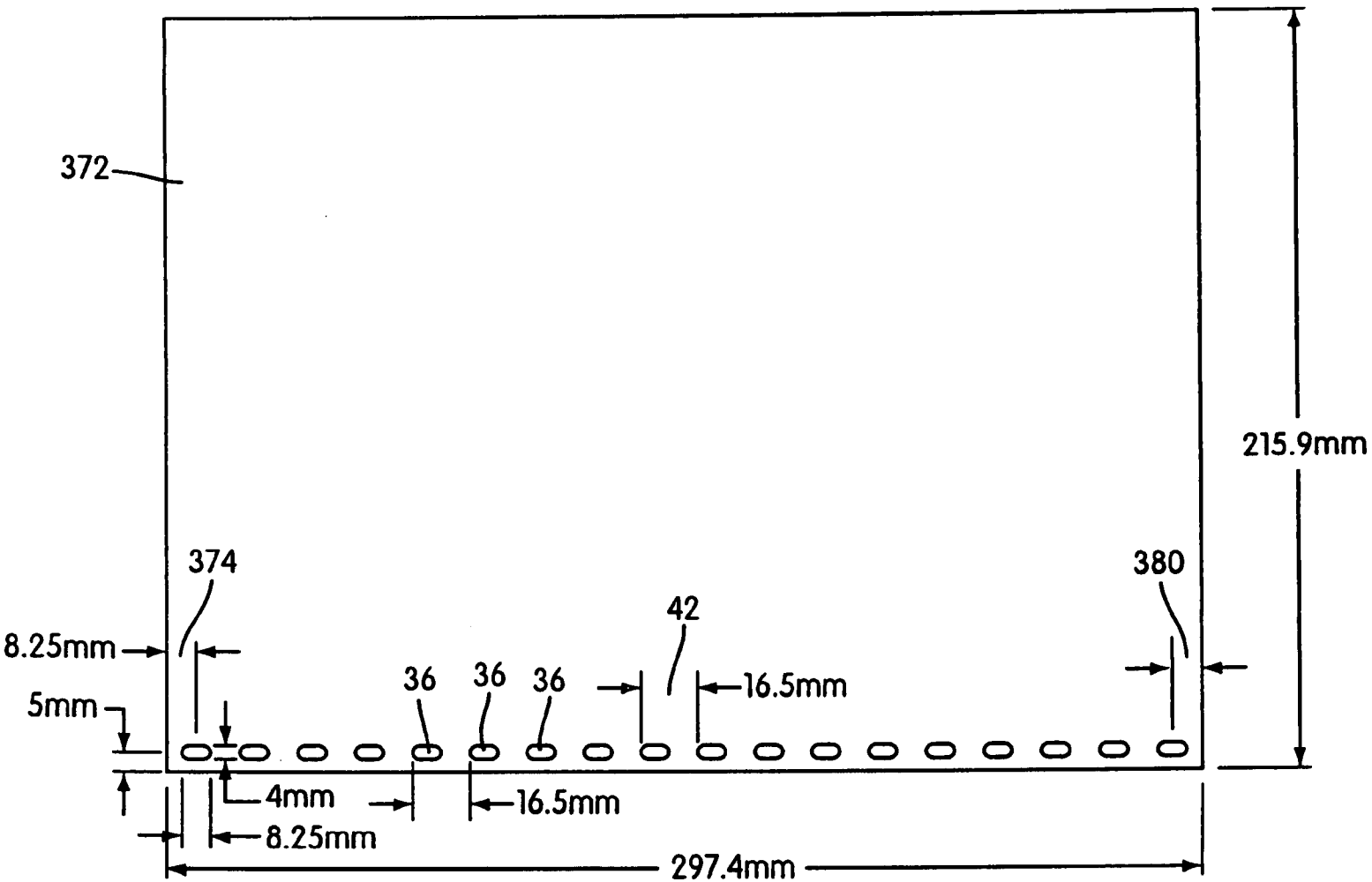
FIG. 40 is a schematic of an 8.5"×11" letter paper that has been punched with the apparatus of FIG. 1.

As shown in FIGS. 39 and 40, the pitch 42 has been selected particularly for both metric A4 paper 370 and 8.5"×11" letter paper 372 so that the same apparatus 12, 212 may be used to punch and bind both sizes of paper with suitable results (other pitches may be used, such as those described hereinbelow). For example, it has been determined that using a pitch 42 of about 16.5 mm, allows eighteen holes 36 to be punched in a stack of paper 14 that includes metric A4 paper 370 and seventeen holes 36 to be punched in a stack of paper 14 that includes 8.5"×11" letter paper 372. As shown in FIG. 39, this pitch 42 also allows the holes 36 in the metric A4 paper to be centered such that offsets 374 from a top edge 376 and a bottom edge 378 are substantially the same and are about one-quarter of the pitch 42.

As shown in FIG. 40, for 8.5"×11" letter paper, the offset 374 may be the same one-fourth of the pitch 42 at one end, but an offset 380 at the other end will be less than one-fourth of the pitch 42. However, the less than one-fourth of the pitch 42 is still considered to be an acceptable amount by those skilled in the art. Of course, the apparatus 12, 212 may be configured to hold the 8.5"×11" letter paper 372 such that the offsets 374, 380 are the same at each end. Such a configuration will yield offsets 374, 380 that are both less than one-fourth of the pitch 42.

As part of the system 10, the fingers 104 of the binding element 16 are spaced apart at the pitch 42. Thus, the fingers 104 of the binding element 16 have a pitch of about 16.5 mm. Because a different number of holes are required between the metric A4 paper and the 8.5"×11" letter paper, the binding element 16 may include eighteen fingers 102 for use with the metric A4 paper and seventeen fingers 102 for use with the 8.5"×11" letter paper. It is contemplated that different indicators may be placed on the binding elements 16 to indicate paper size, as well as diameter, such that the indicators may be sensed by sensors within the apparatus, as discussed above.

Figure 41:
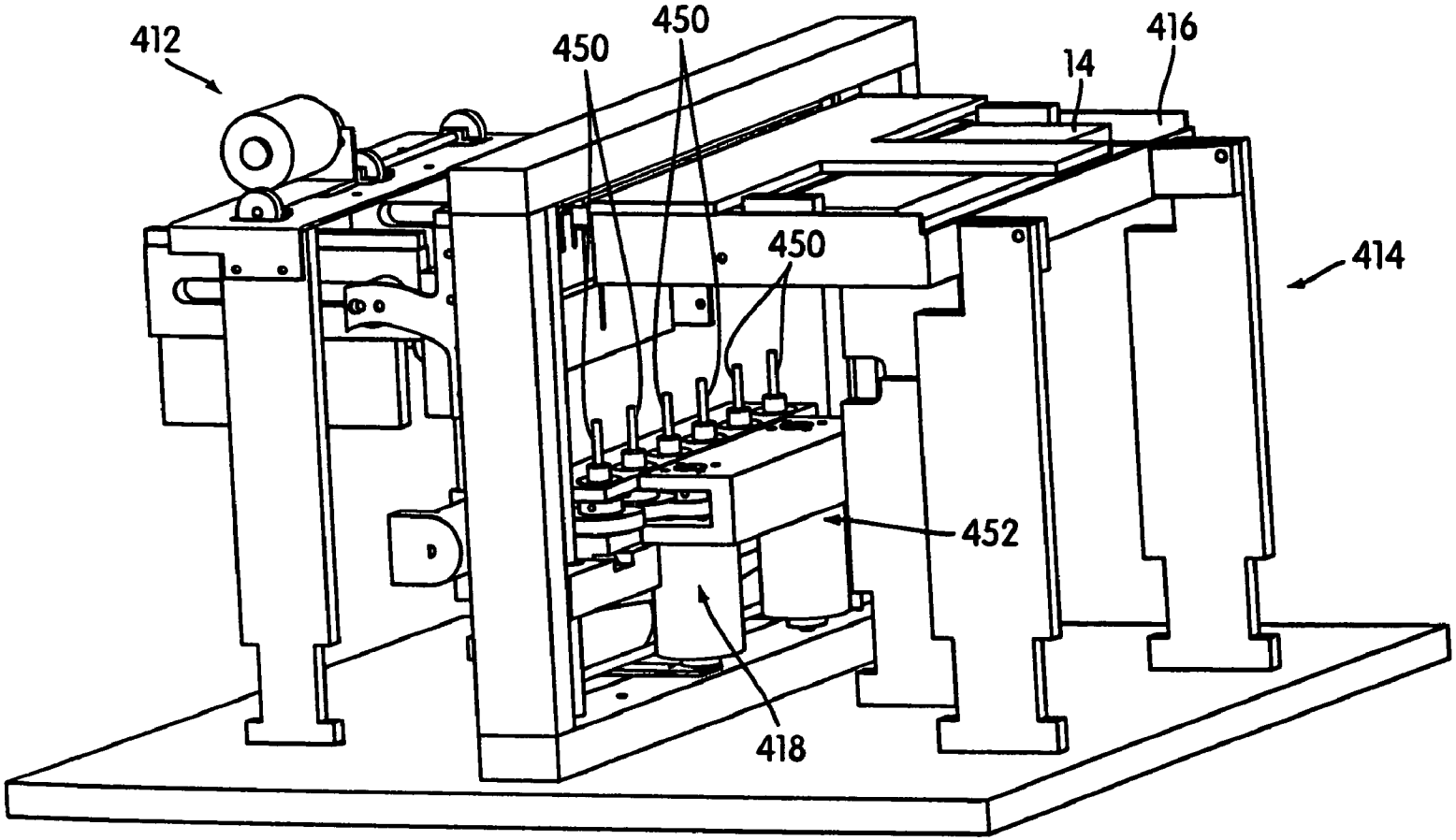
FIG. 41 is a perspective view of another embodiment of internal components of the binding apparatus of FIG. 1.
Figure 42:
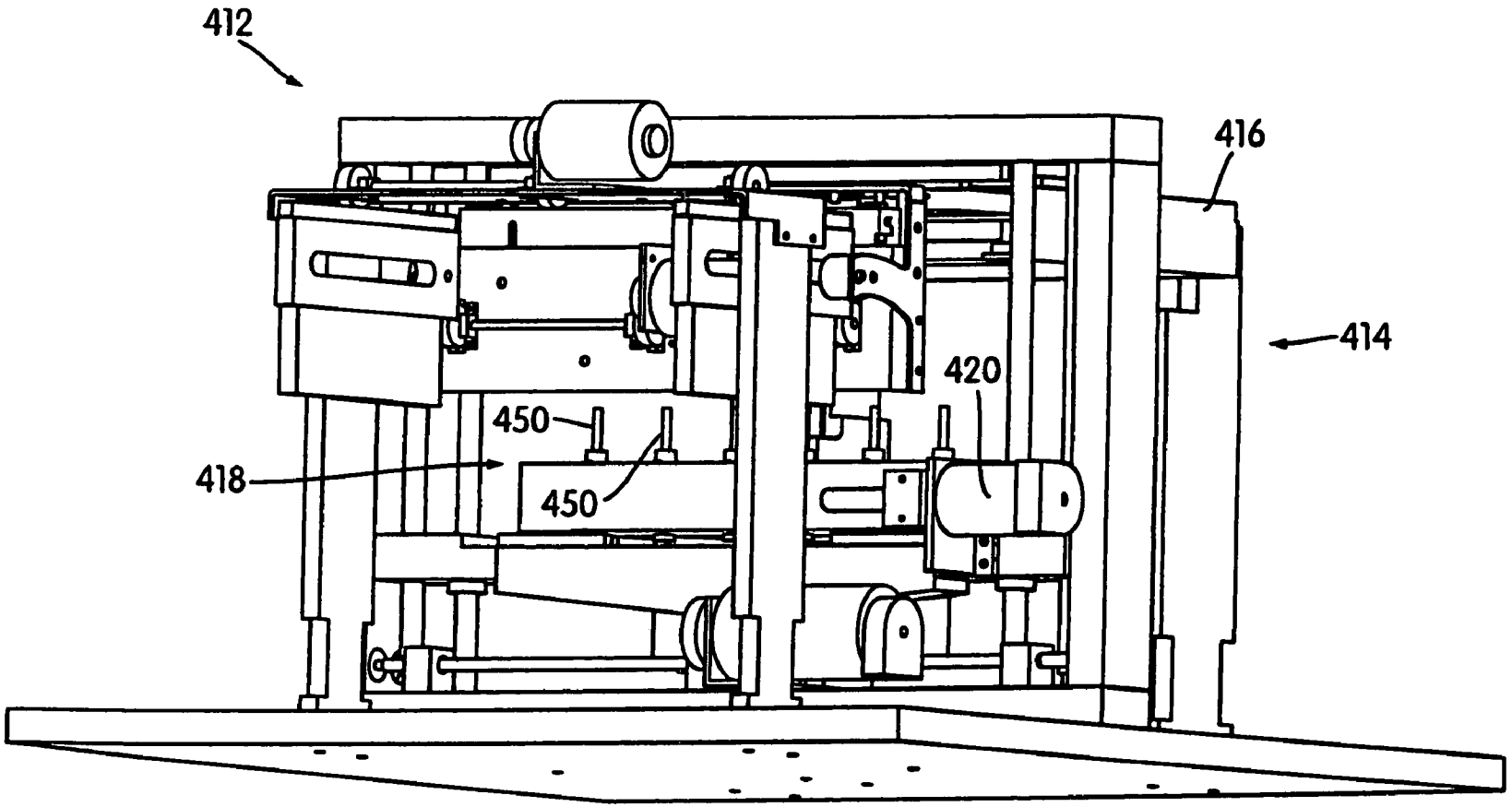
FIG. 42 is another perspective view of the binding apparatus of FIG. 41.
Figure 43:
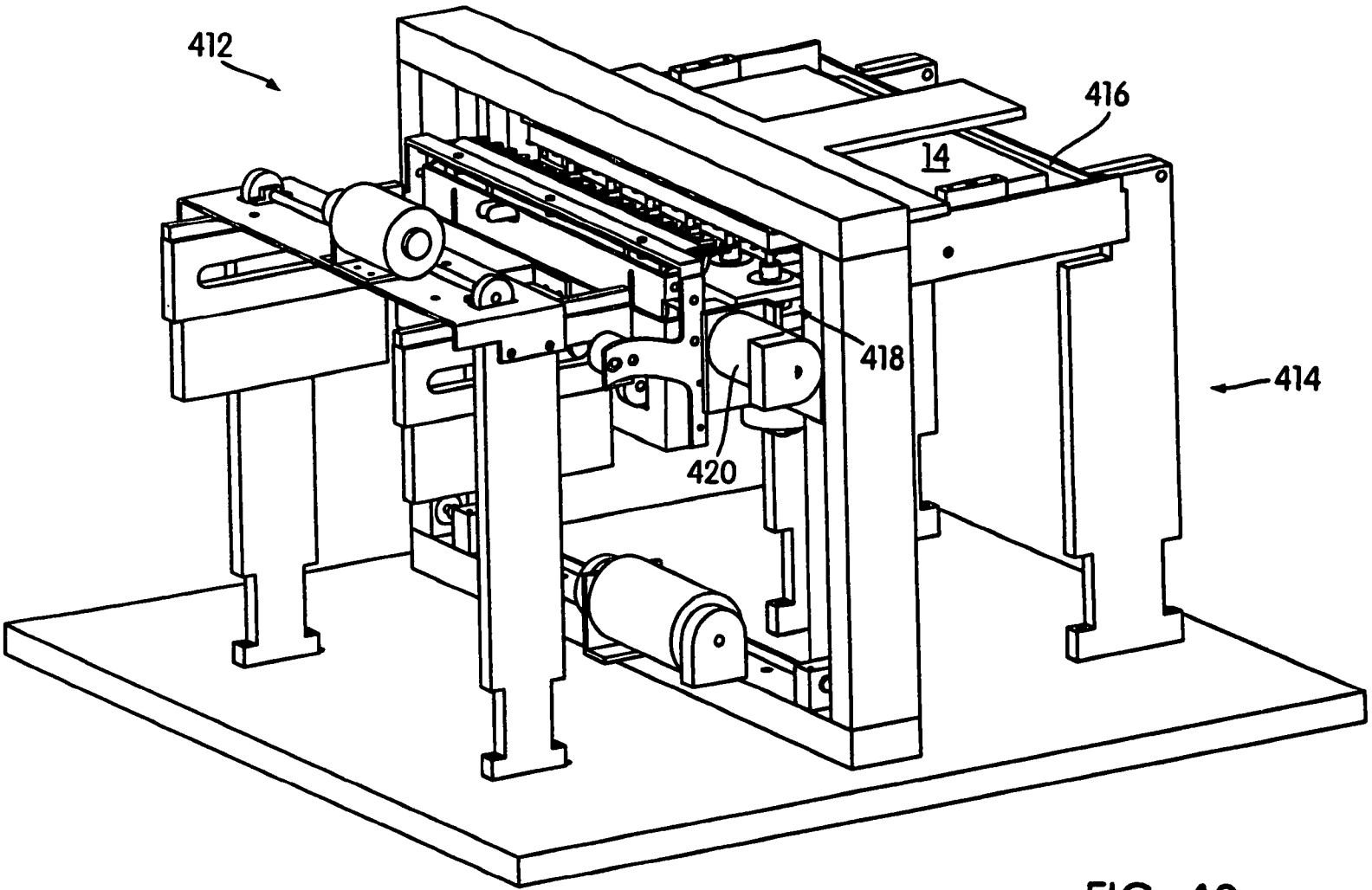
FIG. 43 is a perspective view of the binding apparatus of FIG. 41, with a punch drive unit in an engaged position.
Figure 44:
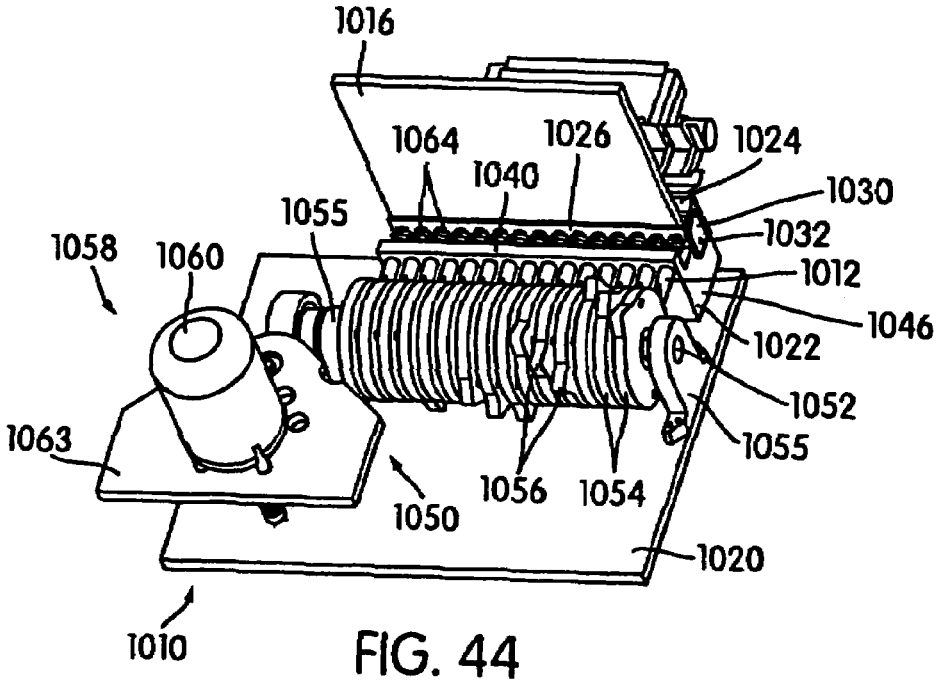
FIG. 44 is a perspective view of a punching apparatus constructed in accordance with the present invention.
Figure 45:
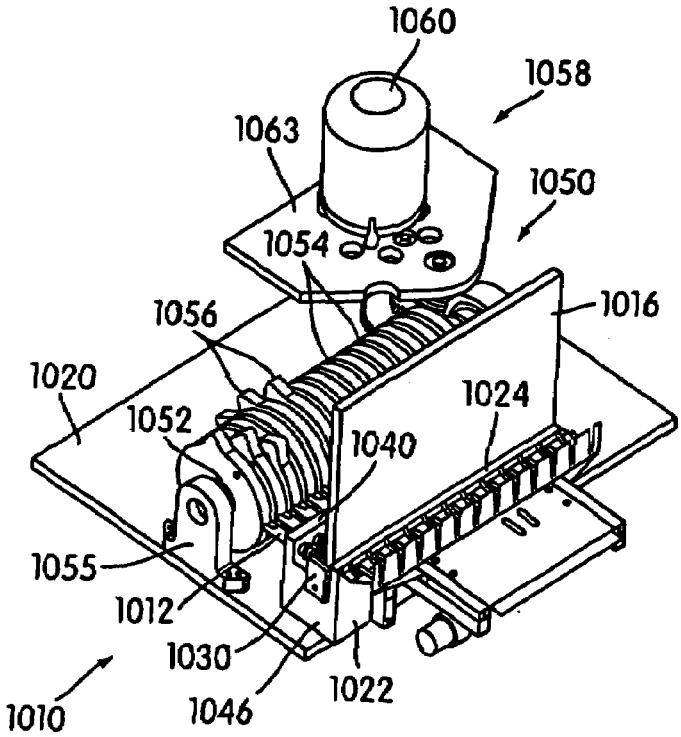
FIG. 45 is another perspective view of the punching apparatus of FIG. 44.
Figure 46:
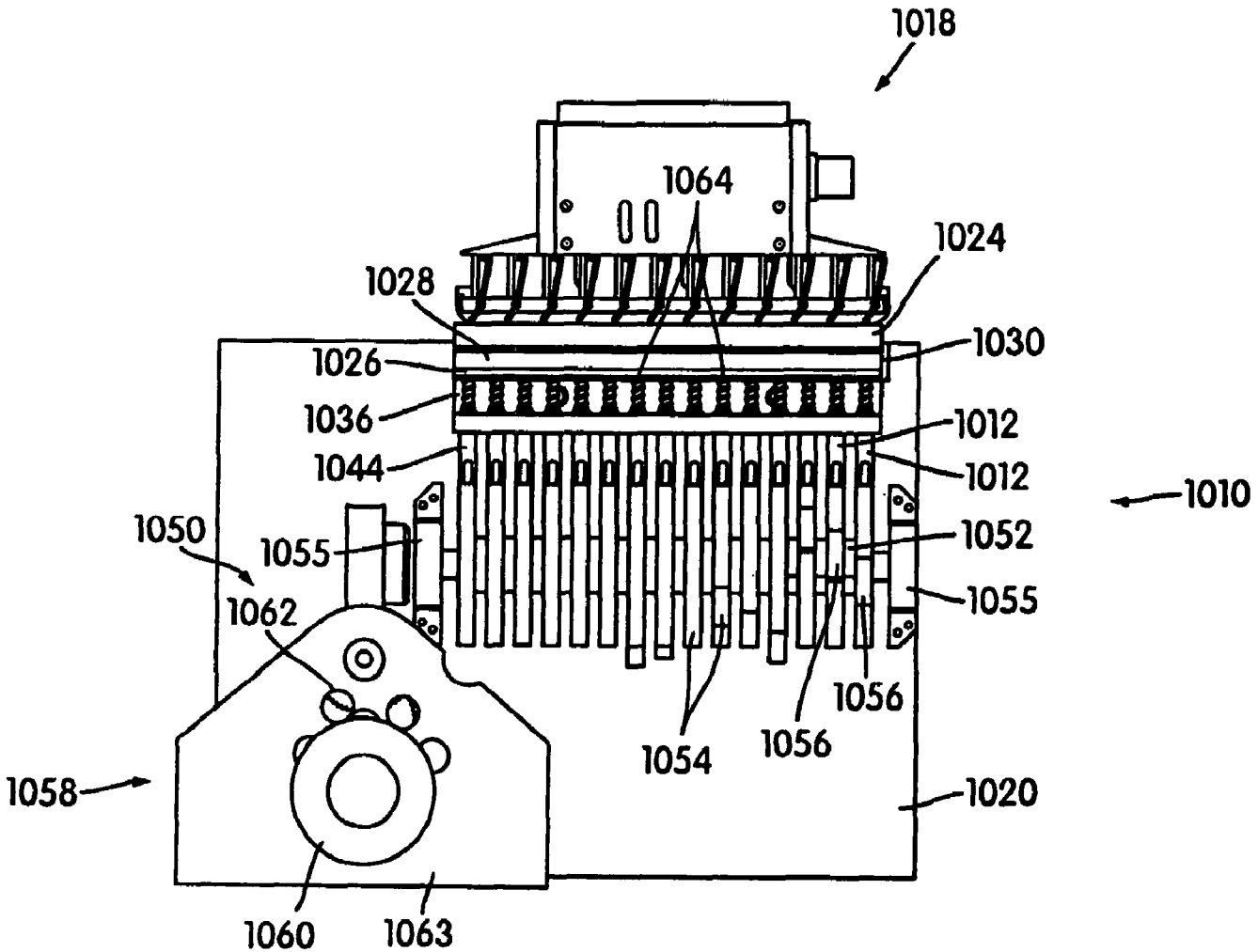
FIG. 46 is a top view of the punching apparatus of FIG. 44.
Figure 47:
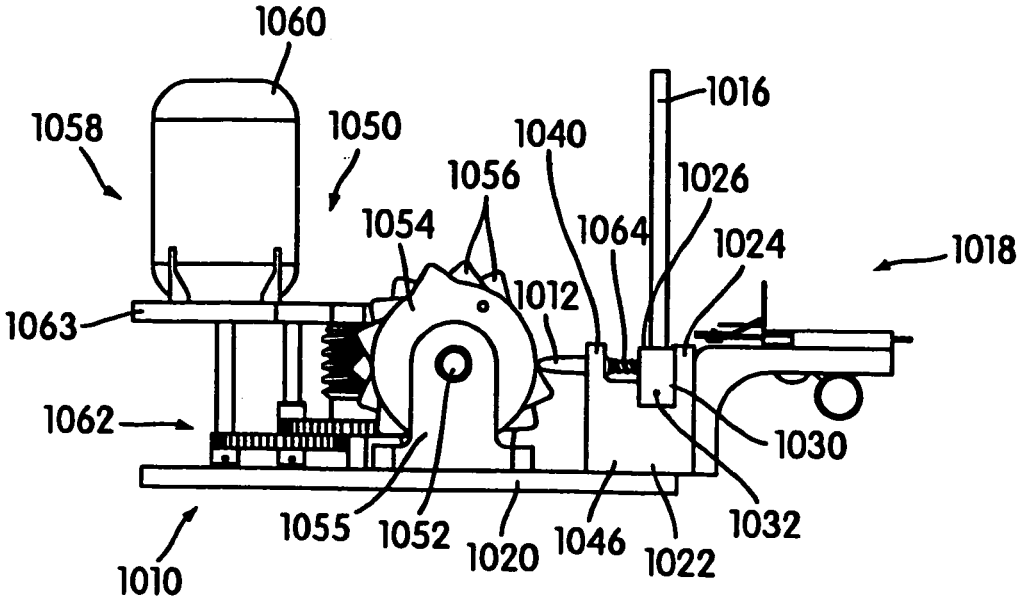
FIG. 47 is a side view of the punching apparatus of FIG. 44.
Figure 48:
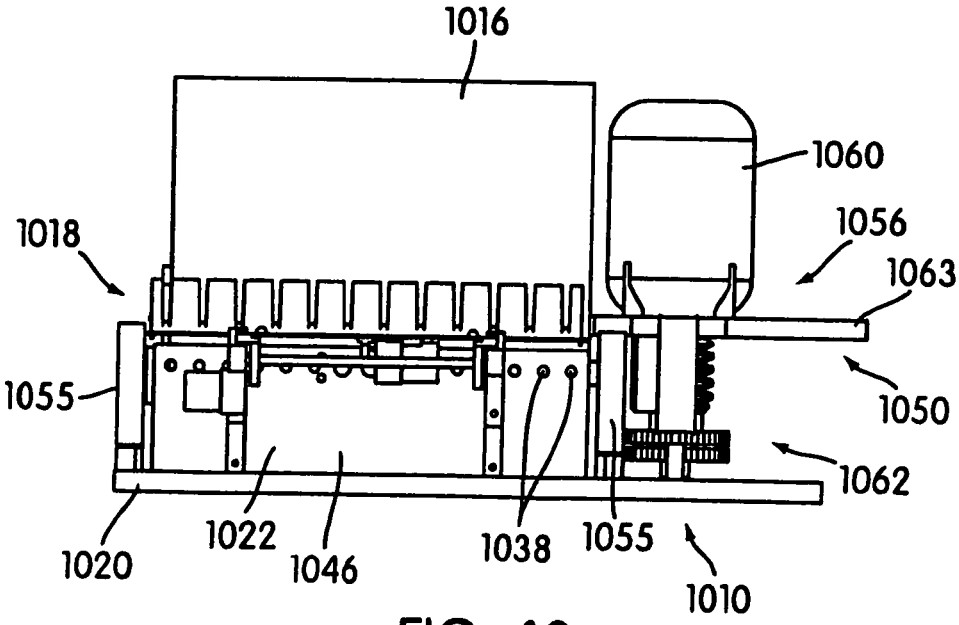
FIG. 48 is rear view of the punching apparatus of FIG. 44.
Figure 49:
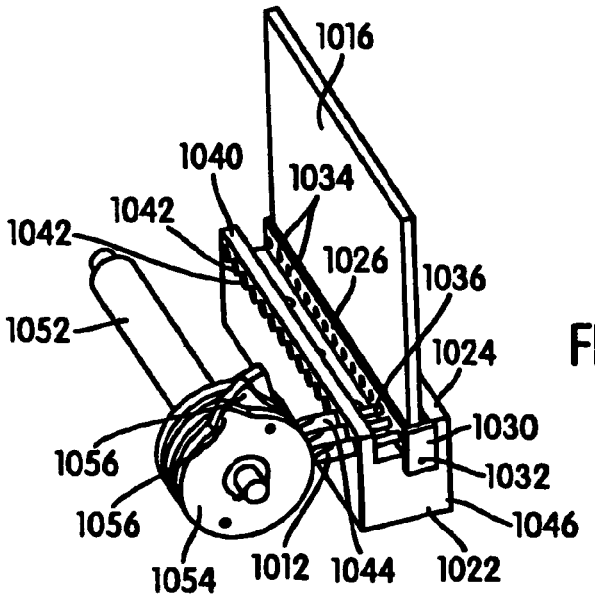
FIG. 49 is a perspective view isolating the document support and select parts of the drive system of the punching apparatus of FIG. 44.
Figure 50:
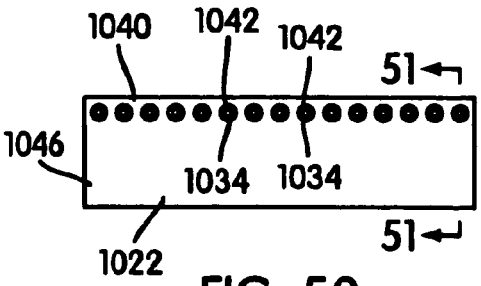
FIG. 50 is a front view of the document support used in the punching apparatus of FIG. 44.
Figure 51:
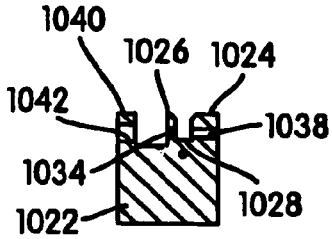
FIG. 51 is a cross-section taken along line 51-51 in FIG. 50.

Yet another embodiment of the apparatus 412 is shown in FIGS. 41-43. In this embodiment, the apparatus 412 is similar to the apparatus 212 shown in FIGS. 21-38, except a frame 414 of the apparatus 412 is arranged so as to elevate a paper support base 416 a greater distance. Also, the apparatus 412 includes a punch drive unit 418 that includes at least one punch 450, where the at least one punch 450 is actually a plurality of punches 450. Specifically, this embodiment includes six punches 450. Other features of the embodiment shown in FIGS. 21-38, including the binding element applicator 220, may be used in this embodiment and will therefore not be described in detail here.

As shown, the six punches 450 are spaced apart such that the distance between each punch 450 is a multiple of the pitch 42, as defined above. More specifically, each punch 450 is spaced apart, on center, a distance of three times the pitch 42, e.g., 49.5 mm for a 16.5 mm pitch. In this embodiment, the punch drive unit 418 moves the predetermined distance 40 between strokes, and the predetermined distance 40 equals the pitch 42.

In a configuration (not shown) where there are a plurality of punches 450 that are spaced apart at a distance, on center, equal to the pitch 42, the punch drive unit 418 would move the predetermined distance 40 between strokes, where the predetermined distance 40 would be equal to a multiple of the pitch 42. For example, in a configuration with two punches 450, the predetermined distance 40 would be equal to two times the pitch 42. In a configuration with three punches 450, the predetermined distance 40 would be equal to three times the pitch 42, and so on.

FIGS. 41 and 42 show the punch drive unit 418 in its at-rest position. When the punch drive unit 418 is in this position, the stack of paper 14 may be placed on the paper support base 416 and removed from the paper support base 416 without interference from the punches 450. At least one motor 420 may be used to actuate the punch drive unit 418 from the at-rest position to the operating position shown in FIG. 43.

The punch drive unit 418 is configured to drive all six punches 450 at one time. As the punches 450 retract from engagement with the stack of paper 14, a translation mechanism 452 begins to move the punch drive unit 418 the predetermined distance 40. As discussed above in the previously described embodiments, the translational movement is completed before the punches 450 contact the stack of papers 14 during the next stroke. By using a plurality of punches 450, the entire operation takes less time, i.e., about one sixth of the time as compared to the previously described embodiments. Of course, additional power is needed in this embodiment to drive all six punches 450 through the stack of paper 14 at the same time. Thus, variations of the gearing shown in the previous embodiments may be modified, and the use of multiple motors may be used for driving the punches 450 individually or in sub-groups.

FIGS. 44-56 illustrate a punching apparatus 1010 constructed in accordance with the present invention. The apparatus 1010 is of the cam-driven type and designed to accommodate the use of internal bore punches 1012. The general purpose for the apparatus 1010 is to punch a plurality of holes in an edge portion 1014 of a stack of documents 1016 for receipt of a binding element for binding the stack together. Such documents may include, but are not limited to, business reports, photographs, presentations, plastic films, a cover leaf for the front and/or back of the stack, or any other conceivable substrate that one would want punch holes in for the purpose of receiving a binding element for binding them together. The apparatus 1010 may include a binding apparatus 1018, but may also be a standalone punching apparatus that does not include the binding apparatus 1018. In that event, the user would use a separate binding apparatus for applying a binding element to the holes of the stack, or may even apply the binding element manually.

The apparatus 1010 comprises a frame 1020. A housing is provided to house the internal components of the apparatus 1010. The frame 1020 may have any suitable construction for mounting the various components of the apparatus 1010, and may be made from metal, any other suitable material, or any combination of materials. The frame 1020 is only shown in part and the housing is not shown at all so that the internal components of the apparatus can be clearly seen. It can be readily appreciated that the housing would be configured so as to house the internal components, yet provide access to components needed for operation. For example, the housing would have an open area on its top wall to enable the user to load the stack of documents into the document support member 1022, discussed below. Also, the housing may be removable, or have a removable or openable section, such as a lid, for enabling a user to access the internal components of the apparatus 1010. This would be desirable for periodically replacing dulled punches, or removing document segments (i.e., chads) that have been punched out from document stacks.

The document support 1022 provides a document supporting surface configured to receive the stack of documents 1016 in a punching position, shown throughout the Figures. In this punching position, the edge portion 1014 of the stack 1016 of documents extends in a longitudinal direction. The edge of the stack being punched could be either the long side, e.g., the 11 inch side in a stack of 8.5 inch×11 inch documents, or the short side, e.g., the 8.5 inch side in such a stack, and thus the term longitudinal direction does not refer to the long side of a stack, but rather refers to the direction in which the punches are arrayed. In the illustrated embodiment, the document support 1022 has two opposing walls 1024, 1026 and an edge alignment wall 28 extending between the two opposing walls 1024, 1026 in the longitudinal direction. As the illustrated embodiment is designed to be "top loading" (i.e. the stack of documents are in a generally vertical orientation when in the punching position, as illustrated), the two opposing walls 1024, 1026 extend generally vertically and the edge alignment wall 1028 extends generally horizontally. The document supporting surface in that case is defined by both the first wall 1024 and the edge alignment wall 1028. The edge alignment wall 1028 supports the stack 1016 from the bottom, and the first wall 1024 provides some support to help maintain the stack 1016 upright, as well as supporting the stack 1016 against movement in the punching direction during the punching operation.

As an optional feature, a vertical guide (not shown) may be provided. This guide would extend generally vertically above the document support 1022 to provide additional support to the document stack 1016 and help keep it upright in its generally vertical orientation. Possibly, two parallel guides could be provided for this purpose. One of the guides would preferably have its surface aligned with the surface of the first wall 1024 to ensure that the stack 1016 is properly seated against the first wall 1024.

The edge alignment wall 1028 enables an end of the edge portion 1014 to be abutted against it for aligning ends of the documents in the stack 1016 in a plane parallel to the punching and longitudinal directions. This can best be seen in FIGS. 55 and 56. The punching direction is the direction in which the punches 1012 move during the punching operation, and in those Figures it is in the right to left direction. The longitudinal direction is the direction in which the edge portion 1014 of the stack 1016 is oriented, and in those Figures that direction is perpendicular to the drawing. The plane in which the edge alignment wall 1028 aligns the ends of the documents in the stack is the plane defined by the surface of the edge alignment wall 1028 (which is horizontal in the illustrated embodiment).

The document support 1022 further comprises a perpendicular edge alignment wall 1030 provided at a longitudinal end thereof. The wall 1030 enables a longitudinal end of the edge portion 1014 to be abutted against it for aligning the ends of the documents in the stack 1016 in a plane perpendicular to the longitudinal direction and parallel to the punching direction. This plane is defined by the surface of the perpendicular edge alignment wall 1030 against which the stack is abutted (which is vertical in the illustrated embodiment). This wall 1030 is an optional feature, but is preferred to ensure that the documents in the stack are completely aligned to provide for a quality end product. The wall 1030 may be a separate structure attached by a fastener 1032, such as a screw or bolt, or it may be formed integrally as part of the document support 1022.

Preferably, but not necessarily, the spacing between the first and second walls 1024, 1026 is selected to correspond to the maximum capacity of the apparatus 1010. That is, the spacing corresponds to the thickest stack 1016 of documents that the apparatus 1010 is designed to punch. Such a design feature is beneficial for preventing a user from putting too thick of a stack 1016 into the document support member 1052, as exceeding maximum capacity could result in the failure or fatiguing of various components of the apparatus 1010. Of course, the apparatus 1010 may be design to have any desired capacity, but for any given apparatus 1010 there will be a maximum capacity. Thus, it is desirable, but not necessary to design the spacing between the walls 1024, 1026 to limit the thickness of the stack 1016 loaded into the document support 1022. Other ways of achieving this may also be used.

In the illustrated embodiment, the second wall 1026 of the two opposing walls 1024, 1026 has a plurality of openings 1034 formed therethrough in the punching direction and facing towards the first opposing wall 1024. This is best seen in FIGS. 49-51, 55, and 56. The number of openings 1034 corresponds to the number of punches 1012. The punches 1012 and the openings 1034 are arranged such that the punching ends 1036 of the punches 1012 travel through the openings 1034 as the punches 1012 are moved in the punching direction during the punching operation, discussed below. Each of the openings 1034 has an internal shape matching an external shape of the punching end 1036 of an associated punch 1012, thereby guiding the punching ends 1036 as the punches 1012 are moved in the punching direction during the punching operation. This configuration may also serve to prevent any deflection or off-center movement of the punching ends 1036 during the punching operation, which in turn helps to ensure that the force applied to the punches 1012 is effectively used and also helps to ensure that the holes being formed are cleanly punched.

Figure 56:
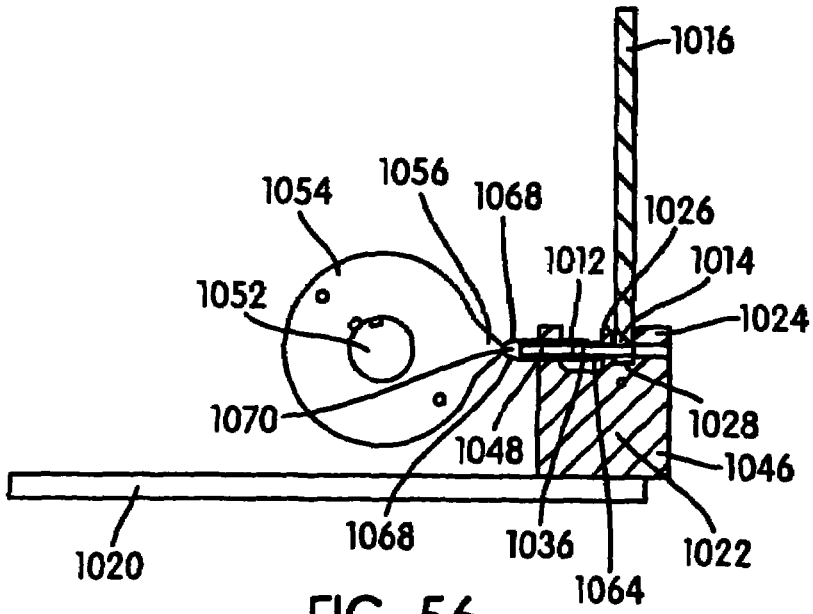
FIG. 56 is a side view similar to FIG. 55, but showing a camming portion of a cam engaging the punch in a camming action to move the punch in a punching direction to form a hole in the stack of documents.

The first wall 1024 also has a plurality of openings 1038 respectively aligned with the openings 1034 in the second wall 1026. The openings 1038 in the first wall enable the punching ends 1036 of the punches 1012 to travel entirely through the edge portion 1014 of the stack 1016. Specifically, the punching ends 1036 can enter into the openings 1038, as shown in FIG. 56, thus ensuring a complete punching of the stack 1016. While this is an optional feature, the use of these openings 1038 is an improvement over using a solid wall 1024, acting as an anvil surface, because the edge of the punching ends 1036 may become dulled by repeated contact with the solid wall. Alternatively, a solid wall could be used, or the wall could be provided with a deformable material that accommodates some movement of the punching ends 1036 beyond the stack 1016.

Preferably, but not necessarily, the openings 1038 have an internal shape matching the external shape of the punching ends 1036 of the punches 1012. This ensures that as the punching ends 1036 enter these openings 1038, the ends of the holes being formed do not become flared. Specifically, if the openings 1038 were oversized relative to the punching ends 1036, as the punching ends 1036 move through the stack 1016 and into the openings 1038, portions of the documents at the ends of the holes may be deformed slightly into the openings 1038, thus creating a slight flare. By matching the openings 1038 to the punching ends 1036, this flaring is prevented because the wall 1034 supports the portions of the documents surrounding the holes, and there is no space in the openings 1038 to accommodate the flaring.

The document support 1022 has a third wall 1040 spaced from the second wall 1026 in a direction opposite the first wall 1024. The third wall 1040 has a plurality of openings 1042 formed therethrough in the punching direction and respectively aligned with the openings 1034 formed through the second wall 1026. The punches 1012 and the openings 1042 on the third wall 1040 are arranged such that the driving ends 1044 of the punches 1012 travel through the openings 1042 as the punches 1012 are moved in the punching direction during the punching operation. Each of the openings 1042 of the third wall 1040 has an internal shape matching an external shape of the driving end 1044 of an associated punch 1012, thereby guiding the driving ends as the punches are moved in the punching direction during the punching operation. Like the openings 1034 in the second wall 1026, this configuration may also serve to prevent any deflection or off-center movement of the driving ends 1036 during the punching operation, which in turn ensures that the force applied to the punches 1012 is used effectively to drive the punches 1012 and also helps to ensure that the holes being formed are cleanly punched.

In the illustrated embodiment, the document support 1022 has a solid base 1046 and the walls 1024, 1026, and 1028 extend vertically from the base 1046 and are formed integrally therewith. Preferably, the document support 1022 is made from a rigid metal, but other suitable materials may be used.

Also, the document support 1022 and walls 1024, 1026, 1028, and 1040 may have any length in the longitudinal direction. Preferably, this length is over 11 inches, so that 8.5 in.×11 in. documents can be accommodated lengthwise. More preferably, the length is sufficient to accommodate 8.5 in.×11 in. documents lengthwise. However, any other suitable length may be used, and these examples are provided as common examples.

The illustrated document support 1022 should not be regarded as limiting and it may have any construction or configuration. For example, the document support 1022 could be oriented at an angle, so that the stack 1016 is received at an angle in an inclined orientation in its punching position. Likewise, the document support 1022 could be oriented so that the stack 1016 is oriented horizontally in its punching position. In such a horizontal orientation, only one surface would need to serve as the document supporting surface 1022, as the edge portion 1014 of the stack 1016 would be resting on the same surface which the punches will force it against. Any other variations on the document support may be practiced within the scope of the invention, and the term document support is a generic structural term intended to encompass all such structures that serve to provide support to the stack 1016 during the punching operation.

The plurality of punches 1012 are provided in a row extending in the longitudinal direction. These punches 1012 are respectively aligned with the openings 1034, 1038, and 1040, as discussed above. As mentioned above, each punch 1012 comprises a punching end 1036 and a driving end 1044. The punch end 1036 is configured to punch through the stack 1016 of documents in the punching direction, which is generally perpendicular to the longitudinal direction. This punching action forms the plurality of holes in the edge portion 1014 of the stack of documents 1016. The punching end 1036 may be made of a thin tubular metal wall and its free edge may be sharpened to facilitate penetration of the documents, which in turn reduces the amount of force that needs to be applied to the punches. The drive end 1044 may be made of a thicker tubular metal wall to facilitate receiving the driving force from the cams, as discussed below. The punching end 1036 may be welded, threaded, press-fit, or otherwise attached to the driving end 1044. Likewise, the structures could be made a one-piece unit if desired.

Each punch also has an internal bore 1048 extending therethrough from the punching end 1036 to the driving end 1044. The bore 1048 is open to the punching end 1036 for enabling document segments punched from the stack 1016 of documents to pass therethrough as the punch 1012 is driven through the edge portion of the stack of documents.

The punches 1012 are preferably equally spaced from one another so that the pitch of the holes formed in the document stack 1016 is essentially equal throughout its length. One preferred pitch is essentially 16.5 mm, as is discussed above. Another desirable pitch is essentially 25.8 mm. Although other pitches may be used, a pitch of 16.5 mm or 25.8 mm is desirable because the spacing between the opposing ends of the document stack and the punched holes will have an aesthetically pleasing appearance on both A4 and 8.5 inch×11 inch documents, particularly when the long side of the documents are punched. That is, the spacing between the punched holes at the opposing ends of the series of holes will be adequately spaced from the ends of the document stack, and the spacing will not be too far from or too close to the ends of the documents, irrespective of whether A4 or 8.5 inch×11 inch documents are used. With a 16.5 mm pitch, the long side of a stack of A4 documents would be punched with eighteen holes, and the long side of a stack of 8.5 inch×11 inch documents would be punched with seventeen holes. With a 25.8 mm pitch, the long side of a stack of A4 documents would be punched with twelve holes, and the long side of a stack of 8.5 inch×11 inch documents would be punched with eleven holes. Other pitches that are suitable for this purpose are described herein.

Other details concerning the punches 1012 will be provided after discussing the punch drive system 1050.

The punch drive system 1050 of the apparatus 1010 comprises a shaft 1052 extending in the longitudinal direction, one or more cams 1054 fixed on the shaft 1052, and a driver 1058 for selectively rotating the shaft 1052. In the illustrated embodiment, the one or more cams includes a plurality of cams 1054 fixed on the shaft 1052 in a row extending in the longitudinal direction. The number of cams 1054 corresponds to the number of punches 1012, and each cam 1054 is associated with a respective punch 1012. Each cam 1054 is positioned adjacent the driving end 1044 of its associated punch 1012. Further, each cam 1054 has a camming portion 1056 configured to apply force to its associated punch in the punching direction by engaging the driving end 1044 thereof in a camming action as the shaft 1052 is rotated. This camming action drives the punching ends 1036 of the punches through the edge portion 1014 of the stack of documents 1016 to form the plurality of holes. As can be seen best in FIGS. 47, 49, 55 and 56, the shaping of these camming portions 1056 is eccentric with respect to the rotational axis of the shaft 1052 and they extend radially with respect to the shaft 1052.

At least two of the cams 1054 are mounted to the shaft 1052 with their camming portions 1056 angularly offset from another such that their camming portions 1056 engage the driving ends 1044 of their associated punches 1012 in the camming action at different times during the rotation of the shaft 1052. This reduces the number of punches 1012 being driven into the stack 1016 at any one time, which in turn reduces the amount of torque that needs to be applied to the shaft 1052 to effect punching. Some of the camming portions 1056 may be angularly aligned with one another so that multiple punches 1012 are driven into the stack 1016 at the same time, but it is preferred to minimize the number of angularly aligned camming portions 1056 to reduce number of punches being driven at any one time (although some may be driven at the same time), and hence reduce the amount of torque that needs to be applied to the shaft 1052. Preferably, a majority of the cams 1054 are mounted to the shaft 1052 with their camming portions 1056 angularly offset from one another. More preferably, all the cams 1054 are mounted to the shaft 1052 with their camming portions 1056 angularly offset from one another, as is shown in the illustrated embodiment.

Whatever the arrangement of the cams 1054 and their camming portions 1056, it is desirable to provide one angular section of the row of cams 1054 where no camming portions 1056 are provided. This angular section ensures that all the punches 1012 can be withdrawn from the stack 1016 at the same time, thus allowing the stack 1016 to be removed from the document support 1022. Likewise, this will allow an unpunched stack 1016 to be placed into the document support 1022. This section can be best seen in the side view of FIG. 47, where the section is located in the upper right quadrant of the row of cams 1054.

To key the cams 1054 onto the shaft 1052, the shaft 1052 has a polygonal cross-section and the openings in the cams 1054 have matching shapes. When the cams 1054 are received on the shaft 1052, the interface between the shaft 1052 and the cam openings will prevent rotation of the cam 1054 relative to the shaft 1052. Other ways of keying the cams 1054 onto the shaft 1052 may be used, and this example is not intended to be limiting.

As can be seen in the Figures, the shaft 1052 is rotatably supported at its axial ends on a pair of journal supports 1055. These journal supports 1055 are fixedly mounted to the frame 1020. However, any other suitable arrangement for supporting the shaft 1052 may be used.

Other arrangements of the cams 1054 may be practiced, and the illustrated embodiment is not intended to be limiting. For example, the cams 1054 could have the same general configuration, but be made wider to engage and drive multiple punches 1012 at once, thus resulting in fewer cams 1054 each associated with multiple punches 1012. Also, the shaping of these wider cams could be altered so that their camming portions 1056 are angularly offset with respect to one another, thus also resulting in fewer cams 1054, but avoiding having the same cam 1054 driving more than one punch 1012 at a time. Further, there could be one single cam associated with all the punches 1012 and having a plurality of camming portions 1056 formed thereon. Preferably, these camming portions 1056 would be angularly offset with respect to one another, as discussed above. However, for a low capacity apparatus, or one with few punches 1012, this single cam could have one continuous camming portion 1056 extending longitudinally along its length for engaging all the punches 1012. This would simplify manufacturing and assembly, although it would increase the amount of torque that needs to be applied to the shaft 1052, as all the punches 1012 would be driven at once. Other such variations may be practiced within the scope of the invention, and these alternatives are not intended to be limiting.

Preferably, the driver 1058 includes a motor 1060 coupled to the shaft 1052 for selectively rotating the shaft 1052. To increase the torque output by the motor 1060, the driver includes a reduction transmission 1062 coupling the motor 1060 to the shaft 1052. The motor 1060 is preferably electrically powered, and may be controlled by a controller (not shown). The motor 1060 may be of any type, and suitable motors 1060 are well known. Thus, specifics of the motor 1060 are not detailed in this application. The reduction transmission may also be of any type, and the one illustrated uses a variety of intermeshed gears to increase the torque being applied to the shaft 1052. Similarly to the motor 1060, suitable reduction transmissions are well known, and thus the specifics of the transmission 1062 are not detailed in this application. The choice of the motor 1060 and transmission 1062 would be determined by the amount of torque required to drive the shaft 1052 for performing the punching operation. This torque in turn is dictated by the maximum capacity of the apparatus 1010, the force required to drive each punch 1012 through a stack 1016 of that maximum capacity, and the number of punches 1012 being driven into the stack 1016 at any one time.

In the Figures, the motor 1060 and transmission 1062 are mounted on support structure 1063, which may be part of the frame 1020. However, any suitable mounting bracket or other structure may be used. For example, the support structure 1063 may be formed as a one-piece integral structure with other parts of the apparatus, such as the frame 1020, the journal supports 1055, the document support 1022, and any other structures. However, the invention is not intended to be limited in this respect to any particular construction.

As mentioned above, the motor 1060 may be controlled by a controller. This controller is preferably operates to control the motor 1060 such that the motor 1060 rotates the shaft 1052 through a single rotation during each punching operation. A single rotation ensures that all the punches 1012 are driven through the document stack 1016, but avoids the need for repeating the driving of each punch 1012. This control may be achieved in any suitable manner. For example, the shaft 1052 could be provided with a slit plate on an axial end thereof, and an optical sensor coupled to the controller could monitor the rotation of the shaft 1052 and stop rotation once a single full rotation is completed. In one embodiment, the slit plate could have a single slit that aligns with and is sensed by the optical sensor when the angular section of the cams 1054 with no camming portions 1056 is positioned adjacent the punches 1012. The controller would cease rotation of the shaft 1052 each time this single slit is encountered, thus ensuring that each punching operation includes a single full rotation of the shaft 1052, and also ensuring that the angular section with no camming portion 1056 is positioned adjacent the punches 1012 at the end of each rotation. This allows all the punches 1012 to be withdrawn from the stack 1016, thus allowing the punched stack 1016 to be removed and a new stack 1016 to be loaded into the document support 1022. Such monitoring of the shaft 1052 may also be accomplished by a Hall effect sensor, mechanical switches/contacts or any other suitable device. Likewise, instead of monitoring the shaft 1052, any gear in the transmission 1062 or the rotation of the motor 1060 could be monitored. Further, the controller could simply be designed to rotate the motor 1060 a sufficient number of times to achieve a single rotation with no positional feedback from a sensor.

The controller may be coupled to a control panel provided on the exterior of the housing. Such a control panel would have a manual switch that the user engages the signal the controller to commence the punching operation. However, any suitable way of commencing punching may be used.

In some variations of the invention, it is possible to use a manual lever or crank as the driver 1058 for effecting rotation of the shaft 1052. Such a lever or crank would preferably, but not necessarily be coupled to the shaft 1052 by a reduction transmission, such as transmission 1062 or any other suitable transmission. This alternative may have applicability to low cost, low capacity punching apparatuses 1010.

The apparatus 1010 further comprises a plurality of springs 1064 associated with the punches 1012. As can be seen in the Figures, the number of springs 1064 equals the number of punches 1012. Each spring 1064 biases an associated punch 1012 opposite the punching direction to withdraw the punches 1012 from the edge portion 1014 of the stack 16 of documents after the camming action. Specifically, as the punch 1012 is cammed and the peak of the camming portion 1056 moves past it, the associated spring 1064 will bias the punch 1012 opposite the biasing direction to withdraw it from the stack 1016. Any suitable metal or non-metal spring may be used.

Figure 52:
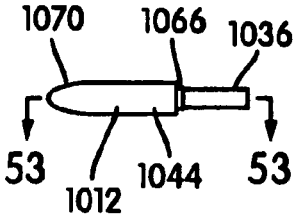
FIG. 52 is a side view of a punch used in the punching apparatus of FIG. 44.
Figure 54:
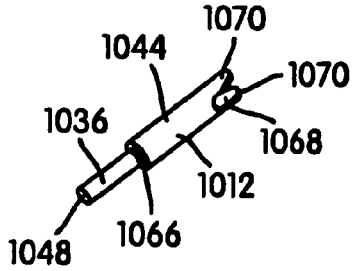
FIG. 54 is a perspective view of the punch shown in FIG. 52.
Figure 53:
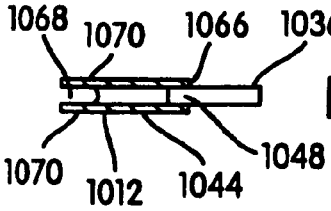
FIG. 53 is a cross-section taken along line 53-53 in FIG. 52.
Figure 55:
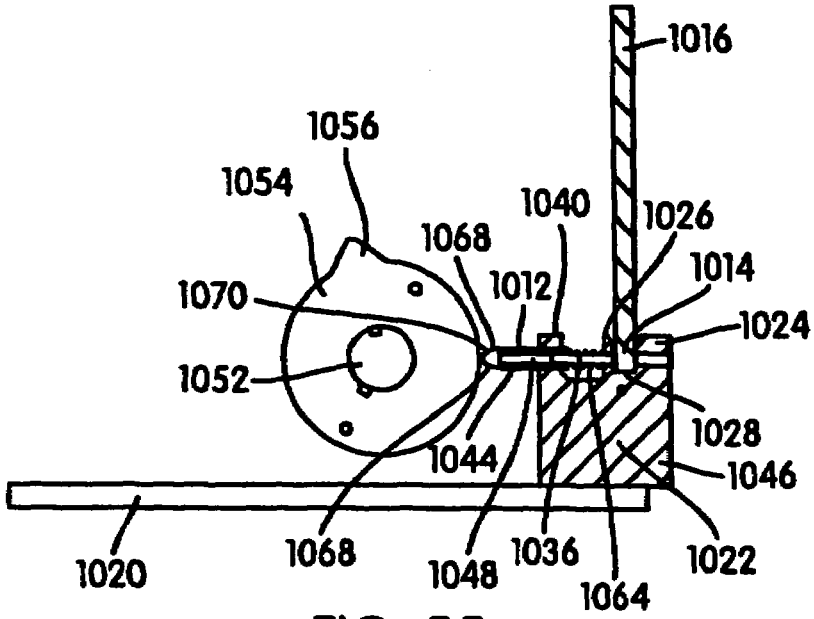
FIG. 55 is a side view showing a cross-section of the document support and one punch to show the punch in the withdrawn position prior to punching the stack of documents.

In the illustrated embodiment, the driving end 1044 of each punch 1012 is wider than the punching end 1036 to define a shoulder 1066 therebetween (see FIGS. 52-54). Each spring 1064 is a coil spring received over the punching end 1036. These springs 1064 each have one end engaged with the shoulder 1066 of an associated punch 1012, and an opposite end engaged with the second wall 1026 of the document support 1022, or some other fixed surface of the apparatus 1010. However, the illustrated springs 1064 are not intended to be limiting and any other suitable arrangement may be used for biasing the punches 1012 opposite the punching direction to withdraw them from the stack 1016 after punching the same.

As can be seen best in FIGS. 52-56, at least one relief opening 1068 is provided for each associated punch 1012 and camming portion 1056. The relief opening 1068 is communicated to the internal bore 1048 at least when the camming portion 1056 is engaged in the camming action with the driving end 1044 of the punch 1012 for enabling the document segments passing through the internal bore 1048 to exit the internal bore 1048. This relief opening 1068 may have any configuration and may have any location, such as on the cam portion 1056, on its associated punch 1012, or be defined partly by both. In the illustrated embodiment, the driving end 1044 of each punch 1012 has a pair of spaced apart walls 1070 defining at least one opening 1068 facing to a side of the punch 1012. This opening 1068 defined by the spaced apart walls 1070 provides the relief opening for each punch by enabling the document segments passing through the internal bore 1048 to exit therefrom. The ends of the walls 1070 are engaged by the camming portions 1056 of the cams 1054 in the camming action as the shaft 1052 is rotated to thereby drive the punching end 1036 thereof through the edge portion 1014 of the stack 1016 of documents.

In the illustrated punch 1012, the spaced apart walls 1070 define a pair of such openings 1068 facing to opposing sides of the punch 1012, thus providing a pair of relief openings 1068 for each punch 1012. However, the punch 1012 could have only a single relief opening 1068. Other variations on the construction of this relief opening can be used. For example, the driving end 1044 could be closed off, and the relief opening could be provided as a bore in the side of the punch 1012 that communicates with the bore 1048. Preferably, a contour inside the bore 1048 would be provided to urge the segments laterally out from that relief opening. Thus, the relief opening in this alternative would not interface with the cam portion 1056. However, the illustrated construction with spaced apart walls 1070 does have the advantage of using the contour of the camming portion 1056 to facilitate discharge of the punched document segments (i.e., chads). Specifically, as the segments reach the driving end 1044 of the punch 1012 and contact the surface of the camming portion 1056, the contour of the camming portion 1056 will urge the segments to move laterally out of one of the openings 1068. Generally, the document segments will be urged in the direction the cam 1054 is rotating, as the sloped surface of the camming portion 1056 facing in that direction is the surface that is engaged with the driving end 1044 as the punching end 1036 is being driven through the stack 1016. It is during this time that the document segments are advanced through the bore 1048, because the new segments being punched will displace the segments already received in the bore and force them towards the driving end 1044. This avoids the manufacturing challenge associated with providing a contour inside the bore 1048, but it is still within the scope of the invention to use such a construction.

By providing the relief opening 1068 for each punch 1012, the invention achieves the significant advantage of enabling punches with internal bores to be used in the context of a cam-driven punching apparatus. The relief opening 1068 allows each camming portion 1056 to engage the driving end 1044 of its associated punch 1012 without interfering with the ability of the punched document segments to exit from the internal bore 1048 as the punch 1012 is being driven through the stack of documents 1016. This is beneficial because, generally, the punched segments in the bore 1048 are tightly compressed and it is only during the time that the punch 1012 is being driven that these segments are moved through the bore 1048 by the entering of new ones via the open end of the punching end 1036. Thus, providing the relief opening 1068 allows the punched segments at the driving end 1044 to exit the bore 1048, so that the newly punched segments can enter at the punching end 1036. This allows the punching apparatus 1010 to punch through a stack of documents with a lower force while still using a cam-driven construction.

As another alternative, a wider bore (not shown) could provided in the driving end 1044 in direct alignment with the bore 1048 in which the punched segments are tightly compressed. As the punched segments are passed into this wider bore, they will no longer be tightly compressed against the interior surface of a bore, and can more easily exit from the punch 1012. Such a wider bore would also be considered a relief opening. Although this approach could be used in other contexts, this would be better applied to an apparatus where the stack is received horizontally or at an inclined angle, as then the punches 1012 may be oriented with this wider bore facing at least partly downwardly to allow the segments received in the wider bore to just fall out by gravity as the camming portion 1056 disengages the driving end 1044.

In some constructions, a beneficial feature would be to provide a device for neatly collecting the punched segments discharged from the relief opening. For example, such a device could be a removable tray disposed vertically beneath the punches 1012. In such a construction, the user could just pull the tray out from the housing and empty the same periodically. Likewise, a sloped surface could be provided underneath the punches 1012 to receive the discharged segments and guide them to a collection area or tray at the side of the apparatus where they can be discarded periodically by the user. Any suitable device for managing the punched segments may be used, and the invention is not intended to be limited in this respect.

For example, a mechanical sweeper could be used to push the punched segments out towards the side of the machine, where an easily accessible receptacle may be located. Such a sweeper may be mechanically linked to the shaft 1052 so as to push the punched segments once per rotation of the shaft 1052. Instead of providing a receptacle for receiving the punched segments, a clear window could be provided on the side of the apparatus so the user can see the punched segments, and tell when the segments need to be removed. Also, a "breakaway" door could be used at the side of the apparatus, and it would push open when the punched segments pile up against it and the action of the sweeper applies enough force to open the door. Further, a sensor, such as an optical sensor or mechanical sensor, could be used to determine when the punched segments have collected above a certain level. This sensor could be used with a sweeper, or without it. Other variations are possible, and the use of such devices for managing the punched segments is not necessary.

Figure 57:
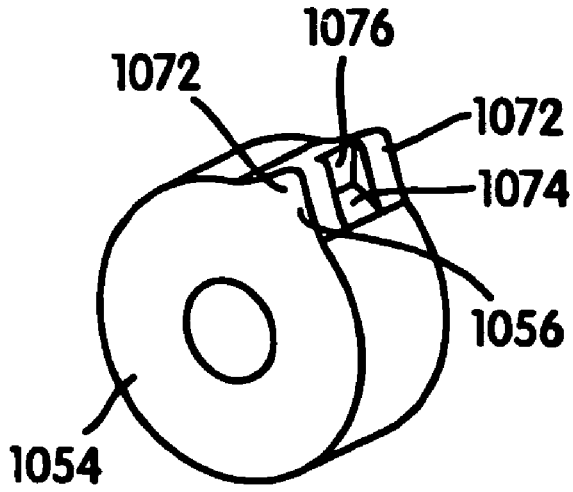
FIG. 57 is a perspective view of an alternative cam that can be used in the punching apparatus of FIG. 44.
Figure 58:
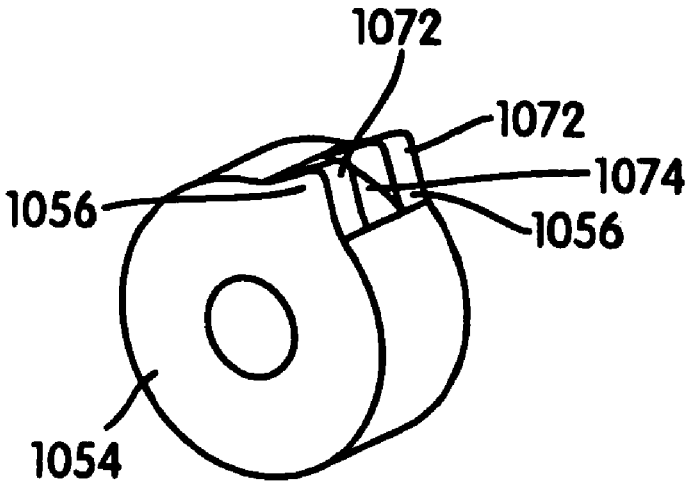
FIG. 58 is a perspective view of yet another alternative cam that can be used in the punching apparatus of FIG. 44.

As yet another alternative, the relief openings could be provided on the camming portions 1056 of the cams 1054. FIGS. 57 and 58 show two non-limiting variations of this. In each of these Figures, the camming portion 1056 of each cam 1054 has a pair of spaced apart walls 1072 defining a segment receiving space 1074 open both radially and circumferentially with respect the cam 1054. The walls 1072 are configured to apply the force to the associated punch 1012 by engaging the driving end 1044 thereof in the camming action as the shaft 1054 is rotated. When the camming portion 1056 engages the driving end 1044 of its associated punch 1012 in the camming action, the internal bore 1048 of the punch 1012, which is open to the driving end 1044 thereof, becomes aligned with the segment receiving space 1074 of the camming portion 1056. This allows the document segments passing through the internal bore 1048 during the punching operation to exit the internal bore 1048 into the segment receiving space 1074. The segment receiving space 1074 provides the relief opening for each camming portion by enabling the document segments entering the segment receiving space to exit circumferentially therefrom.

In the embodiment of FIG. 57, a transverse wall 1076 connects the two walls 1072, thus providing additional structural strength to the camming portion 1056. In the embodiment of FIG. 58, this transverse wall 1076 is omitted. The advantage of the embodiment of FIG. 57 is that it is stronger, but it should be mounted to the shaft 1052 so that the segment receiving space 1074 faces in the direction the cam 1054 is rotated during punching to ensure that the punched segments can be received therein. The embodiment of FIG. 58, while omitting the strengthening transverse wall 1076, can be mounted in either orientation, as its segment receiving space 1074 faces in both directions. However, these examples are not intended to be limiting, and any other configuration for providing a relief opening may be used. For example, other shapes may be used. Likewise, instead of providing the opening on just the cam or just the punch, it may be defined partly by the punch, and partly by the cam. A variety of other constructions may be used.

Figure 59:
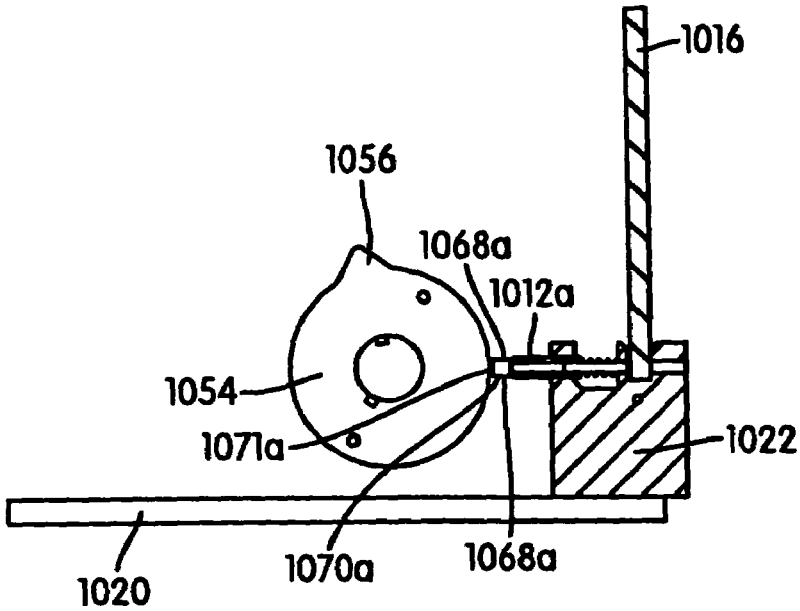
FIG. 59 is a cross-sectional view similar to FIG. 55, but showing an alternative punch.
Figure 60:
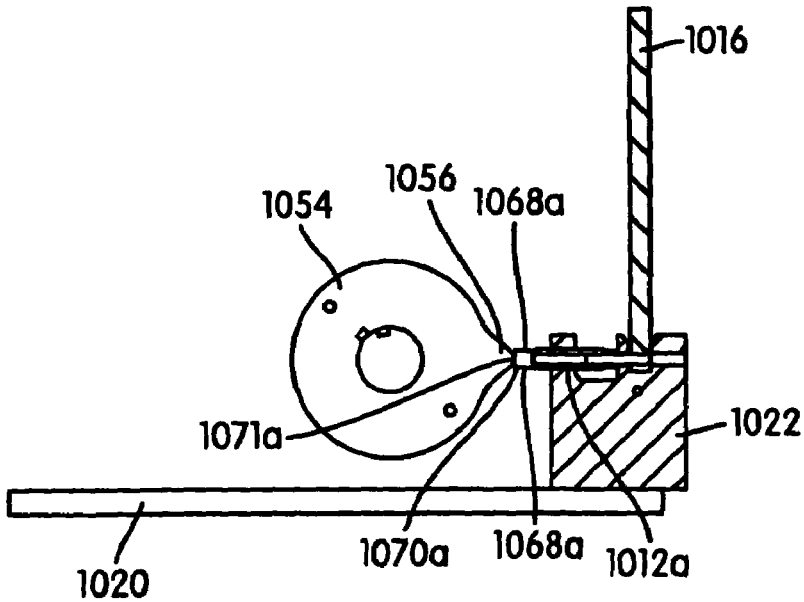
FIG. 60 is a cross-sectional view similar to FIG. 59, but showing the alternative punch of FIG. 59.

FIGS. 59 and 60 show another alternative arrangement for the punch. The punch 1012*a* of FIGS. 59 and 60 is generally similar to punch 1012 discussed above, and thus the same reference numerals will be used in FIGS. 59 and 60, but with an "a" added. The punch 1012*a* has spaced apart walls 1070*a* that define a pair of relief openings 1068*a*, similarly to the previous embodiment. However, instead of having the end surfaces of the walls 1070*a* sloped on opposing sides, the end surfaces 1071*a* of the walls 1070*a* are sloped from one side to the other at an angle relative to the punches' axis, as can be seen in FIGS. 59 and 60. This is beneficial because it allows the camming portion 1056 to maintain more contact with the sloped end surfaces 1071*a* at or near the axis of the punch 1012*a* (which axis extends in the punching direction), thereby focusing the force delivered to the punch 1012*a* along that axis. The sloped end surfaces 1071*a* illustrated in FIGS. 59 and 60 are shown as being flat, but may be made slightly convex or concave, if desired. Of course, the end surfaces 1071*a* should be angled so that they face towards the camming portion 1056 approaching it so that the camming portion 1056 can properly engage it in a camming action.

Figure 61:
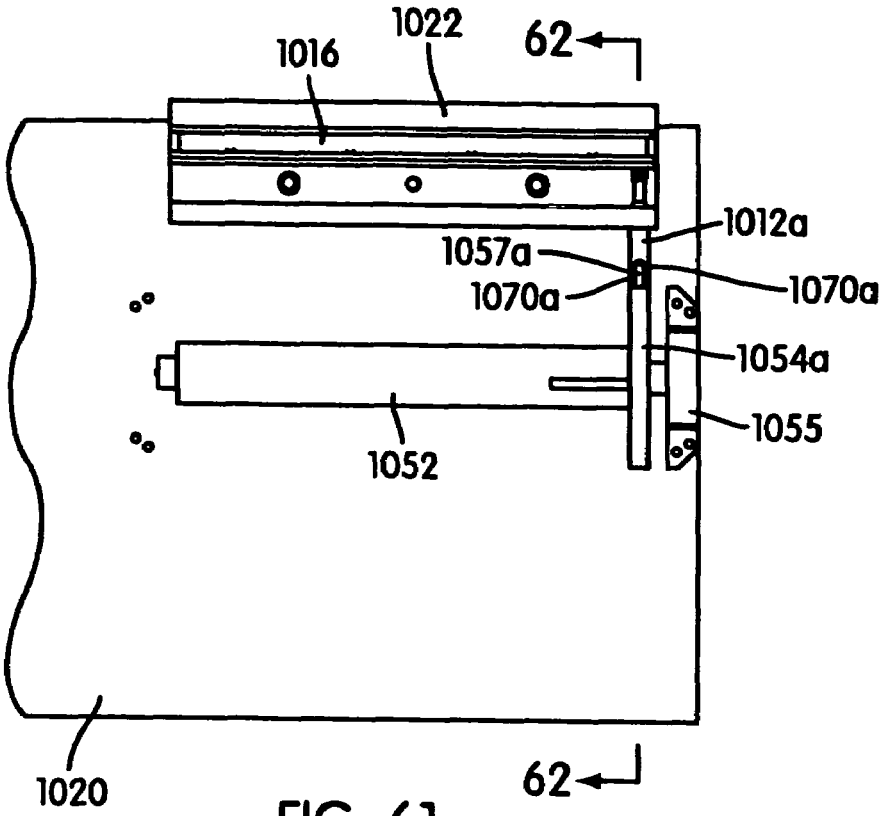
FIG. 61 is a top view showing selected parts of an alternative embodiment.
Figure 62:
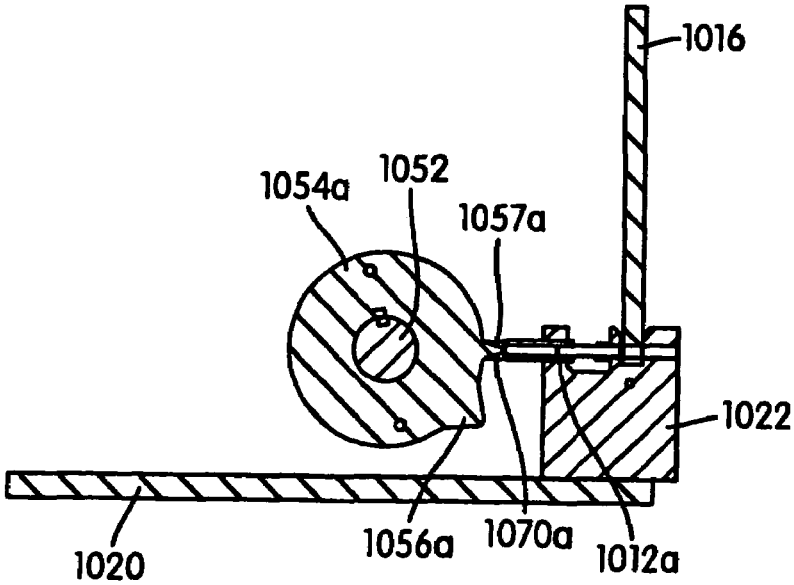
FIG. 62 is a cross-sectional view taken along line 62-62 in FIG. 61.

FIGS. 61 and 62 show another alternative embodiment for the cam. Because the cam 1054*a* in FIGS. 61 and 62 is generally similar to cam 1054, similar reference numerals will be used in FIGS. 61 and 62, but with an "a" added. The punch shown is punch 1012*a*, discussed above, but the cam 1054*a* can be used with any other punch, such as punch 1012, also discussed above. Like cam 1054, cam 1054*a* has a camming portion 1056*a*. However, in addition to camming portion 1056*a*, the cam 1054*a* also has a punch clearing protrusion 1057*a* extending radially therefrom. The protrusion 1057*a* is configured to pass between the walls 1070*a* of punch 1012*a* so as to clear any punched segments that may have become stuck between the walls 1070*a*. This is beneficial for allowing the punched segments from the punches 1012*a*. The protrusion 1057*a* may be located forwardly of the camming portion 1056*a* in the camming portion's direction of travel, or it may be located rearwardly of the camming portion 1056*a* in its direction of travel. While FIGS. 61 and 62 only show one cam 1054*a*, this is simply for convenience and clarity, and the protrusion 1057*a* may be provided on all the cams. Also, the protrusion 1056*a* may have any shape or configuration for clearing out punched segments from between the walls 1070*a* of the punch 1012*a* (or any other punch that is used).

As mentioned above, the punching apparatus 1010 includes an optional a binding apparatus 1018. This binding apparatus 1018 is constructed to open and apply a binding element (not shown) having an elongated spine and a plurality of fingers to the edge portion 1014 of the document stack 1016 after punching the edge portion 1014. Such a binding element may, for example, be a comb binding element with resilient fingers spaced at pitch essentially equal to the pitch of the punched holes, it may be binding element with relative rigid fingers that snap together at their ends, or it may have any other construction or configuration. Suitable binding apparatuses 1018 are well known for accomplishing this function, and any suitable power-operated or manually driven type may be used.

The fingers of such a binding element would have a pitch essentially matching the pitch of the punched holes. Thus, as discussed above, a binding element having fingers with a pitch of essentially 16.5 mm would be used to bind a stack of documents punched with holes at a pitch of essentially 16.5 mm. Likewise, a binding element having fingers with a pitch of essentially 25.8 mm would be used to bind a stack of documents punched with holes at a pitch of essentially 25.8 mm. The resulting product would be a bound book comprising (a) a stack of documents having a series of holes punched through an edge thereof, the series of holes being spaced apart at the appropriate pitch, and (b) a binding element comprising an elongated spine and a series of fingers spaced apart essentially evenly in the longitudinal direction of the spine with a matching pitch, the fingers extending into and through the holes in the edge of the stack to bind the stack of documents together. The pitch may be the 16.5 mm or 25.8 mm pitch mentioned above, or any other pitch, such as those described hereinbelow.

Other binding elements, such as spiral, wire, double loop wire, etc., may be used to secure documents together. Such binding elements may be applied manually, or using an apparatus, such as apparatus 1018.

The housing described above may also be constructed to conceal various components of the binding apparatus 1018, yet have open areas for loading of the document and the binding element. This is not necessary, but any suitable construction may be used.

As an optional feature, a clamp or other device may grasp the punched stack of paper and move the same into an operative position in the binding apparatus 1018. In this operative position, the stack would be positioned in the binding apparatus for receipt of the bonding element. Such a clamp or other device is beneficial to avoid the need for the user to handle the punched stack when moving it to the binding apparatus 1018. As mentioned above, this feature is optional and not necessary.

Figure 63:
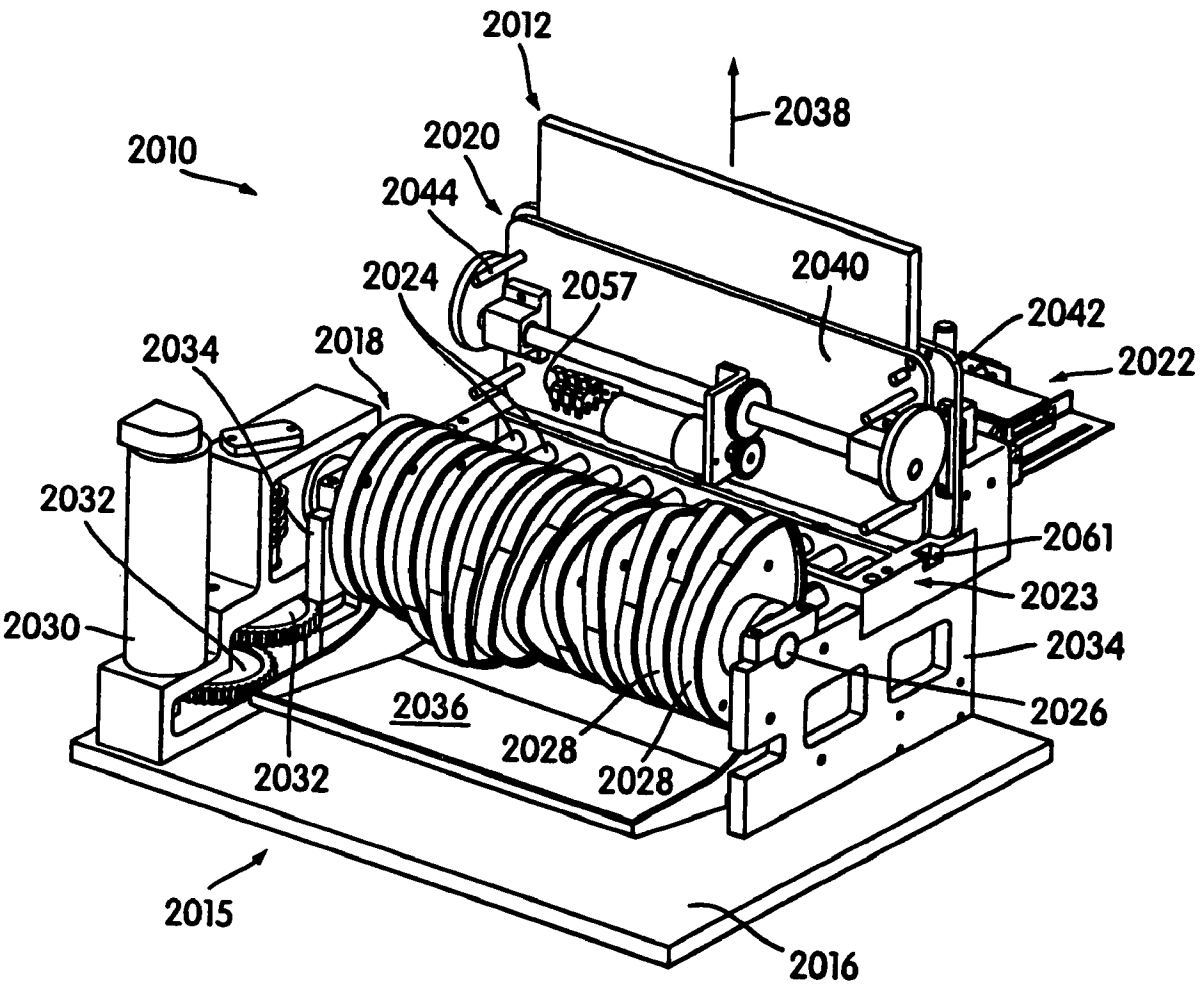
FIG. 63 is a top rear left perspective view of another embodiment of a binding apparatus of the present invention, with a cover removed.
Figure 64:
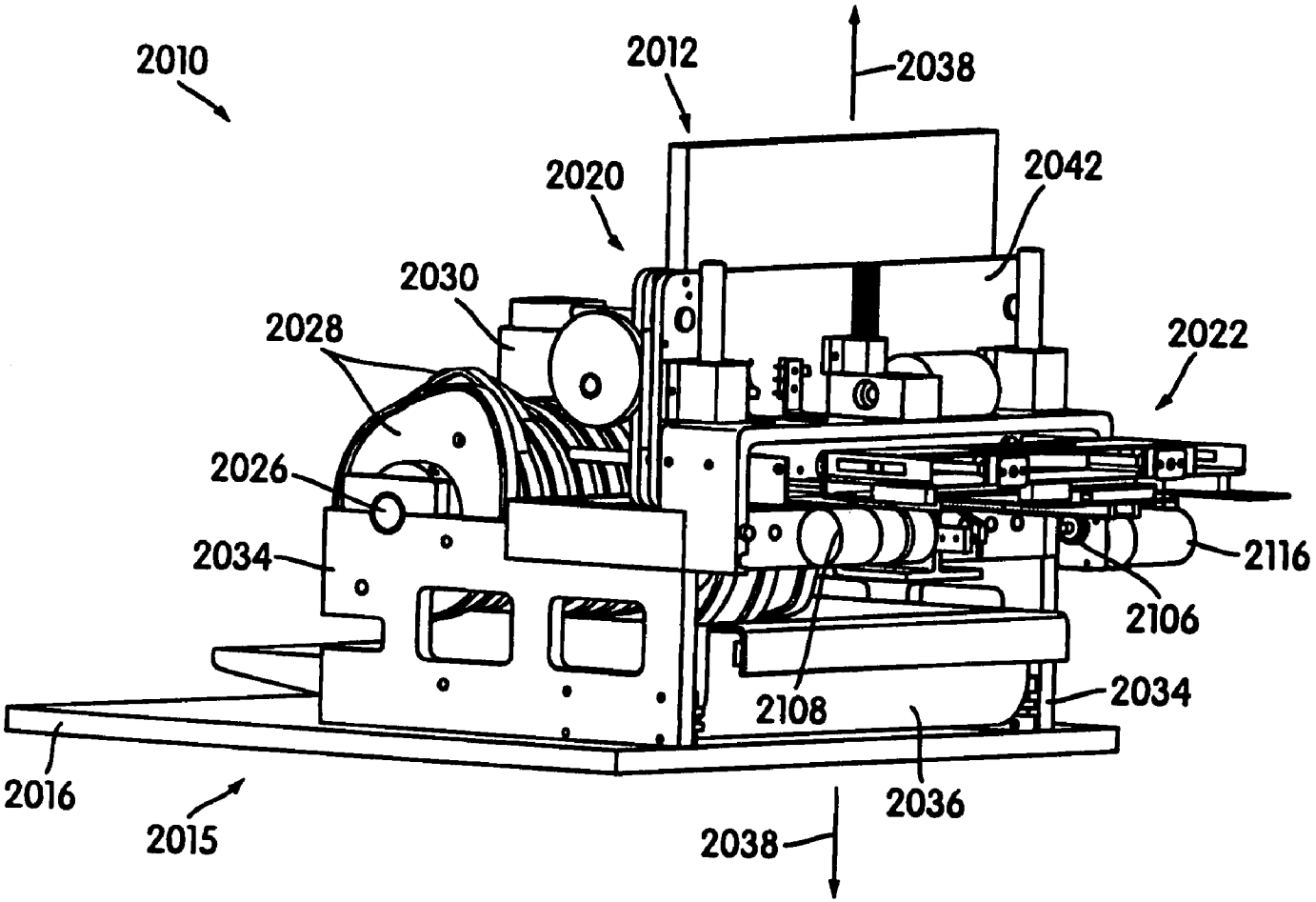
FIG. 64 is a front left perspective view of the binding apparatus of FIG. 63.
Figure 65:
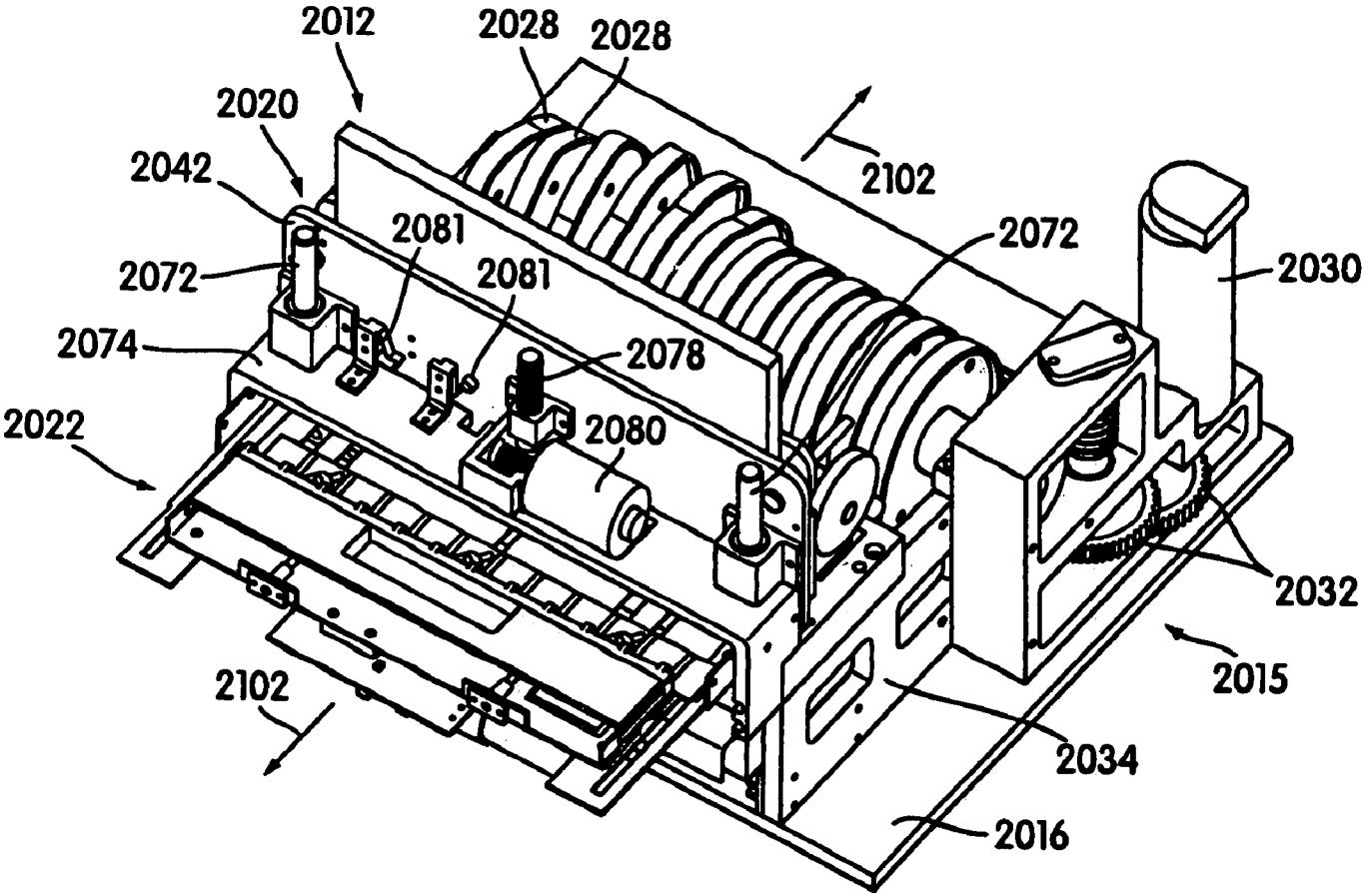
FIG. 65 is a top front right perspective view of the binding apparatus of FIG. 63.

FIGS. 63-65 show another embodiment of a binding apparatus 2010 of the present invention. In FIGS. 63-65, a cover and outer housing of the binding apparatus 2010 has been removed for clarity. The apparatus 2010 is constructed and arranged to bind a plurality of papers or other documents 2012 together with a binding element 2014, as will be discussed in greater detail below. The documents may be of any type, and may include covers, index separators with tabs for separating sections, etc. The apparatus 2010 includes a frame 2015 having a base 2016 that supports a punching mechanism 2018, a paper clamp 2020, and a binding element insertion device 2022.

Figure 104:
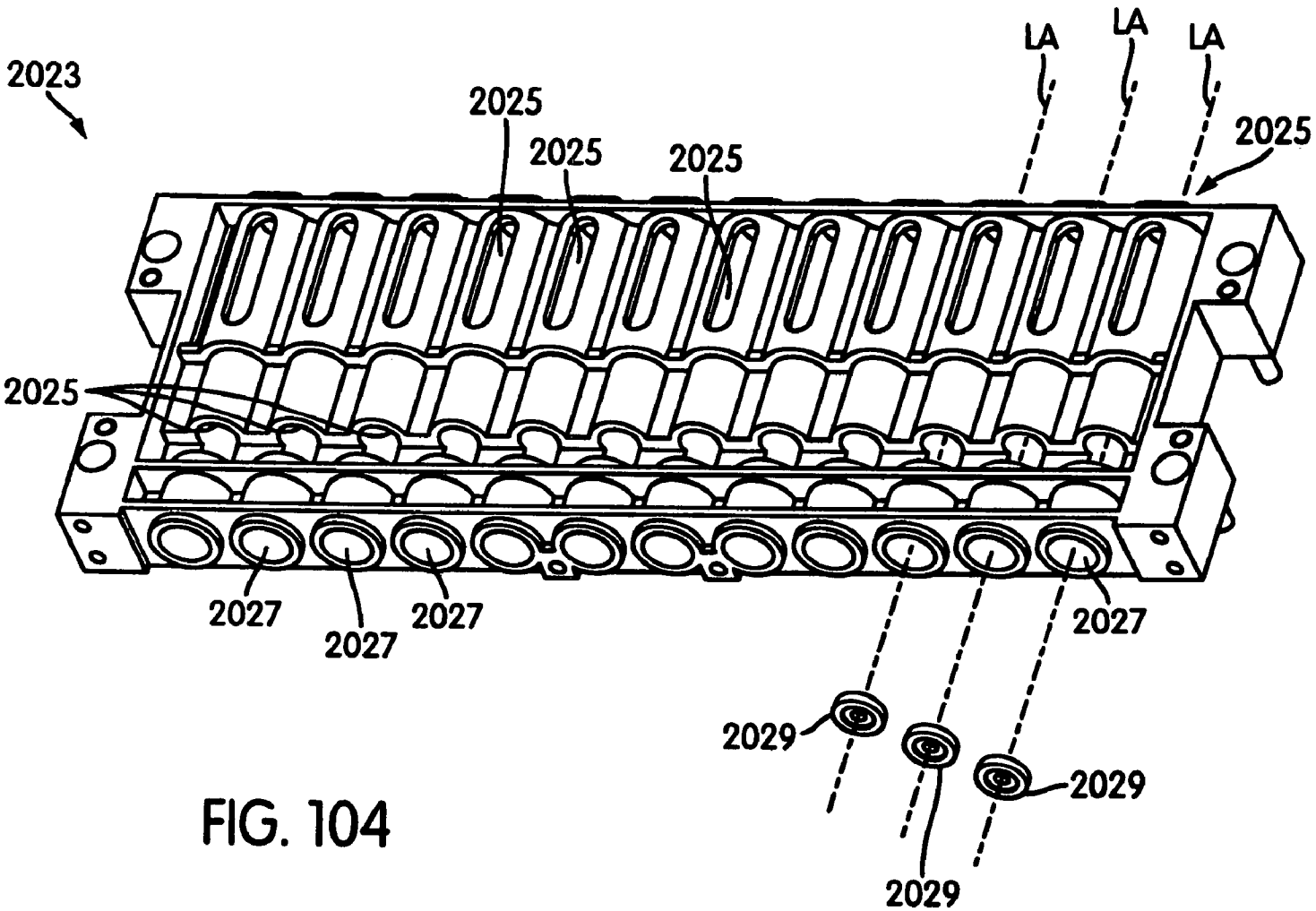
FIG. 104 is a top perspective view of a punch receiving block of a punching mechanism of the apparatus of FIG. 63.
Figure 105A:
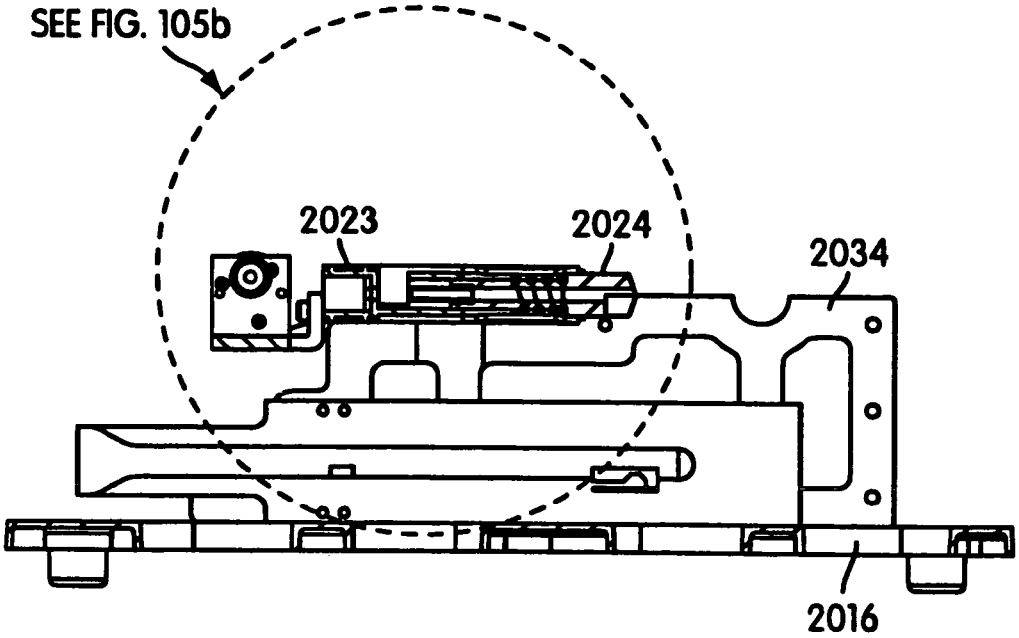
FIG. 105*a* is a cross-sectional view of the portion of the punching mechanism of FIG. 104 in the apparatus of FIG. 63 with a punch in a rest position.
Figure 105B:
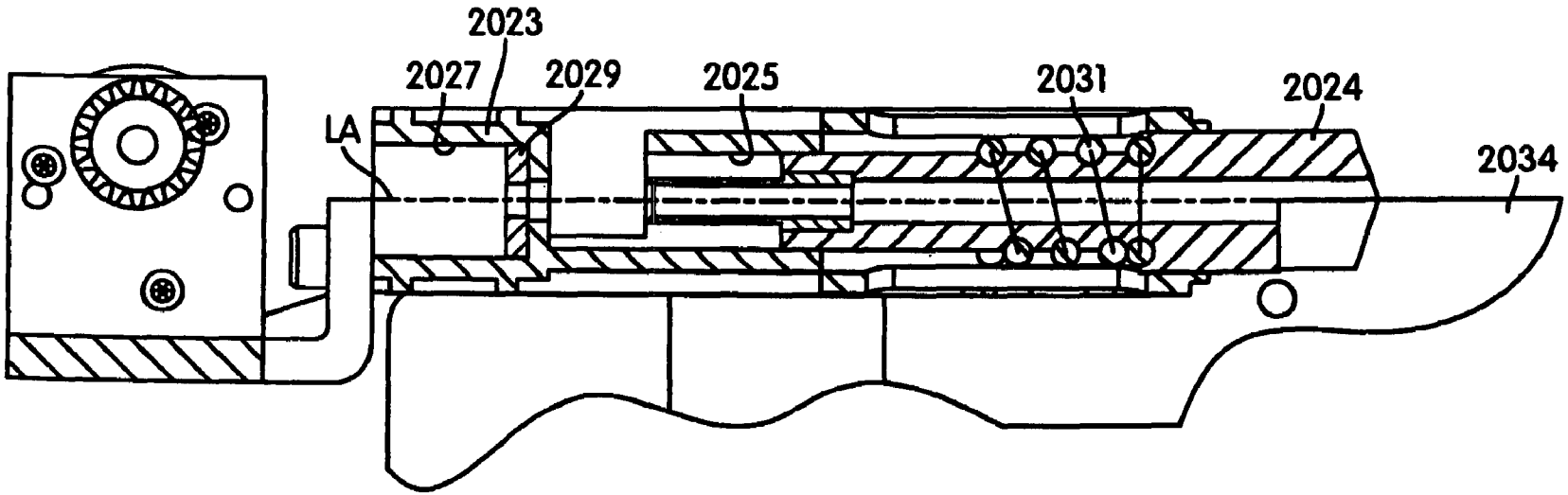
FIG. 105*b* is a view of detail D of FIG. 105*a;*
Figure 106A:
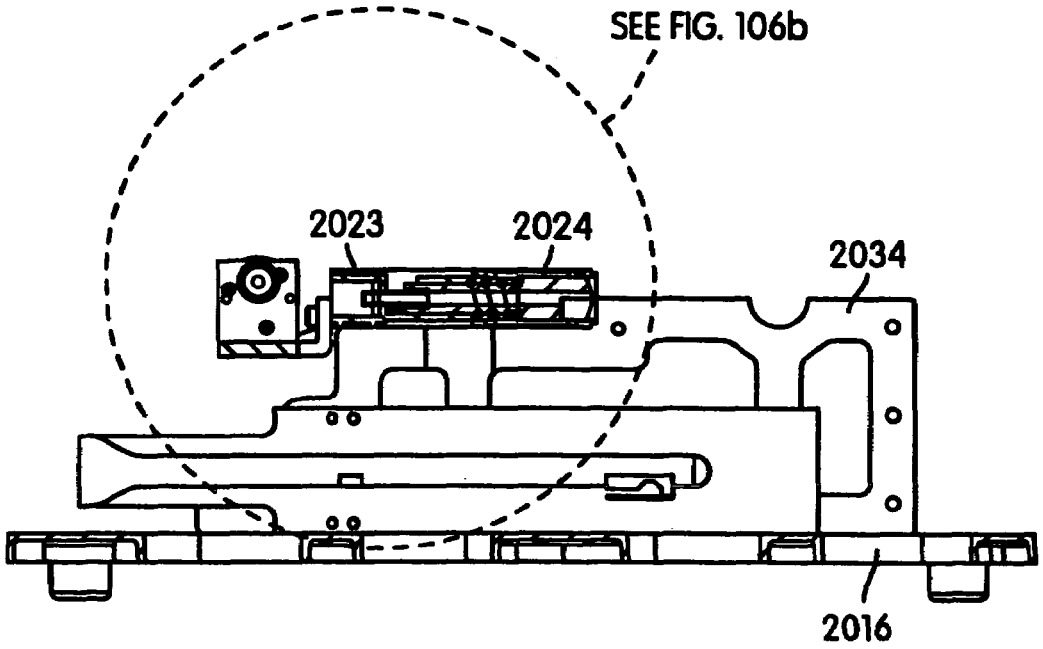
FIG. 106*a* is a cross-sectional view of the portion of the punching mechanism of FIG. 105*a* with the punch in a punching position.
Figure 106B:
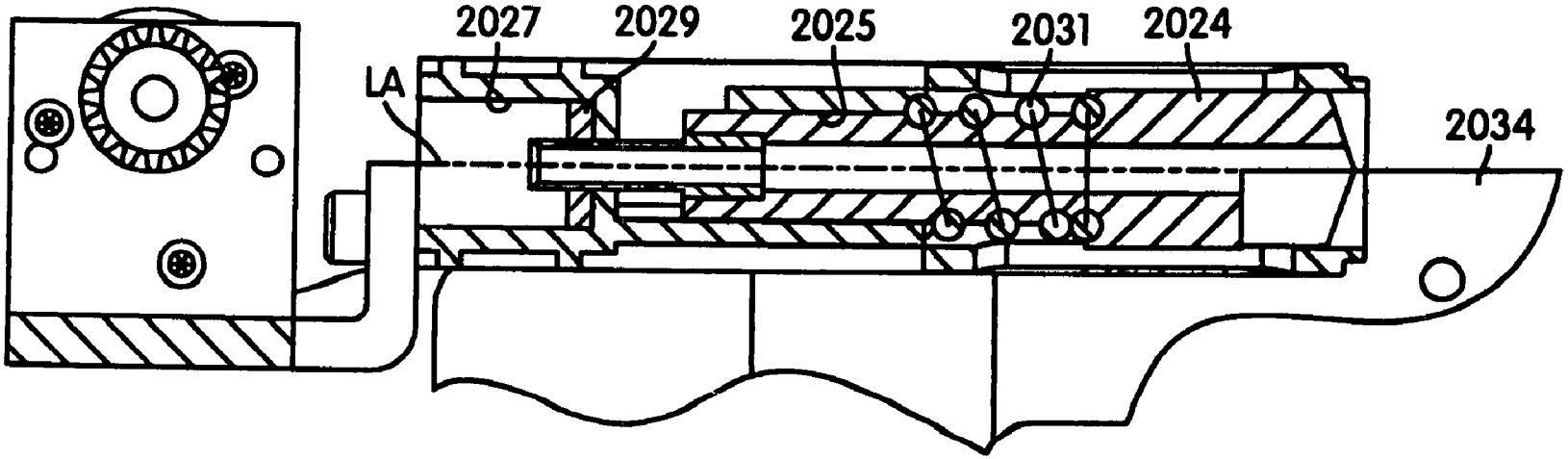
FIG. 106*b* is a view of detail E of FIG. 106*a;*

The punching mechanism 2018 includes a punch receiving block 2023 that receives a plurality of punches 2024, each of which is operatively connected to a common shaft 2026 via a cam 2028, as shown in FIG. 63. Each of the plurality of punches 2024 is spaced apart by a predetermined distance such that a plurality of holes may be punched through the plurality of papers, or other documents or substrates 2012 near an edge thereof. The punch receiving block 2023, shown in greater detail in FIG. 104, includes a plurality of substantially cylindrical openings 2025 that are sized to allow each of the punches 2024 to move along a longitudinal axis LA of each opening 2025. Each of the openings 2025 guide each of the plurality of punches 2024 from a rest position, shown in FIGS. 105*a* and 105*b* to a punching position, shown in FIGS. 106*a* and 106*b*, and back to the rest position. The punch receiving block 2023 also includes a second plurality of openings 2027 at an end opposite the openings 2025 that receive the plurality of punches 2024, as shown in FIGS. 104, 105*b*, and 106*b*. Each of the second plurality of openings 2027 is also aligned on each of the longitudinal axes LA, as shown in FIG. 104. A plurality of chad removal devices 2029, or chad removers, may also be provided as part of the punching mechanism 2018 and may be received by the second plurality of openings 2027, as shown in FIGS. 105*b* and 106*b*. The chad removal devices 2029 are discussed in more detail below.

Returning to FIG. 63, the plurality of papers 2012 are arranged in a stack. As the shaft 2026 rotates, the cams 2028 rotate such that they drive each of the punches 2024 sequentially. A plurality of springs 2031, shown in FIGS. 105*b* and 106*b*, may be provided to bias the punches 2024 in a position away from the plurality of papers 2012, thereby allowing the punches 2024 to return to such a position when the rotation of the cam 2028 allows for such movement. The shaft 2026 is operatively connected to a motor 2030. A series of gears 2032 may be used between the motor 2030 and the shaft 2026 so that the proper speed reduction between the motor 2030 and the shaft 2026 may be realized. The shaft 2026 is supported by a pair of supports 2034 that extend upward from the base 2016 so that the cams 2028 may fully rotate without interference by the base 2016. Bearings may be used to connect the shaft 2026 to the supports 2034. A tray 2036 is disposed beneath the shaft 2026 and is supported by the base 2016. The tray 2036 is positioned so that pieces of paper that are displaced by the punches 2024 may be collected. The tray 2036 is removable so that it may be emptied from time to time, as will be discussed in further detail below.

Figure 107:
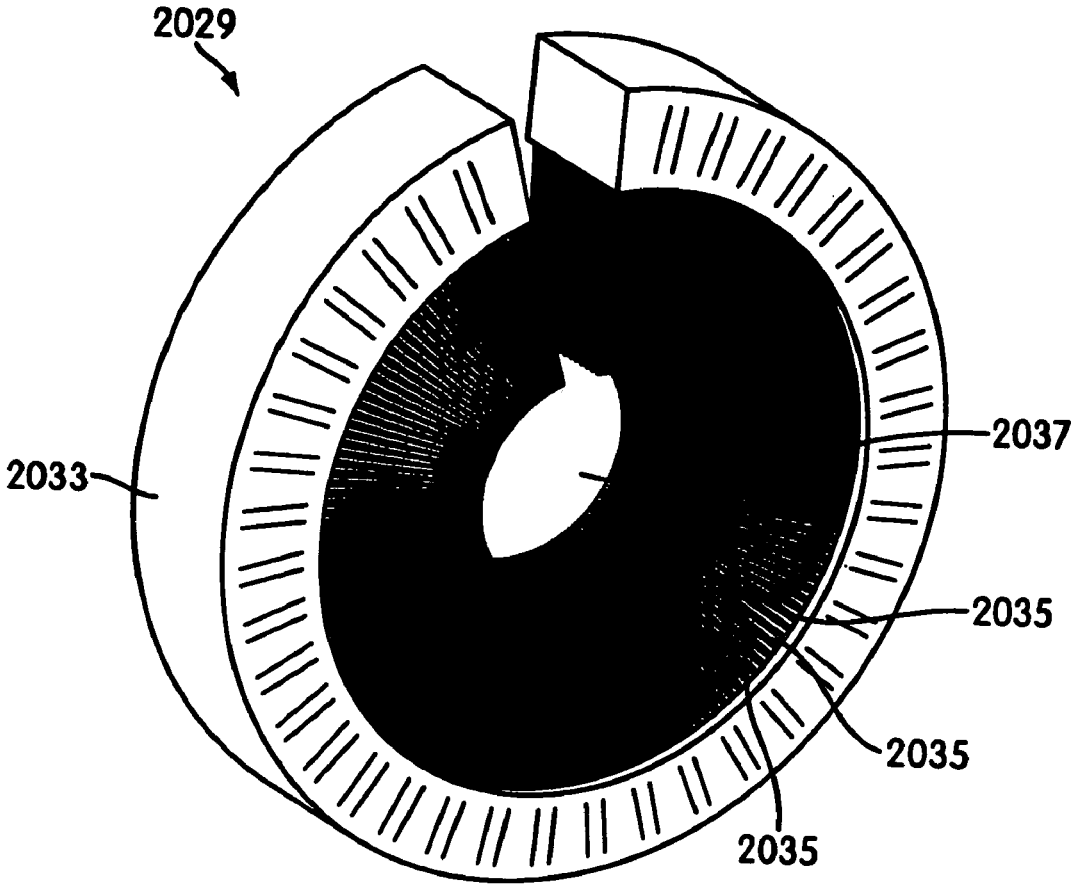
FIG. 107 is a perspective detailed view of a chad removal device of the punching mechanism of FIG. 104.
Figure 108A:
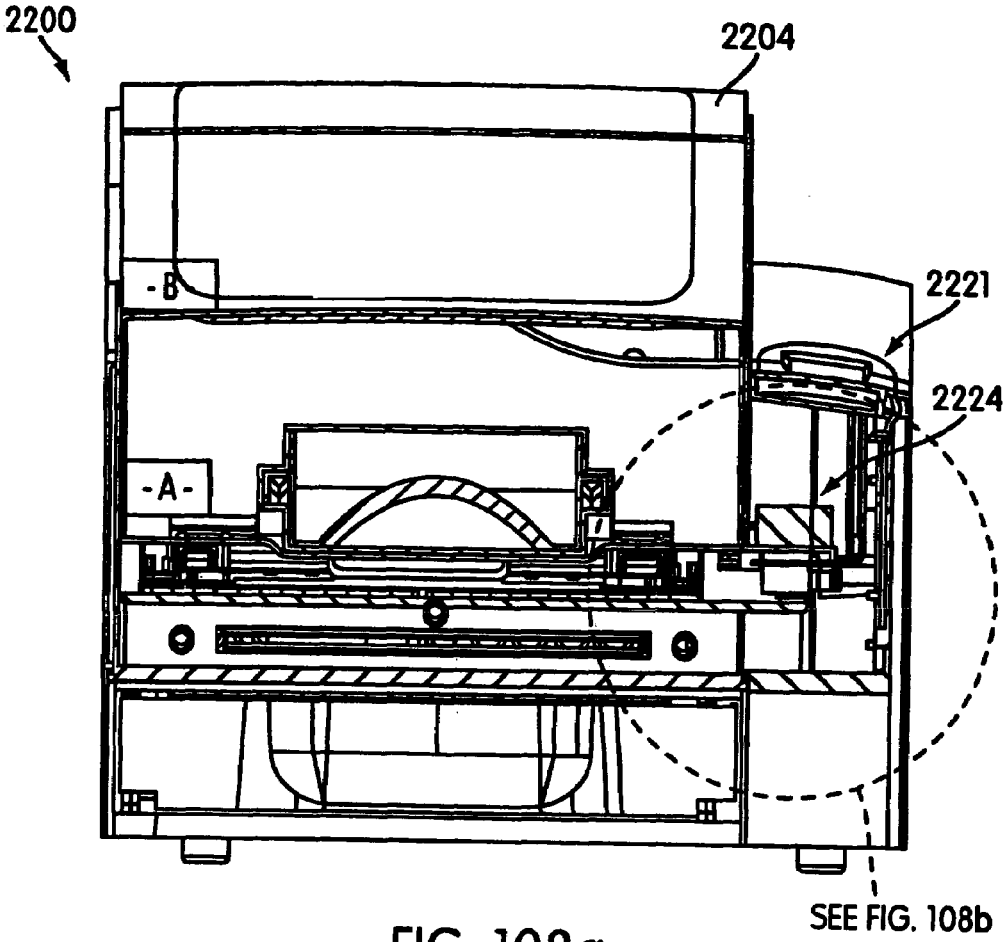
FIG. 108*a* is a cross-sectional view of the apparatus of FIG. 89 with a lid in an open position.
Figure 108B:
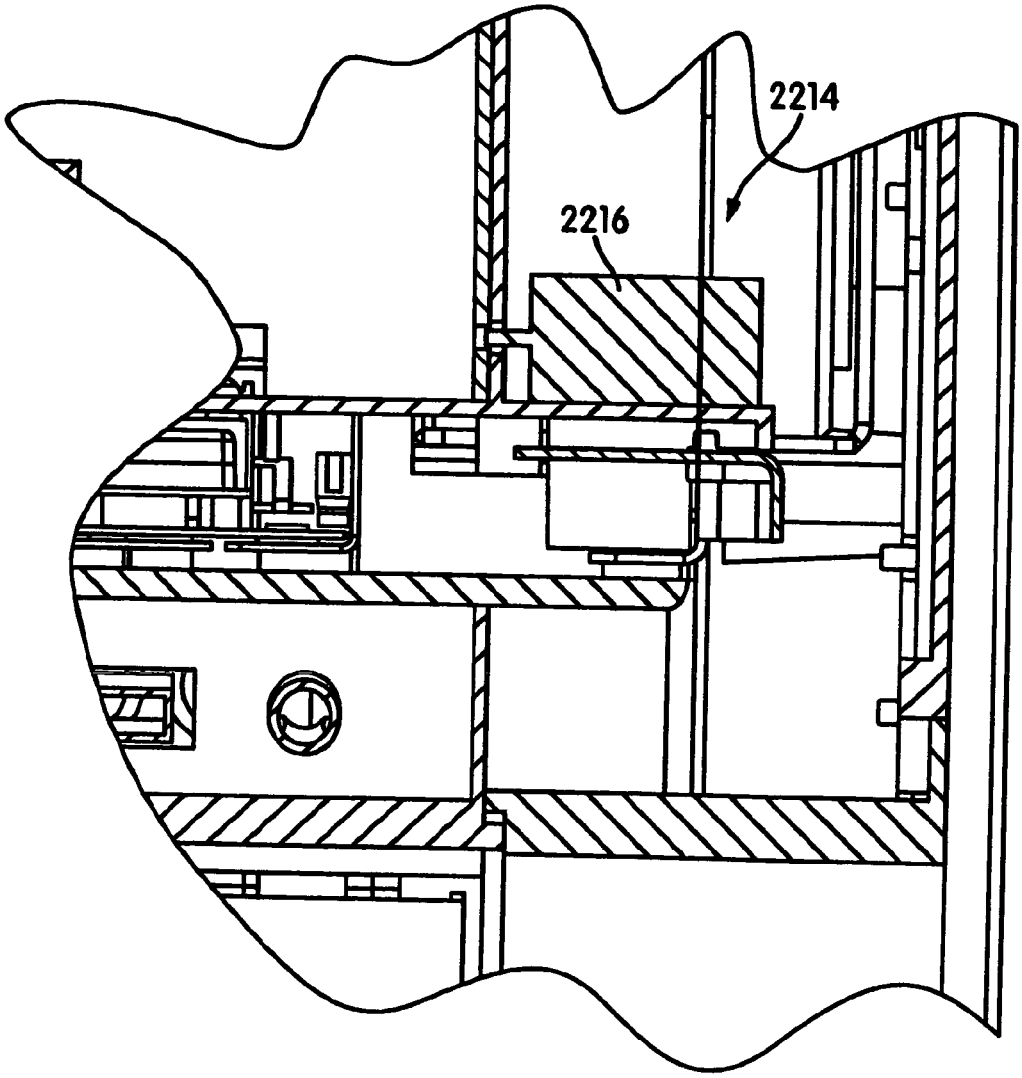
FIG. 108*b* is a view of detail F of FIG. 108*a;*

FIG. 107 shows a more detailed view of one of the chad removal devices 2029. The device 2029 includes a substantially circular frame 2033 and a plurality of resilient bristles 2035 that extend generally radially inwardly from the frame 2033. The bristles 2035 are sized so that a punch receiving opening 2037 is created. The punch receiving opening 2037 is smaller than the end of the punch itself so that the bristles 2035 may engage the end of the punch 2024 and create a slight resistance. This allows the bristles 2035 to grasp any chads of paper (i.e., punched segments) that are attached to the punch 2024 after the punch 2024 has punched through the plurality of papers 2012. Such chads may be ones that are compressed together and extend from the lead end of the punch 2024. As the punches 2024 are withdrawn in the return direction, the bristles 2035 will grasp the exposed chards and prevent them from passing through the opening 2037. This prevents the chads from falling off in the paper stack 2012 as the punches 2024 are moved in the return direction, and hence interfering with a subsequent binding operation.

The punching mechanism 2018 is discussed in greater detail above in regard to the embodiment of the apparatus 1010 illustrated in FIGS. 44-56. Therefore, further details of the punching mechanism 2018 of this embodiment will not be discussed herein. However, it is not necessary to use the punching mechanism 2018 illustrated, and any suitable punching mechanism for hole punching may be used. For example, some embodiments may use a V-shaped rack of punches that are driven linearly into the document stack, or some embodiments may use the single punch approach described above in regard to the punch drive unit 212 of FIGS. 25-33. Likewise, rotating paper drills, or any other suitable mechanism may be used. Thus, the illustrated punching mechanism 2018 is not intended to be limiting. Moreover, the term "punching mechanism" is used as a generic structural term to describe mechanisms that form holes in a document stack using, for example, the approaches mentioned above, or any other approach.

As shown in FIGS. 63-65, the paper clamp 2020 is constructed and arranged to clamp the stack of papers 2012. The paper clamp 2020 is also supported by the pair of supports 2034 at a position that is near the punches 2024. The paper clamp 2020 is movable relative to the base 2016 along or parallel to a first axis 2038. In the illustrated embodiment, the first axis 2038 is substantially vertical, but in other embodiments, it may be horizontal or otherwise. The paper clamp 2020, shown in greater detail in FIGS: 66-69, includes a first plate 2040 and a second plate 2042 that are disposed substantially parallel to each other, as well as to the first axis 2038. The first plate 2040 and the second plate 2042 are movable relative to one another so that the paper clamp 2020 may accommodate paper stacks 2012 with a range of varying thicknesses. It is contemplated that up to about 125 papers 2012 of a typical thickness may be bound with the apparatus 2010 of the present invention. However, the apparatus 2010 may be able to accommodate more or less than this amount, depending on its design.

In the illustrated embodiment, the first plate 2040 is operatively connected to the second plate 2042 via a plurality of posts 2044 that are disposed substantially at the corners of the plates 2040, 2042. Each post 2044 includes a head 2046 and a body portion 2048 that is connected to the head 2046 (best seen in FIGS. 66-69). The head 2046 contacts the second plate 2042 and provides a stop so that the post 2044 will not pull through the second plate 2042. The body portion 2048 extends through holes located in the second plate 2042 and the first plate 2040. As shown in FIG. 67, a spring 2050 is disposed on the body portion 2048 of the post 2044 on a side of the first plate 2040 that is opposite the second plate 2042. The spring 2050 is held in position by a stop 2052 so that the spring 2050 biases the first plate 2040 towards the second plate 2042. Although only one spring 2050 and stop 2052 are shown in FIG. 67, it is understood that the spring 2050 and the stop 2052 may be provided on each post 2044 in the same or similar manner.

As shown in FIG. 67, an optional hole punch receiving flange 2053 is connected to the first plate 2040 so that the flange 2053 extends below the bottom edge of the first plate 2040. The flange 2053 includes a plurality of slots 2055 that align with the plurality of punches 2024 when the paper clamp 2020 is in the punching position. The slots 2055 are sized so that the punches 2024 can pass through to the stack of papers 2012 without contacting the flange 2053, and are open at the bottom edge of the flange 2053 so that the binding element 2014 may be inserted without any obstruction from the flange 2053. The flange 2053 is designed to provide some stiffness to the edge of the stack of papers 2012 during the punching process so as to allow for easier withdrawal of the punches 2024 from the stack 2012.

Figure 68:
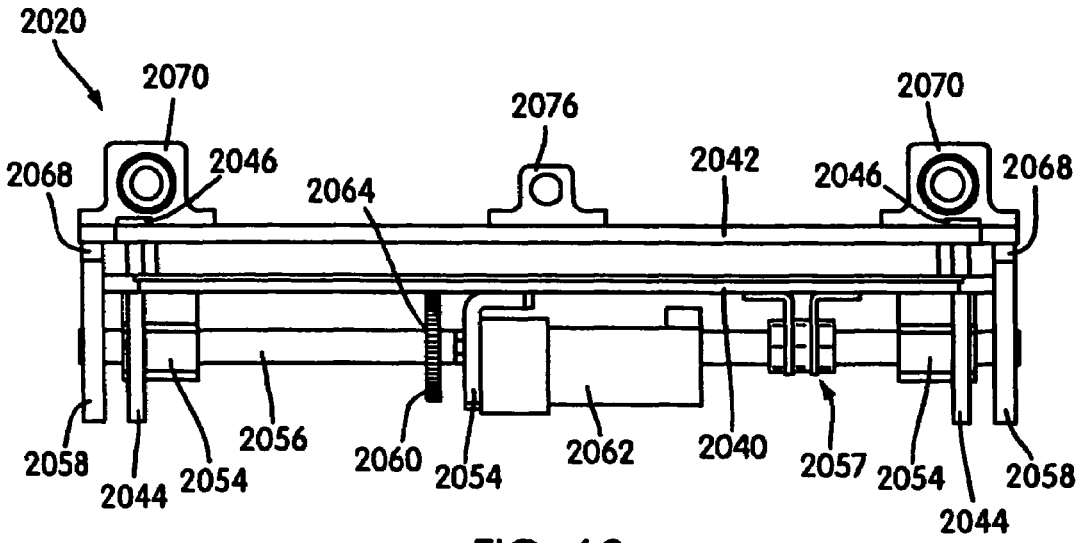
FIG. 68 is a bottom view of the paper clamp of FIG. 66.
Figure 69:
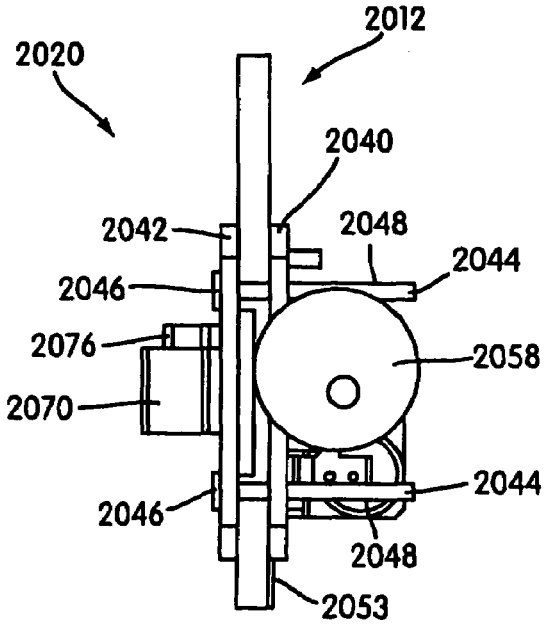
FIG. 69 is a right side view of the paper clamp of FIG. 66.

As shown in FIG. 68, a plurality of shaft supports 2054 are disposed on the first plate 2040. The shaft supports 2054 may be attached to the first plate 2040 by known methods, such as by welding, or with the use of fasteners or rivets, or any combination thereof. The shaft supports 2054 are constructed and arranged to receive a shaft 2056 that may rotate freely within the shaft supports 2054. The shaft supports 2054 may be lined with bushings or any other type of material that enhances rotation of the shaft 2056 relative to the shaft supports 2054. At least one cam 2058 is disposed on the shaft 2056. In the illustrated embodiment, a pair of cams 2058 are used, with one cam 2058 being provided on each end of the shaft 2056. As shown in FIG. 69, the cam 2058 is eccentric, i.e., the axis of rotation of the cam 2058 is not in the center of the cam 2058. Also disposed on the shaft 2056 is a gear 2060 that operatively connects the shaft 2056, and, hence, the cams 2058 to a motor 2062 via another gear 2064. As shown, the motor 2062 is also supported by one of the shaft supports 2054.

Each cam 2058 is also operatively connected to the second plate 2042 near an edge 2066 thereof. As shown, a spacer 2068 is provided on the second plate 2042 near each edge 2066. The biasing of the springs 2050 located on the posts 2044 push the first plate 2040 towards the second plate 2042, causing the cams 2058 to contact the spacers 2066. Upon rotation, the eccentricity of the cams 2058 pushes the first plate 2040 away from the second plate 2042 to open the paper clamp 2020. To close the paper clamp 2020, the cams 2058 may be rotated back (or rotated further past the peak of their eccentricity) so that the springs 2050 can force the first plate 2040 back towards the second plate 2042. This will clamp a stack 2012 received between the two plates 2040, 2042.

As shown in FIG. 67, a sensor 2057 for sensing the position of the first plate 2040 relative to the second plate 2042 is disposed on the first plate 2040 near the shaft 2056. The sensor 2057 includes a plurality of switches 2059, each of may be an associated finger (not shown) on the shaft 2056 in such a way so as to determine the rotational position of the shaft 2056. Also, the shaft 2056 may have matching indicators disposed thereon that interact with each of the fingers. Each of the three switches 2059 corresponds to a condition of the paper clamp 2020, such as fully closed, fully open, and partially open. Since three switches are used, three angularly spaced fingers would be used to contact the appropriate switch at different angular positions of the shaft 2056. By being able to sense the condition of the paper clamp 2020 in terms of how open it is, a controller 2170, which will be discussed in greater detail below, may be used to manipulate the size of the opening of the clamp 2020 during different parts of a cycle. For example, at the beginning of the cycle, when the stack of papers 2012 is to be loaded, the paper clamp 2020 may be moved to the fully open position. When the apparatus 2010 is in a stand-by mode, the paper clamp 2020 may be moved to a partially open position, or even a closed position.

As shown in FIG. 63, a thickness sensor 2061 may be attached to one of the supports 2034 in a position near a bottom edge of the first plate 2040. Indicators (not shown) that correspond to the position of the first plate 2040, and therefore the thickness of the stack of papers 2012, may be disposed on the first plate 2040 so that as they pass by the thickness sensor 2061 as the paper clamp 2020 closes, the thickness sensor 2061 may sense, within a range, the thickness of the stack of papers 2012. For example, if there are 61-90 pieces of paper 2012 being clamped, only one of the indicators will have passed over the sensor 2061. If there are 31-60 pieces of paper 2012 being clamped, the first plate 2040 will be closer to the second plate 2042, and a second indicator will pass over the sensor 2061, and so on. For example, the sensor 2061 may be a momentary switch and the indicators associated with the first plate 2040 may be a series of projections or bumps on the bottom edge of the first plate 2040. As the plate 2040 moves, these bumps or projections will contact the switch, and the position of the plate 2040 (and hence the thickness of the stack 2012) can be monitored by monitoring the engagement of the switch by the bumps or projections. As other alternatives, a potentiometer connected to the plate 2040 or a Hall effect sensor on the shaft 2056 could be used to monitor movement of the plate 2040. Generally, any type of sensor may be used to monitor the relative movement between the plates 2040, 2042. The thickness sensor 2061 is also in communication with the controller 2170, as will be discussed in further detail below.

Moreover, the functionalities of sensor 2057 and sensor 2061 may be combined into a single sensor that monitors relative movement of the plates 2040, 2042.

Figure 66:
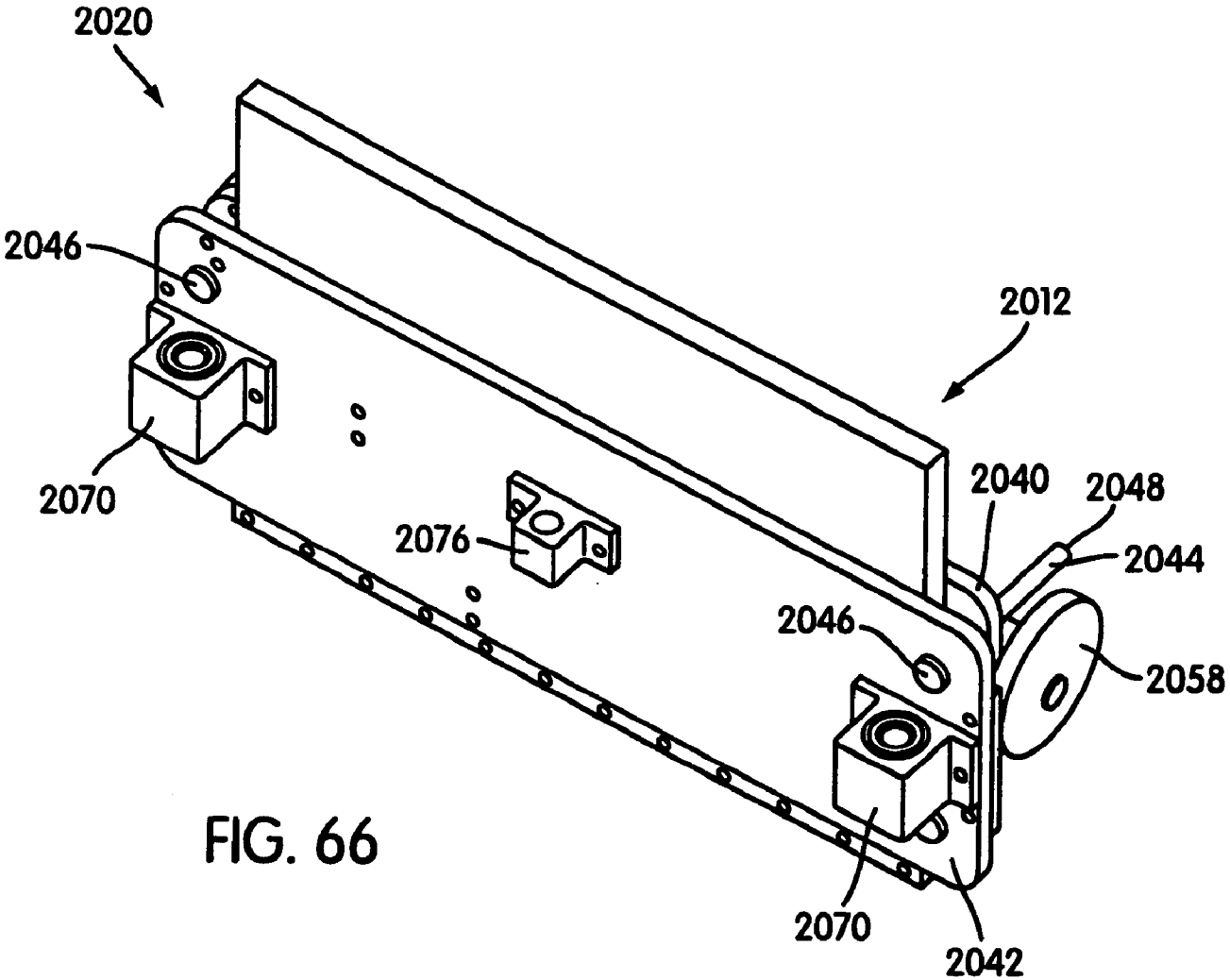
FIG. 66 is a top front right perspective view of a paper clamp of the binding apparatus of FIG. 63.
Figure 67:
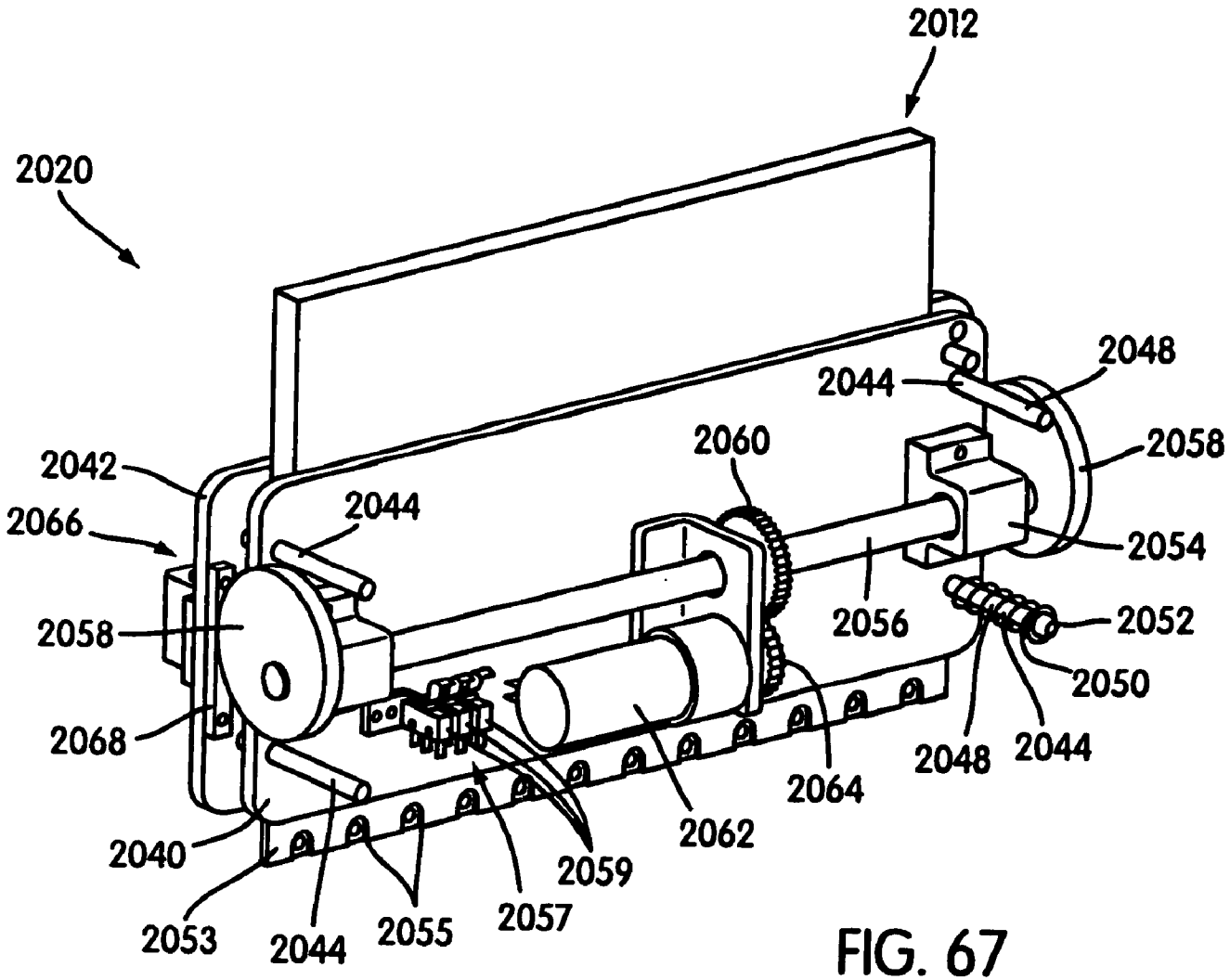
FIG. 67 is a top rear right perspective view of the paper clamp of FIG. 66.

As shown in FIG. 66, a plurality of guiding brackets 2070 may be attached to the second plate 2042 by known methods. As shown in FIG. 65, the brackets 2070 are constructed and arranged to receive posts 2072 that are mounted on a platform 2074 supported by the supports 2034. Holes in the brackets 2070 are sized so that the brackets 2070 may slide along the posts 2072. The posts 2072 assist in guiding the brackets 2070, and, hence, the paper clamp 2020, along a plane that is parallel to the first axis 2038.

Also shown in FIG. 68 is another bracket 2076 that is disposed between the guiding brackets 2070. The bracket 2076 is constructed and arranged to interact with a rotatable post 2078 such that when the rotatable post 2078 rotates, the bracket 2076, and, hence, the second plate 2072 will move along the first axis 2038. Rotation of the rotatable post 2078 in one direction causes the second plate 2072 to move in a first direction, while rotation of the rotatable post 2078 in the opposite direction causes the second plate 2072 to move in a direction that is opposite the first direction. To provide this action, the post 2078 is externally threaded and the bracket 2076 is internally threaded. This is often referred to as a drive screw connection. The rotatable post 2078 is operatively connected to a reversible electric motor 2080 via gearing so that the motor 2080 powers the rotation of the rotatable post 2078. As shown in FIG. 65, the motor 2080 may be mounted on the platform 2074. Thus, in the illustrated embodiment, the motor 2080 is configured to move the entire paper clamp 2020 along the first axis 2038. Of course, the paper clamp 2020 is not intended to be limited to the illustrated embodiment.

As shown in FIG. 65, a sensor 2081 for sensing the position of the paper clamp 2020 along the first axis 2038 is disposed on the platform 2074 and is operatively connected to the second plate 2042. This sensor 2081 is similar to the sensor 2057 that senses the position of the first plate 2040 relative to the second plate 2042 in that the sensor 2081 gives the controller 2170 information, so that the controller 2170 may cause the paper clamp 2020 to be moved in different positions along the first axis 2038 during different parts of the cycle. For example, the sensor 2081 may be configured to sense when the clamp 2020 is in a fully upward position, for paper loading, or a fully downward position for paper punching. Any suitable other type of sensor may be used.

An optional paper sensor (not shown) may be constructed and arranged to sense whether or not the papers 2012 have been inserted into the paper clamp 2020. The paper sensor may be in communication with the controller 2170 so that the controller 2170 may execute certain programs, based on what condition is sensed, as will be explained in more detail below. The paper sensor is preferably an optical sensor, by may be a contact switch, or any type of sensor that is configured to sense the presence of the papers 2012.

Generally, the paper clamp 2020 may have any construction or configuration, and the illustrated construction is not intended to be limiting. For example, other mechanisms may be used to move the paper clamp 2020 parallel to the first axis 2038, other mechanisms may be used to move the plates 2040, 2042 relative to one another, or other types of sensors may be used to detect the thickness of the stack of papers 2012 or the presence of the stack of papers 2012 in the clamp 2020, or such sensors may even be eliminated. Also, limit switches may also be used to sense the position of the paper clamp 2020 relative to, for example, the supports 2034 and base 2016.

The binding element insertion device 2022 is shown in greater detail in FIGS. 70-75. In the illustrated embodiment, the binding element insertion device 2022 includes a base 2082 that supports a binding element loading device, which is generally indicated at 2084. The binding element loading device 2084 is constructed and arranged to receive the binding element 2014 and includes a support 2086 on which the binding element 2014 rests when it is received by the binding element loading device 2084.

The binding element loading device 2084 also includes a pusher 2088 that moves relative to the support 2086. At least one plunger 2090 (two are shown in the figures) biases the pusher 2088 in a direction toward the first axis 2038. The plunger 2090 includes a spring, or any other type of resilient member, for providing a suitable biasing force. The pusher 2088 includes a recessed portion 2092 that is configured to be engaged by a person's hand. This way, when loading a binding element 2014 into the binding element loading device 2084, the user may pull the pusher 2088 away from wall 2094 against the bias of the plungers 2090 via the recessed portion 2092, insert the binding element 2014, and release the pusher 2088. The pusher 2088 then pushes the binding element 2014 against the wall 2094 that extends upward from the base 2082.

Figure 75:
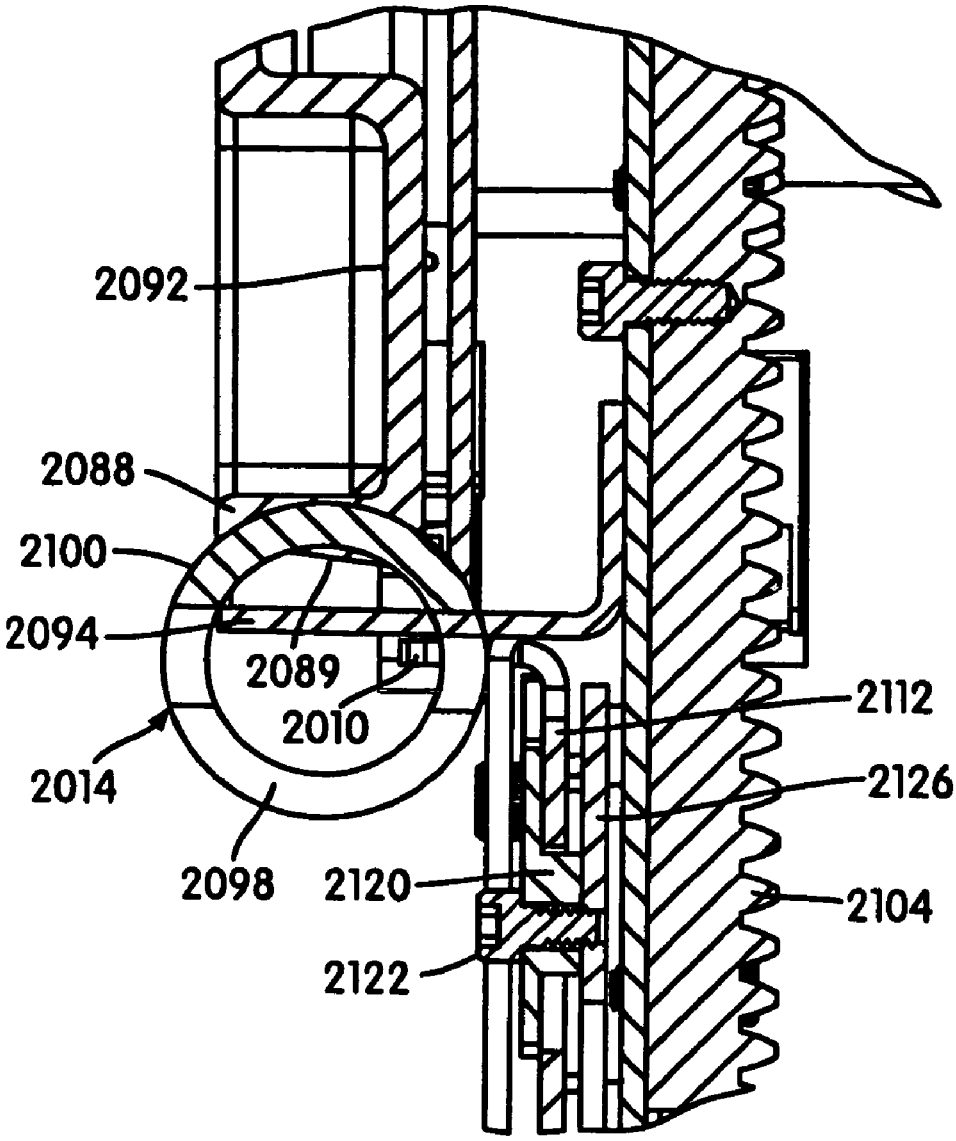
FIG. 75 is detail A of FIG. 74.
Figure 76:
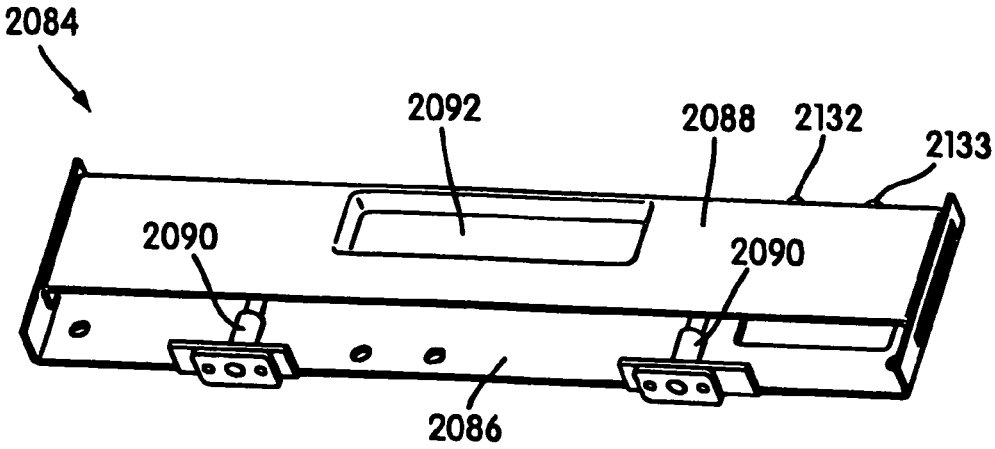
FIG. 76 is a top front right perspective view of a binding element loading device of the binding element insertion device of FIG. 70.

As shown in FIG. 75, the pusher 2088 includes an optional plow-like surface 2089 with a radius that allows for increased contact with the binding element 2014. The curved, plow-like surface 2089 is configured to assist in placing the binding element 2014 in the proper position for alignment with the stack of paper 2012. For example, the surface 2089 helps to slightly lift the binding element 2014 and provides a spine 2100 of the binding element 2014 with support. In the illustrated embodiment, the curvature of the surface 2089 essentially matches the external curvature of part of the binding element 2014 and includes a lower portion to help lift the binding element upwardly to a proper location. Preferably, the locating of the binding element 2014 is such that the bottom longitudinal edges of the spine 2100 at the joined edges of the fingers 2098 is engaged with the wall 2094. More preferably, the locating is such that both longitudinal edges of the spine 2100 are engaged with the wall 2094. The wall 2094 includes a plurality of slots 2096 that are constructed and arranged to allow a plurality of fingers 2098 that are attached to the spine 2100 of the binding element 2014 to pass through the wall 2094, while preventing the spine 2100 from passing through the wall 2094. The interaction of the pusher 2088 and the wall 2094 essentially clamps the binding element 2014 into the proper position for being attached to the stack of papers 2012.

Figure 73:
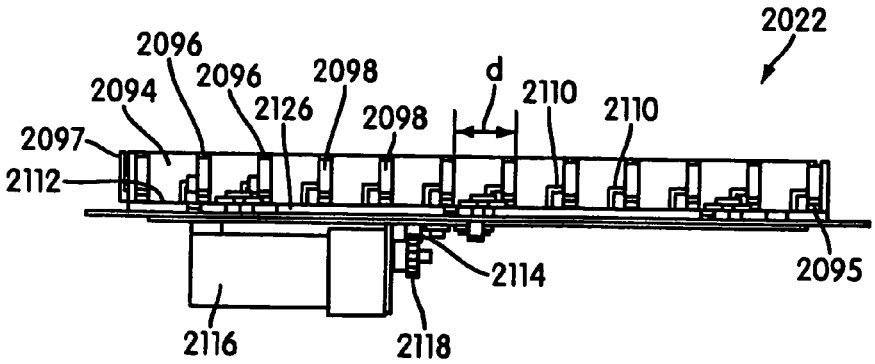
FIG. 73 is a rear view of the binding element insertion device of FIG. 70.
Figure 74:
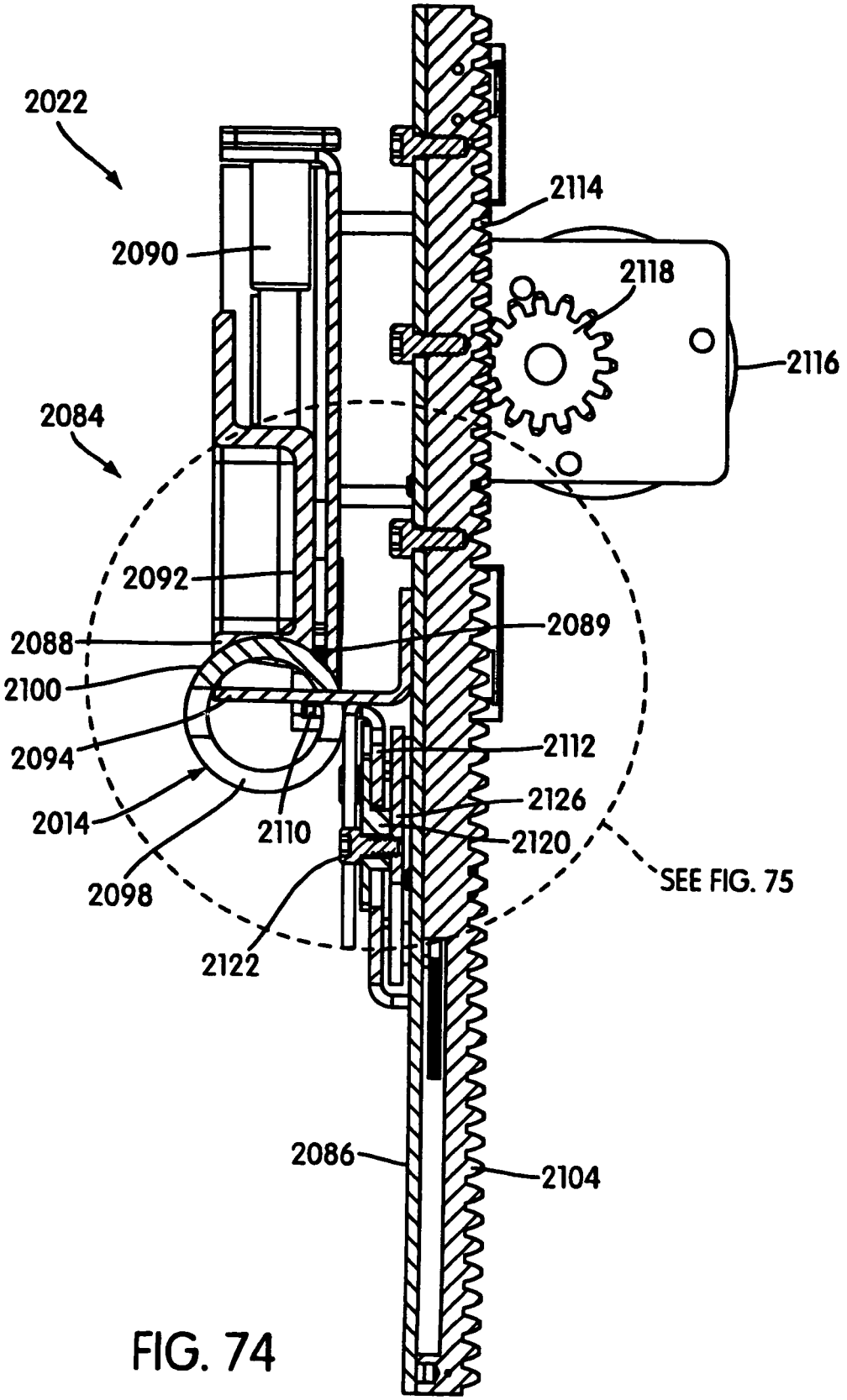
FIG. 74 is a cross-sectional view of the binding element insertion device along line 74-74 in FIG. 72.

As shown in FIG. 73, the slots 2096 of the wall 2094 and the fingers 2098 of the binding element 2014 are spaced apart at a distance d of about 25.85 mm. The binding element 14 has a pitch of about 25.75 mm to about 25.95 mm, and more preferably has a pitch of about 25.85 mm. It has been found by the inventors that a pitch of 25.85 mm allows for 8.5"×11" paper and A4 paper to be bound on the same apparatus 2010 with acceptable spacing between the longitudinal ends of the stack and the end holes in the stack for either size paper. With a pitch of about 25.85 mm, each binding element 2014 used to bind 8.5"×11" paper includes eleven fingers 2098, and each binding element 2014 used to bind A4 paper includes twelve fingers 2098. Such a pitch is unique, because conventional apparatus and binding elements are specifically designed for each size of paper, i.e., the pitch of a binding element for 8.5"×11" paper is different than the pitch of the binding element for A4 paper.

Figure 71:
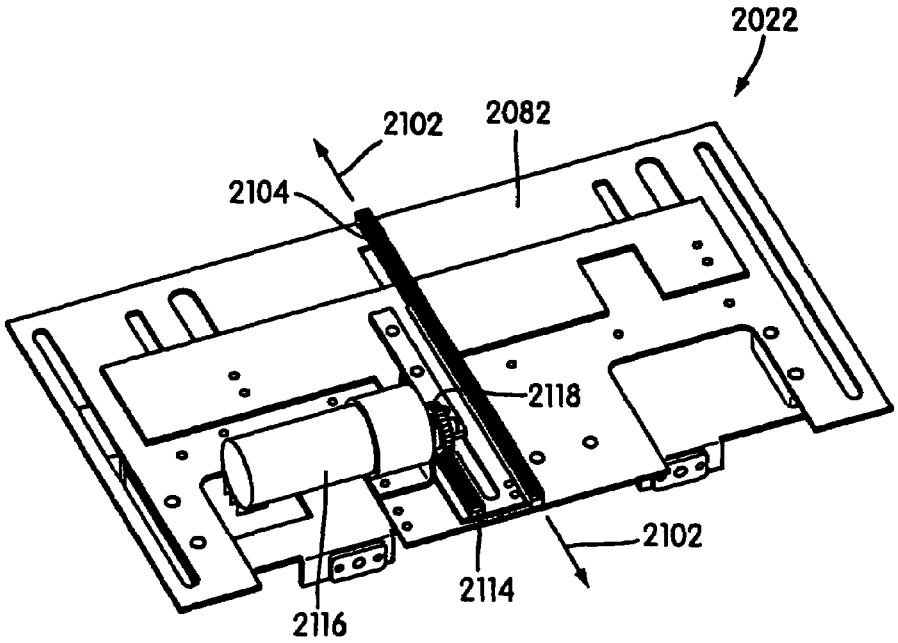
FIG. 71 is a bottom front right perspective view of the binding element insertion device of FIG. 70.

The entire binding element insertion device 2022 is movable relative to the base 2016 of the apparatus 2010 along a second axis 2102. In the illustrated embodiment, the second axis 2102 is substantially parallel to the base 2016 and is substantially perpendicular to the first axis 2038. As shown in FIG. 71, a rack 2104 is disposed at an underside of the base 2082 of the binding element insertion device 2084. The rack 2104 interacts with a pinion 2106 that is operatively connected to a motor 2108, as shown in FIG. 64. The motor 2108 is supported by one of the supports 2034 so that it is stationary relative to the base 2016. The motor 2108 rotates the pinion 2106 in one direction, such that the rack 2104 and the binding element insertion device 2022 moves in a first direction along the second axis 2102, towards the first axis 2038. When the motor 2108 rotates the pinion 2106 in the opposite direction, the rack 2104 and the binding element insertion device 2022 moves in a second direction along the second axis 2102, away from the first axis 2038. Interaction of the binding element insertion device 2022 and the paper clamp 2020 during operation of the apparatus 2010 will be discussed in further detail below.

The binding element insertion device 2022 also includes a plurality of finger pullers 2110 that are disposed adjacent to the plurality of slots 2096 in the wall 2094 on a side of the wall 2094 that faces the paper clamp 2020. The plurality of finger pullers 2110 are constructed and arranged to engage the plurality of fingers 2098 of the binding element 2014 and extend the fingers 2098 away from the spine 2100 so as to "open" the binding element 2014. The plurality of finger pullers 2110 are connected to a single puller plate 2112 so that the finger pullers 2110 all move together.

Figure 70:
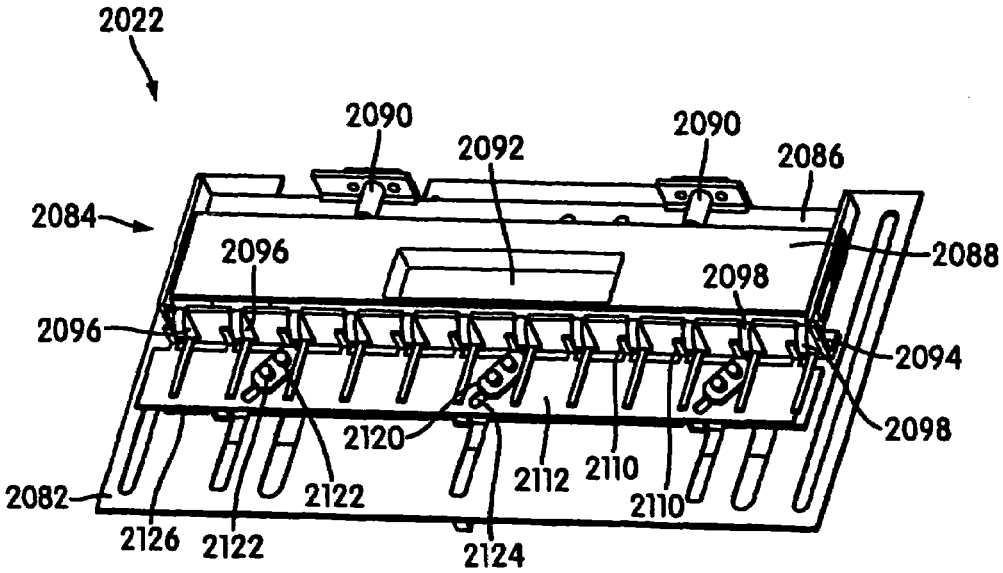
FIG. 70 is a top rear left perspective view of a binding element insertion device of the binding apparatus of FIG. 63.
Figure 72:
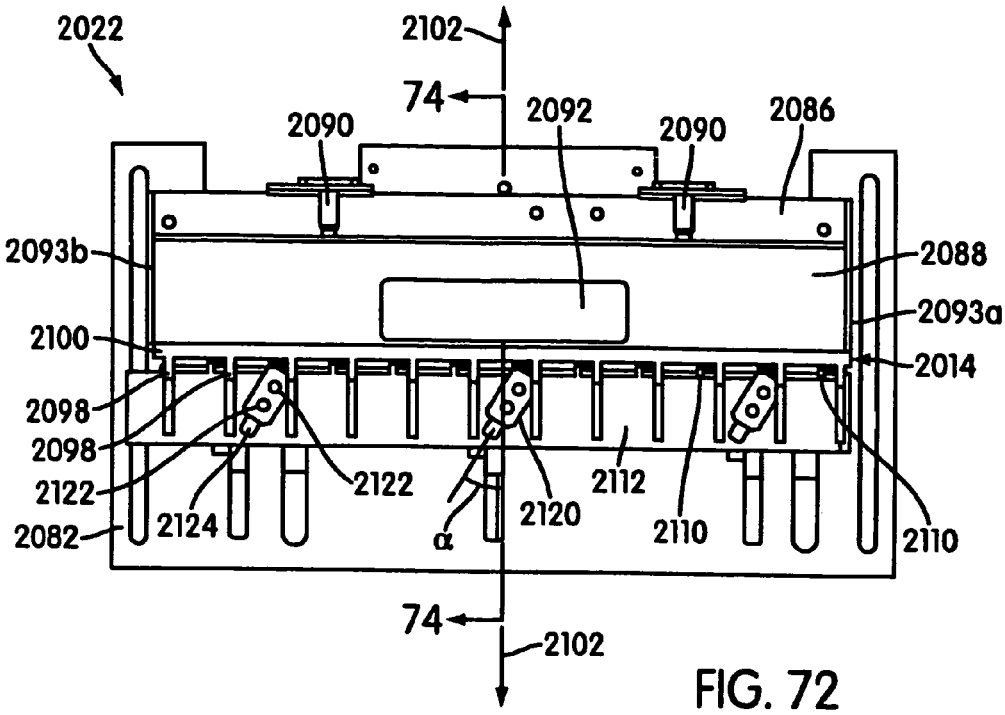
FIG. 72 is a top view of the binding element insertion device of FIG. 70.

As shown in FIG. 71, a motor 2116 is mounted to the base 2082 of the binding element insertion device 2022. The motor 2116 is operatively connected to a pinion 2118 that interacts with a rack 2114. The rack 2114 is connected to a slide plate 2126. The motor 2116 causes the pinion 2118 to rotate in a first direction, which causes the rack 2114 and the slide plate 2126 to move toward the paper clamp 2020. As shown in FIGS. 70 and 72, a plurality of guides 2120 are each connected to the plate 2126 with a pair of fasteners 2122. Each pair of fasteners 2122 passes through a slot 2124 that is located in the finger plate 2112. The slots 2124 are disposed at an angle $\alpha$, as shown in FIG. 72. This way, as the slide plate 2126 is moved in the direction toward the paper clamp 2020, the guides 2120 will cause the finger plate 2112 to first move in a substantially lateral direction, which causes the finger pullers 2110 to engage the fingers 2098 of the binding element 2014. Further movement of the slide plate 2126 and the guides 2120 will then cause the finger plate 2112 to move substantially along the second axis 2102, which allows the finger pullers 2110 to pull the fingers 2098 to the open, extended position. When the motor 2116 reverses direction, the pinion 2118 rotates in a direction that is opposite the first direction, so that the rack 2114 and the slide plate 2126 move away from the paper clamp 2020. This allows the fingers 2098 of the binding element 2014 to relax and recoil so as to "close" the binding element 2014. When the finger plate 2112 returns to its original position, the finger pullers 2110 will shift laterally back their original position.

Figure 77:
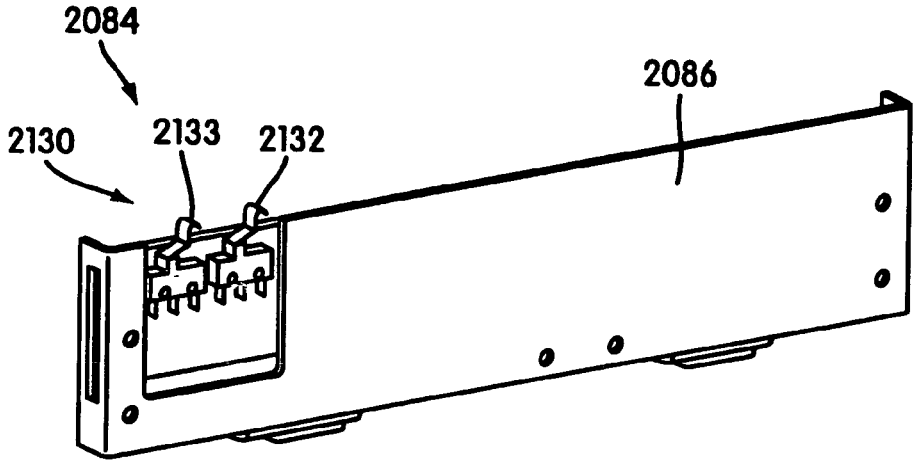
FIG. 77 is a bottom right perspective view of the binding element loading device of FIG. 76.
Figure 78:
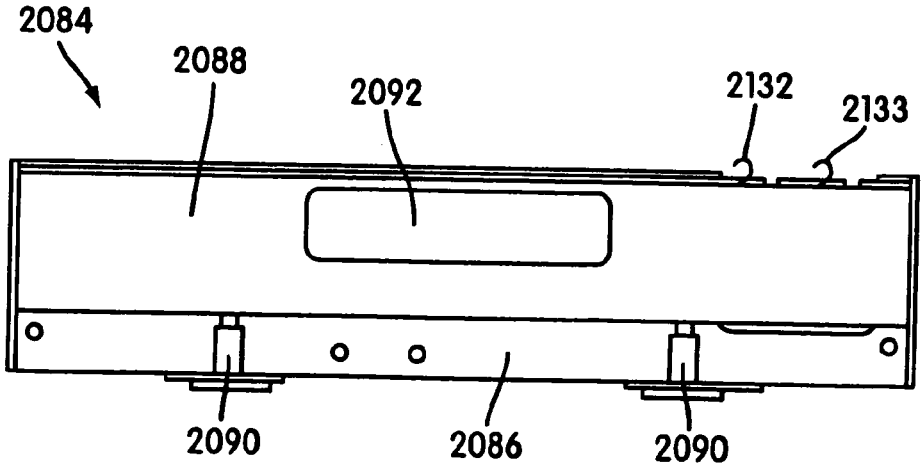
FIG. 78 is a top view of the binding element loading device of FIG. 76.
Figure 79A:
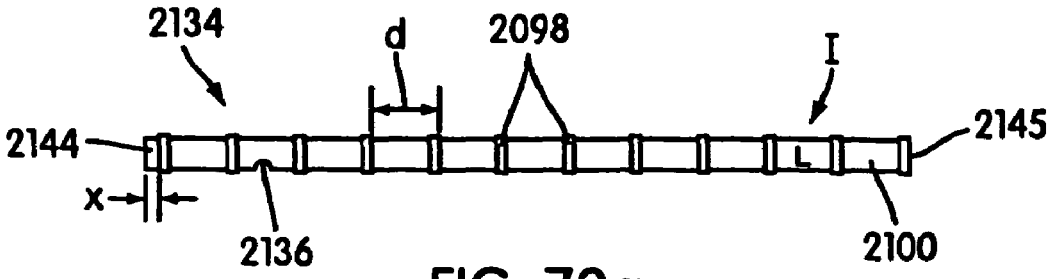
FIG. 79*a* is a front view of an embodiment of a large binding element to be used in the binding apparatus of FIG. 63.

As shown in FIG. 77, the binding element insertion device 2022 also includes a sensor 2130 for sensing the size of the binding element 2014 that has been inserted into the binding element loading device 2084. Any suitable sensor for detecting binding size may be used. In the illustrated embodiment, the sensor 2130 includes a first switch 2132, and a second switch 2133 that are spaced apart so that three different binding element sizes may be detected. For example, a "large" binding element 2134 is illustrated in FIG. 79*a*. The large binding element 2134 has a notch 2136 that is located so that it corresponds to the first switch 2132 when the large binding element 2134 is put into the binding element loading device 2084. When the large binding element 2134 is put into the binding element loading device 2084, the second switch 2133 is depressed, but the first switch 2132 is not depressed, because the first switch 2132 is received by the notch 2136. The depression of the second switch 2133 indicates that the binding element 2014 that has been inserted into the binding element insertion device 2022 is a large binding element 2134, the significance of which will be described in further detail below.

Figure 79B:
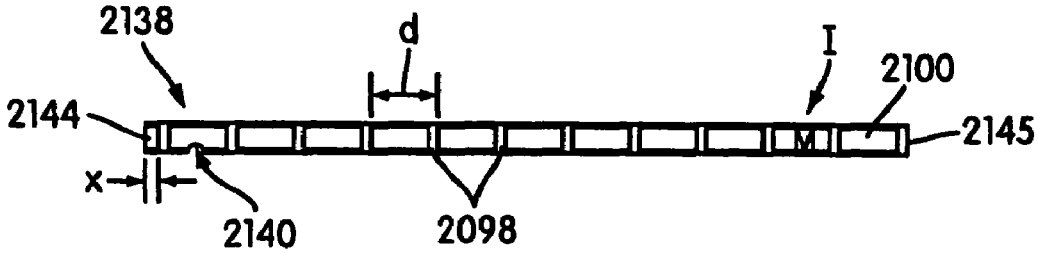
FIG. 79*b* is a front view of an embodiment of a medium binding element to be used in the binding apparatus of FIG. 63.

Similarly, a "medium" binding element 2138 is shown in FIG. 79*b* and also includes a notch 2140. However, the notch 2140 in the medium binding element 2138 is located at a different position than the notch 2136 in the large binding element 2134. The position of the notch 2140 in the medium binding element 2138 corresponds to the second switch 2133 in the sensor 2130. This way, when the medium binding element 2138 is put into the binding element loading device 2084, the first switch 2132 is depressed and the second switch 2133 is received by the notch 2140 in the medium binding element 2138. The depression of the first switch 2132 indicates that the binding element 2014 that has been inserted into the binding element insertion device 2022 is a medium binding element 2138, the significance of which will be described in further detail below.

Figure 79C:
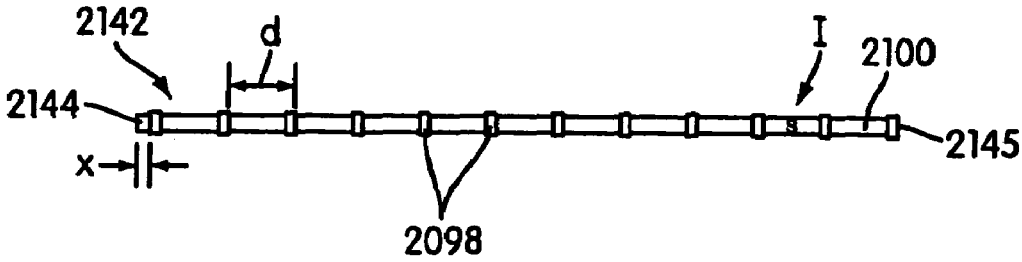
FIG. 79*c* is a front view of an embodiment of a small binding element to be used in the binding apparatus of FIG. 63.

FIG. 79*c* shows an embodiment of a "small" binding element 2142. As illustrated, the small binding element 2142 does not have a notch. This way, when the small binding element 2142 is inserted into the binding element loading device 2084, both the first switch 2132 and the second switch 2133 are depressed. The depression of both switches 2132, 2133 indicates that the binding element 2014 that has been inserted into the binding element insertion device 2022 is a small binding element 2142, the significance of which will be described in further detail below. Thus, not only does the sensor 2130 sense what size of binding element 2014 has been inserted, it senses whether a binding element 2014 has been inserted at all.

Of course, the sensor 2130 may be configured to sense more or less than three different binding element sizes. The three binding element sizes discussed above are but one example and are not intended to be limiting in any way. For example, the sensor 2130 may be configured to sense four or more different sizes of binding elements. Other sensors, such as bar code, optical, or other types of sensors could be used. The illustrated sensor should not be regarded as limiting.

The binding elements 2014 themselves may each be labeled with an indicator I, or mark, that gives some indication to the user as to what size it is, such as a graphical indicator, as shown in FIGS. 79*a-c*. For example, binding elements 2142 of the "small" size may include the letter "S" along its spine, "medium" binding elements 2138 may include the letter "M" along its spine, and "large" binding elements 2134 may include the letter "L" along its spine. Moreover, additional indicators, such as "XS" for extra-small binding elements and "XL" for extra-large binding elements may also be used. It is also contemplated that numbers, or combinations of numbers and letters may be used to distinguish the different sizes of binding elements. For example, the numbers 1, 2, and 3 could be used in place of S, M, L. Likewise, different colors for the different sizes may also be used, either alone, or in combination with a graphical indicator described above. It is also contemplated that similar indicators and/or color schemes may also be used to distinguish binding elements 2014 to be used to bind 8.5"×11" paper from binding elements 2014 to be used to bind A4 paper.

As shown in FIGS. 79*a* and 79*b*, the plurality of fingers 2098 on each binding element 2134, 2138, 2142 are disposed equidistantly along each spine 2100. However, the spacing between the last or outermost finger 2098 and the end of the spine 2100 at one end 2144 is different than the spacing between the last or outermost finger 2098 and the end of the spine 2100 of the opposite end 2145. This difference in spacing helps to ensure that the binding element 2014 is inserted in the correct orientation. As shown in FIG. 73, the slots 2096 in the wall 2094 are disposed so that a first slot 2095 at one end of the wall 2094 is closer to the wall 2093*a* than a second slot 2097 is to an opposite wall 2093*b*. Walls 2093*a* and 2093*b* are sidewalls of the binding element loading device 2084. Specifically, the spacing between wall 2093*b* and slot 2097 is equal to or greater than the spacing X between the spine end and the last finger 2098 at end 2144 of the binding element 2014; and the spacing between wall 2093*b* and slot 2095 is less than the spacing X. This allows the binding element 2014 to be properly loaded in only one orientation (i.e., with end 2144 adjacent wall 2093*b*), because the plurality of fingers 2098 of the binding element 2014 will not line up properly with the plurality of slots 2096 in the wall 2094 if the binding element 2014 is loaded backward (i.e., with the end 2144 adjacent wall 2093*a*). This is also illustrated in FIG. 72. If the binding element 2014 were to be loaded improperly and the plurality of fingers 2098 were able to extend through the plurality of slots 2096 in the wall 2094, the plurality of fingers 2098 would be opened upside down, thereby making it difficult to line the plurality of fingers 2098 with the plurality of holes in the papers 2012 and attaching the binding element 2014 to the papers 2012 properly.

Other structures for ensuring proper loading of the binding element 2014 may be used and the illustrated embodiment should not be regarded as limiting.

In order to accommodate all three sizes of binding elements 2134, 2138, 2142, the binding element insertion device 2022 interacts with the controller 2170. Once the size of the binding element 2014 has been sensed, the controller 2170 determines how far the finger pullers 2110 should move to fully open the binding element 2014. Also, the movement of the binding element insertion device along the second axis 2102 relative to the paper clamp 2020, and the first axis 2038, is also dependent on the detected size of the binding element 2014. For example, if the binding element 2014 is the large binding element 2134, the controller 2170 will signal the motor 2116 to move the finger pullers 2110 a longer distance than if the binding element 2014 is the small binding element 2142, because the fingers 2098 of the large binding element 2134 are longer than the fingers 2098 of the small binding element 2142 and more movement is needed to fully open the large binding element 2134. Similarly, as will become more apparent below, the binding element insertion device 2022 will not have to move as far when moving along the second axis 2102 toward the paper clamp 2020 when the large binding element 2134 is used. Thus, the controller 2170 will use the information received from the sensor 2130 to control the two motors 2116, 2108 that affect the opening of the binding element 2014 and the positioning of the binding element 2014 with respect to the papers 2012 to be bound.

Generally, the binding element insertion device 2022 may have any construction or configuration and the construction illustrated is not intended to be limiting. Instead, the term "binding element insertion device" may be regarded as a generic structural term to describe a mechanism that insert the fingers of a binding element into the punched holes in a stack of documents. For example, the binding element insertion device may use a different mechanism for engaging and opening the fingers, a different binding element pusher (or it may be omitted), or different sensors for detecting the size of the binding element (or no sensors may be used at all).

Figure 80:
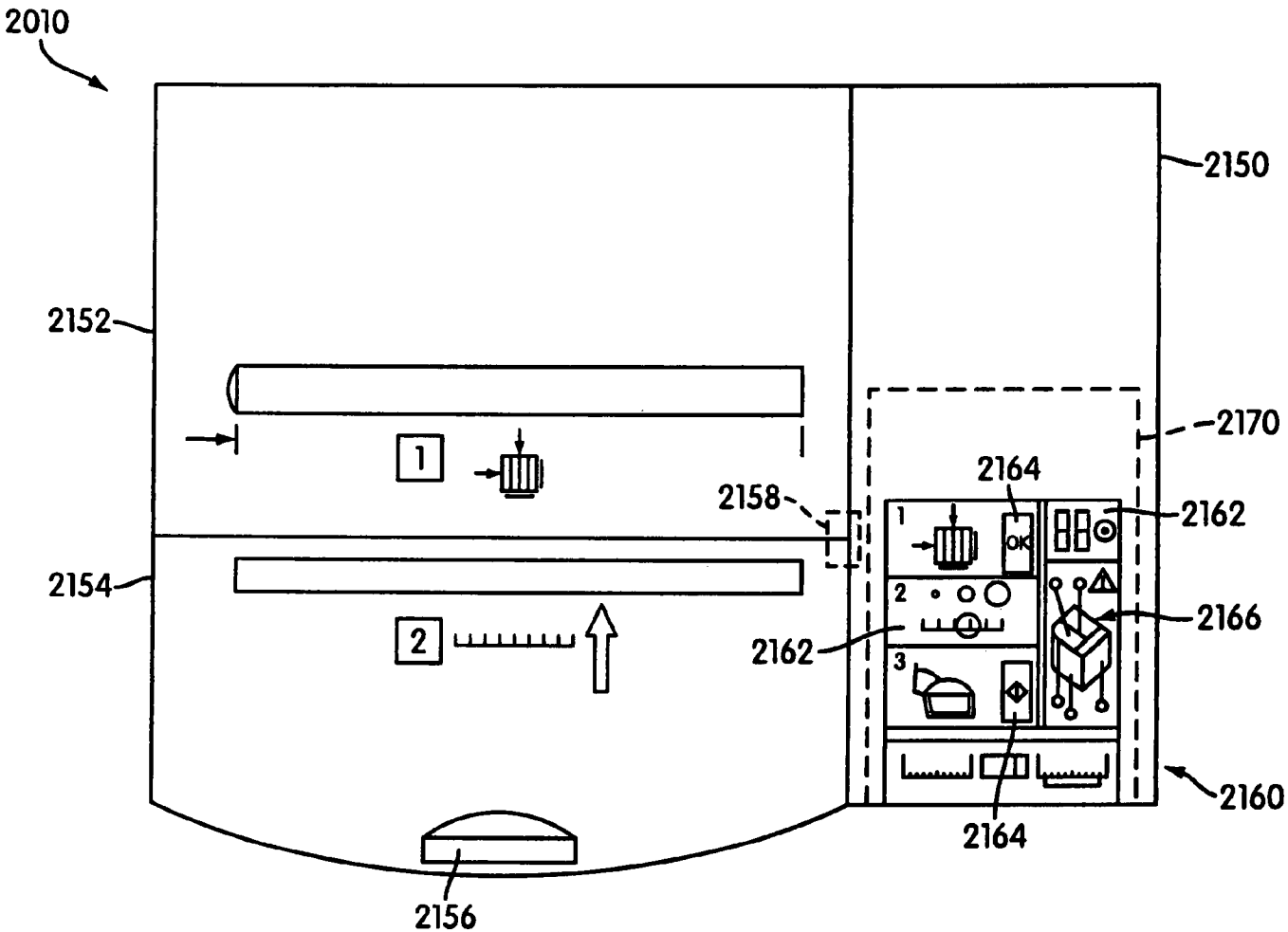
FIG. 80 is a top view of the binding apparatus of FIG. 63 with the cover in place.

One embodiment of the apparatus 2010 with a cover 2150 is shown in FIG. 80. The cover 2150 includes a lid 2152 that is hingedly mounted to the rest of the cover 2150 so that the user may open the lid 2152 to insert the stack of papers 2012 in the paper clamp 2020. A second lid 2154 may also be hingedly mounted to the rest of the cover 2150 so that the user may open the lid 2154 to insert the binding element 2014. It is also contemplated that the lid 2154 that provides access to the binding element loading device 2084 may be slidably mounted such that it interacts with the pusher 2088, e.g. the recess portion 2092. This way, the user may pull on a handle 2156 that is disposed on the lid 2154 to load the binding element 2014. Of course, the invention is not limited to the illustrated embodiment. For example, it is contemplated that a single lid may be used to provide access to both the paper clamp 2020 and the binding element insertion device 2022. An interlock device 2158 may also be provided to lock the lids 2152, 2154, or the single lid, in the closed position once operation of the apparatus 2010 has begun.

Also shown in FIG. 80 is a user interface 2160 that is configured to provide the user with information about the stage of the process, which will be discussed below in greater detail. In the illustrated embodiment, the interface 2160 includes a plurality of visual indicators 2162 that may indicate whether the papers 2012 have been loaded properly, may tell the user which size of binding element 2014 to insert, based on the measured thickness of the stack of papers 2012, and may also alert the user when the bound product is ready to be taken out of the apparatus 2010. The user interface 2160 also includes a plurality of input devices 2164, such as buttons, that the user may use to give instructions to the apparatus 2010. One of the indicators 2166 may be used to alert the user when an error has occurred in the apparatus 2010 so that the user may take corrective action.

Figure 81:
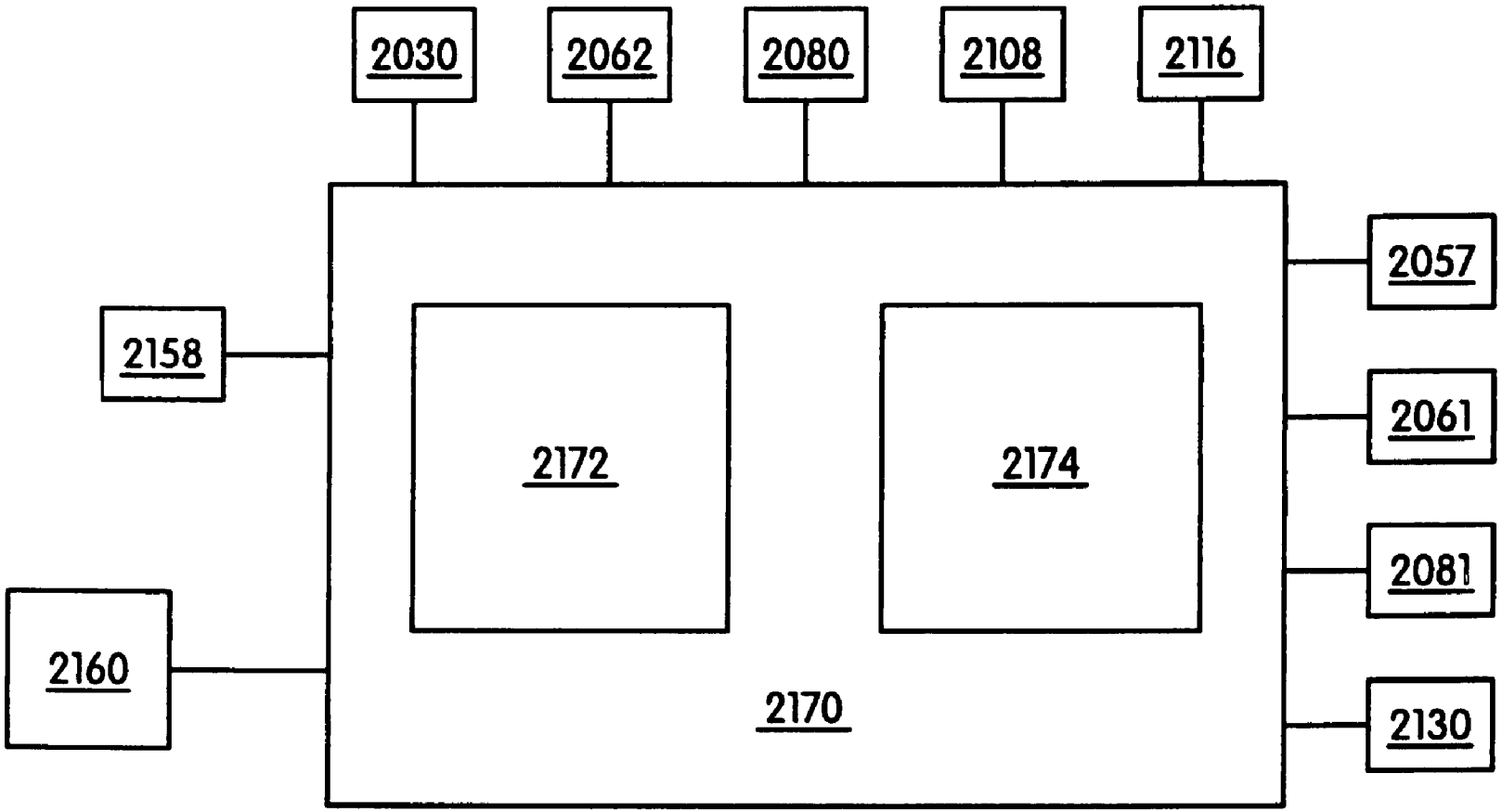
FIG. 81 is a schematic view of a controller of the binding apparatus of FIG. 63.

The user interface 2160 is in communication with the controller 2170, as shown schematically in FIG. 81. The controller 2170 is also in communication with all of the motors 2030, 2062, 2080, 2108, 2116, the sensors 2057, 2061, 2081, 2130, and the interlock device 2158, discussed above, that are located within the apparatus 2010. Hence, the controller 2170 controls the entire punching and binding method, which is discussed in further detail below. The controller 2170 includes a central processor 2172 that is capable of receiving and executing commands that may be programmed and stored in memory 2174. The controller 2170 may be hard-wired into the apparatus 2010 and thus physically connected to the motors and sensors of the apparatus, or the controller 2170 may use wireless technology to communicate with these components, or a combination of hard-wired and wireless connections may be used. Details of the controller 2170 are not discussed herein, as any controller may be used to carry out the functions of the apparatus 2010. The illustrated controller 2170 is not intended to be limiting in any way.

When the user would like to bind a stack of papers 2012 together with a binding element 2014, the user starts by opening the lid 2152 of the apparatus 2010. The paper clamp 2020 is already in an open position, and the user places the papers 2012 in the paper clamp 2020 and ensures that the papers 2012 are properly aligned with each other in the stack.

The paper sensor senses the presence of the papers 2012 and sends a signal to the controller 2170 so that the controller 2170 will be ready to send a signal to the motor 2062. The user may press the button 2164 at the user interface 2160 to indicate that the user is ready to proceed with the binding operation. The depression of the button 2164 sends a signal to the controller 2170, which signals the motor 2062 to rotate the gear 2064 so that the cams 2058 rotate and allow the first plate 2040 to move towards the second plate 2042. As the first plate 2040 moves toward the second plate 2042 to clamp the stack of papers 2012, the thickness sensor 2061 senses the thickness of the stack of papers 2012, and sends a signal to the controller 2170. The controller 2170 sends a signal to the user interface 2160 so that an indicator 2162 may tell the user what size binding element 2014, e.g. small 2142, medium 2138, or large 2134, to insert into the apparatus 2010. The user chooses the correct binding element 2014, opens the lid 2154, pulls back the pusher 2088, and inserts the binding element 2014 into the binding element loading device 2084. The users releases the pusher 2088, and if the binding element 2014 has been inserted with the proper orientation, the pusher 2088 will push the plurality of fingers 2098 through the plurality of slots 2096 in the wall 2094. The sensor 2130 senses which size binding element 2014 has been inserted, and compares the sensed size to the size that was signaled to the user. If these sizes are not the same, an error message is sent to the user interface 2160 at the error indicator 2166, thereby alerting the user that a binding element 2014 of the wrong size has been inserted into the apparatus 2010. The apparatus 2010 will not operate until a binding element 2014 of the correct size has been inserted, in the correct orientation, into the binding element loading device 2084.

When the binding element 2014 of the correct size for the thickness of the stack of papers 2012 being held by the paper clamp 2020 has been properly loaded, the controller 2170 sends a signal to the user interface 2160 that tells the user to close the lids 2152, 2154 of the apparatus 2010. As an optional feature, once the lids 2152, 2154 have been closed, interlocks actuate so that the lids 2152, 2154 cannot be opened until either the binding apparatus 2010 has finished its cycle, or the cycle has been safely aborted.

Figure 82:
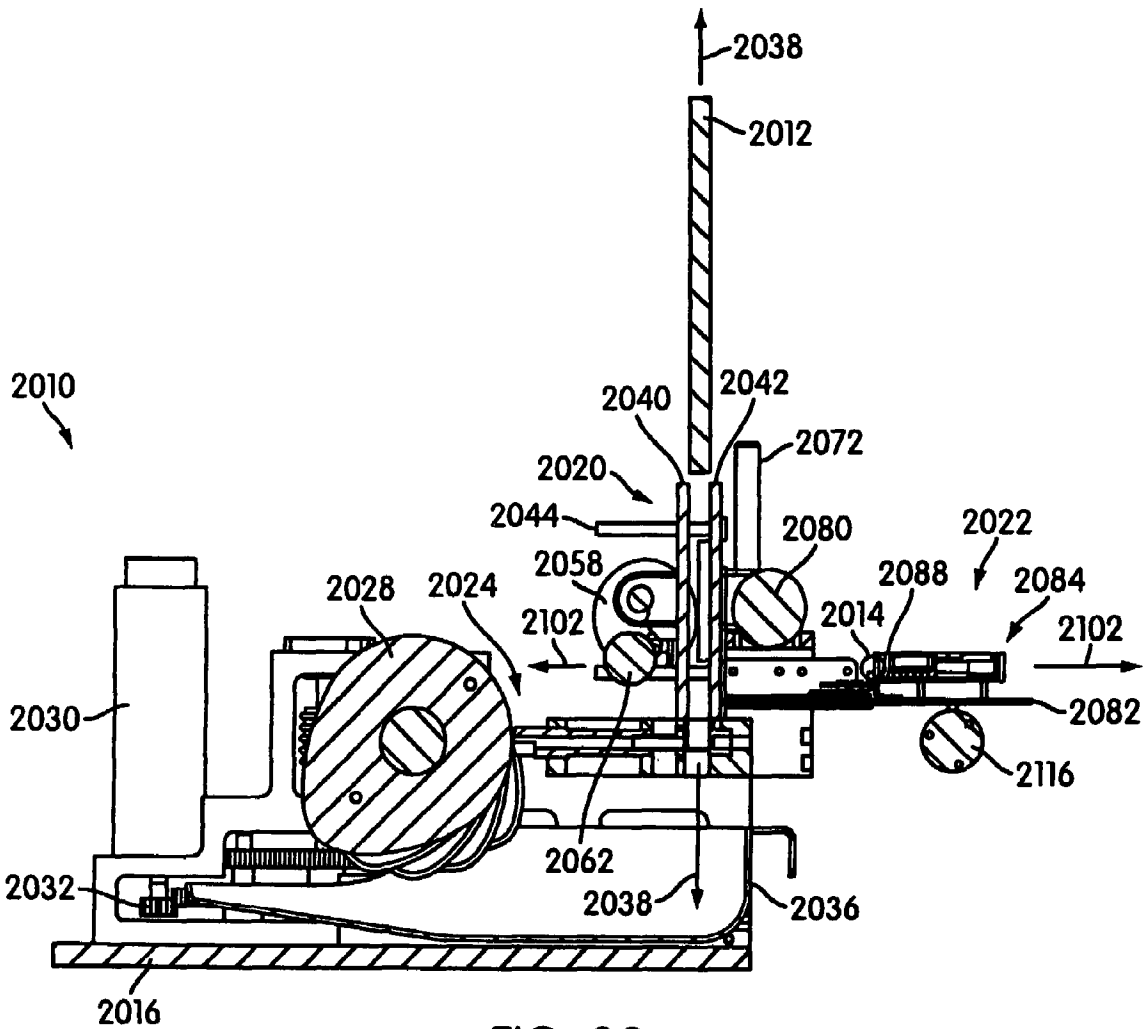
FIG. 82 is a cross-sectional view of the binding apparatus of FIG. 63 as a plurality of papers are being loaded into the apparatus.
Figure 83:
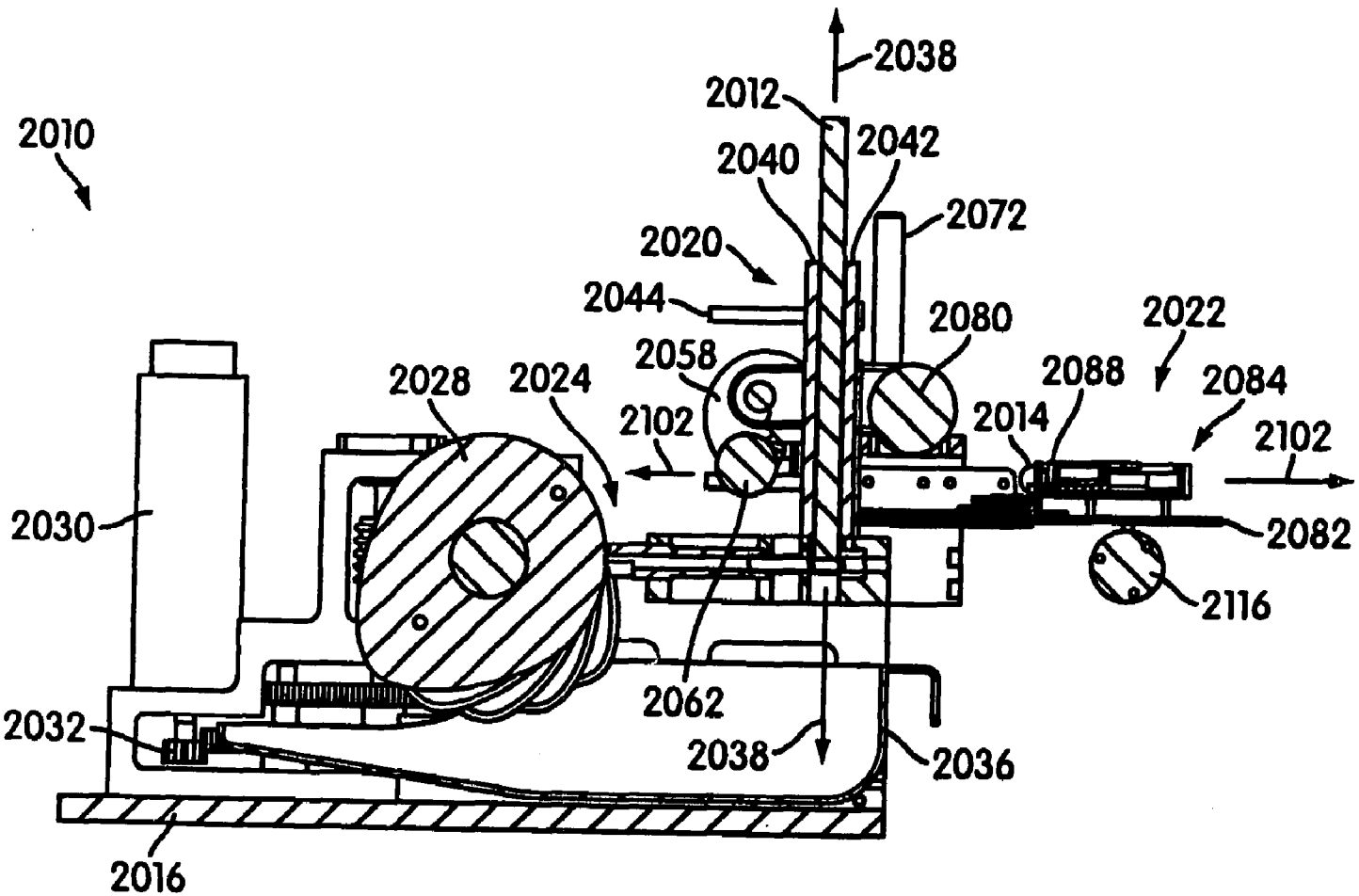
FIG. 83 is the cross-sectional view of FIG. 82, after the plurality of papers have been loaded, but before the papers have been punched.

FIGS. 82-88 illustrate the internal operation of the binding apparatus 2010. As shown in FIG. 82, the papers 2012 are loaded into the paper clamp 2020, and the binding element 2014 is loaded into the binding element insertion device 2022. FIG. 83 shows the position of the papers 2012 when the papers 2012 are being clamped by the paper clamp 2020 and are ready to be punched by the plurality of punches 2024. As shown in FIG. 83, the binding element loading device 2084 is located away from the punches 2024.

Figure 84:
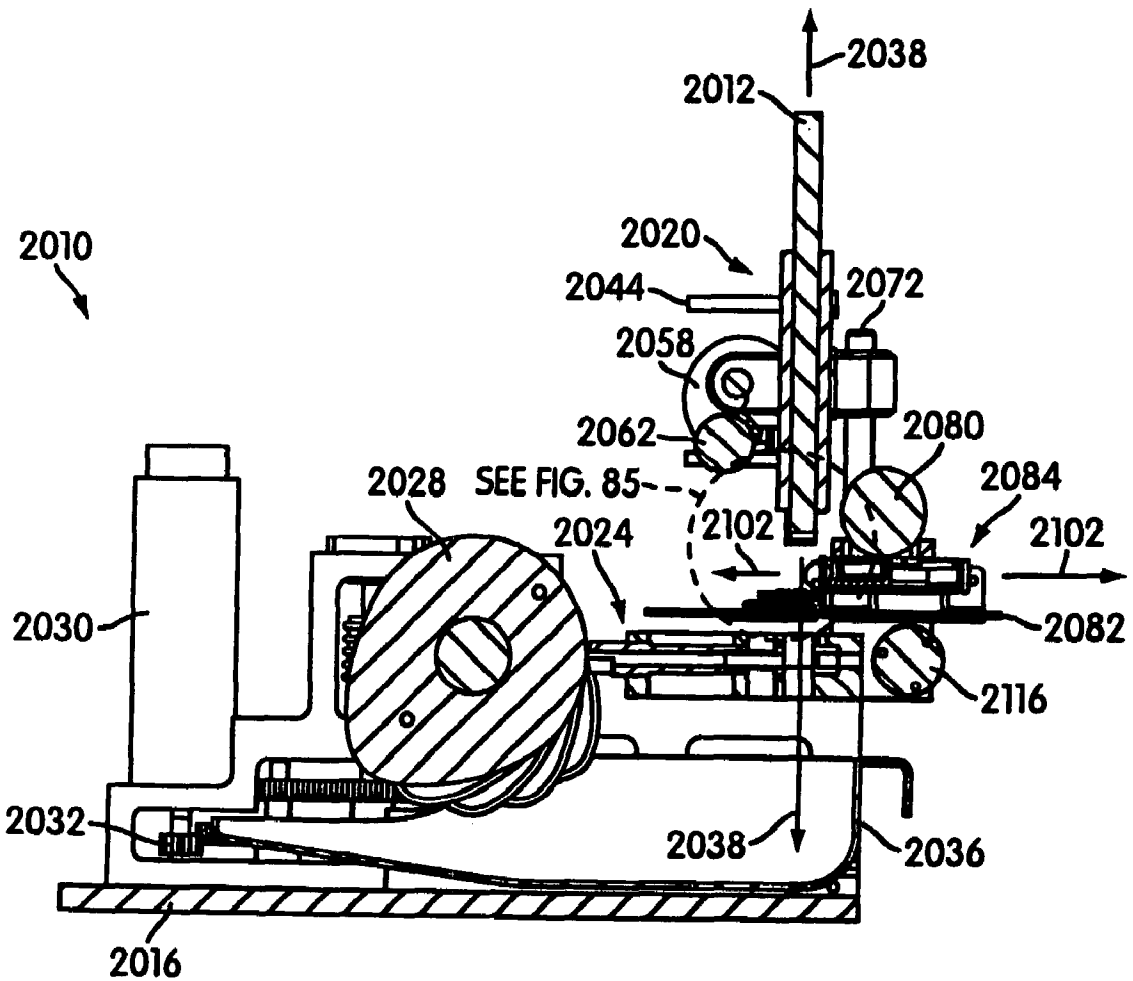
FIG. 84 is the cross-sectional view of FIG. 82, after the papers have been punched and the paper clamp has moved the papers upward, as the binding element insertion device is moved into position relative to the paper clamp.
Figure 85:
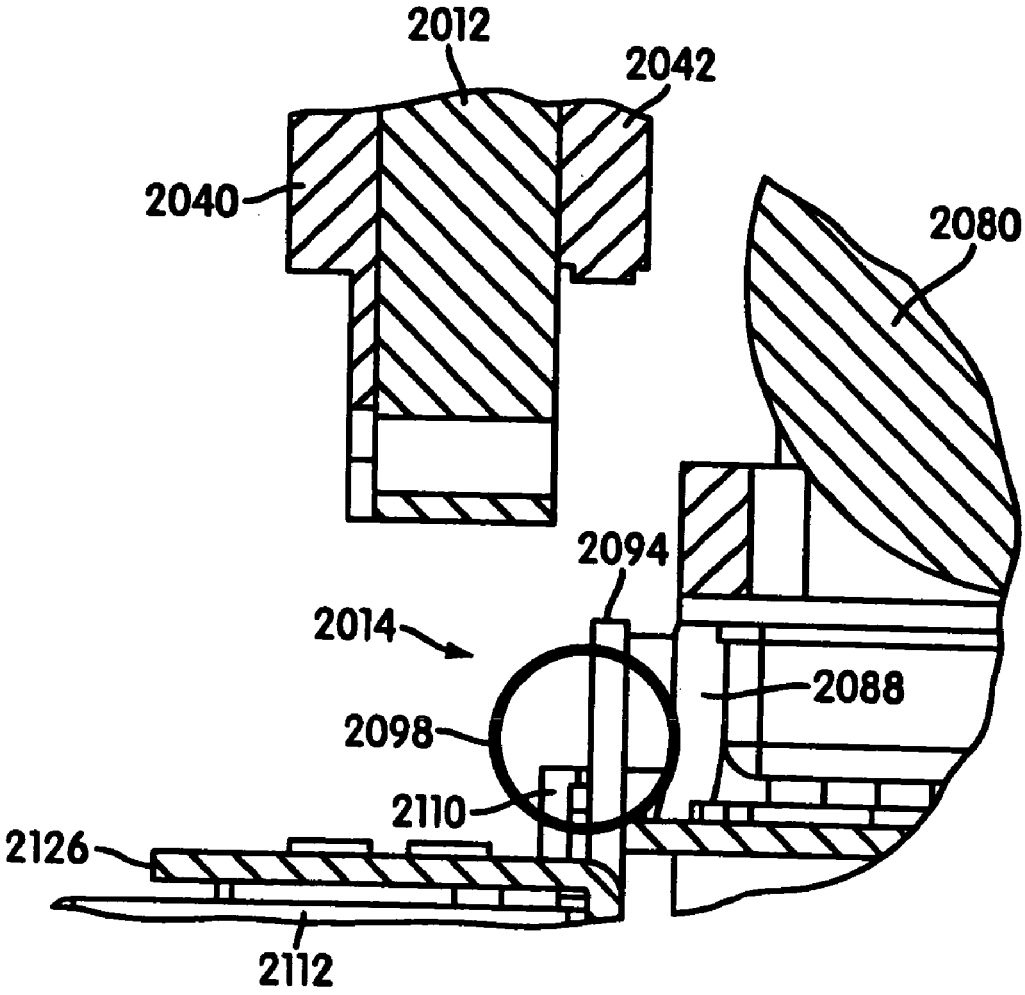
FIG. 85 is detail B of FIG. 84.
Figure 86:
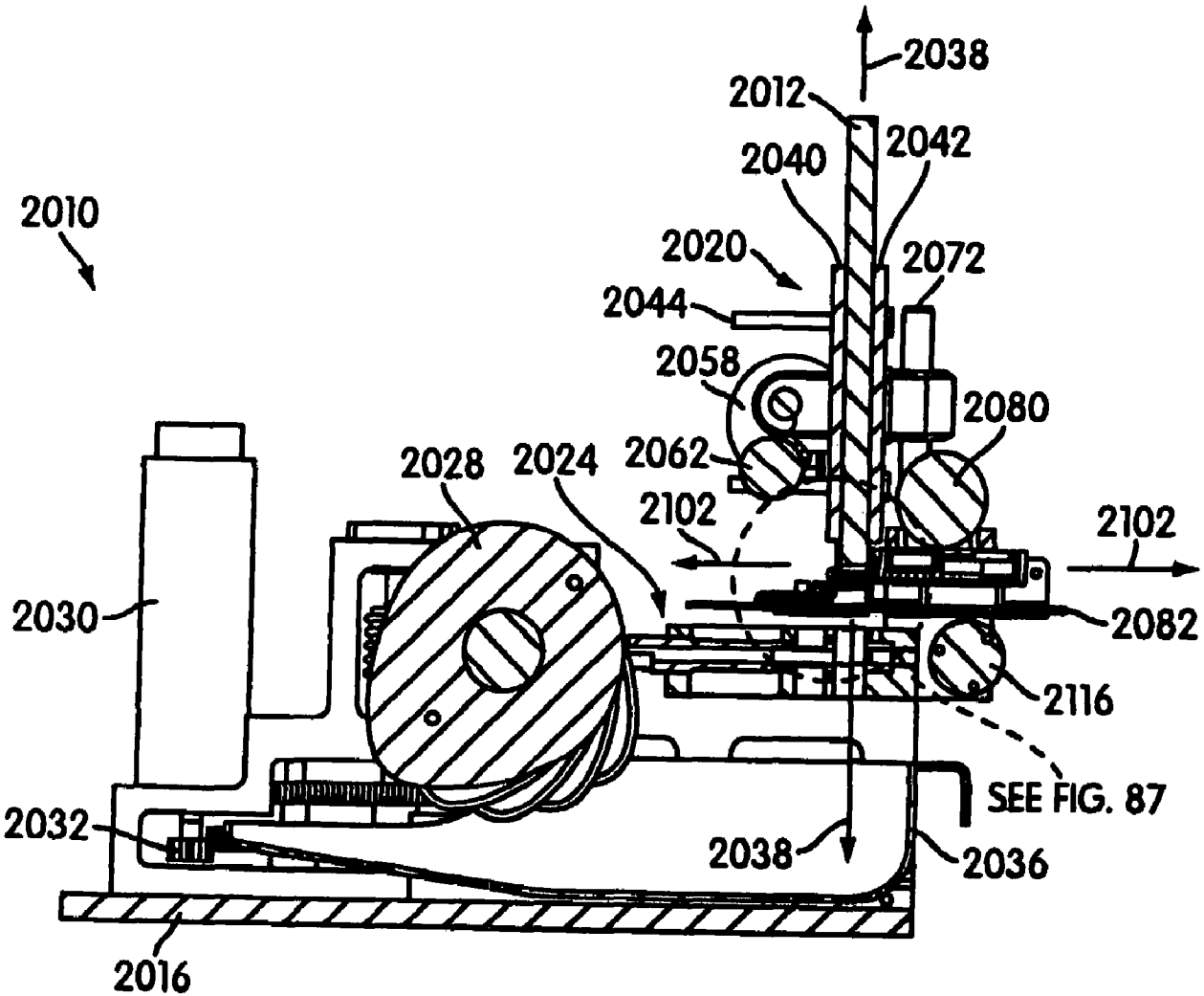
FIG. 86 is the cross-sectional view of FIG. 82, with the paper clamp and the binding element insertion device in position, with a plurality of fingers of the binding element fully extended.
Figure 87:
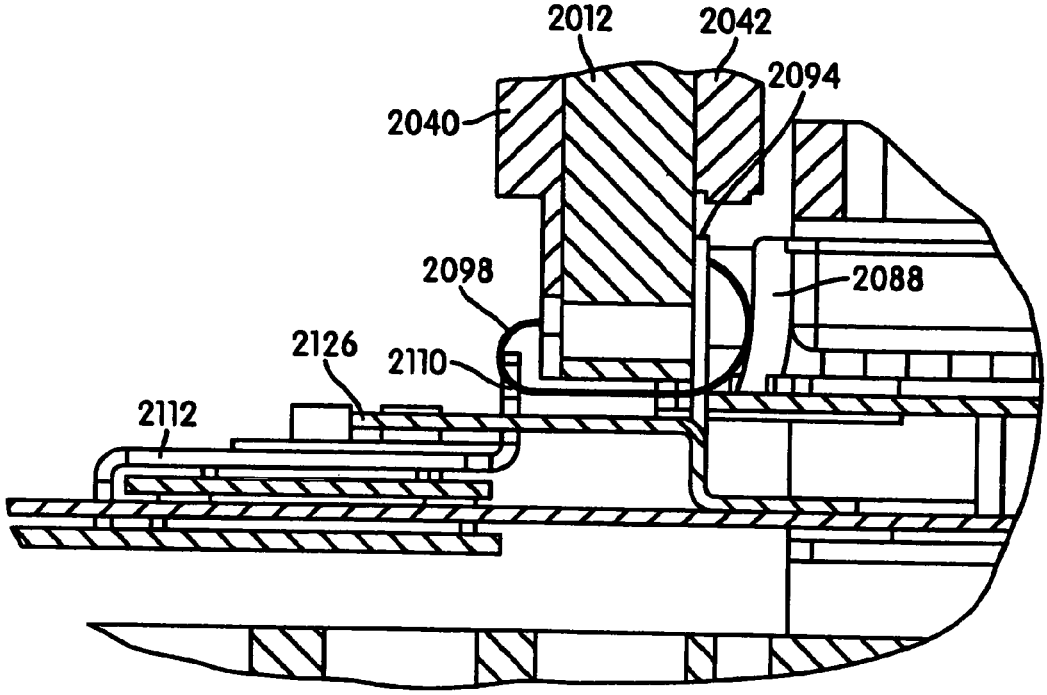
FIG. 87 is detail C of FIG. 86.

Once the papers 2012 have been punched by all of the punches 2024, the motor 2080 rotates the rotatable post 2078 such that the paper clamp 2020, with the punched papers 2012 therein, is raised along the first axis 2038. The binding element insertion device 2022 is powered along the second axis 2102 by the motor 2108 toward the first axis 2038, as shown in FIGS. 84 and 85. Either as the binding element insertion device 2022 is moving, or shortly after it has stopped in its binding element insertion position, the motor 2116 moves the plurality of finger pullers 2110 so that the plurality of fingers 2098 of the binding element 2014 are pulled into their open, extended position, as shown in FIGS. 86 and 87. The motor 2080 moves the paper clamp 2020 downward along the first axis 2038 to a position that is above the punching position, as shown in FIGS. 86 and 87, and at a position that places the punched holes in alignment with tips of the plurality of fingers 2098 of the binding element 2014. The controller 2170 controls the precise stopping location of the paper clamp 2020, as the location is based on the size of the binding element 2014 being used. For example, if the binding element 2014 is the large binding element 2134, the paper clamp 2020 will not need to move down as far as it would if the binding element 2014 is the small binding element 2142 because the tips of an uncurled large binding element will be somewhat higher.

Once the paper clamp 2020 and the binding element insertion device 2022 are in their proper positions, based on the size of the binding element 2014, the motor 2116 reverses so that the finger pullers 2110 may return to their original position, thereby releasing the fingers 2098 of the binding element 2014. Because the fingers 2098 of the binding element 2014 are aligned with the holes in the papers 2012, the fingers 2098 pass through the holes, back toward the spine 2100, thereby binding the papers 2012.

Figure 88:
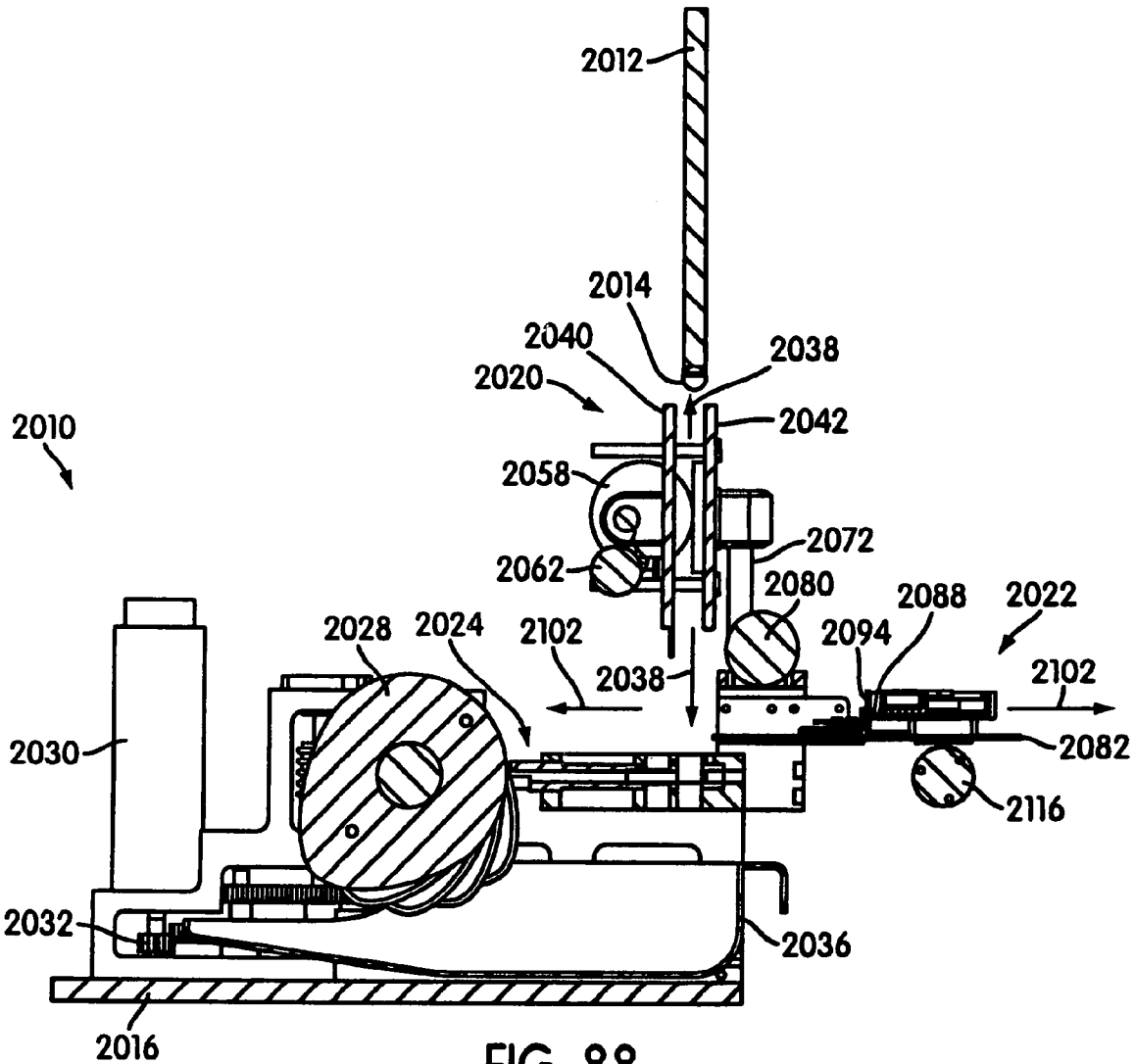
FIG. 88 is the cross-sectional view of FIG. 82, with the papers bound by the binding element, and the bound papers being removed from the apparatus.

As shown in FIG. 88, the paper clamp 2020 moves upward along the first axis 2038, and the binding element insertion device 2022 moves away from the first axis 2038 along the second axis 2102. The motor 2062 causes the paper clamp 2020 to open so that the bound papers 2012 may be removed from the apparatus. The binding element insertion device 2022 is ready to be loaded again. Once the bound papers have been removed from the apparatus 2010, the controller 2170 signals the motor 2080 to move the paper clamp 2020 back to the position shown in FIG. 82, so that it is ready to receive a new set of papers to be bound, even if the thickness of the papers is different from the thickness of the previously bound set.

The controller 2170 may also be programmed to count the number of cycles that have been completed so that it may provide a signal to the user interface 2160 that indicates that the tray 2036 should be emptied. Because information about the thickness of the papers 2012 that are punched and bound in the apparatus 2010 is provided to the controller 2170, the count may be weighted to provide a more accurate signal.

Figure 89:
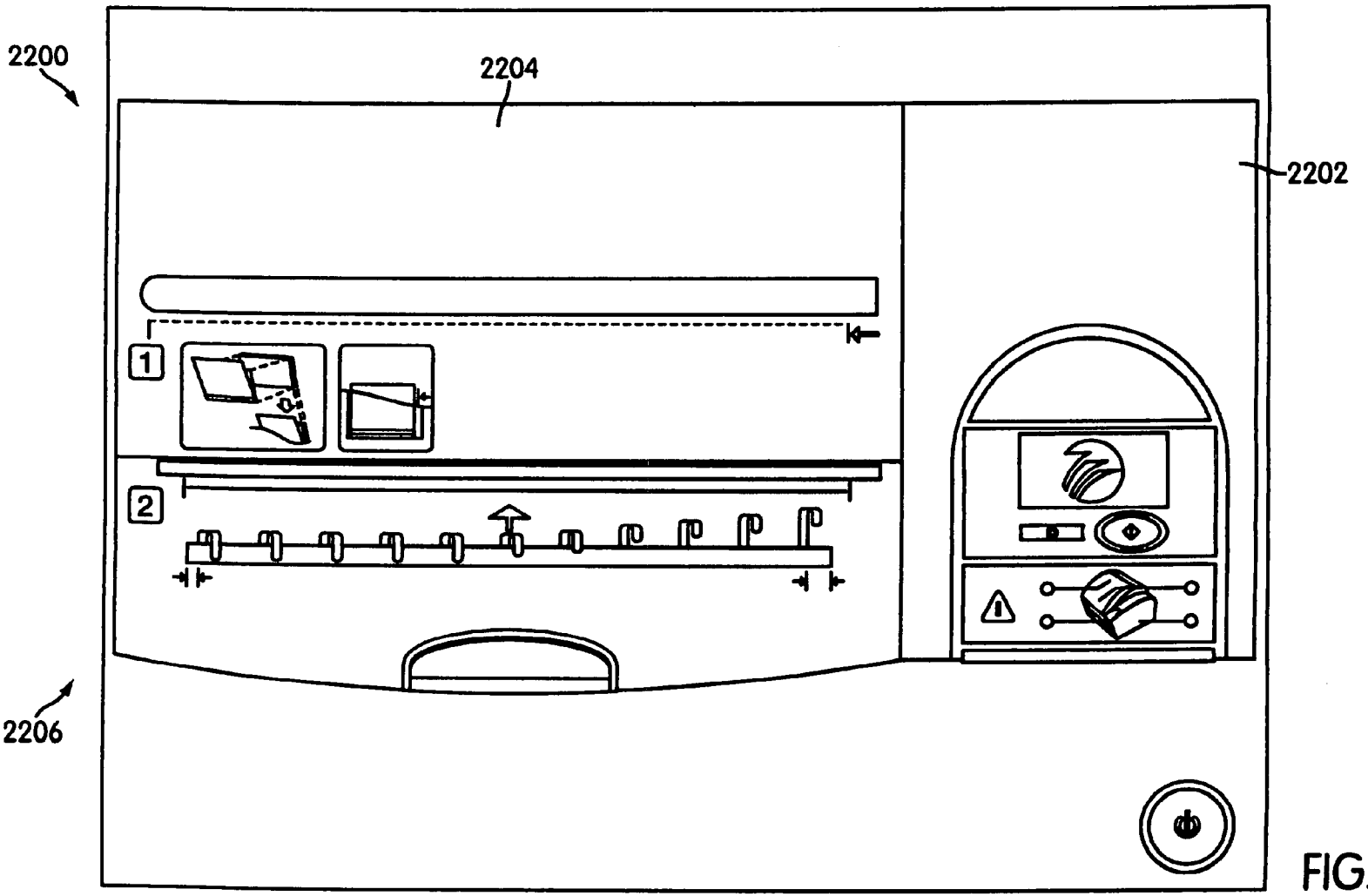
FIG. 89 is a top view of another embodiment of the binding apparatus with a user interface, with the apparatus in a standby state.

FIGS. 89-101, 108*a*, and 108*b* illustrate another embodiment of a binding apparatus 2200. In this embodiment, the internal features in the apparatus 2010 described above may also be used. As shown in FIG. 89, the apparatus 2200 includes a housing 2202 that protects the internal assemblies, such as the frame 2015, the punching mechanism 2018, the paper clamp 2020, and the binding element insertion device 2022.

Figure 90:
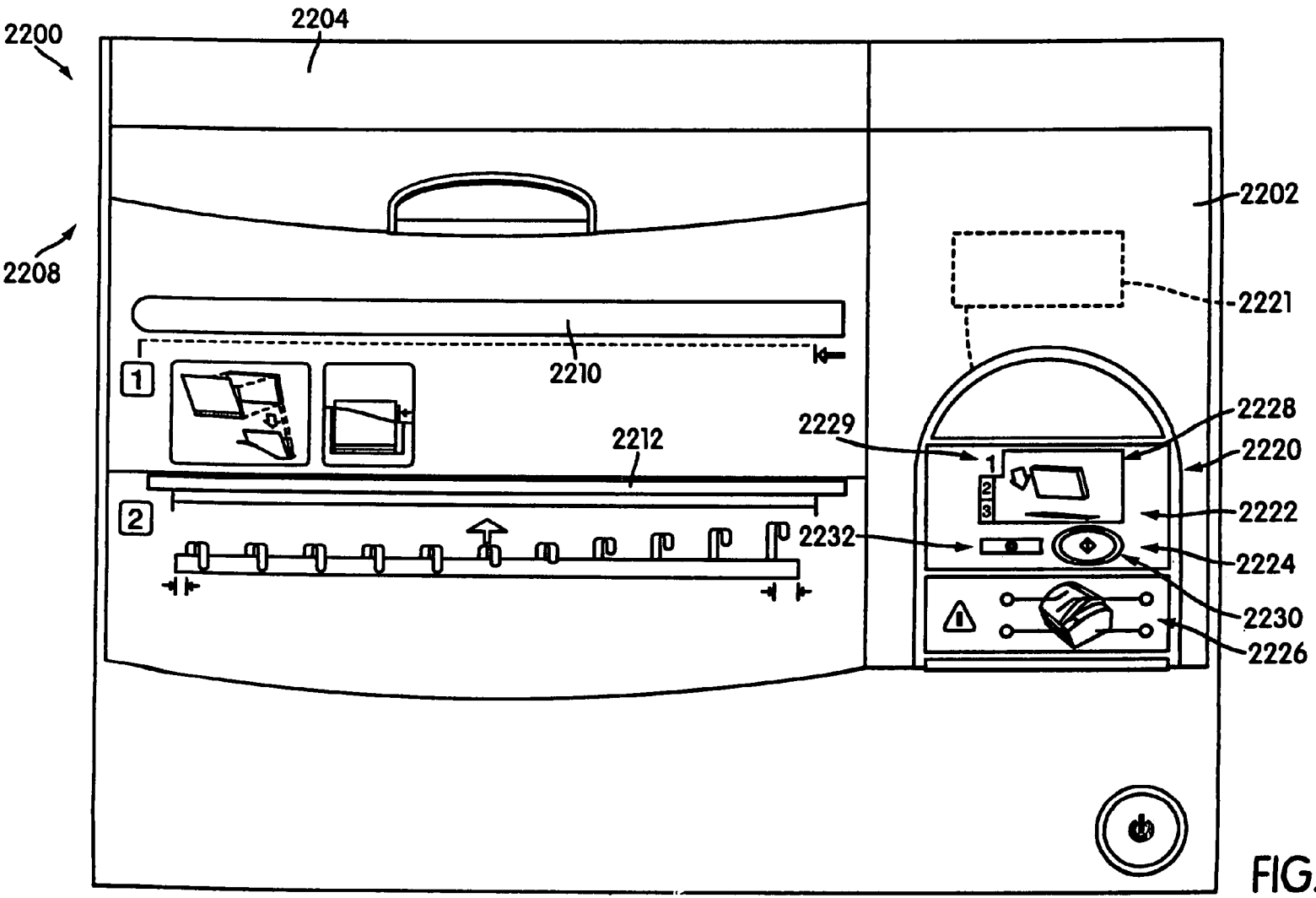
FIG. 90 is a top view of the binding apparatus of FIG. 89, with a lid in an open position.

A lid 2204 is operatively connected to the housing 2202 so that the lid 2204 may be moved between a closed position 2206, as shown in FIG. 89, and an open position 2208, as shown in FIG. 90. The lid 2204 may be hinged so that the lid 2204 may pivot between the closed position 2206 and the open position 2208, or the lid 2204 may be configured to slide relative to the housing 2202. The illustrated embodiment is not intended to be limiting in any way. Any configuration is contemplated, so long as a paper opening, generally shown at 2210, and a binding element opening, generally shown at 2212, are accessible by the user when the lid 2204 is in the open position 2208. An interlock device 2214, shown in FIGS. 108*a* and 108*b*, may be used to lock the lid 2204 in the closed position 2206 so that the user cannot access the inside of the apparatus 2200 once the punching an binding operations have begun. Likewise, the interlock device 2214 is configured to not allow the apparatus 2200 to operate if the lid 2204 is in the open position 2208. The interlock device 2214 may be of the type that includes a solenoid 2216 and arm arrangement, as would be appreciated by one of skill in the art. Any interlock device may be used, and the one illustrated is not intended to be limiting in any way. The interlock device

2214 is in communication with a controller 2221, which controls the various motors, discussed above, within the apparatus.

As shown in the Figures, the user interface 2220 is provided on the housing 2202 in a location that is convenient to the user. As shown, the user interface 2220 is generally located on the top of the apparatus 2200. It is also contemplated that the user interface 2220, or even parts of the user interface 2220, described in further detail below, may be located on the front or the side of the apparatus 2200. The user interface 2220 is in communication with the controller 2221. The controller 2221, like the controller 2170 discussed above, is in communication with the various sensors and motors throughout the apparatus 2200. The controller 2221 may be a microprocessor with suitable software for controlling the operations of the apparatus 2200.

As shown in FIG. 90, the user interface 2220 generally includes three portions, including a visual display portion 2222, at least one input device 2224, and at least one indicator 2226. The visual display 2222 is configured to provide information to the user to help guide the user through a plurality of steps during operation of the apparatus 2200. For example, the visual display 2222 may include a screen 2228 that displays different steps of the process, either through the use of word, symbols, or preferably animation. The screen 2228 may be an LCD display or may be a small monitor, and a display driver (not shown) may be used to display items on the screen 2228. When the apparatus 2200 is powered down, or in the "off" condition, the screen 2228 is preferably blank. When the apparatus 2200 is powered up, or in the "on" condition, the screen 2228 preferably provides information as to the state of the apparatus 2200, such as "standby," "loading," "punching," "binding," "unloading," etc.

Figure 91:
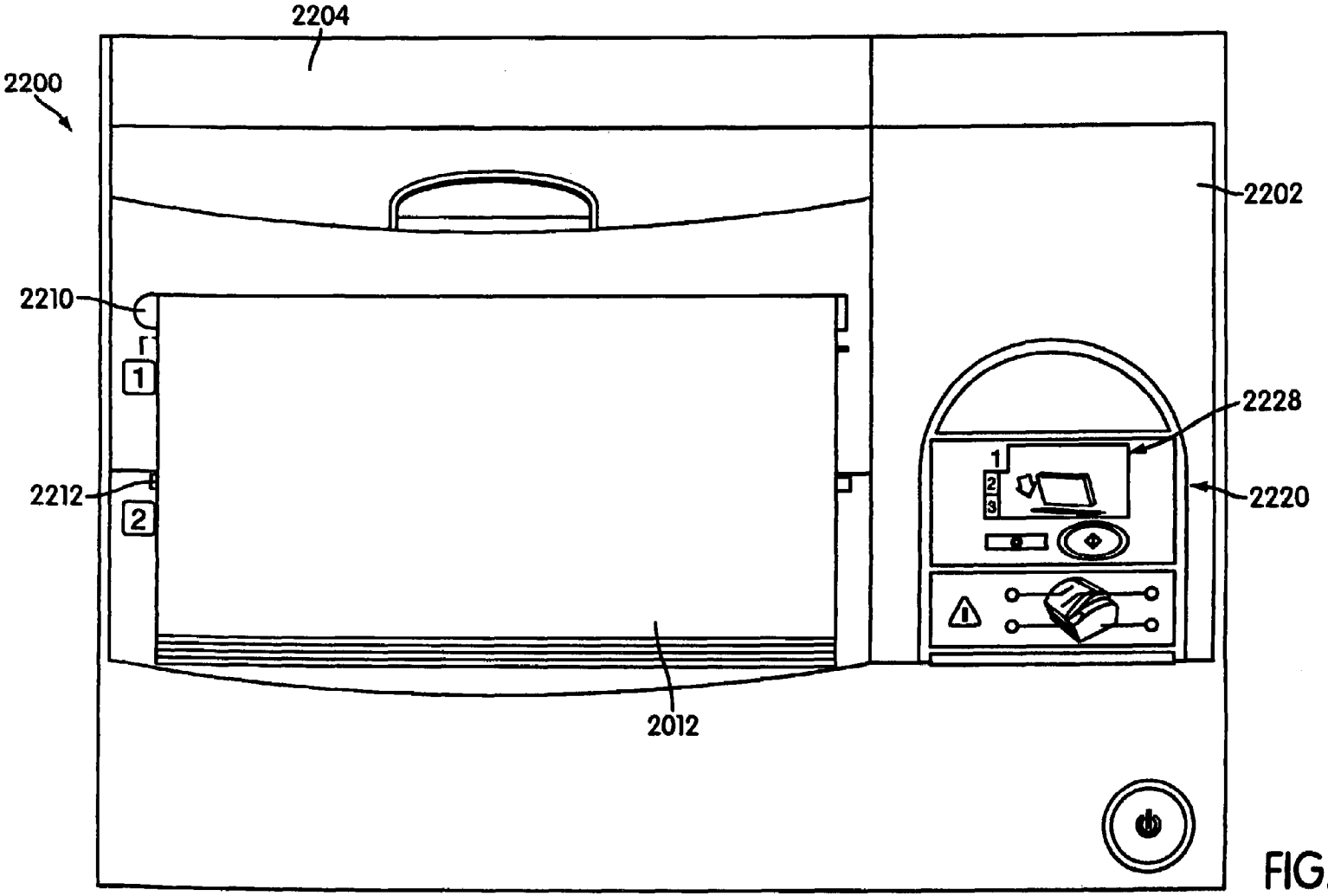
FIG. 91 is a top view of the binding apparatus of FIG. 89, with the plurality of papers being loaded into the apparatus.

For example, after the apparatus 2200 has been turned on, the screen 2228 may show an animation representative of the lid 2204 being opened, thereby communicating to the user that the lid 2204 should be moved from the closed position 2206 to the open position 2208. After the user has opened the lid 2204, a lid sensor (not shown) that has sensed the movement, or has sensed that the lid 2204 is now in the open position 2208, will provide a signal to the controller 2221, which signals the screen 2228 to generate an image that informs the user to insert the papers 2012 into the paper opening 2210, as shown in FIG. 90. In the illustrated embodiment, the image may be an animation representative of the papers 2012 being inserted into the apparatus 2200. Alternatively, a still image of the papers 2012 being inserted into the apparatus 2200 may be used. In addition to providing the image, the screen 2228, or another part of the visual display 2222, may also provide an indication 2229 as to which step in a sequence of steps is being performed. For example, as shown in FIG. 90, the numeral "1" is shown to indicate that loading of the paper 2012 is the first step. Any other sequence of indications (e.g., A, B, C, or I, II, III, etc.) may be used, with each indicator in the sequence corresponding to the main phases of operation for the apparatus 2200. Upon prompting, the user may load the papers 2012 through the paper opening 2210, as shown in FIG. 91.

Figure 92:
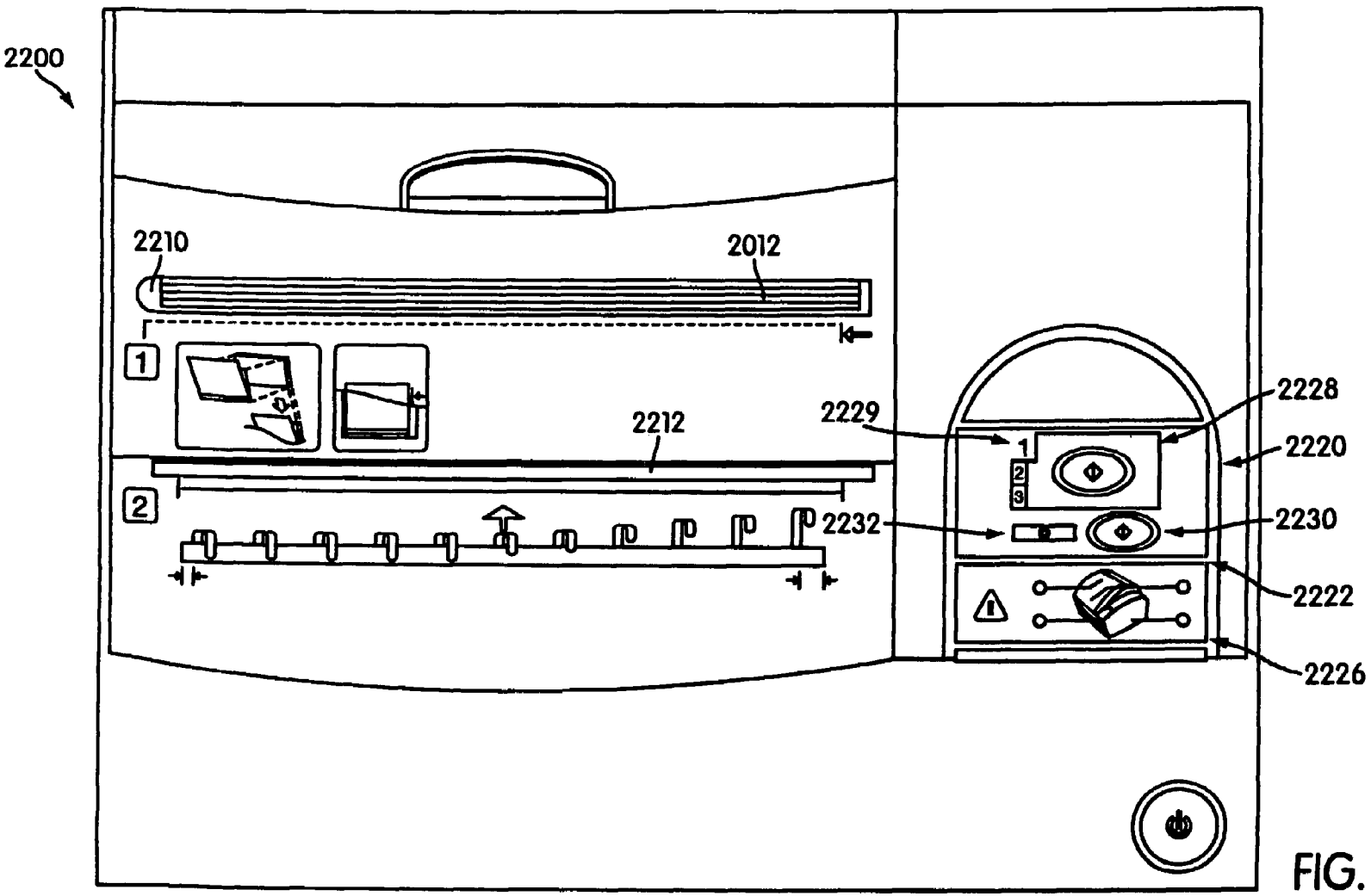
FIG. 92 is a top view of the binding apparatus of FIG. 89, with the plurality of papers loaded in the apparatus and the user interface instructing the user to press an input device.

After the paper 2012 has been loaded, and the presence of the paper 2012 has been detected, the controller 2221 may signal the screen 2228 so that the screen 2228 indicates that the user needs to press one of the input devices 2224 to proceed, as shown in FIG. 92. A first input device 2230 may be shaped differently from a second input device 2232 to indicate to the user that they provide different function. The first and second input devices 2230, 2232 may also be color coded. For example, the first input device 2230 may be substantially circular in shape and be colored green, thereby indicating that the user should press the first input device 2230 to signal to the apparatus 2200 to continue. The second input device 2232 may be substantially rectangular in shape and be red in color, thereby indicating that the user should press the second input device 2232 to abort the operation of the apparatus 2200. Of course any combination of shapes and color may be used, and the shapes shown and colors described herein are merely examples, and are not intended to be limiting in any way. As shown in FIG. 92, the indicator on the screen 2228 may be a pictorial representation of the first input device 2230 so that the user knows to engage the first input device 2230 to proceed. After the user has engaged the first input device 2230, the paper clamp 2020, discussed above, may clamp the paper 2012 and the sensor 2061, also discussed above, may sense the thickness of the paper 2012 and provide the sensed information to the controller 2221. The controller 2221 may then communicate the appropriate information, such as the size of the binding element 2014 that should be inserted into the binding element opening 2212, to the screen 2228 so that the screen 2228 may provide the information to the user, as shown in FIGS. 93 and 94.

Figure 93:
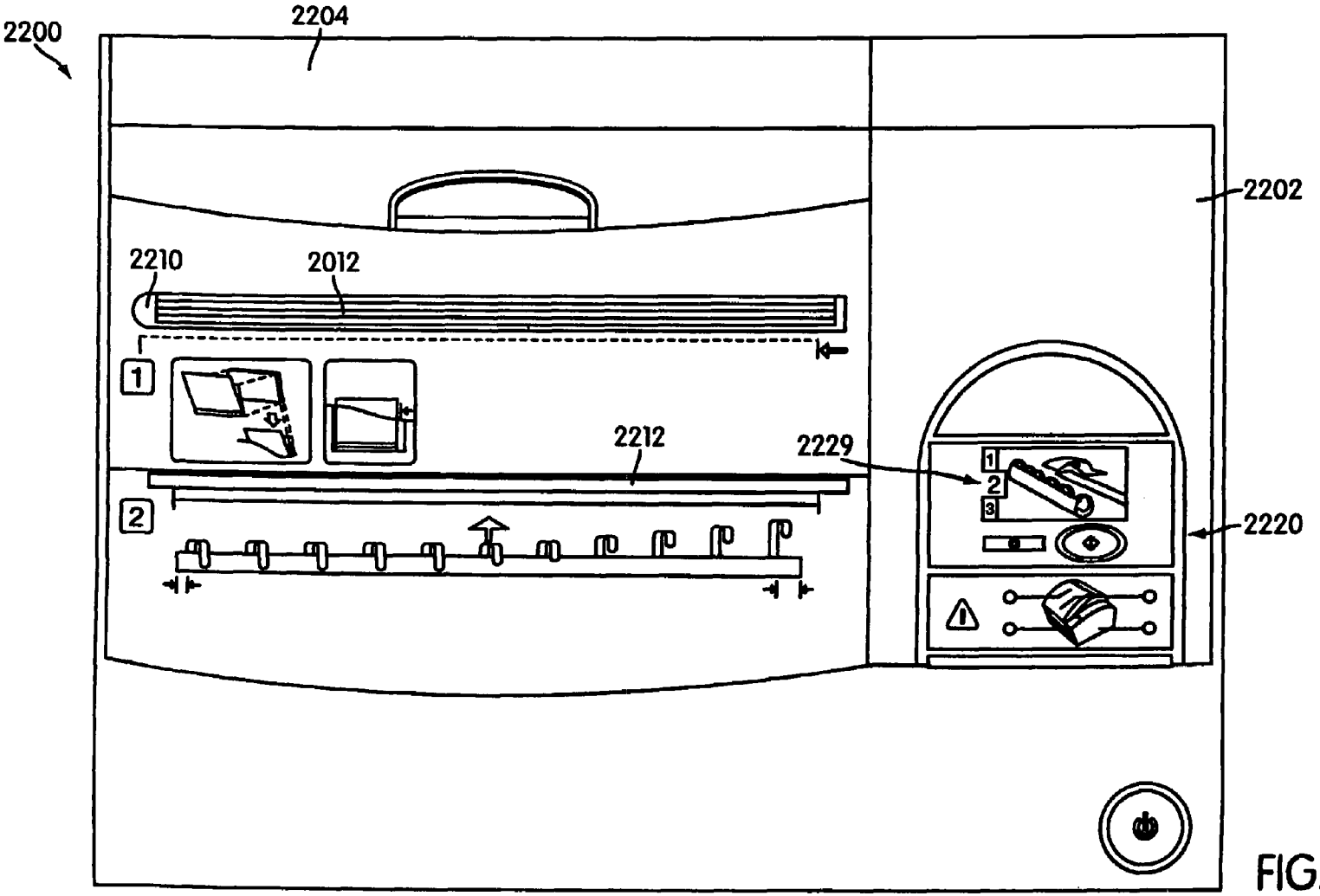
FIG. 93 is a top view of the binding apparatus of FIG. 89, with the user interface instructing the user to load the binding element into the apparatus.
Figure 94:
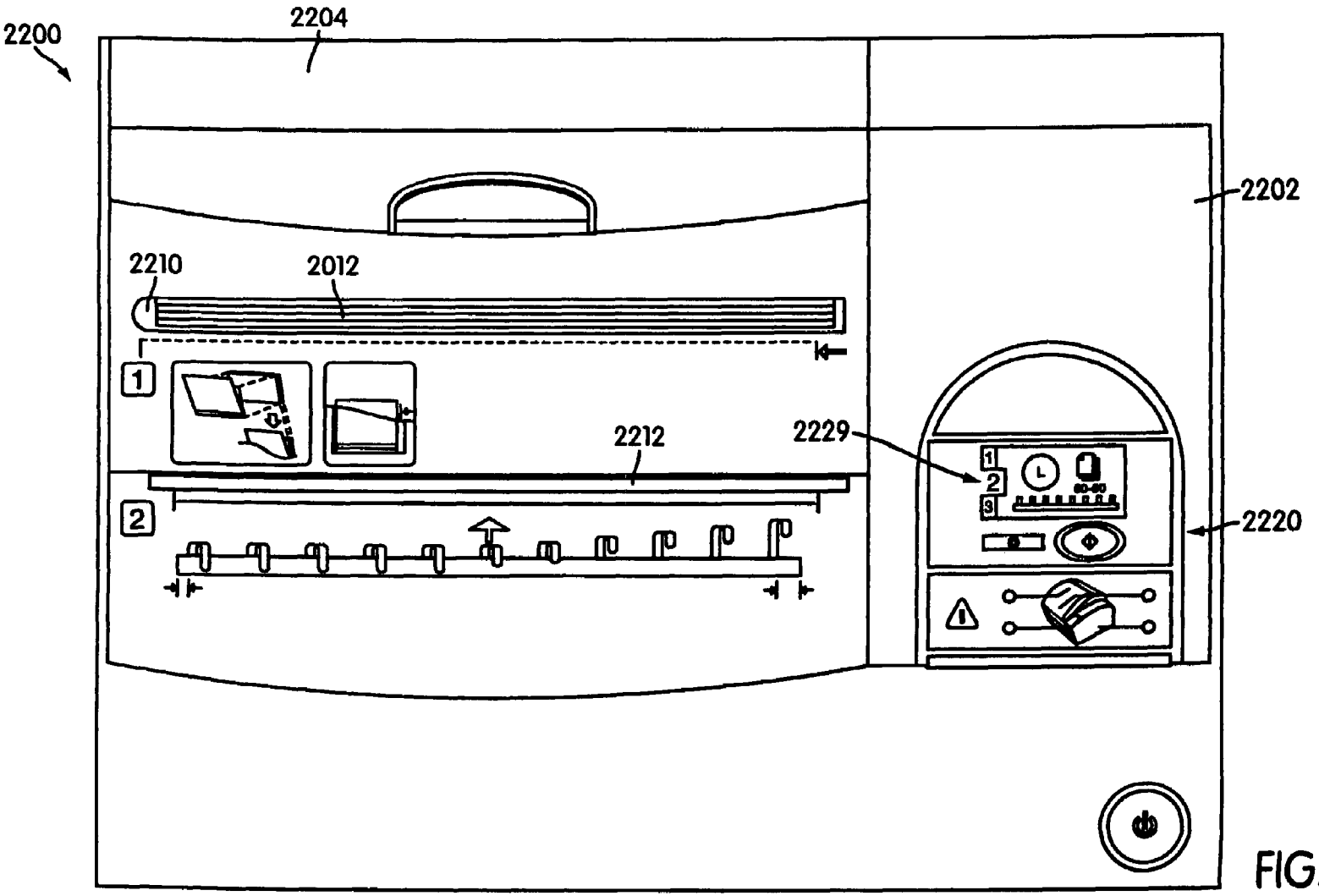
FIG. 94 is a top view of the binding apparatus of FIG. 89, with the user interface providing the user with information regarding the size of the binding element to load into the apparatus.

As seen in FIG. 94, a still or animated image representative of the binding element 2014 being inserted into the apparatus 2200 is displayed to indicate to the user to insert the binding element 2014 into the apparatus 2200. As seen in FIG. 94, an indication of the size of the binding element 2014 to be inserted is displayed. In FIG. 94, the indication is shown as an "L," indicating that a large binding element 2014 should be used. The images of FIGS. 93 and 94 may be alternated repeatedly while waiting for the binding element 2014 to be inserted. Also, instead of displaying separate images, the images of FIGS. 94 and 95 may be combined and displayed together. Any suitable imagery or information may be used.

Figure 95:
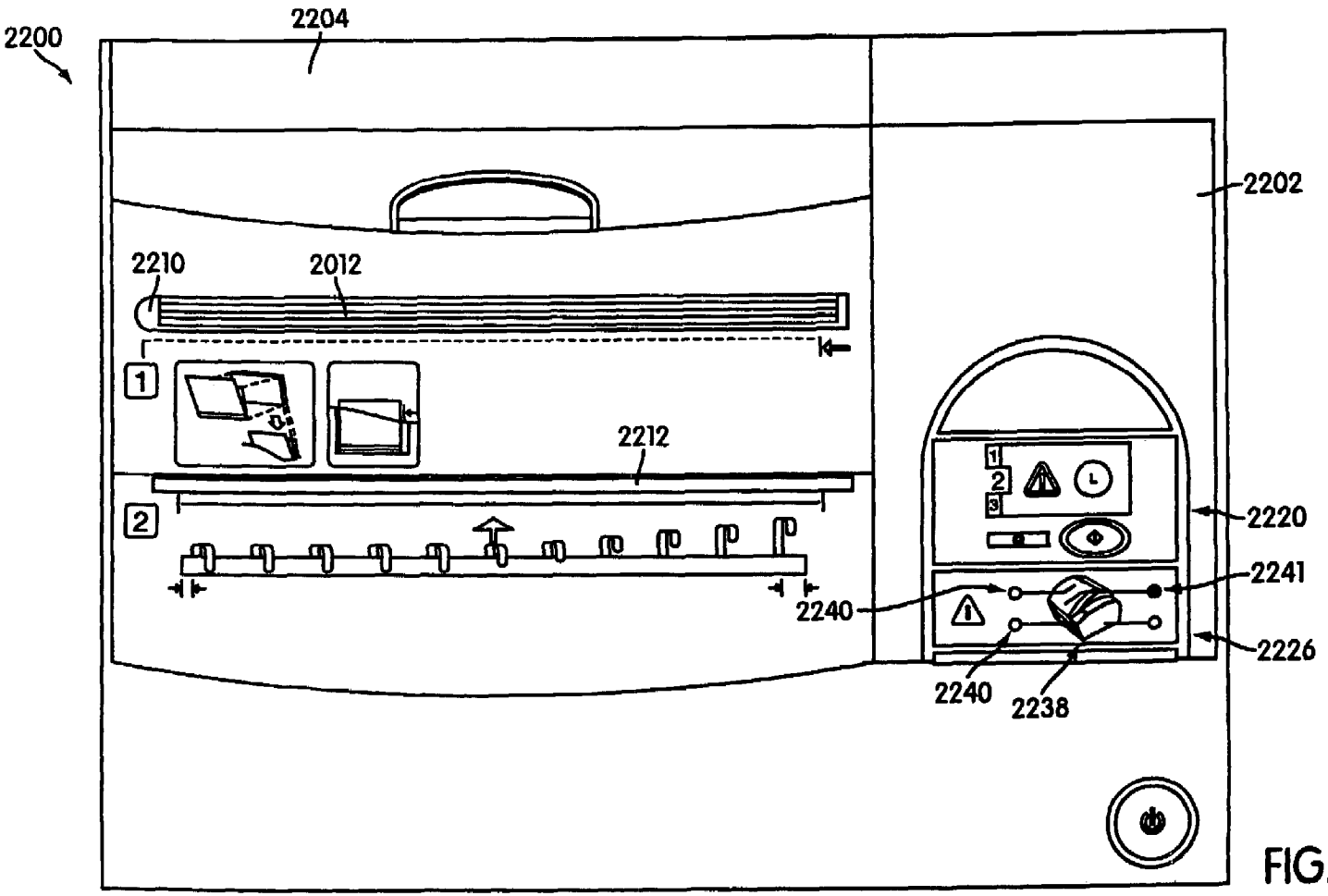
FIG. 95 is a top view of the binding apparatus of FIG. 89, with the user interface providing an error message to the user indicating that the wrong sized binding element has been loaded, and the correct size that should be loaded.

Also shown in FIGS. 93 and 94 is the indication 2229 that loading the binding element 2014 may be designated as step "2" in the process. Again, such an indication keeps the user informed as to the status of the overall process. The user may then select the indicated binding element 2014 and load the binding element 2014 into the binding element opening 2212 in the housing 2202. If the sensor 2130, described above, senses that the binding element 2014 that was inserted into the binding element opening 2212 was not the correct size, or was not loaded in the proper orientation, an error message may be displayed on the screen 2228, as shown in FIG. 95, so that the user may take corrective action. The user will not be prompted to proceed past this step (step "2") until the proper sized binding element 2014 has been inserted into the apparatus 2200 in the proper orientation.

Figure 96:
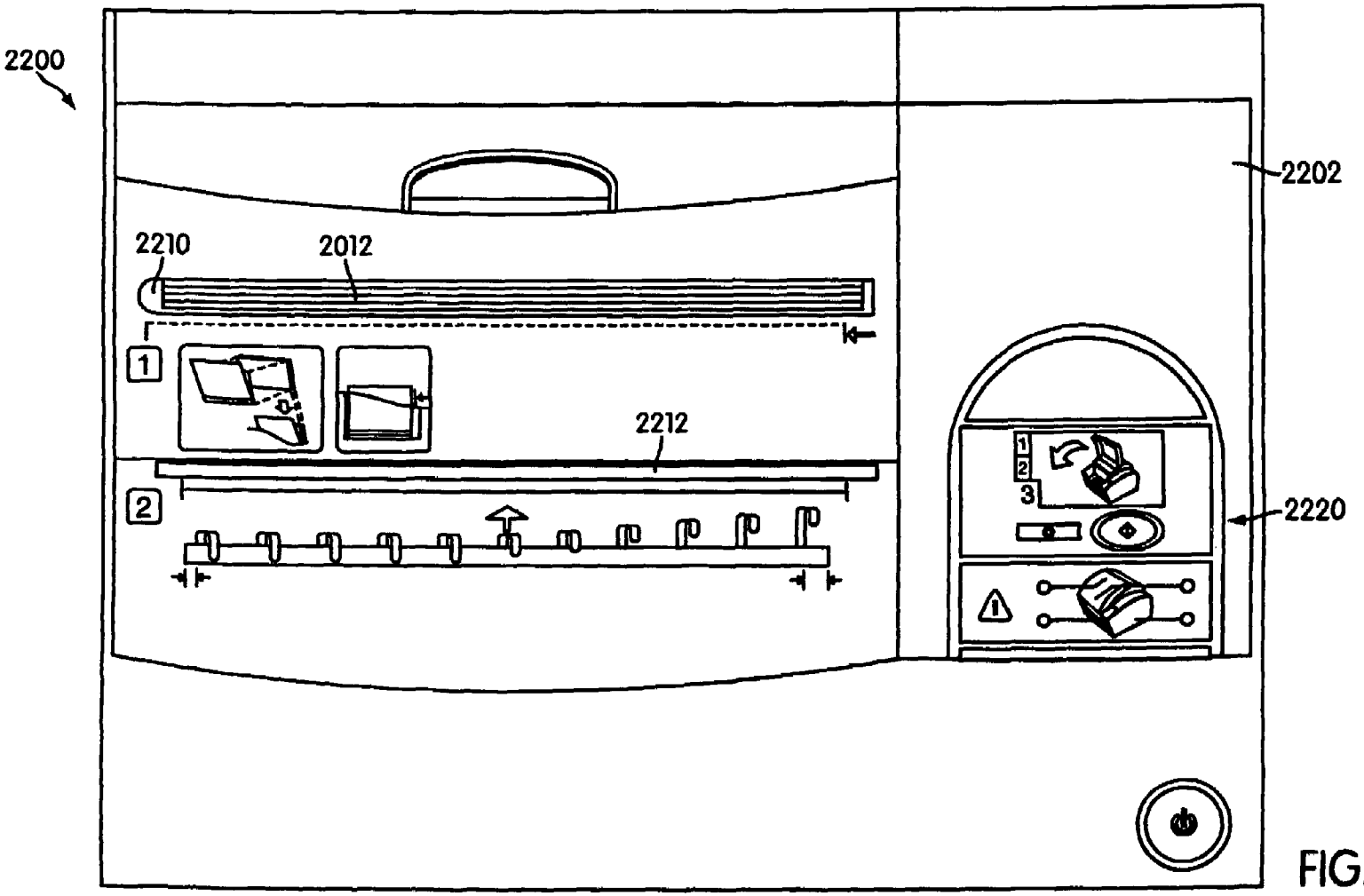
FIG. 96 is a top view of the binding apparatus of FIG. 89, after the binding element has been properly loaded, with the user interface instructing the user to move the lid to a closed position.
Figure 97:
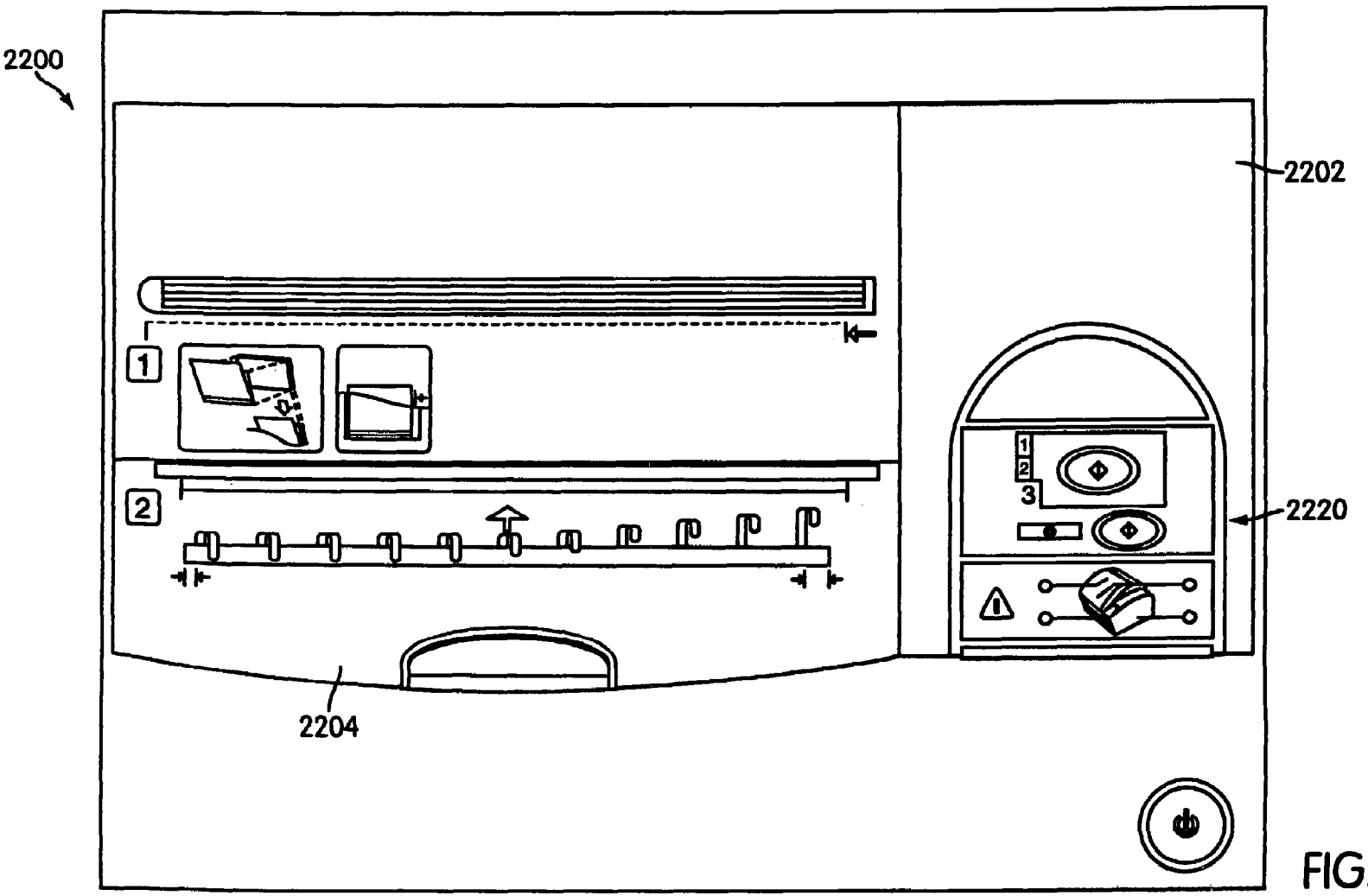
FIG. 97 is a top view of the binding apparatus of FIG. 89, with the user interface again instructing the user to press the input device.

Once the sensor 2130 senses that the correct binding element 2014 has been loaded properly, the screen 2228 may display the next action to be taken by the user. As shown in FIG. 96, the screen 2228 indicates that the lid 2204 should be returned to the closed position 2206, and that the process has proceeded to the next step, illustrated as step "3" in the Figure. This is done by displaying a still or animated image representative of the lid 2204 being closed, thereby indicating to the user to move the lid 2204 to the closed position 2206. Once the lid sensor senses that the lid 2204 has been moved to the closed position 2206, the controller 2221 instructs the screen 2228 to display the next image. As shown in FIG. 97, the screen 2228 then shows the first input device 2232, thereby indicating to the user that the first input device 2232 should be engaged to proceed with the binding operation. Once the first input device 2232 has been pressed at this stage of the process, the lid 2204 becomes locked with the interlock device 2214. This prevents the lid 2204 from being moved from the closed position 2206 while the punching mechanism 2018 and the binding element insertion device 2022 are in operation.

Figure 98:
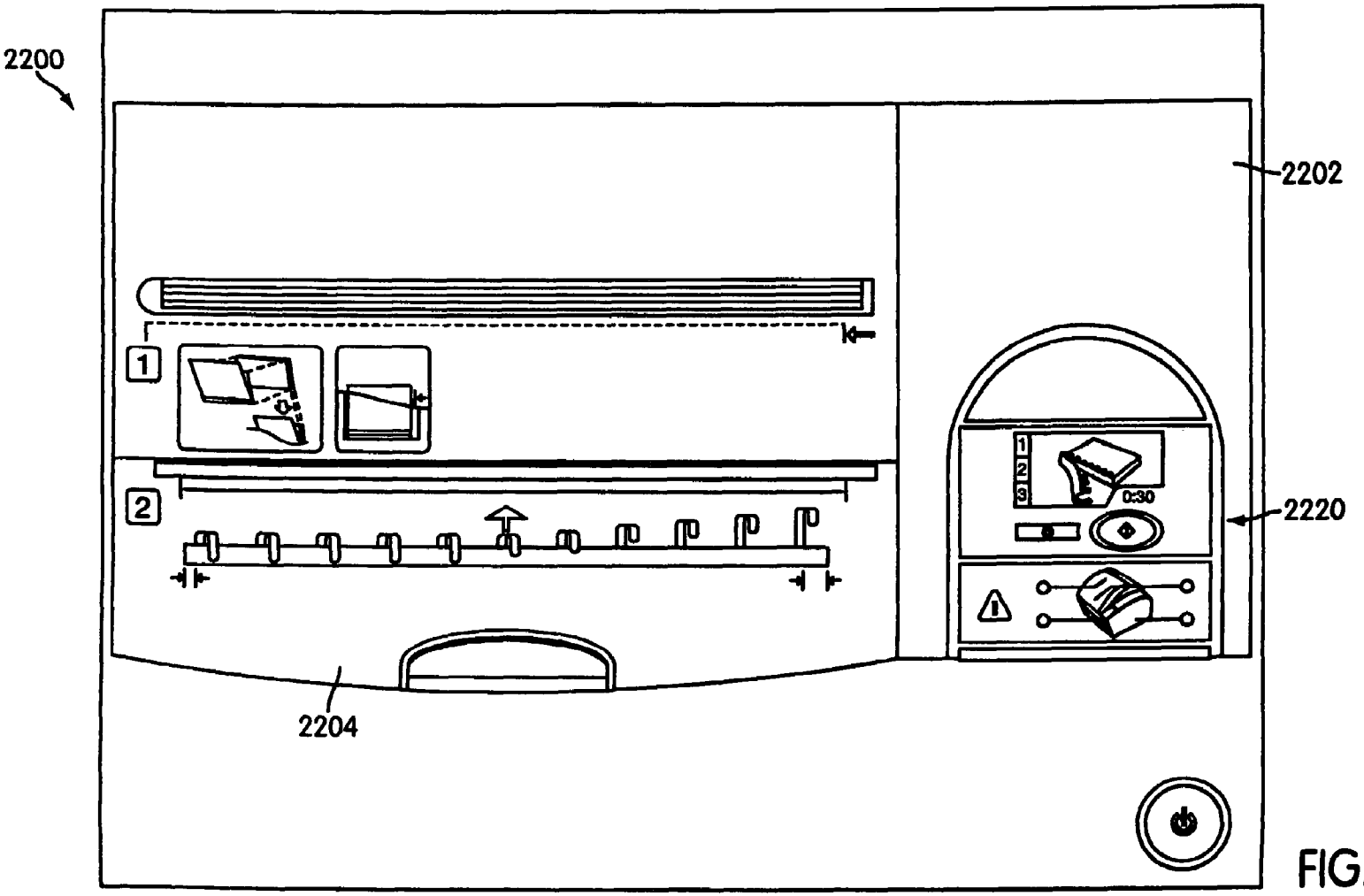
FIG. 98 is a top view of the binding apparatus of FIG. 89, with the user interface providing information about the status of the internal operations of the apparatus.

The screen 2228 may then be programmed to provide an animation of the punching and binding operations as they are taking place. As shown in FIG. 98, the visual display 2222 may also provide additional information at the same time, such as a countdown timer 2236 that provides the user with information on how much time before the finished product will be ready to be pulled out of the apparatus 2200. Such a timer 2236 allows the user to complete other tasks while waiting on the binding operation to be completed.

Figure 99:
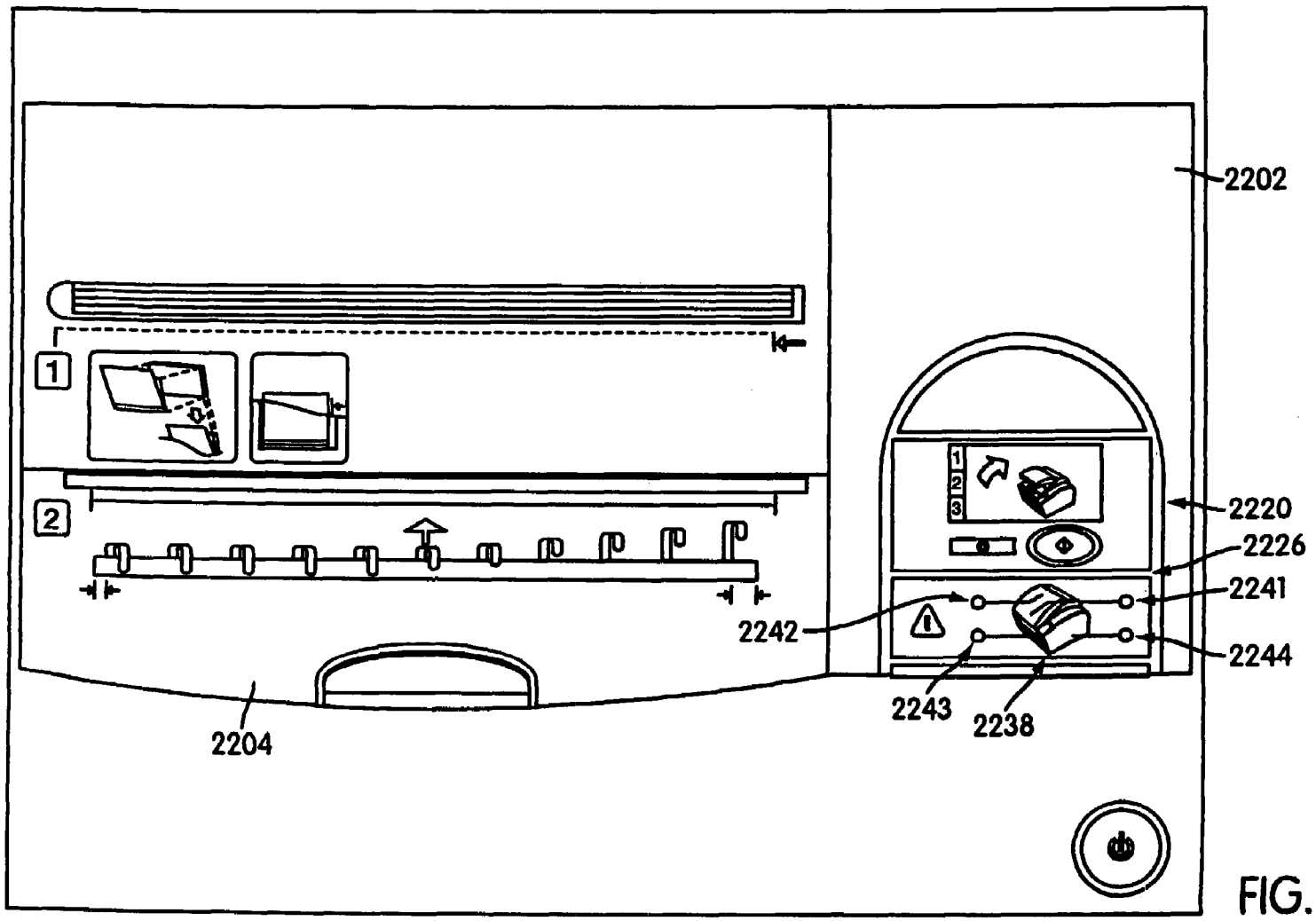
FIG. 99 is a top view of the binding apparatus of FIG. 89, with the user interface instructing the user to move the lid to the open position.
Figure 100:
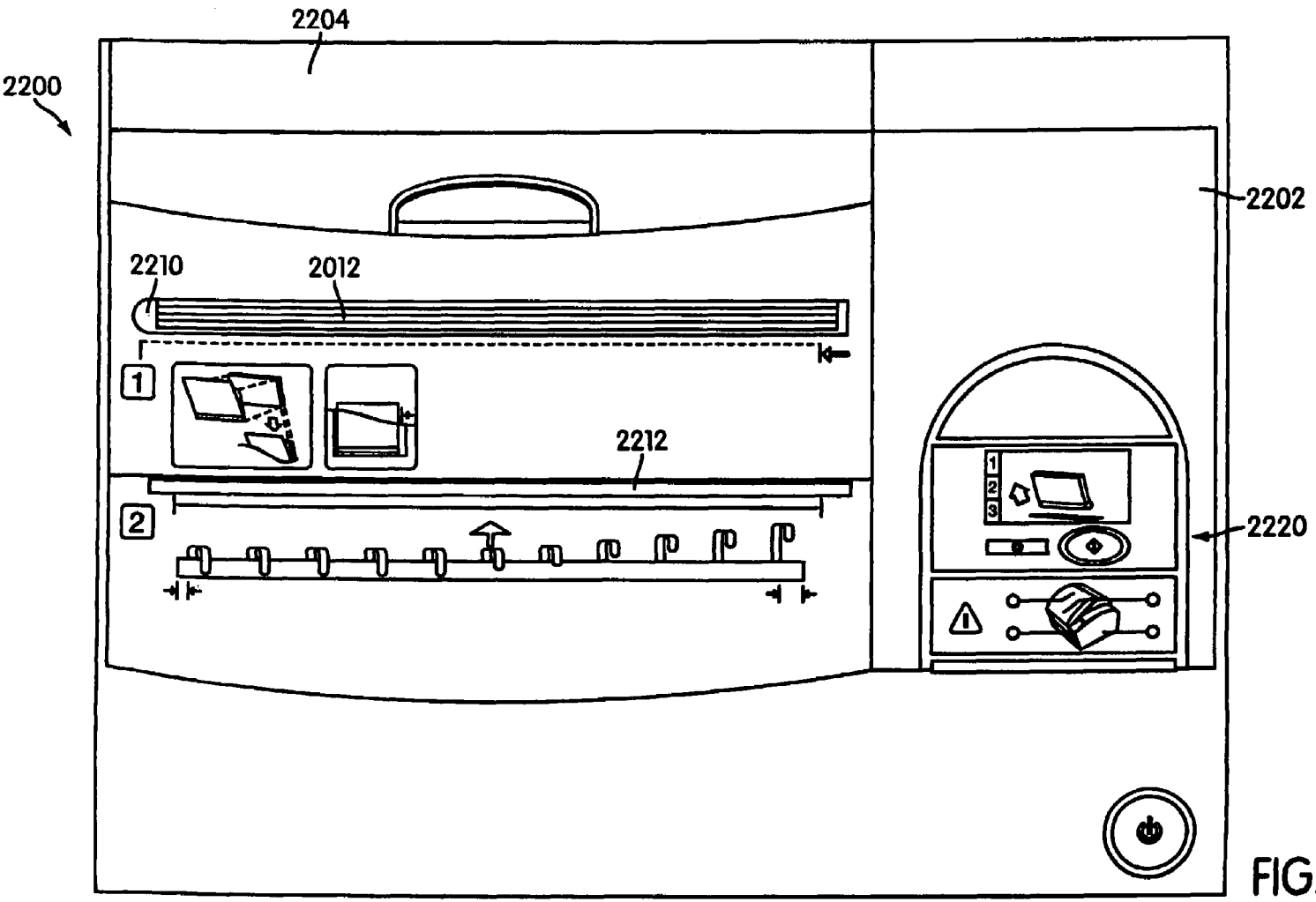
FIG. 100 is a top view of the binding apparatus of FIG. 89, with the user interface instructing the user to remove the bound plurality of papers from the apparatus.
Figure 101:
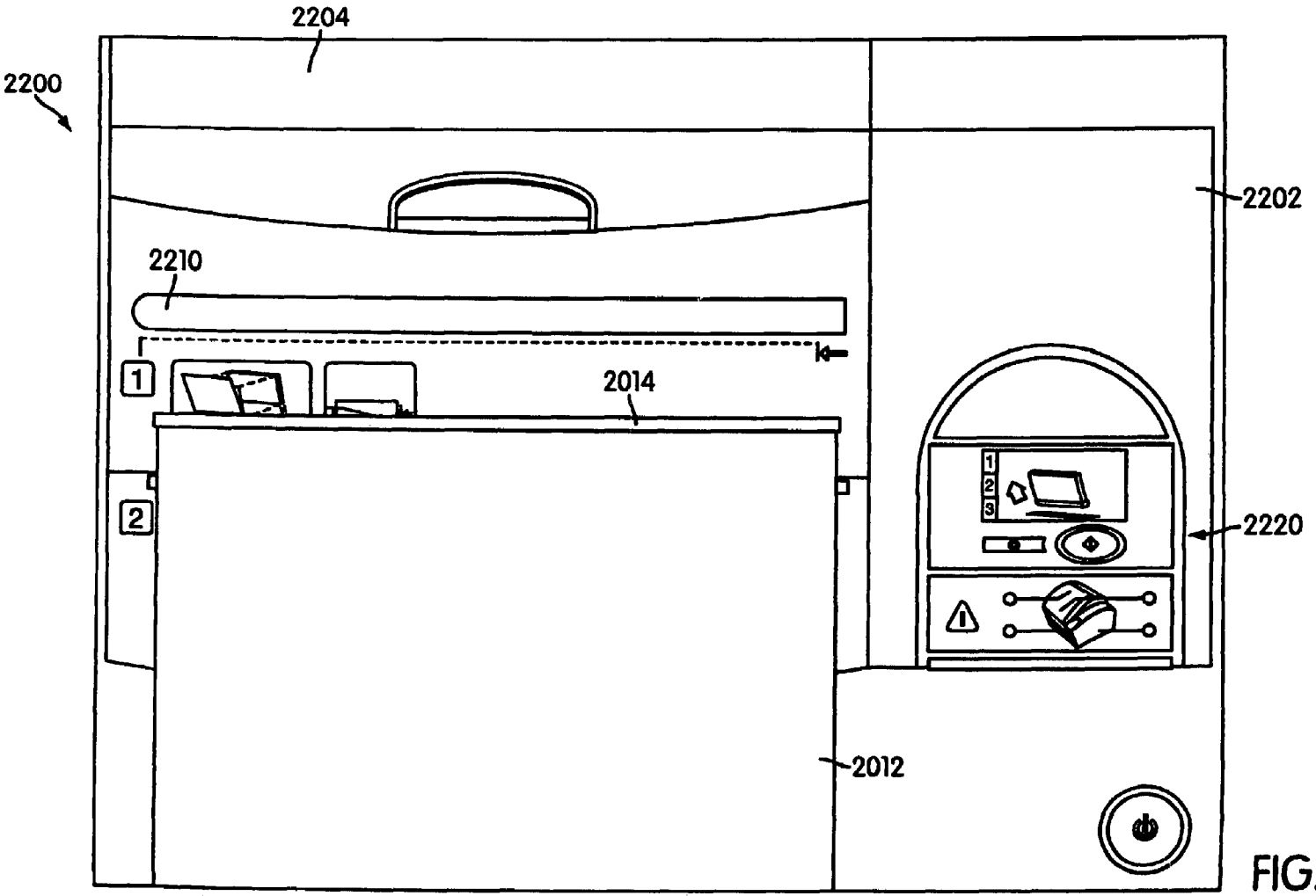
FIG. 101 is a top view of the binding apparatus of FIG. 89 showing the bound plurality of papers being removed from the apparatus.

Once the binding operation has been completed, the screen 2228 may indicate to the user that the paper 2012 has been successfully bound with the binding element 2014 and, as shown in FIG. 99, the lid 2204 may be moved to the open position 2208. When the lid sensor senses that the lid 2204 is in the open position 2208, the controller 2221 may instruct the screen 2228 to display an animated image of a bound document being pulled out of the apparatus 2200, as shown in FIG. 100, thereby instructing the user to remove the document from the apparatus 2200. FIG. 101 shows a bound document 2237 being removed from the apparatus 2200. After the sensor (described above) senses that the paper 2012 has been removed from the paper clamp 2020, the program may start again and the visual display 2222 may once again inform the user to load a new stack of papers 2012.

As shown in FIG. 95, the indicator portion 2226 of the user interface 2220 may include a schematic 2238 of the apparatus and a plurality of indicators 2240 that correspond to plurality of possible errors that may occur during operation of the apparatus 2200. In essence, the indicators 2240 are arranged to provide the user with a graphical state of the binding apparatus. For example, if the lid 2204 is in the open position 2208 and needs to be moved to the closed position 2206, one of the indicators 2240 may flash or may be provided as a red light. This provides a more direct indication to the user that action should be taken before the process may proceed. Other indicators that provide information regarding the proper loading of the paper 2012 and the binding element 2014 may also be provided. As shown in FIG. 95, when an error is indicated to the user, an indicator 2241 that corresponds with the loading of the binding element 2014 may light up and even flash, further indicating to the user that an error has occurred and action should be taken before the apparatus 2200 can continue with the binding operation.

In the embodiment of the apparatus 2200 shown in FIGS. 89-101, in addition to the binding element indicator 2241, the plurality of indicators 2240 includes a paper clamp error indicator 2242 (shown in FIG. 96) that alerts the user when the paper clamp 2020 has not functioned properly, a tray indicator 2243 that alerts the user when the tray 2036 should be removed from the apparatus 2200 and emptied, and an internal error indicator 2244 that alerts the user when some other error within the apparatus has occurred. Of course, greater or fewer indicators 2240 may be used. The illustrated indicator portion 2226 is not intended to be limiting in any way.

Figure 102:
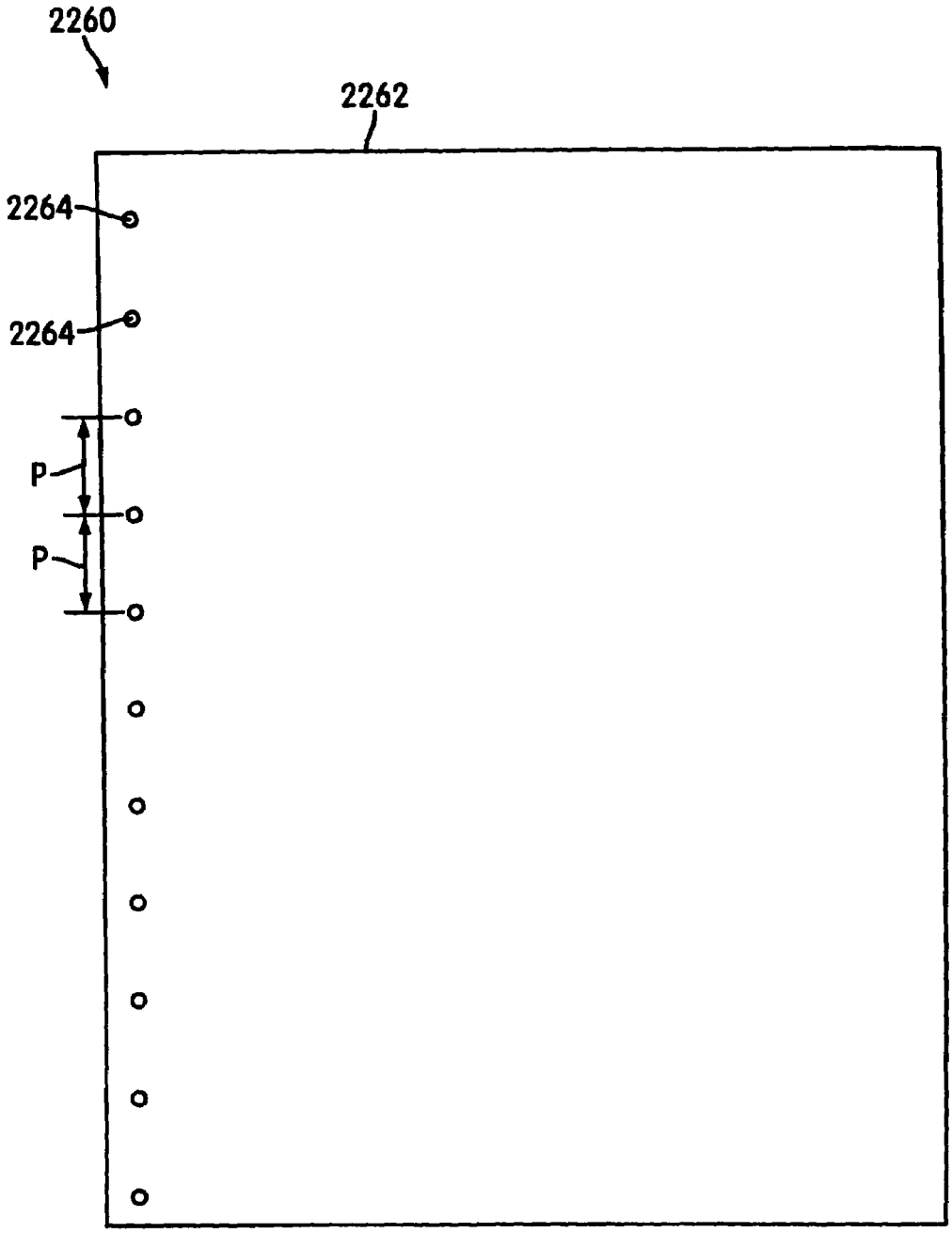
FIG. 102 is a top view of one embodiment of a pre-punched cover that may be used with the apparatus shown in the Figures.

Pre-punched covers 2260 to be bound with the papers 2012 may also be provided. As shown in FIG. 102, one embodiment of the pre-punched cover 2260 is a single cover 2262 that is configured to cover only one side of the stack of papers 2012. The single cover 2262 includes a plurality of holes 2264 at an edge thereof. The each hole 2264 is sized to receive one of the fingers 2098 of the binding element 2014. The plurality of holes 2264 are substantially equidistant from each other at a pitch of about 25.85 mm. Such a pitch substantially corresponds to the pitch of the fingers 2098 of the binding elements 2014.

Figure 103:
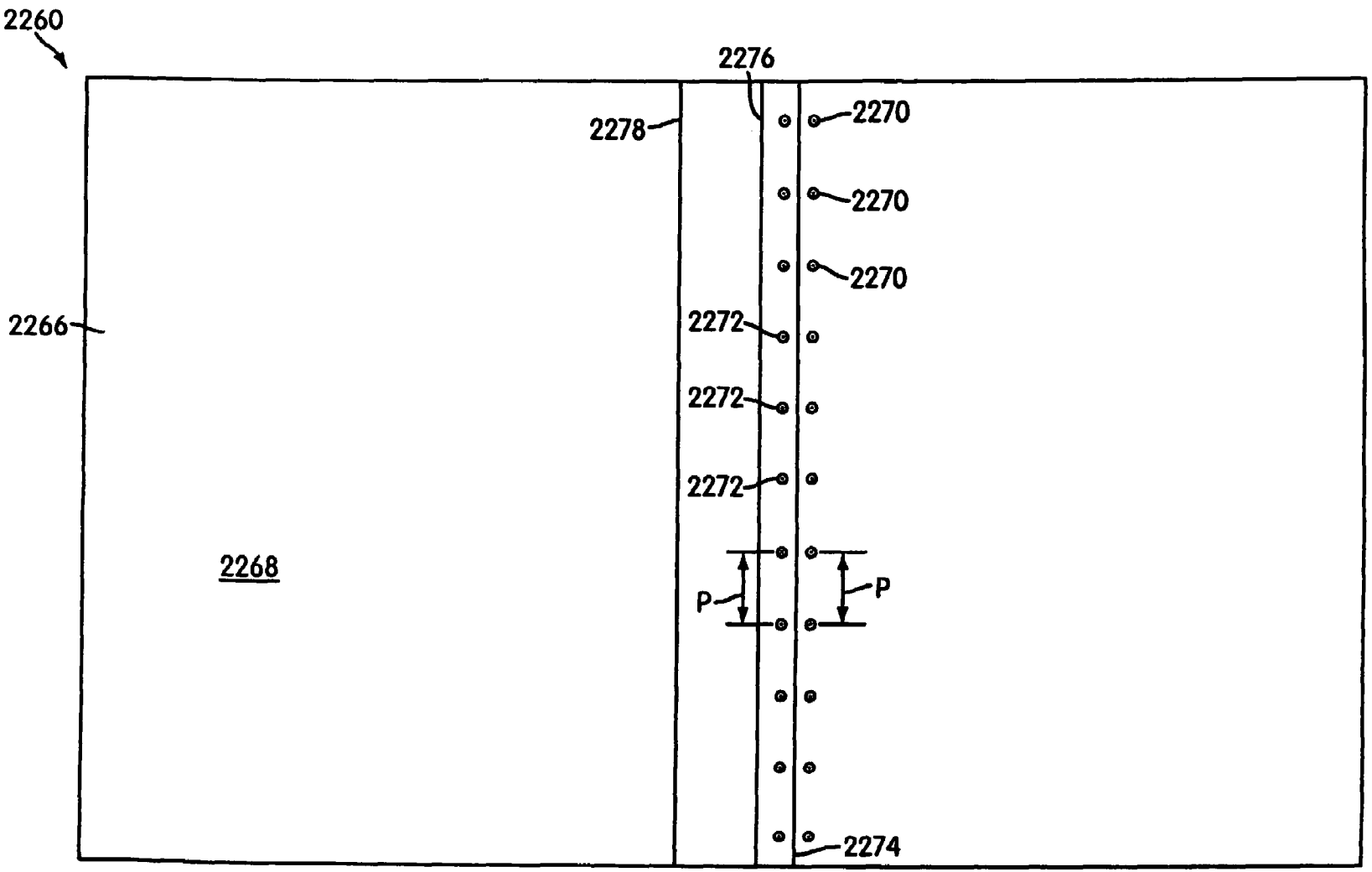
FIG. 103 is a top view of another embodiment of a pre-punched cover that may be used with the apparatus shown in the Figures.

Another embodiment of a pre-punched cover 2260 is a wrap-around cover 2266, shown in FIG. 103, that covers three sides of the stack of papers 2012, e.g. the front, back, and spine of the bound stack of papers 2012. The wrap-around cover 2266 is preferably made from a single substrate 2268 and includes two sets of holes 2270, 2272 that are disposed toward the center of the substrate 2268. Within each of the two sets of holes 2270, 2272, the plurality of holes are substantially equidistant from each other at a pitch of about 25.85 mm. A crease 2274 is preferably provided in between the two sets of holes 2270, 2272 so that the cover 2266 may be easily folded along the crease 2274, and aligned with the stack of paper 2012 before being loaded into the apparatus 2200. The holes 2270, 2272 are positioned so as to allow the punches 2024 to pass through them as the punches 2024 punch the stack of paper 2012. As shown in FIG. 103, additional creases 2276, 2278 may also be provided to generally define the size of the final, bound product. Different wrap-around covers 2266 of different sizes may be used in conjunction with the different sizes of binding elements 2014 so that the finished product may have a more finished appearance. The covers 2260 may be made from a pulp-based product, such as cardboard, or may be made from a plastic.

Figure 109:
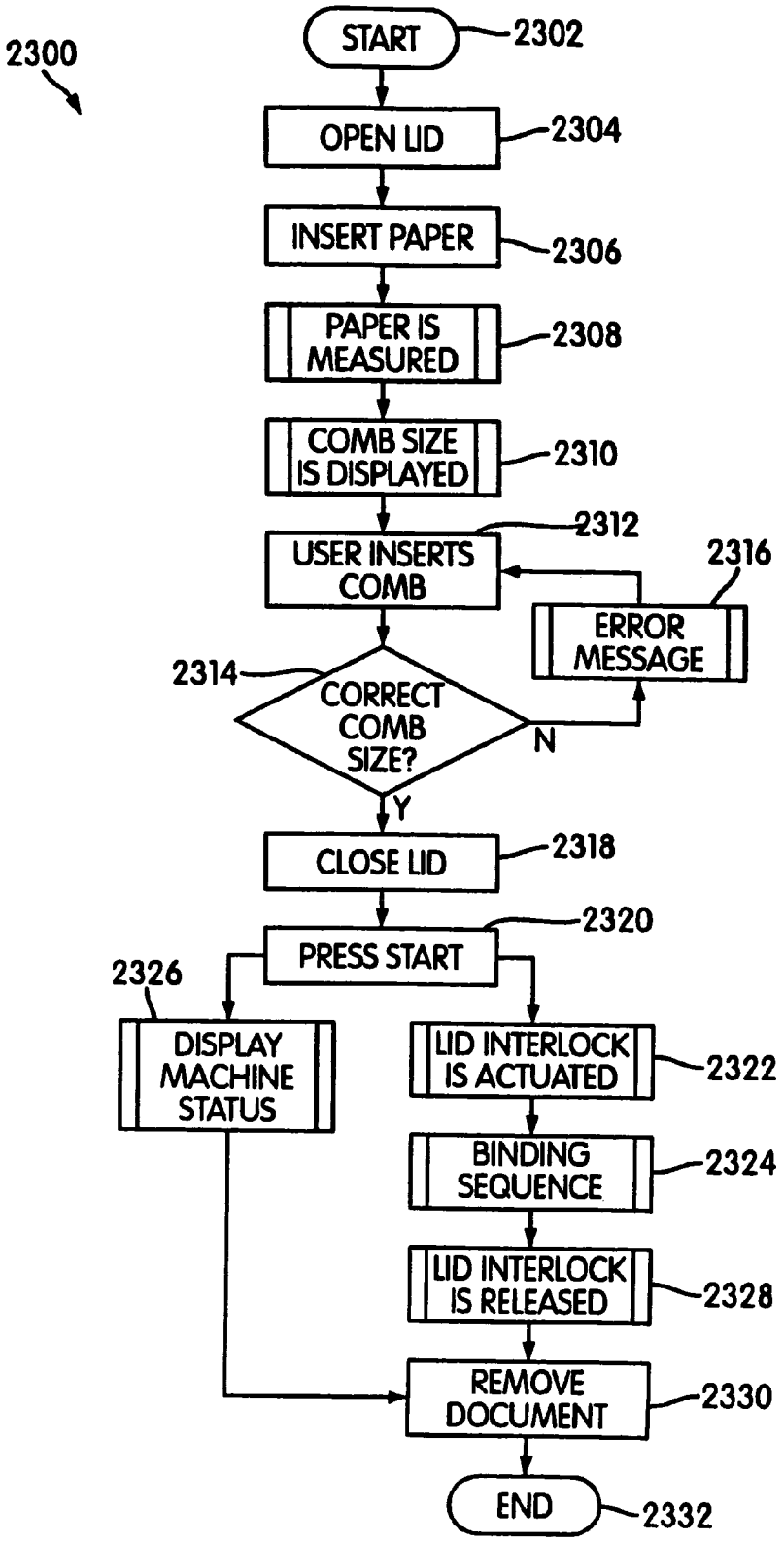
FIG. 109 is a flow chart of a method of operation of the apparatus of FIG. 89.

A method for binding a plurality of papers is generally shown in FIG. 109 at 2300. The method starts at 2302. At 2304, the user moves the lid 2204 of the apparatus 2200 from the closed position 2208 to the open position 2210. The lid sensor senses that the lid 2204 is in the open position 2208. Such sensing allows the controller 2221 to prevent operation of the punching mechanism 2018 and the binding element insertion device 2022, as long as the lid 2204 is in the open position 2208. Such sensing also allows the controller 2221 to begin execution of a preprogrammed set of instructions 2250, which are described in conjunction with the method 2300. It is understood that the some of the preprogrammed instructions may be displayed to the user-via the visual display 2222 discussed above, and some of the preprogrammed instructions are executed internal to the apparatus 2200 and provide for various sensing and movement within the apparatus 2200, as would be understood by one of ordinary skill in the art.

At 2306, the visual display 2222 instructs the user to load the paper 2012 into the paper opening 2210, and the user then loads the paper 2012 into the paper opening 2210. The paper sensor senses that the paper 2012 has been loaded into the paper clamp 2020. The controller 2221 then instructs the visual display 2222 to instruct the user to engage the first input device 2230. In addition, the first input device 2230 may optionally provide an indication to the user that the user should engage the first input device 2230, such as by flashing a green light. The user engages the first input device 2230 at 2308 so that the thickness of the papers 2012 may be measured. The controller 2221 then signals the paper clamp 2020 to close. The sensor 2061 senses the thickness of the papers 2012 and communicates the thickness to the controller 2221, which determines which predetermined size, e.g. S, M. L, or XL, of binding element 2014 should be used to bind the loaded papers 2012 together. At 2310, the visual display 2222 instructs the user which size binding element 2014 to insert into the apparatus 2200 through the binding element opening 2212. The user inserts the binding element 2014 into the binding element opening 2212 at 2312. The sensor 2130 senses the size of the binding element 2014 that has been inserted and communicates the size information to the controller 2221. The controller 2221 determines whether the correct size of binding element 2014 has been inserted at 2314. If the incorrect size has been inserted, the visual display 2222 displays an error message, and the indicator portion 2226 indicates that an error has occurred in the binding element opening 2212 at 2316. The user removes the incorrect binding element 2014, and the method 2300 returns to 2312. If the correct size binding element 2014 has been inserted, the method 2300 proceeds to 2318, where the visual display 2222 instructs the user to move the lid 2204 to the closed position 2206. As instructed, the user moves the lid 2204 to the closed position 2206. Once the lid sensor senses that the lid 2204 is in the closed position 2206, the visual display 2222 instructs the user to engage the first input device 2230 to proceed with the punching and binding operation at 2320. After the user has instructed the apparatus 2200 to proceed by engaging the first input device 2230, the interlock device 2214 locks the lid 2204 in the closed position 2206 at 2322, and the punching and binding operation commences at 2324. During the punching and binding operation, the visual display 2222 provides status information to the user at 2326, such as the time remaining before the binding operation will be complete. Upon completion of the punching and binding operation, the interlock device 2214 unlocks the lid 2204 at 2328, the visual display 2222 instructs the user to open the lid 2204, and the user opens the lid 2204. Once the lid sensor senses that the lid 2204 is in the open position 2208, the visual display 2222 instructs the user to remove the bound document from the apparatus 2200 at 2330. After the user removes the bound document from the apparatus 2200, the method ends at 2332. Of course the method 2300 disclosed above may include additional steps or may not include one of the steps described. The illustrated method is not intended to be limiting in any way and is intended to describe but one possible method to bind the papers 2012 together using the apparatus 2200 described herein.

Figure 110:
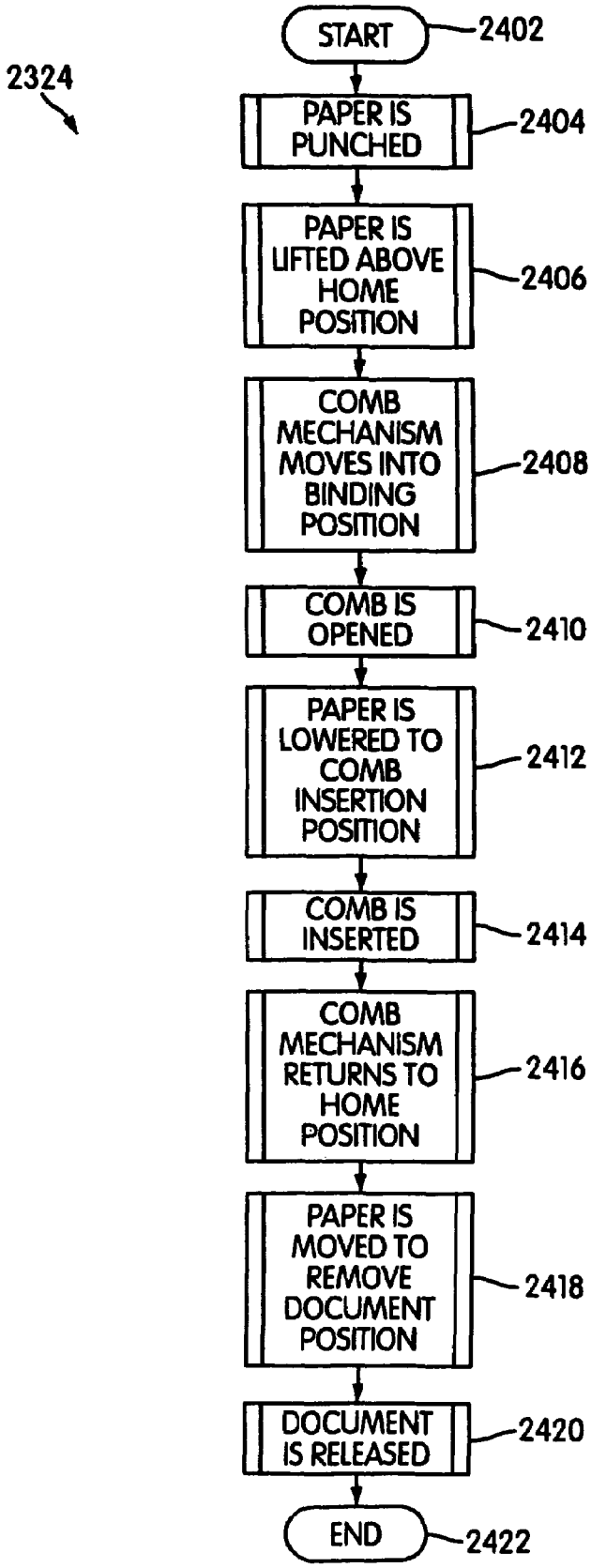
FIG. 110 is a flow chart of a binding sequence of the method of FIG. 109.

FIG. 110 illustrates the punching and binding operation 2324 of the method 2300 of FIG. 109 in greater detail. The punching and binding operation 2324 starts at 2402. At 2404, the stack of paper 2012 is punched with the punching mechanism 2018 in the manner described above. After all of the holes have been punched, the paper 2012 is lifted by the paper clamp 2020 above home position at 2406. At 2408, the binding element insertion device 2022, or comb mechanism, moves into the binding position, as described above. The binding element 2014, or comb, is opened at 2410. The stack of paper 2012 is then lowered by the paper clamp 2020 to the appropriate position to receive or accept the binding element 2014 at 2412. Next, the binding element 2014 is inserted into the paper 2012 by the binding element insertion device 2022 at 2414. At 2416, the binding element insertion device 2022 returns to its home position, and at 2418, the bound document is moved by the paper clamp 2020 to a position at which the bound document may be removed from the apparatus 2200. The bound document is released by the paper clamp 2020 at 2420. The punching and binding operation 2324 ends at 2422.

The foregoing illustrated embodiments have been provided solely for illustrating the structural and functional principles of the present invention and are not intended to be limiting. To the contrary, the present invention is intended to encompass all modifications, alterations, substitutions, and equivalents within the spirit and scope of the following claims.

All of the various features and mechanisms described with respect to the specific embodiments may be interchanged with the various embodiments described, or may be used with other variations or embodiments.

What is claimed is:

1. A binding apparatus for binding a stack of papers having a plurality of holes together with a binding element having a plurality of fingers insertable in the holes, the apparatus comprising:

a paper holder for holding the stack of papers; and a binding element applicator for securing the binding element to the stack of papers so as to bind the stack of papers together;

the binding element applicator comprising a wall with a plurality of slots constructed to enable the binding element to be received in the binding element applicator with the fingers extending through the slots;

the binding element applicator further comprising a finger extender constructed to open the fingers of the binding element for allowing tips thereof to be received in the holes in the stack of paper;

the binding element applicator further comprising a binding element pusher constructed to push the binding element in the applicator against the wall prior to being opened and secured to the stack of papers;

wherein the binding applicator further comprises at least one resilient member for biasing the pusher toward the wall.

2. A binding apparatus according to claim 1, wherein the at least one resilient member is at least one spring.

3. A binding apparatus according to claim 1, wherein the pusher comprises manually engageable portion for the user to engage to retract the pusher away from the wall against the biasing.

4. A binding apparatus according to claim 3, wherein the manually engageable portion is a recessed portion.

5. A binding apparatus according to claim 3, wherein the finger extender of the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

6. A binding apparatus according to claim 3, further comprising a hole puncher constructed to punch the holes in the stack of paper.

7. A binding apparatus according to claim 1, wherein the pusher includes a sloped surface facing the wall, the slope of sloped surface being configured to lift the binding element and push the binding element against the wall.

8. A binding apparatus according to claim 7, wherein the sloped surface is curved.

9. A binding apparatus according to claim 8, wherein the binding element includes a spine with opposing longitudinal edges with the fingers being attached to the opposing longitudinal edges, the curvature of sloped surface being configured to lift and push the binding element so as to engage both opposing longitudinal edges of the spine against the wall.

10. A binding apparatus according to claim 9, wherein the finger extender of the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

11. A binding apparatus according to claim 8, wherein the finger extender of the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

12. A binding apparatus according to claim 7, wherein the binding element includes a spine with opposing longitudinal edges with the fingers being attached to the opposing longitudinal edges, the slope of sloped surface being configured to lift and push the binding element so as to engage both opposing longitudinal edges of the spine against the wall.

13. A binding apparatus according to claim 12, wherein the finger extender of the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

14. A binding apparatus according to claim 7, wherein the finger extender of the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

15. A binding apparatus according to claim 7, further comprising a hole puncher constructed to punch the holes in the stack of paper.

16. A binding apparatus according to claim 1, wherein the finger extender of the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

17. A binding apparatus according to claim 1, further comprising a hole puncher constructed to punch the holes in the stack of paper.

18. A binding apparatus for binding a stack of papers having a plurality of holes together with a binding element having a plurality of fingers insertable in the holes, the apparatus comprising:

a paper holder for holding the stack of papers; and a binding element applicator for securing the binding element to the stack of papers so as to bind the stack of papers together;

the binding element applicator comprising a wall with a plurality of slots constructed to enable the binding element to be received in the binding element applicator with the fingers extending through the slots;

the binding element applicator being constructed to open the fingers of the binding element for allowing tips thereof to be received in the holes in the stack of paper;

the binding element applicator further comprising a binding element pusher constructed to push the binding element in the applicator against the wall prior to being opened and secured to the stack of papers, and wherein the binding applicator further comprises at least one resilient member for biasing the pusher toward the wall;

the pusher includes a sloped surface facing the wall, the slope of sloped surface being configured to lift the binding element and push the binding element against the wall, and the binding element includes a spine with opposing longitudinal edges with the fingers being attached to the opposing longitudinal edges, the slope of sloped surface being configured to lift and push the binding element so as to engage both opposing longitudinal edges of the spine against the wall.

19. A binding apparatus according to claim 18, wherein the binding element applicator comprises a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

20. A binding apparatus for binding a stack of papers having a plurality of holes together with a binding element having a plurality of fingers insertable in the holes, the apparatus comprising:

a paper holder for holding the stack of papers; and a binding element applicator for securing the binding element to the stack of papers so as to bind the stack of papers together;

the binding element applicator comprising a wall with a plurality of slots constructed to enable the binding element to be received in the binding element applicator with the fingers extending through the slots;

the binding element applicator being constructed to open the fingers of the binding element for allowing tips thereof to be received in the holes in the stack of paper;

the binding element applicator further comprising a binding element pusher constructed to push the binding element in the applicator against the wall prior to being opened and secured to the stack of papers;

wherein the binding applicator further comprises at least one resilient member for biasing the pusher toward the wall;

the pusher includes a sloped surface facing the wall, the slope of sloped surface being curved and configured to lift the binding element and push the binding element against the wall, and the binding element includes a spine with opposing longitudinal edges with the fingers being attached to the opposing longitudinal edges, the curvature of sloped surface being configured to lift and push the binding element so as to engage both opposing longitudinal edges of the spine against the wall.

21. A binding apparatus according to claim 20, wherein the binding element applicator comprising a plurality of finger pullers, the finger pullers being constructed to engage the fingers of the binding element when received in the binding element applicator and being movable relative to the wall to open the engaged fingers for enabling the edge of the stack of paper to be received in the opened binding element for insertion of the fingers into the holes in the stack.

* * * * *

UNITED STATES PATENT AND TRADEMARK OFFICE

CERTIFICATE OF CORRECTION

PATENT NO. : 7,503,740 B2
APPLICATION NO. : 11/302385
DATED : March 17, 2009
INVENTOR(S) : Paul J Lemens et al.

It is certified that error appears in the above-identified patent and that said Letters Patent is hereby corrected as shown below:

On the title page, please insert the following:
-- Related U.S. Application Data

(62) Divisional of Application Serial No. 11/133,311, filed May 20, 2005.

(60) Provisional application No. 60/572,474, filed on May 21, 2004; Provisional application Serial No. 60/613,509, filed on Sept. 28, 2004; Provisional application Serial No. 60/635,443 filed Dec. 14, 2004; and Provisional application Serial No. 60/663,877 filed March 22, 2005. --

Signed and Sealed this

Twenty-sixth Day of May, 2009

John Doll

JOHN DOLL
*Acting Director of the United States Patent and Trademark Office*